US007837311B2

(12) United States Patent
Hattori et al.

(10) Patent No.: US 7,837,311 B2
(45) Date of Patent: Nov. 23, 2010

(54) INK CARTRIDGES

(75) Inventors: Shingo Hattori, Tsushima (JP); Tomohiro Kanbe, Nagoya (JP); Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1090 days.

(21) Appl. No.: 11/529,219

(22) Filed: Sep. 29, 2006

(65) Prior Publication Data

US 2007/0070145 A1 Mar. 29, 2007

(30) Foreign Application Priority Data

Sep. 29, 2005 (JP) ..... 2005-284646
Nov. 28, 2005 (JP) ..... 2005-342693
Mar. 23, 2006 (JP) ..... 2006-081806

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS 4,422,085 A 12/1983 Sumitomo et al.
4,861,254 A 8/1989 Takeuchi et al.
5,132,711 A 7/1992 Shinada et al.
5,221,935 A 6/1993 Uzita
5,604,523 A 2/1997 Tsukuda et al.
5,609,810 A 3/1997 Fujiware et al.
5,631,674 A 5/1997 Shinada et al.
5,659,345 A 8/1997 Altendorf
5,732,751 A 3/1998 Schmidt et al.
5,852,459 A 12/1998 Pawlowski, Jr. et al.
5,900,896 A 5/1999 Barinaga et al.
5,966,155 A 10/1999 Pawlowski, Jr. et al.
6,012,795 A 1/2000 Saito et al.
6,033,064 A 3/2000 Pawlowski, Jr. et al.
6,254,226 B1 7/2001 Lengyel et al.
6,270,207 B1 8/2001 Sasaki
6,293,143 B1 9/2001 Denton et al.
6,364,472 B1 4/2002 Hmelar et al.
6,390,590 B1 5/2002 Hansburg
6,422,693 B2 7/2002 Pawlowski, Jr. et al.
6,499,840 B2 12/2002 Day et al.

(Continued)

FOREIGN PATENT DOCUMENTS

DE 19521413 A1 12/1996

(Continued)

*Primary Examiner*—An H Do
(74) *Attorney, Agent, or Firm*—Baker Botts L.L.P.

(57) ABSTRACT

An ink cartridge includes an ink chamber, a communication path configured to dispense ink from an interior of the ink chamber to an exterior of the ink chamber, and a valve member disposed within the communication path. The valve member is configured to selectively open and close the communication path. The ink cartridge also includes an elastic, and the elastic member has a first opening formed therethrough. Moreover, the ink cartridge includes a cap member connected to the elastic member, such that the elastic member is positioned between the cap member and the valve member, and the cap member has a second opening formed therethrough and a chamber formed therein. In addition, a portion of the chamber is aligned with the first opening.

8 Claims, 67 Drawing Sheets

U.S. PATENT DOCUMENTS

| | | | | |
|---|---|---|---|---|
| 6,508,545 | B2 | 1/2003 | Dowell et al. | |
| 6,585,358 | B2 | 7/2003 | Usui et al. | |
| 6,648,459 | B2 * | 11/2003 | Usui et al. | 347/86 |
| 6,676,237 | B2 | 1/2004 | Kobayashi et al. | |
| 6,722,762 | B2 | 4/2004 | Miyazawa et al. | |
| 6,786,583 | B2 | 9/2004 | Ota et al. | |
| 6,796,627 | B2 | 9/2004 | Kimura et al. | |
| 6,796,642 | B2 | 9/2004 | Toba et al. | |
| 6,802,601 | B2 | 10/2004 | Suzuki et al. | |
| 6,866,355 | B2 | 3/2005 | Aruga et al. | |
| 6,874,874 | B2 | 4/2005 | Sasaki | |
| 6,886,928 | B2 | 5/2005 | Sasaki et al. | |
| 6,899,418 | B2 | 5/2005 | Sasaki et al. | |
| 6,905,199 | B2 | 6/2005 | Miyazawa et al. | |
| 6,926,396 | B2 | 8/2005 | Ota et al. | |
| 6,938,996 | B2 | 9/2005 | Sasaki et al. | |
| 6,938,997 | B2 | 9/2005 | Toba et al. | |
| 6,945,641 | B2 | 9/2005 | Sasaki et al. | |
| 6,951,388 | B2 | 10/2005 | Sasaki | |
| 6,955,422 | B2 | 10/2005 | Miyazswa et al. | |
| 6,976,749 | B2 | 12/2005 | Sasaki et al. | |
| 6,979,079 | B2 | 12/2005 | Hashii et al. | |
| 7,008,053 | B2 | 3/2006 | Hashii et al. | |
| 7,011,397 | B2 | 3/2006 | Miyazswa et al. | |
| 7,014,304 | B2 | 3/2006 | Sasaki | |
| 7,029,104 | B2 | 4/2006 | Sakai et al. | |
| 7,334,889 | B2 * | 2/2008 | Sasaki et al. | 347/86 |
| 2001/0017641 | A1 | 8/2001 | Kobayashi et al. | |
| 2002/0024543 | A1 | 2/2002 | Kimura et al. | |
| 2002/0085050 | A1 | 7/2002 | Aruga et al. | |
| 2002/0089555 | A1 | 7/2002 | Kobayashi et al. | |
| 2002/0109760 | A1 | 8/2002 | Miyazawa et al. | |
| 2002/0158948 | A1 | 10/2002 | Miyazawa et al. | |
| 2002/0171721 | A1 | 11/2002 | Ota et al. | |
| 2002/0171722 | A1 | 11/2002 | Hara et al. | |
| 2002/0171723 | A1 | 11/2002 | Ota et al. | |
| 2002/0180849 | A1 | 12/2002 | Sakai et al. | |
| 2003/0007043 | A1 | 1/2003 | Ota et al. | |
| 2003/0030682 | A1 | 2/2003 | Kim et al. | |
| 2003/0071881 | A1 | 4/2003 | Toba et al. | |
| 2003/0085970 | A1 | 5/2003 | Sakai et al. | |
| 2003/0117467 | A1 | 6/2003 | Jung | |
| 2003/0184622 | A1 | 10/2003 | Sasaki et al. | |
| 2003/0184623 | A1 | 10/2003 | Sasaki et al. | |
| 2003/0184626 | A1 | 10/2003 | Sasaki et al. | |
| 2003/0184627 | A1 | 10/2003 | Sasaki et al. | |
| 2004/0017447 | A1 | 1/2004 | Suzuki et al. | |
| 2004/0051766 | A1 | 3/2004 | Miyazawa et al. | |
| 2004/0104984 | A1 | 6/2004 | Hall et al. | |
| 2004/0135857 | A1 | 7/2004 | Hashii et al. | |
| 2004/0150697 | A1 | 8/2004 | Sasaki et al. | |
| 2004/0160497 | A1 | 8/2004 | Suzuki et al. | |
| 2004/0165042 | A1 | 8/2004 | Ichihashi et al. | |
| 2004/0174417 | A1 | 9/2004 | Kobayashi et al. | |
| 2004/0196339 | A1 | 10/2004 | Kobayashi et al. | |
| 2004/0196342 | A1 | 10/2004 | Hara et al. | |
| 2004/0201655 | A1 | 10/2004 | Miyazawa et al. | |
| 2004/0239736 | A1 | 12/2004 | Miyazawa et al. | |
| 2005/0017178 | A1 | 1/2005 | Katsuyama et al. | |
| 2005/0030357 | A1 | 2/2005 | Sakai et al. | |
| 2005/0041061 | A1 | 2/2005 | Ishizawa et al. | |
| 2005/0068389 | A1 | 3/2005 | Katayama et al. | |
| 2005/0068390 | A1 | 3/2005 | Katayama et al. | |
| 2005/0099474 | A1 | 5/2005 | Sasaki et al. | |
| 2005/0134661 | A1 | 6/2005 | Miyazawa | |
| 2005/0146580 | A1 | 7/2005 | Hashii et al. | |
| 2005/0157109 | A1 | 7/2005 | Muranaka et al. | |
| 2005/0162490 | A1 | 7/2005 | Katayama et al. | |
| 2005/0179754 | A1 | 8/2005 | Sasaki | |
| 2005/0195254 | A1 | 9/2005 | Takagi et al. | |
| 2005/0200670 | A1 | 9/2005 | Hashii et al. | |
| 2005/0270347 | A1 | 12/2005 | Yamamoto | |
| 2005/0270348 | A1 | 12/2005 | Sasaki | |
| 2006/0007259 | A1 | 1/2006 | Zhang | |
| 2006/0007278 | A1 | 1/2006 | Holland et al. | |
| 2006/0007283 | A1 | 1/2006 | Sacco, Jr. et al. | |
| 2006/0028517 | A1 | 2/2006 | Ishizawa et al. | |
| 2006/0033789 | A1 | 2/2006 | Sasaki et al. | |
| 2006/0098062 | A1 | 5/2006 | Miyazawa | |
| 2006/0119677 | A1 | 6/2006 | Shinada et al. | |

FOREIGN PATENT DOCUMENTS

| | | | |
|---|---|---|---|
| DE | 19809855 | A1 | 9/1999 |
| EP | 0519664 | A2 | 12/1992 |
| EP | 0647527 | A1 | 12/1995 |
| EP | 0834403 | A2 | 4/1998 |
| EP | 1097814 | A2 | 5/2001 |
| EP | 1382451 | A1 | 1/2004 |
| EP | 1510346 | A2 | 3/2005 |
| EP | 1520706 | A2 | 6/2005 |
| EP | 1547785 | A2 | 6/2005 |
| GB | 2089720 | A | 6/1982 |
| JP | H63-51111 | A | 3/1988 |
| JP | H63-252747 | A | 10/1988 |
| JP | H2-243351 | A | 9/1990 |
| JP | H4-133748 | A | 5/1992 |
| JP | H5 4249 | | 1/1993 |
| JP | H5-332812 | A | 12/1993 |
| JP | H6-210871 | A | 8/1994 |
| JP | H6-328717 | A | 11/1994 |
| JP | H7-32603 | A | 2/1995 |
| JP | H7-304185 | A | 11/1995 |
| JP | H7-314716 | A | 12/1995 |
| JP | H3-138158 | A | 6/1996 |
| JP | H8-174959 | A | 7/1996 |
| JP | H8-197743 | A | 8/1996 |
| JP | H8-258280 | A | 10/1996 |
| JP | H8-281966 | A | 10/1996 |
| JP | H9-1818 | A | 1/1997 |
| JP | H9-29992 | A | 2/1997 |
| JP | H10-119297 | A | 5/1998 |
| JP | H11-058783 | A | 3/1999 |
| JP | H11-58783 | A | 3/1999 |
| JP | H11-58792 | A1 | 3/1999 |
| JP | H11-129490 | A | 5/1999 |
| JP | H11-157099 | A | 6/1999 |
| JP | 2000141684 | A | 5/2000 |
| JP | 2000158666 | A | 6/2000 |
| JP | 2000246922 | A | 9/2000 |
| JP | 2000318148 | A | 11/2000 |
| JP | 2000334973 | A | 12/2000 |
| JP | 2001105619 | A | 4/2001 |
| JP | 2001105624 | A | 4/2001 |
| JP | 2001191548 | A | 7/2001 |
| JP | 2001212974 | A | 8/2001 |
| JP | 2001287380 | A | 10/2001 |
| JP | 2001347681 | A | 12/2001 |
| JP | 2003261823 | A | 3/2002 |
| JP | 2002103640 | A | 4/2002 |
| JP | 2002160383 | A | 6/2002 |
| JP | 2002187292 | A | 7/2002 |
| JP | 2003127410 | A | 5/2003 |
| JP | 2004034406 | A | 2/2004 |
| JP | 2004114557 | A | 4/2004 |
| JP | 2004114702 | A | 4/2004 |
| JP | 2004123099 | A | 4/2004 |
| JP | 2004148649 | A | 5/2004 |
| JP | 2004148650 | A | 5/2004 |
| JP | 2004216866 | A | 5/2004 |
| JP | 2004 284094 | | 10/2004 |
| JP | 200525025 | A | 2/2005 |
| JP | 200547089 | A | 2/2005 |
| JP | 2005047258 | A | 2/2005 |

| | | | |
|---|---|---|---|
| JP | 200559405 | A | 3/2005 |
| JP | 200559590 | A | 3/2005 |
| JP | 2005125738 | A | 5/2005 |
| JP | 2005254701 | A | 9/2005 |
| JP | 2005262499 | A | 9/2005 |
| JP | 2005262563 | A | 9/2005 |
| JP | 2005262650 | A | 9/2005 |
| JP | 2005288777 | A | 10/2005 |
| JP | 2005289071 | A | 10/2005 |
| JP | 2005297445 | A | 10/2005 |
| JP | 2005324165 | A | 11/2005 |
| JP | 2005059482 | A | 9/2006 |
| KR | 20030091373 | A | 12/2003 |
| KR | 20040006426 | A | 1/2004 |
| KR | 10-0520535 | B1 | 10/2005 |

* cited by examiner

INK CARTRIDGES

CROSS-REFERENCE TO RELATED APPLICATIONS

The present application claims priority from Japanese Patent Application No. JP-2005-284646, which was filed on Sep. 29, 2005, Japanese Patent Application No. JP-2005-342693, which was filed on Nov. 28, 2005, and Japanese Patent Application No. JP-2006-081806, which was filed on Mar. 23, 2006, the disclosures of which are incorporated by reference in their entirety.

BACKGROUND OF THE INVENTION

1. Field of the Invention

The present invention relates generally to ink cartridges. In particular, the present invention is directed towards ink cartridges which may be used in combination with ink jet printers.

2. Description of Related Art

Ink cartridges which are configured to be used in combination with ink jet printers are known in the art.

SUMMARY OF THE INVENTION

A need has arisen for ink cartridges which overcome the shortcomings of known ink cartridges.

According to an embodiment of the present invention, an ink cartridge comprises an ink chamber, a communication path configured to dispense ink from an interior of the ink chamber to an exterior of the ink chamber, and a valve member disposed within the communication path. The valve member is configured to selectively open and close the communication path. The ink cartridge also comprises an elastic member, and the elastic member has a first opening formed therethrough. Moreover, the ink cartridge comprises a cap member connected to the elastic member, such that the elastic member is positioned between the valve member and the cap member, and the cap member has a second opening formed therethrough and at least one chamber formed therein. In addition, at least a portion of the at least one chamber is aligned with at least a portion of the first opening.

In a modification of this embodiment of the present invention, the first opening is tapered, e.g., a stepped, tapered portion, and a circumference of a first portion of the first opening connected to the communication path is less than a circumference of a second portion of the first opening connected to the second opening.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

FIG. 9(*b*) is a cross-sectional view of the protector of FIG. 9(*a*) along the IXb-IXb line, according to an embodiment of the present invention.

FIG. 14(*b*) is a side view of the ink reservoir element of FIG. 14(*a*), according to an embodiment of the present invention.

FIG. 15(*b*) is a cross-sectional view of the supply path formation portion of FIG. 15(*a*) along the XVb-XVb line; FIG. 15(*c*) is a side view of the supply path formation portion of FIG. 15(*a*), in which an amount of ink has been reduced; and FIG. 15(*d*) is a side view of the supply path formation portion of FIG. 15(*a*), in which the ink has been substantially removed, according to an embodiment of the present invention.

FIG. 16(*b*) is a view of the ambient air path formation portion of FIG. 16(*a*) as seen from the XVIb perspective; and FIG. 16(*c*) is a view of the ambient air path formation portion of FIG. 16(*a*) as seen from the XVIc perspective.

FIG. 17(*b*) is a cross-sectional view of the injection path formation portion of FIG. 17(*a*) along the XVIIb-XVIIb line, according to an embodiment of the present invention.

FIG. 18(*b*) is a cross-sectional view of the signal blocking portion, rib, and translucent portion of FIG. 18(*a*) along the XVIIIb-XVIIIb line; and FIG. 18(*c*) is a cross-sectional view of the signal blocking portion, rib, and translucent portion of FIG. 18(*a*) along the XVIIIc-XVIIIc line, according to an embodiment of the present invention.

FIG. 19(*b*) is a view of the movable member of FIG. 19(*a*) along the arrow XIXb perspective, according to an embodiment of the present invention.

FIG. 20(*b*) is a side view of the front of the ink reservoir element of FIG. 20(*a*); and FIG. 20(*c*) is a cross-sectional view of the ink reservoir element of FIG. 20(*a*) along the XXc-XXc line, according to an embodiment of the present invention.

FIG. 22(*b*) is an expanded diagram of an ambient air intake mechanism, according to an embodiment of the present invention.

FIG. 23(*b*) is a view of a side surface of the supply cap of FIG. 23(*a*) along the arrow XXIIIb perspective; FIG. 23(*c*) is a top view of the supply cap of FIG. 23(*a*); FIG. 23(*d*) is a bottom view of the supply cap of FIG. 23(*a*); and FIG. 23(*e*) is a cross-sectional view of the supply cap of FIG. 23(*c*) along the XXIIIe-XXIIIe line, according to an embodiment of the present invention.

FIG. 24(*b*) is a top view of the supply joint of FIG. 24(*a*); FIG. 24(*c*) is a bottom view of the supply joint of FIG. 24(*a*), and FIG. (d) is a cross-sectional view of the supply joint of FIG. 24(*b*) along the XXIVd-XXIVd line, according to an embodiment of the present invention.

FIG. 25(*b*) is a side view of the supply valve of FIG. 25(*a*) along the arrow XXVb perspective; FIG. 25(*c*) is a top view of the supply valve of FIG. 25(*a*); FIG. 25(*d*) is a bottom view of the supply valve of FIG. 25(*a*); and FIG. 25(*e*) is a cross-sectional view of the supply valve of FIG. 25(*c*) along the XXVe-XXVe line, according to an embodiment of the present invention.

FIG. 26(*b*) is a top view of the first supply spring of FIG. 26(*a*); FIG. 26(*c*) is a bottom view of the first supply spring of FIG. 26(*a*); and FIG. 26(*d*) is a cross-sectional view of the first supply spring of FIG. 26(*b*) along the XXVId-XXVId line, according to an embodiment of the present invention.

FIG. 27(*b*) is a side view of the supply slider of FIG. 27(*a*) along the arrow XXVIIb perspective; FIG. 27(*c*) is a top view of the supply slider of FIG. 27(*a*); FIG. 27(*d*) is a bottom view of the supply slider of FIG. 27(*a*); and FIG. 27(*e*) is a cross-sectional view of the supply slider of FIG. 27(*c*) along the XXVIIe-XXVIIe line, according to an embodiment of the present invention.

FIG. 28(*b*) is a top view of the valve seat of FIG. 28(*a*); FIG. 28(*c*) is a bottom view of the valve seat of FIG. 28(*a*); and FIG. 28(*d*) is a cross-sectional view of the valve seat of FIG. 28(*b*) along the XXVIIId-XXVIIId line, according to an embodiment of the present invention.

FIG. 29(*b*) is a top view of the check valve of FIG. 29(*a*); FIG. 29(*c*) is a bottom view of the check valve of FIG. 29(*a*); and FIG. 29(*d*) is a cross-sectional view of the check valve of FIG. 29(*a*) along the XXIXd-XXIXd line, according to an embodiment of the present invention.

FIG. 30(*b*) is a top view of the cover of FIG. 30(*b*), FIG. 30(*c*) is a bottom view of the cover of FIG. 30(*a*); and FIG. 30(*d*) is a cross-sectional view of the cover of FIG. 30(*b*) along the XXXd-XXXd line, according to an embodiment of the present invention.

FIG. 31(*b*) is a side view of the ambient air cap of FIG. 31(*a*) along the arrow XXXIb perspective; FIG. 31(*c*) is a top view of the ambient air cap of FIG. 31(*a*); FIG. 31(*d*) is a bottom view of the ambient air cap of FIG. 31(*a*); and FIG. 31(*e*) is a cross-sectional view of the ambient air cap of FIG. 31(*c*) along the XXXIe-XXXIe line, according to an embodiment of the present invention.

FIG. 32(*b*) is a top view of the ambient air joint of FIG. 32(*a*); FIG. 32(*c*) is a bottom view of the ambient air joint of FIG. 32(*a*); and FIG. 32(*d*) is a cross-sectional view of the ambient air joint in FIG. 32(*b*) along the XXXIId-XXXIId line, according to an embodiment of the present invention.

FIG. 33(*b*) is a bottom view of the ambient air valve of FIG. 33(*a*), according to an embodiment of the present invention.

FIG. 36(*b*) is a side view of the ink reservoir element of FIG. 36(*a*) showing a welding process for welding one of the film side walls onto the frame portion, according to an embodiment of the present invention.

FIG. 37(*b*) is a side view of the ink reservoir element of FIG. 37(*a*) showing a pressure reducing process; and FIG. 37(*c*) is a side view of the ink reservoir element of FIG. 37(*a*) showing an ink injection process, according to an embodiment of the present invention.

FIG. 38(*b*) is a side view of the ink cartridge of FIG. 38(*a*) showing a welding process for welding components of the case, according to an embodiment of the present invention.

FIG. 39(*b*) is a perspective view showing a process for packaging the ink cartridge of FIG. 39(*a*) using a packaging unit, according to an embodiment of the present invention.

FIG. 42(*b*) is a side view of the ink reservoir element of FIG. 42(*a*) showing the position of the movable member when there is no ink within the ink reservoir element, according to an embodiment of the present invention.

FIG. 46(*c*) is a front view of the an cartridge, according to an embodiment of the present invention.

FIG. 47(*b*) is a front view of the ink cartridge of FIG. 47(*a*); and FIG. 47(*c*) is a perspective view of the ink cartridge of FIG. 47(*a*), according to an embodiment of the present invention.

FIG. 48(*b*) is a front view of a case configured to hold a black ink cartridge and a plurality of color ink cartridge, according to an embodiment of the present invention.

FIG. 49(*b*) is a cross-sectional view of the case of FIG. 48(*b*) along the XXXXIXb-XXXXIXb line, according to an embodiment of the present invention.

FIG. 52(*b*) is a cross-sectional view of the ink cartridge of FIG. 52(*a*) positioned within a multifunction device, according to another embodiment of the present invention.

FIG. 53(*b*) is a perspective view of an ink cartridge, according to still yet another embodiment of the present invention.

FIG. 59(*b*) is a perspective view of an ink cartridge, according to still yet a further embodiment of the present invention.

DETAILED DESCRIPTION OF EMBODIMENTS

Figure 1:
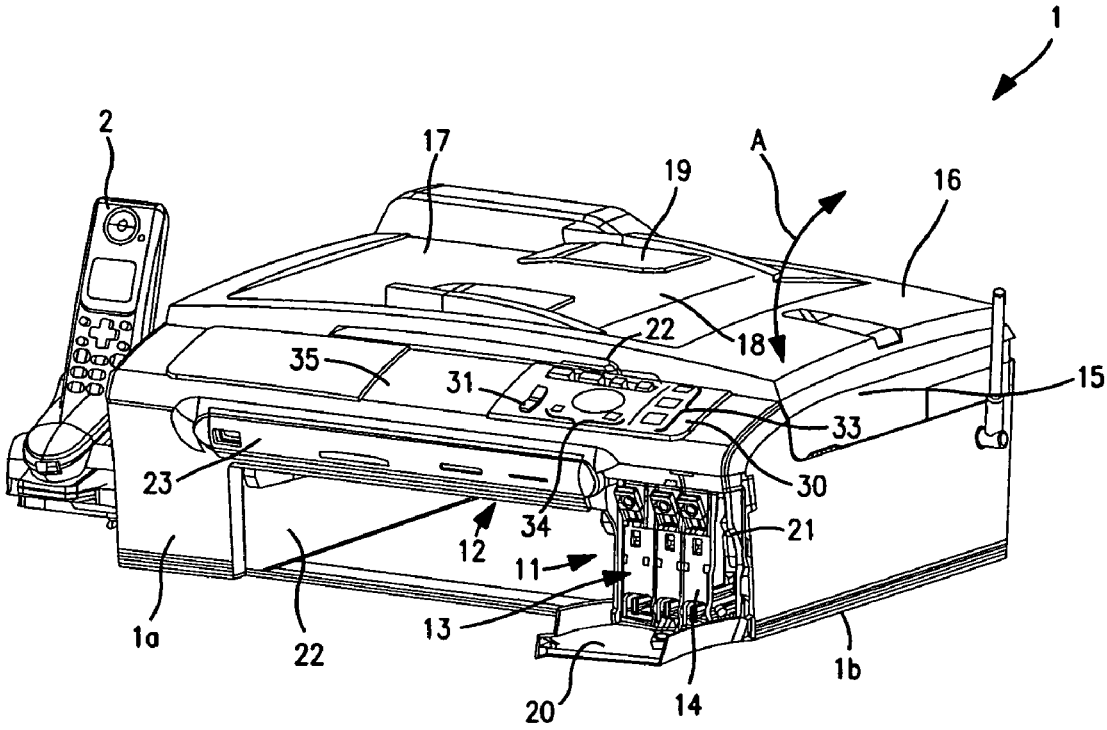
FIG. 1 is a perspective view of multifunction device, according to an embodiment of the present invention.
Figure 2:
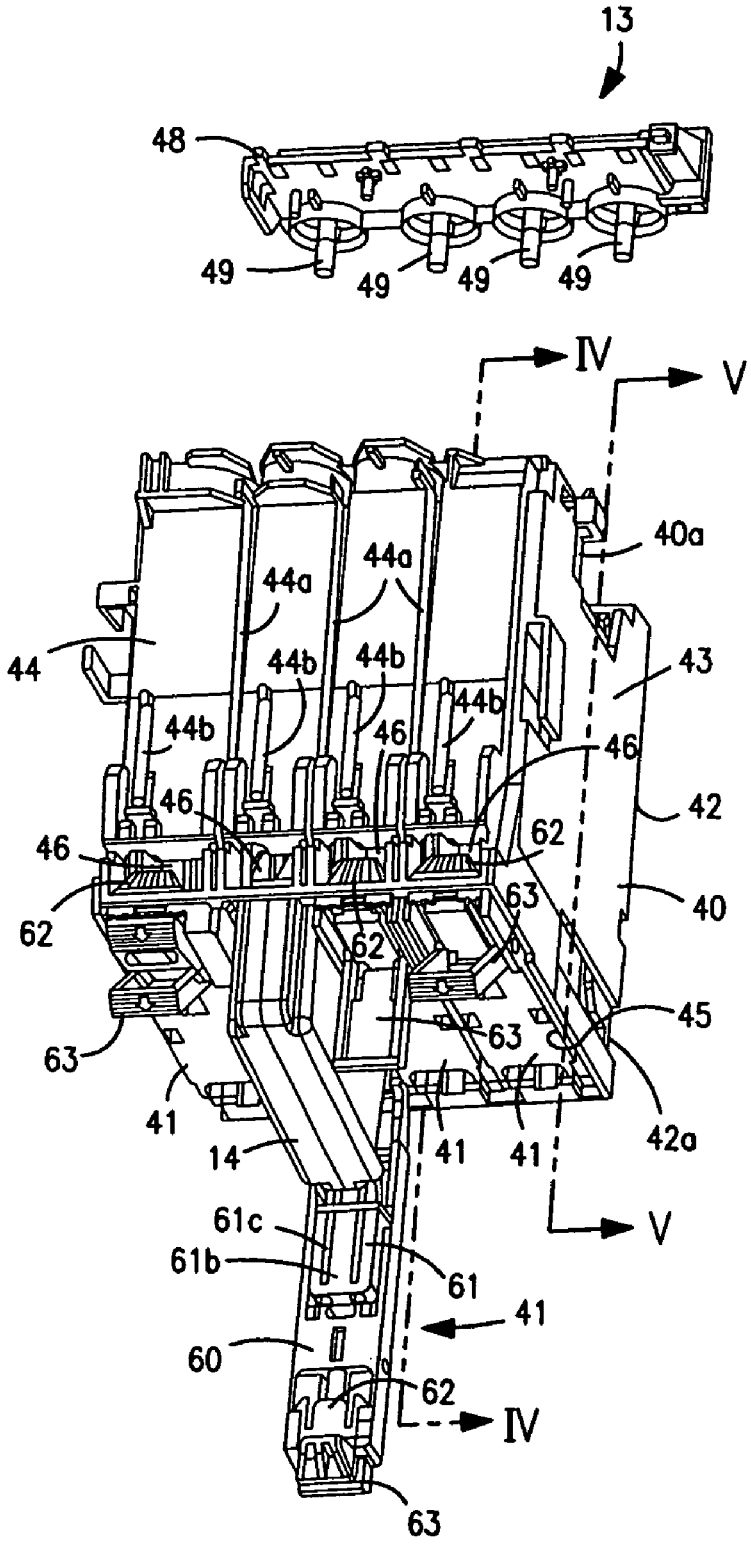
FIG. 2 is perspective view a refill unit, according to an embodiment of the present invention.
Figure 3:
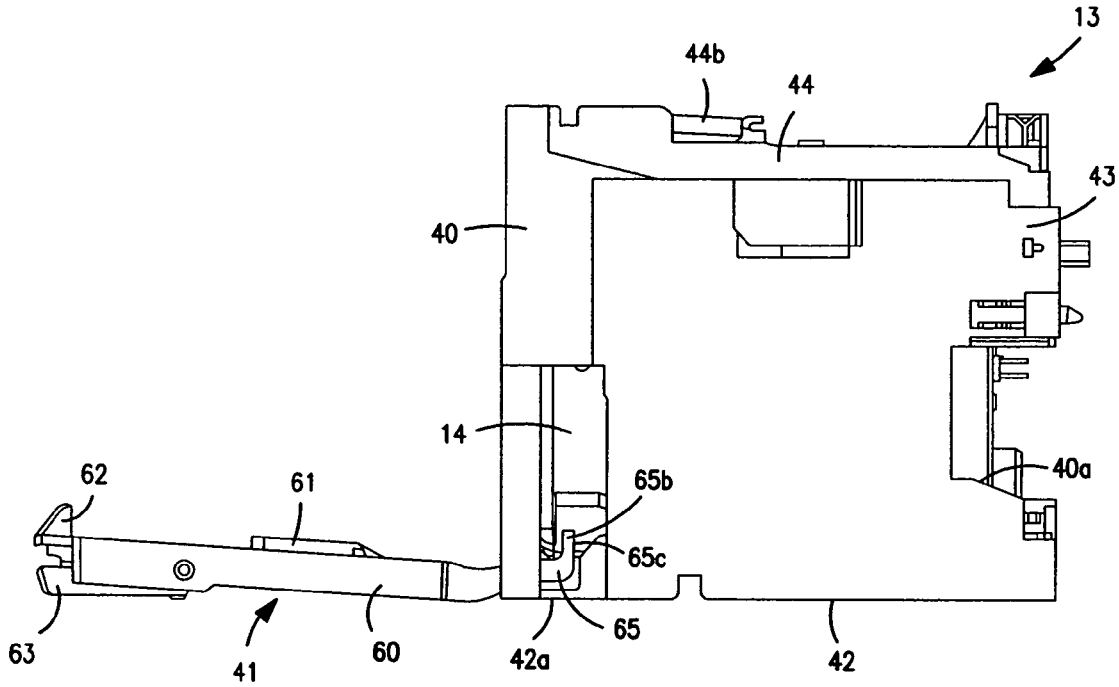
FIG. 3 is a side view showing a state in which a door of refill unit is open, according to an embodiment of the present invention.
Figure 4:
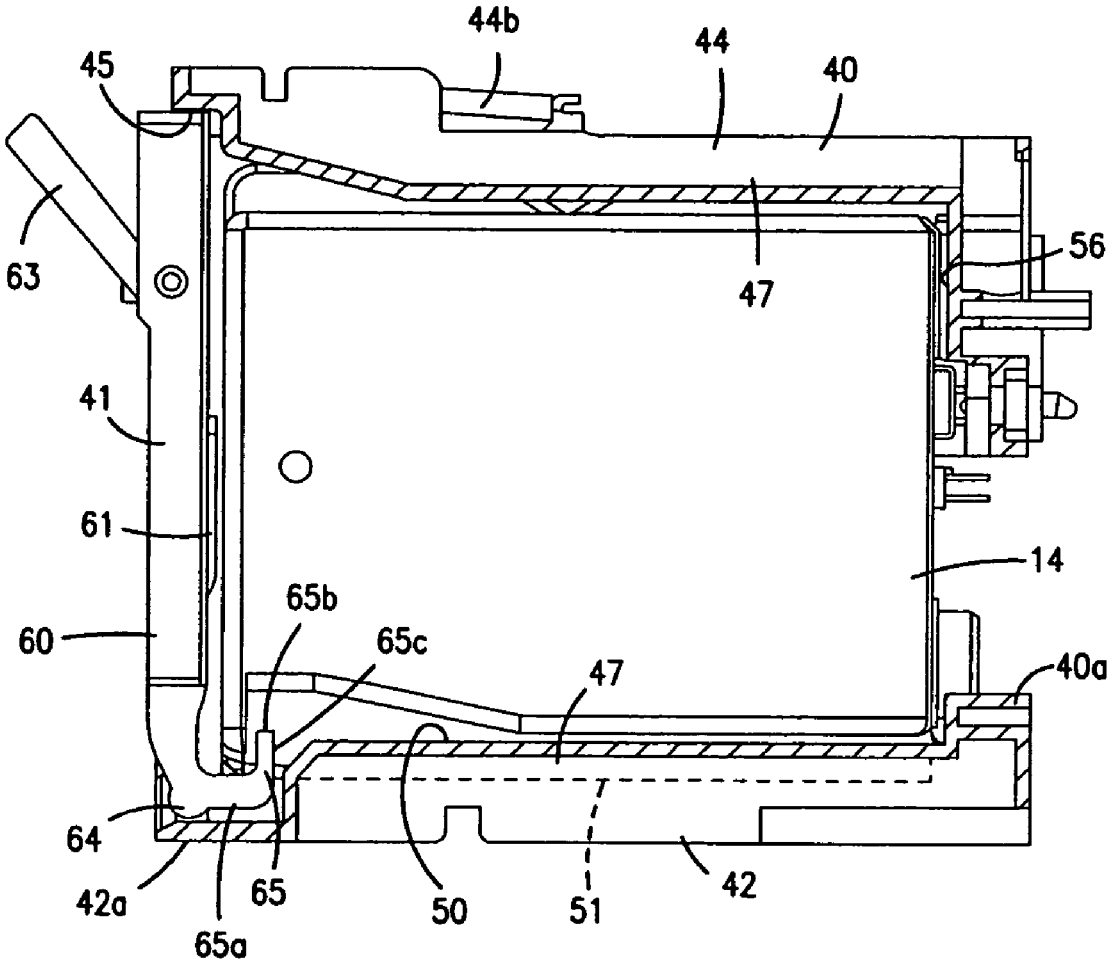
FIG. 4 is a cross-sectional view of refill unit of FIG. 2 along the IV-IV line, according to an embodiment of the present invention.
Figure 5:
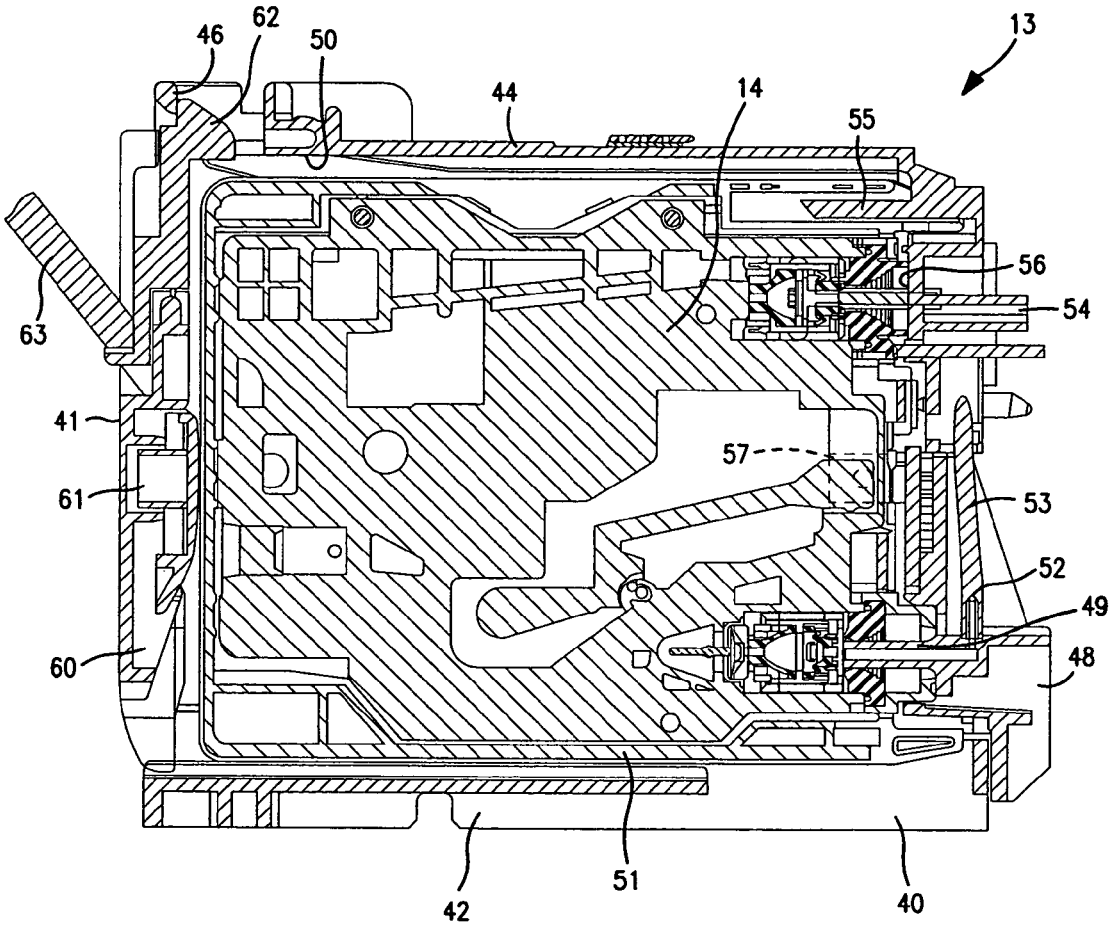
FIG. 5 is a cross-sectional view of refill unit of FIG. 2 along the V-V line, according to an embodiment of the present invention.

Embodiments of the present invention and their features and technical advantages may be understood by referring to FIGS. 1-67(*d*), like numerals being used for like corresponding portions in the various drawings.

FIG. 1 depicts a multifunction device 1 in which an ink cartridge 14 may be installed, according to an embodiment of the present invention. Multifunction device 1 may comprise a printer portion 11 disposed on a lower portion of multifunction device 1, and a scanner portion 12 disposed on an upper portion of printer portion 11. Multifunction device 1 may be a Multi Function Device ("MFD") in which printer portion 11 and scanner portion 12 are a single unit, and may be configured to perform various functions, such as a printer function, a scanner function, a copy function, or a facsimile function, or a combination thereof.

Multifunction device may be connected to a computer (not shown), and may record images or documents on a recording medium (not shown), e.g., a recording paper, based on image data or document data transmitted by the computer to multifunction device 1. Multifunction device 1 also may be connected to an external device (not shown), e.g., a digital camera, such that multifunction device 1 may record image data outputted from the digital camera to the recording medium. Moreover, multifunction device 1 may be coupled to a receiver, e.g., a telephone, and multifunction device 1 may communicate with another multifunction device and send image data to the other multifunction device. Multifunction device 1 also may comprise a slot portion 23, and recording media (not shown), such as a memory card, may be loaded into slot portion 23, and multifunction device 1 may record data, such as image data recorded on the recording media, to the recording medium.

In multifunction device 1, printer portion 11 may be configured as an inkjet recording device, and a refill unit 13 which may store ink which is supplied to a recording head (not shown) which discharges ink drops in advance may be provided at the base of the front surface of multifunction device 1. Refill unit 13 may have a compact design and may be configured, such that ink cartridge 14 readily may be replaced.

Scanner portion 12 may comprise a document bed 15, and scanner portion 12 may function as an Flatbed Scanner ("FBS"). Scanner portion 12 also may comprise a document cover 16 which may be provided at the upper portion of document bed 15. Document cover 16 may comprise an automatic document feeder ("ADF") 17, and may be attached to the back side of document bed 15 via a hinge, such that document cover 16 freely may be opened and closed. Thus, document cover 16 may be opened and closed by rotating in the direction of arrow A with respect to document bed 15. In this embodiment, document bed 15 comprises a portion of the housing of multifunction device 1, and document cover 16 comprises a portion of the top surface of multifunction device 1.

Document bed 15 may comprise a contact glass sheet (not shown) and an image reading unit (not shown). A document may be positioned between document cover 16 and the contact glass sheet, and the image reading unit may read images from the document by moving along the contact glass sheet from the bottom of the contact glass sheet.

ADF 17 may be configured, such that it may consecutively feed a predetermined number of documents from a document tray 18 to a paper ejection tray 19. Alternatively, when document cover 16 does comprise ADF 17, document cover 16 may be opened by the user, and documents may be positioned on the contact glass sheet.

Printer portion 11 may comprise an image recording portion which has an inkjet recording head (not shown), and may be configured as an inkjet recording device. Printer portion 11 also may comprise refill unit 13. For example, refill unit 13 may be built into a front surface 1*a* side and a bottom surface 1*b* side of multifunction device 1. In this embodiment, refill unit 13 may be configured, such that it may house and hold four ink cartridges 14, e.g., a black ink cartridge, a yellow ink cartridge, a magenta ink cartridge, and a cyan ink cartridge. The ink of each ink cartridge 14 may be supplied to the recording head via an ink tube 53.

A cover 20 may be configured to open and close an opening 21 provided at the end of front surface 1*a*, and cover 20 may be provided on the front surface of refill unit 13. Cover 20 may be configured, such that it readily may be rotated between a first position in which it exposes refill unit 13 via opening 21, and a second position in which it closes opening 21.

An opening 22 may be provided in the center of front surface 1*a* of multifunction device 1, and a paper feed tray (not shown) may positioned within opening 22. After a recording paper which is sent from the paper feed tray is sent to the back side, the recording paper is sent to the top, and then is fed to the front side, and images are recorded onto the recording paper while the recording paper is fed. The recording paper then is discharged to a paper ejection tray (not shown) which may be provided on the upper portion of the paper feed tray within opening 22.

An operation panel 30 may be attached to the top surface of the front surface side of multifunction device 1. Operation panel 30 may be an operation portion for the purpose of performing the operations of printer portion 11 and scanner portion 12, and it may comprise various operation keys 31-34 and liquid crystal display portion 35. Operation keys 31-34 positioned on operation panel 30 may be connected to a control device or a control circuit board (not shown) used as a control means for controlling major functions through flat cables (not shown). The control device also may process commands from a receiver 2 and may control the operation of multifunction device 1. When a device, such as a personal computer, is connected to multifunction device 1, the control device may control the operation of multifunction device 1 based on instructions received from the personal computer in addition to the instructions from operation panel 30.

A slot portion 23 may be provided on the bottom of operation panel 30, and a recording media, such as memory card, may be loaded via slot portion 23. Image data may stored on the recording media, and the image data or information associated with the image data may be read out from the recording media and displayed on liquid crystal display portion 35. Multifunction device 1 may be configured, such that arbitrary images displayed on liquid crystal display 35 may be transmitted to recording paper via instructions from operation panel 30.

Referring to FIGS. 2-6, refill unit 13 may comprise a case 40 into which ink cartridges 14 may be selectively inserted and removed, and a plurality of doors 41 which may be connected to case 40. Case 40 may be a substantially rectangular, parallelepiped shaped case, and a plurality of accommodating chambers 50 which house and hold ink cartridges 14 may be partitioned and provided on the inside of case 40. In an embodiment of the present invention, case 40 has four accommodating chambers 50, and four ink cartridges 14 may be selectively inserted into and removed from a corresponding one of accommodating chamber 50. The internal shape of each accommodating chamber 50 may correspond to an external shape of ink cartridge 14, such that ink cartridge 14 may be securely fitted within accommodating chamber 50.

Case 40 may comprise a bottom plate portion 42, a plurality of side plate portions 43 which are provided on the left and right sides of bottom plate portion 42, respectively, and a ceiling plate portion 44 which is positioned, such that it covers the space between each side plate portion 43. Moreover, the inside of accommodating chambers 50 may comprise a plurality of partition wall portions 47 for partitioning each accommodating chamber 50. The number of partition wall portions 47 provided may be based on the number of ink cartridges 14 housed in case 40, and the positions in which partition wall portions 47 are positioned may be based on the thicknesses of ink cartridges 14 in the width direction. Partition walls 47 may have a rib shape from the top and bottom of bottom plate portion 42 and ceiling plate portion 44. Nevertheless, partition wall portions 47 do not need to completely partition each accommodating chamber 50, such that partition wall portions 47 may have any shape so long as partition wall portions 47 protrude to the within from at least one of bottom plate portion 42 and ceiling plate portion 44, and divides the space between adjacent accommodating chambers 50.

A cutout portion 40*a* may be provided on the back side of case 40, and a needle forming member 48 may be fitted into cutout portion 40*a*. A needle or extraction member 49 may be configured to extract ink from an interior of ink cartridges 14, and may be provided on needle forming member 48 based on the number of ink cartridges 14 housed in accommodating chambers 50.

Needle 49 may extend along the direction of opening 45 of case 40 and in a substantially horizontal direction, e.g., the ink cartridge installation direction, when needle forming member 48 is engaged with cutout portion 40*a*. When an ink cartridge 14 is installed in an accommodating chamber 50, needle 49 may be inserted into an ink supply portion 120 of ink cartridge 14, and an ink supply path may be provided as a supply valve 620 of an ink supply mechanism 500 is pressed. Needle 49 may communicate with an ink extraction opening 52 which protrudes upward on the back side of case 40, and ink tube 53 may be connected to ink extraction opening 52. Ink tube 53 also may be connected to the inkjet recording head, and may be configured to supply ink from the interior of ink cartridges 14 to the inkjet recording head.

A path 54, which introduces ambient air into ink cartridges 14 may be provided on the side wall of case 40, which forms the top of needle 49. When the ink within ink cartridges 14 is extracted via needle 49, ambient air corresponding to the extracted ink may pass through path 54 and may be supplied into ink cartridges 14.

Moreover, a protrusion 55 which protrudes to ink cartridge 14 side may be provided on the top of path 54. Protrusion 55 may be a guide protrusion which is fitted into a pair of case fitting grooves 214*b*2 and 224*b*2. When an ink cartridge 14 is about to be installed incorrectly, protrusion 55 may prevent the incorrect installation of ink cartridge 14.

On the back side of case 40, a ink detection sensor 57 which detects the height of the ink liquid level, i.e., ink, within ink cartridge 14 may be provided between needle 49 and path 54. Ink detection sensor 57 may be a transmissive optical sensor which comprises a light emitting portion 57*a* and a light receiving portion 57*b*. Ink detection sensor 57 may be provided in a position corresponding to translucent detection portion 140 of ink cartridge 14 when ink cartridge 14 is housed within accommodating chamber 50, and may be positioned in a position in which translucent detection portion 140 is positioned between light emitting portion 57*a* and light receiving portion 57*b*. Ink detection sensor 57 may be connected to a control device, and the amount of ink stored in each ink cartridge 14 may be monitored by the control device.

A rib 44*a* may be provided on ceiling plate portion 44, which may improve the rigidity of case 40. Ceiling plate portion 44 may comprise a swing arm mechanism 44*b*. A tension spring may be attached between swing arm mechanism 44*b* and ceiling plate portion 44, and swing arm mechanism 44*b* may be elastically biased in the direction of door 41. Swing arm mechanism 44*b* may be configured, such that the ends which protrude into case 40 (accommodating chamber 50) engage with latch portions 217*a* and 227*a* of ink cartridge 14, for example, when it is elastically biased.

An opening 45, i.e., an ink cartridge insertion opening may be provided on the front surface of case 40, such that opening 45 may be an opening for each of accommodating chambers 50. Each door 41 selectively may open and close a corresponding portion of opening 45, such that when each door 41 is in a closed position, opening 45 is closed in its entirety. When door 41 is in the closed position, ink cartridge 14 reliably may be held within accommodating chamber 50, and when door 41 is in the open position, ink cartridge 14 readily may be inserted into or removed from accommodating chamber 50.

Figure 6:
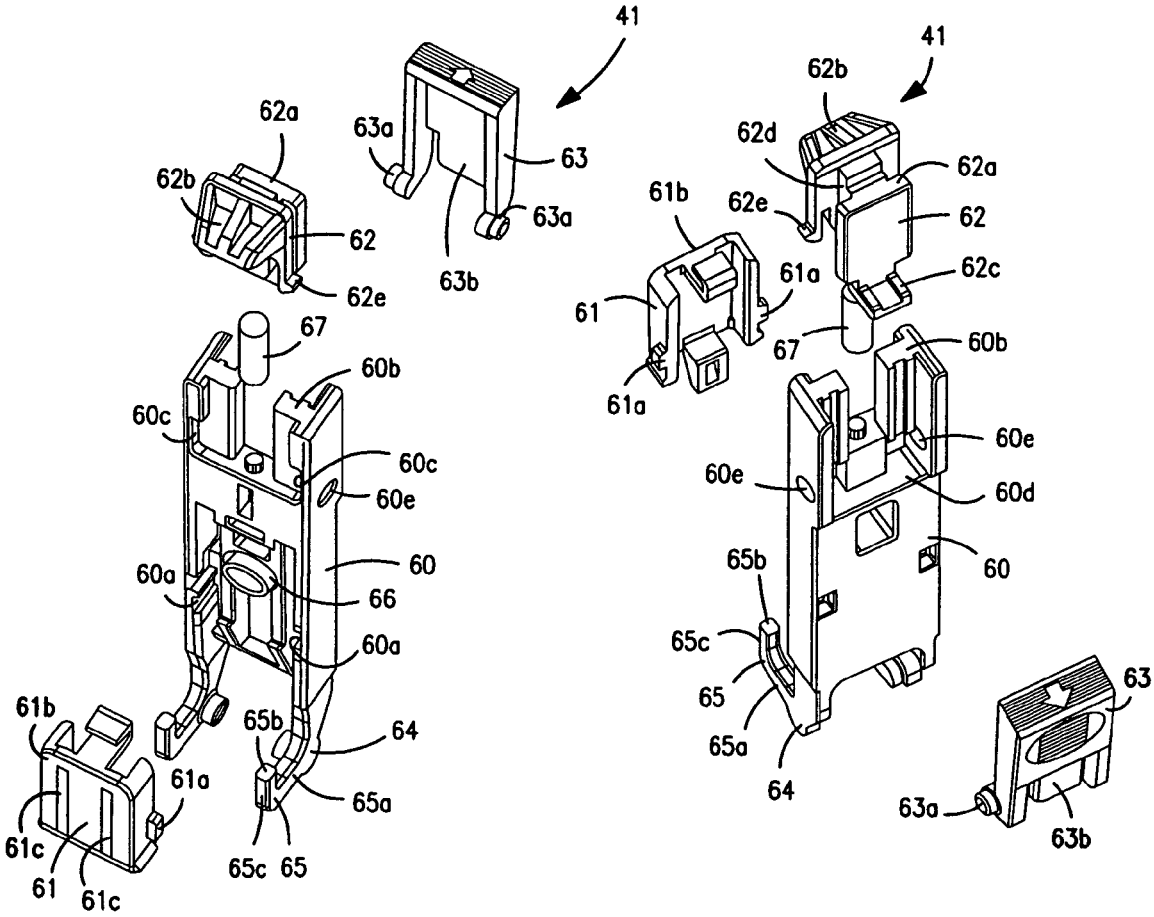
FIG. 6 is an expanded, perspective view of the door of refill unit, according to an embodiment of the present invention.
Figure 7:
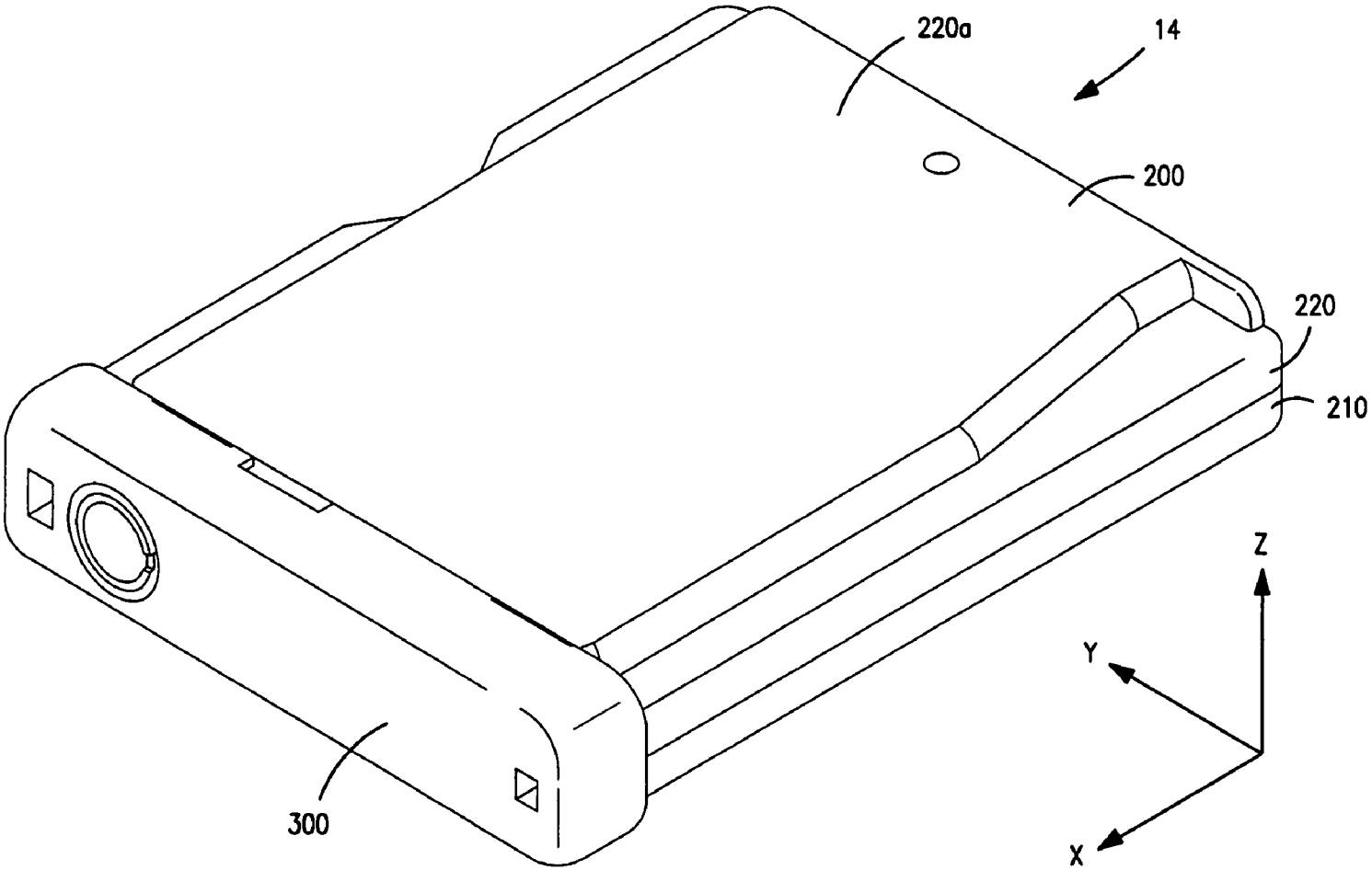
FIG. 7 is a perspective view of a color ink cartridge, according to an embodiment of the present invention.
Figure 8:
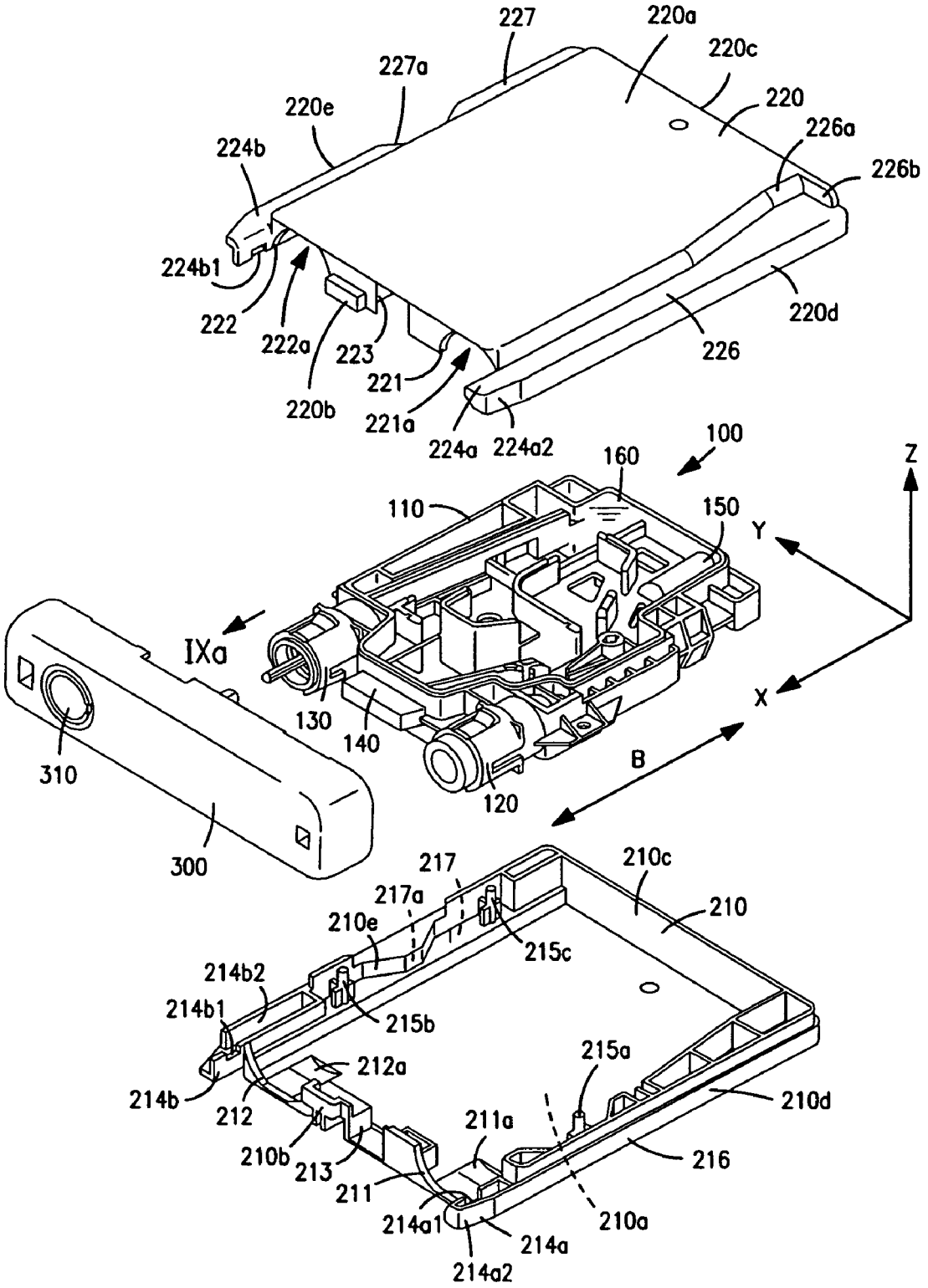
FIG. 8 is an expanded, perspective view showing an interior of the color ink cartridge of FIG. 7, according to an embodiment of the present invention.
Figure 9A:
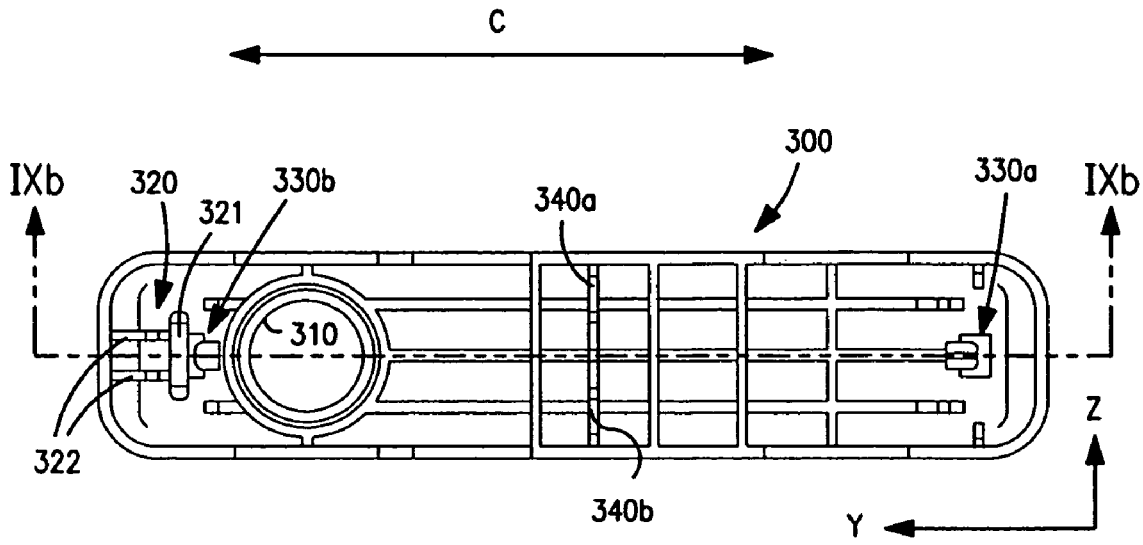
FIG. 9(*a*) is an interior view of a protector of FIG. 8 as seen from the IXa perspective.
Figure 9B:
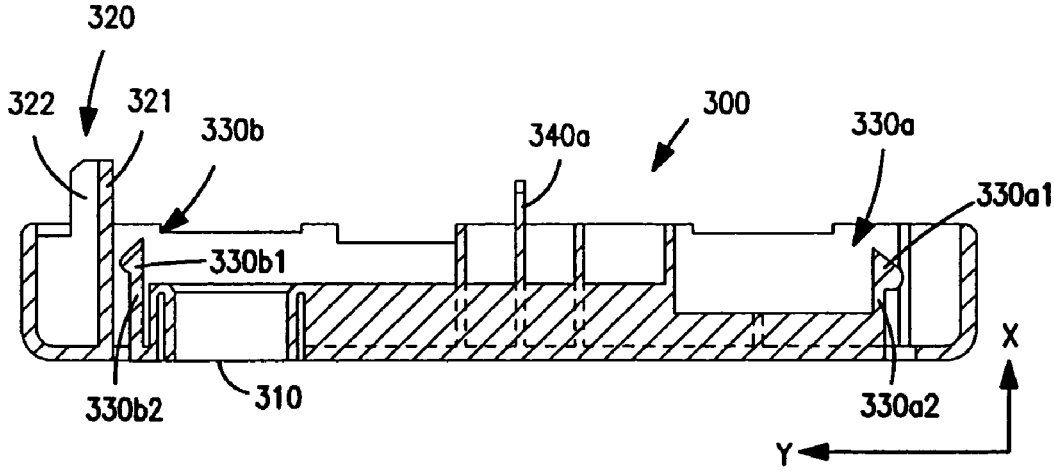
Figure 10:
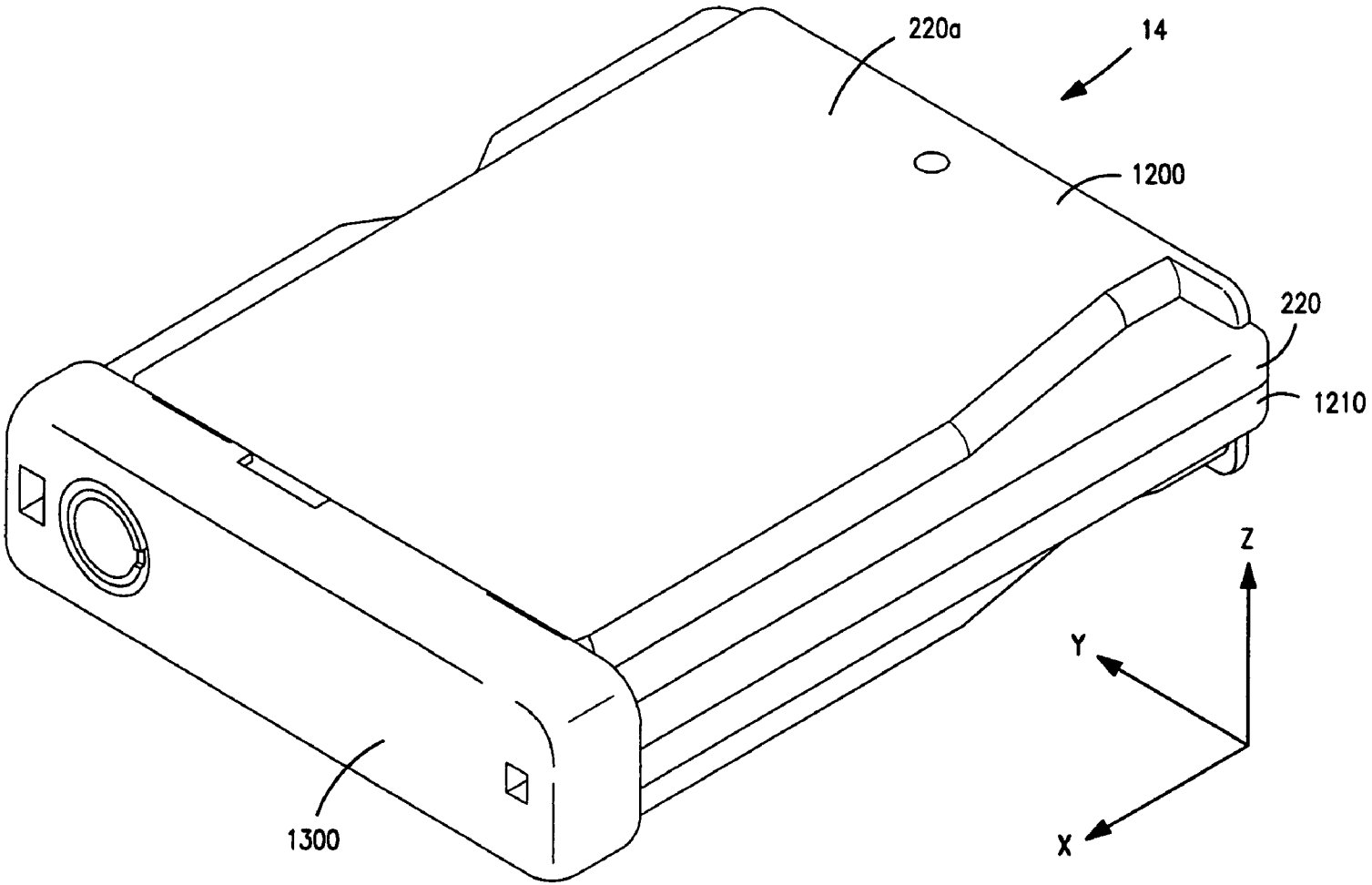
FIG. 10 is a perspective view of a black ink cartridge, according to an embodiment of the present invention.
Figure 11:
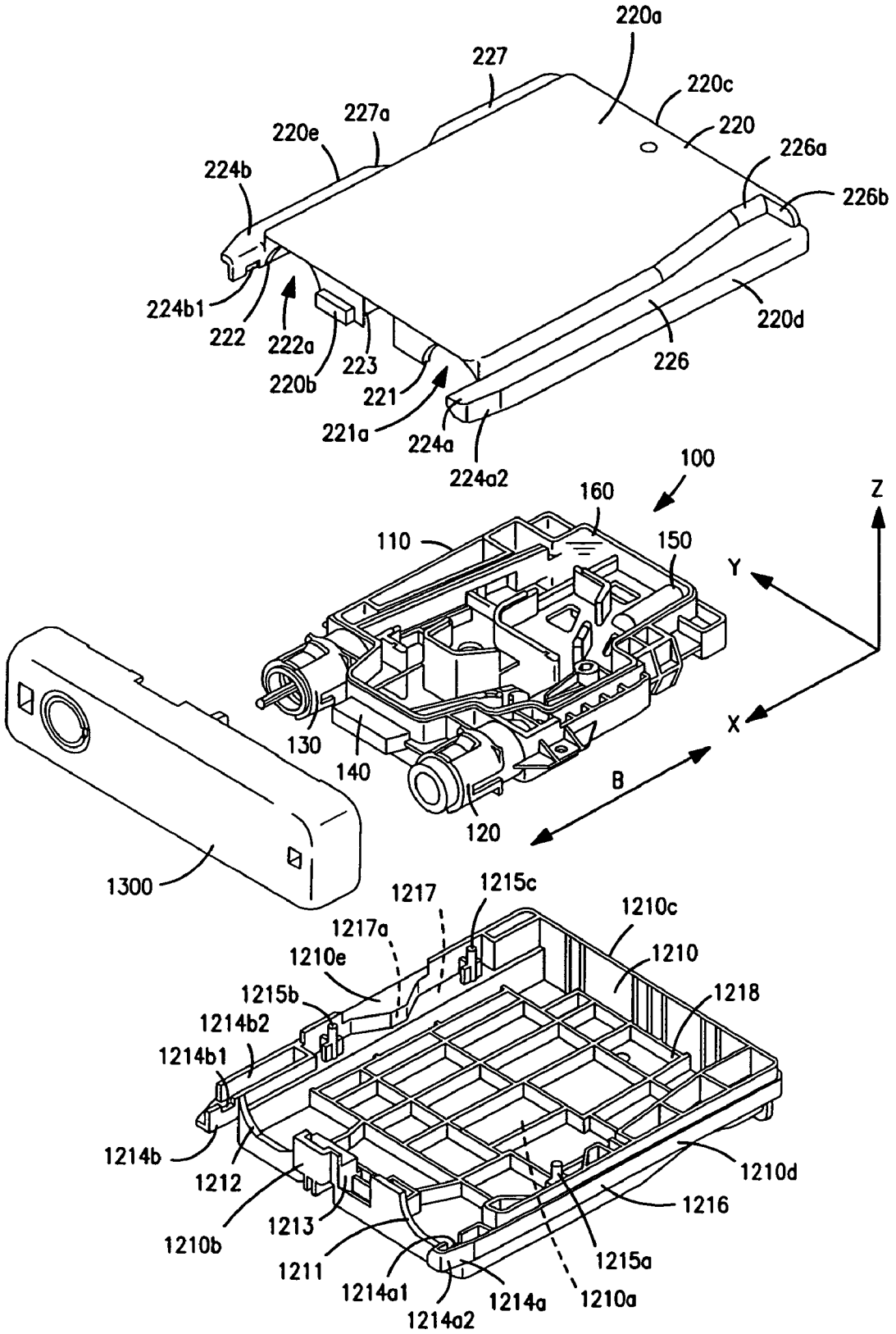
FIG. 11 is an expanded, perspective view showing an interior of the black ink cartridge of FIG. 10, according to an embodiment of the present invention.
Figure 12:
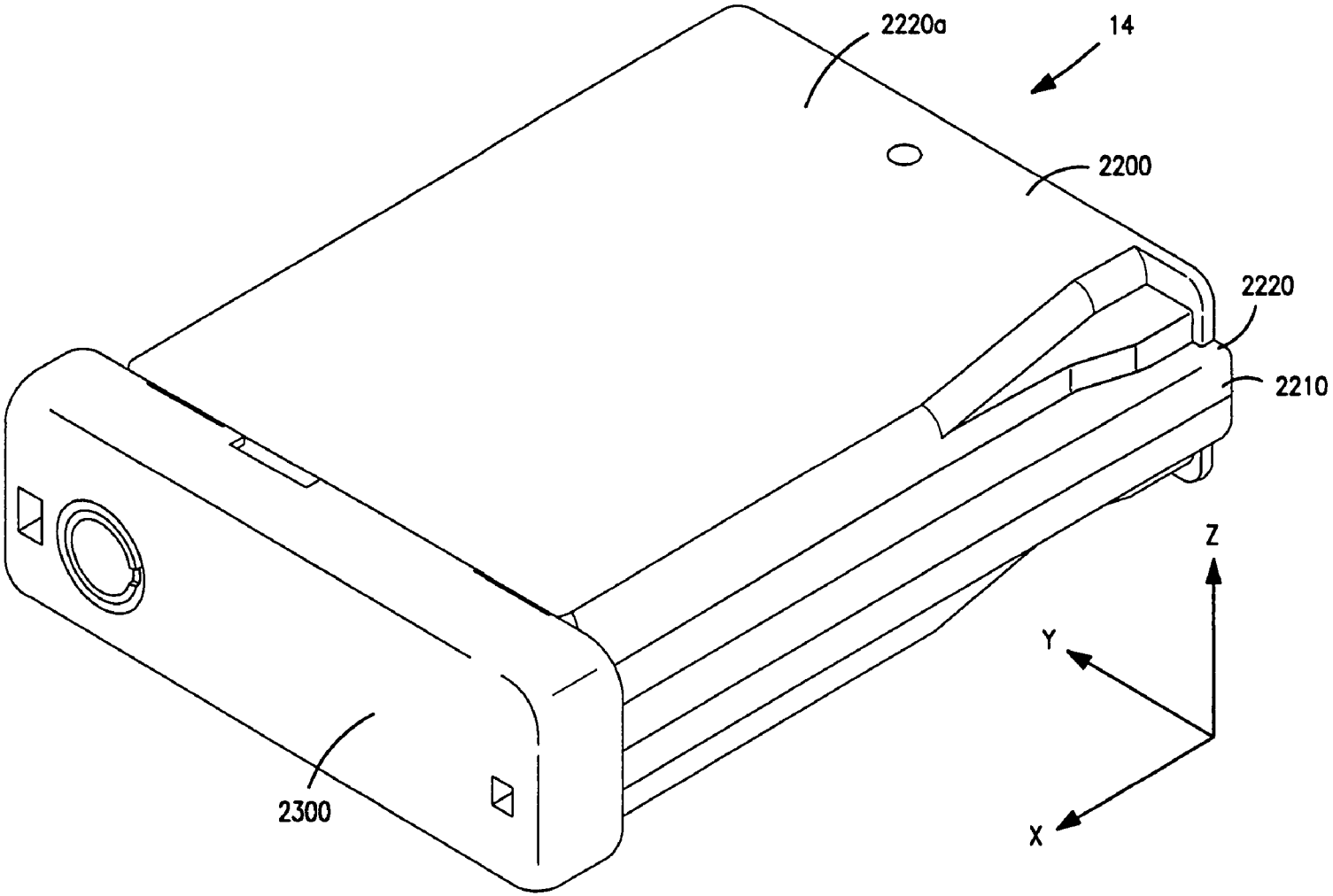
FIG. 12 is a perspective view of a large capacity black ink cartridge, according to an embodiment of the present invention.
Figure 13:
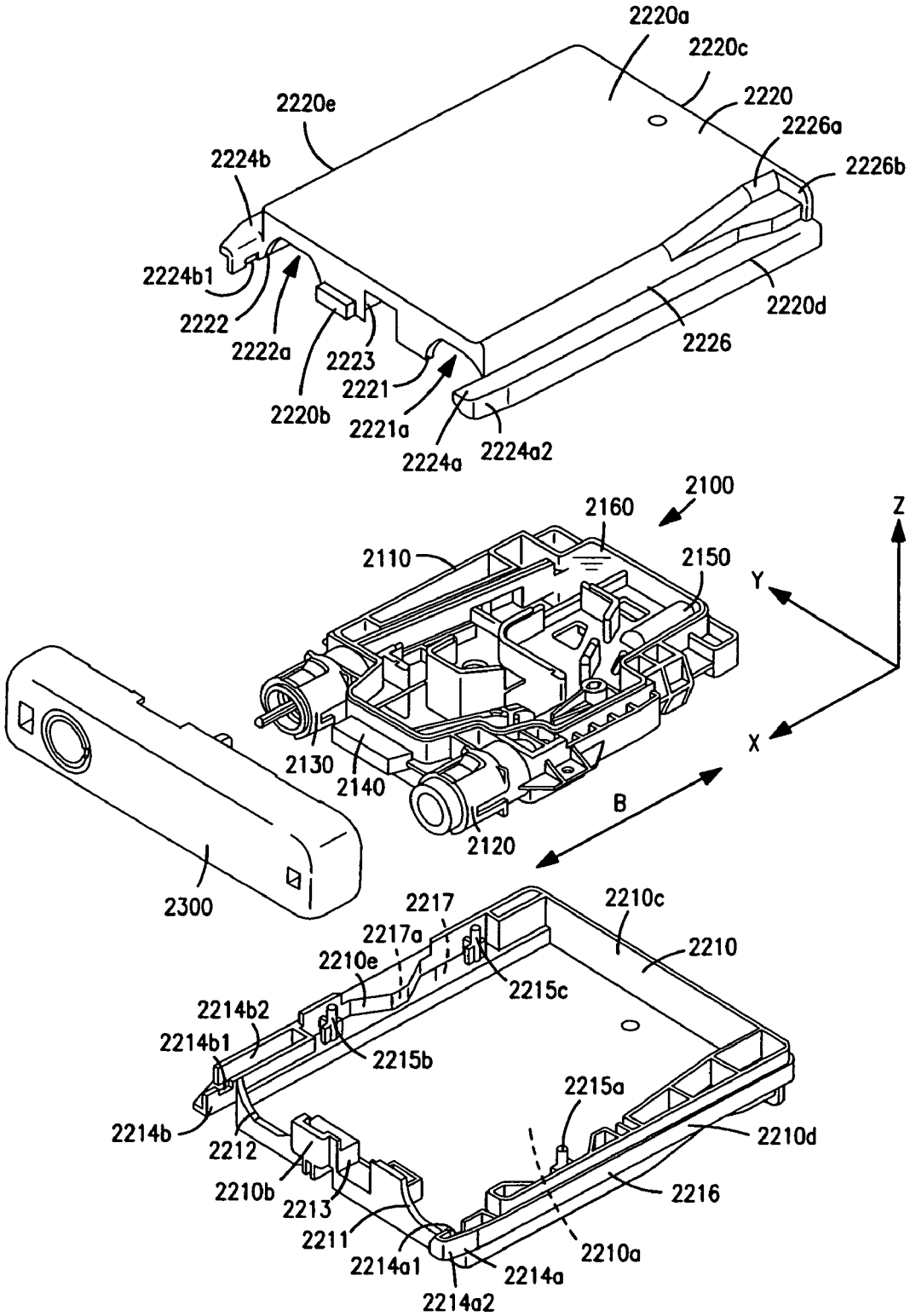
FIG. 13 is an expanded, perspective view showing the interior of the large capacity black ink cartridge of FIG. 12, according to an embodiment of the present invention.

Referring to FIG. 6, door 41 may comprise a door main body 60, a pressing retaining member 61 which is provided on door main body 60, a door lock member 62 which fastens door 41 to case 40, and a lock release lever 63 which releases door 41 from case 40. Door main body 60, pressing retaining member 61, door lock member 62, and lock release lever 63 each may be molded using resins.

Door main body 60 substantially may have the shape of a long and thin rectangle, and the shape of door main body 60 may be the same as the shape of the corresponding portion of opening 45 of case 40. A rotating shaft portion 64 may be supported on the lower portion of the front surface of case 40, and may be provided on the bottom end of door main body 60. For example, a bearing portion 42*a* may be provided on the front end of bottom plate portion 42 of case 40, and rotating shaft portion 64 may be fitted into bearing portion 42*a*, such that rotating shaft portion 64 may rotate freely. Thus, door main body 60 may close opening 45 by standing up or may open opening 45 by folding over.

A pullout member 65 may be provided as a unit with door main body 60, and may be provided on the bottom end of door main body 60. Pullout member 65 substantially may have an L-shape, and may comprise an extension portion 65*a* and a curved portion 65*b*. Extension portion 65*a* may be successively provided on the bottom end of door main body 60, and curved portion 65*b* may be successively provided to form an angle about equal to 90 degrees with respect to extension portion 65*a*.

In an exemplary embodiment of the present invention, when door 41 is in the closed position, a tip of curved portion 65*b* protrudes further upwards than an installation surface 51 of accommodating chamber 50. Door main body 60 rotates around rotating shaft portion 64, and consequently, pullout member 65 also rotates around rotating shaft portion 64. When door 41 moves to the open position, curved portion 65*b* rotates around rotating shaft portion 64. At this time, because of the rotation of curved portion 65*b*, an outer wall surface 65*c* changes from a state in which it stands substantially perpendicularly to a substantially horizontal state. The length of extension portion 65*a* selected to have predetermined dimensions, such that when curved portion 65*b* is rotated, outer wall surface 65*c* is slightly higher than installation surface 51 and is substantially parallel to installation surface 51.

Outer wall surface 65*c* functions as a guide surface which guides ink cartridge 14 to the top of installation surface 51 within accommodating chamber 50. Consequently, pullout member 65 functions not only as a member for pulling ink cartridge 14 out of accommodating chamber 50, but also as a guiding member when inserting ink cartridge 14 into accommodating chamber 50.

In an embodiment of the present invention, two pullout members 65 are provided on each door main body 60. In this embodiment, the spacing between each pullout member 65 is selected to be less than the width of ink cartridge 14.

A claw 61*a* may be provided on both sides of pressing retaining member 61, such that it protrudes to the outside from the side surface, and a claw accommodating portion 60*a*, in which claw 61*a* is housed may be provided on door main body 60. Claw accommodating portion 60*a* may comprise a groove which extends in a direction which is substantially perpendicular to the longitudinal direction of door main body 60. Claw 61*a* may be fitted into claw accommodating portion 60*a*, such that it may slide freely and pressing retaining member 61 is supported, such that it may advance and retreat in a direction which is perpendicular to the longitudinal direction of door main body 60. Moreover, a coil spring 66 may be positioned between pressing retaining member 61 and door main body 60, such that pressing retaining member 61 is elastically biased in the projected position.

When door 41 is in the closed position, pressing retaining member 61 may contact the side surface of ink cartridge 14 and may be displaced to the retreated position side as it is relatively pressed by ink cartridge 14. Thus, ink cartridge 14 receives the elastic force of coil spring 66 via pressing retaining member 61 and is pressed against the back side of case 40. Therefore, ink cartridge 14 may be held in a state in which it is positioned with respect to case 40.

Pressing retaining member 61 may have a flat plate shape, wall surface 61*b* of pressing retaining member 61 may have a flat surface, and a pair of protrusion strips 61*c* may be provided on wall surface 61*b*. Consequently, when door 41 is in the closed position, protrusion strips 61*c* contact and apply pressure to the side surface of ink cartridge 14.

Moreover, pressing retaining member 61 may be configured, such that when in the closed position, it presses slightly downward from the center position in the vertical direction of ink cartridge 14. This may improve the operationality in the case in which the user operates door 41. For example, when pressing retaining member 61 is positioned at or above the center position in the vertical direction of ink cartridge 14, the user operates door 41 by holding it in the vicinity of lock release lever 63, such that the distance between the portion which is operated by the user and the pressing retaining member 61 is relatively small. Therefore, the force induced by coil spring 66 of pressing retaining member 61 becomes relatively large, and a force which is needed to operate door 41 also becomes relatively large. In contrast, when pressing retaining member 61 is positioned below the center position in the vertical direction of ink cartridge 14, the distance between the portion which is operated by the user and pressing retaining member 61 is relatively large, such that the user is able to operate door 41 using a relatively small amount of force. Nevertheless, when pressing retaining member 61 is positioned too far downward in the vertical direction of ink cartridge 14, it presses against the end of ink cartridge 14, such that ink cartridge 14 may slope within accommodating chamber 50, making it unable to hold ink cartridge 14 correctly. In this embodiment of the present invention, pressing retaining member 61 is positioned slightly below the center position in the vertical direction of ink cartridge 14, such that ink cartridge 14 may be installed or held correctly, and may be installed smoothly with a relatively small amount of force.

In this embodiment of the present invention, ink cartridge 14 may comprise an ink supply portion 120 and an ambient air intake portion 130 on the side surface opposite the side surface which contacts pressing retaining member 61, and ink supply portion 120 and ambient air intake portion 130 may comprise first and second valve mechanisms, respectively, having an elastic force, e.g., a biasing force. For example, the first and second valve mechanisms may comprise first and second supply springs 630 and 650 and first and second ambient air springs 730 and 750, respectively, which apply pressure to the supply valve 620 and ambient air valve 720, respectively, such that they block communication between the interior and the exterior of ink cartridge 14. Therefore, in order to reliably enable communication between the interior and the exterior of ink cartridge 14, the elastic force of pressing retaining member 61 may be selected, such that it is greater than the elastic force of the valve mechanisms of ink supply portion 120 and ambient air intake portion 130. Consequently, when ink cartridge 14 is installed within accommodating chamber 50, the ink within ink cartridge 14 reliably may be supplied, and ambient air reliably may be introduced into ink cartridge 14. Moreover, ink supply portion 120 may be on the bottom end and ambient air intake portion 130 may be on the top portion in the position in which ink cartridge 14 is installed in accommodating chamber 50, such that pressing retaining member 61 applies pressure to a position which is relatively close to the center position in the vertical direction of ink cartridge 14. Therefore, in comparison to when pressing retaining member 61 applies pressure to either the top or the bottom end of ink cartridge 14, the direction in which the momentum acts stabilizes, such that ink cartridge 14 may be held stable.

Door lock member 62 may be attached to the top end of door main unit 60. Door lock member 62 may comprise a main shaft portion 62*a*, a key portion 62*b* which protrudes in the direction of the inside of case 40, and a seat portion 62*c* which protrudes in the direction of the outside of case 40.

Door lock member 62 may be supported, such that it may advance and retreat in the vertical direction with respect to door main body 60. A slide rail 60*b* may extend in the vertical direction on the top end of door main body 60. A slide groove 62*d* also may extend in the vertical direction, and may be provided on main shaft portion 62*a*. Slide rail 60*b* may be inserted into slide groove 62*d*, and door lock member 62 may be configured, such that it may freely slide up and down.

A claw 62*e* may be provided on the bottom portion of both sides of key portion 62*b*. When door lock member 62 is fitted into door main unit 60, claw 62*e* may be housed in a claw accommodating portion 60*c* provided on door main body 60. Claw accommodating portion 60*c* may be configured from a groove which extends to a predetermined length in the vertical direction. Therefore, when door lock member 62 slides upward or downward, claw 62*e* contacts the within wall surface of claw accommodating portion 60*c*, and the sliding of door lock member 62 in the vertical direction thus may be restricted.

The sliding range of door lock member 62 may be defined consequently of the selection of the length of the groove which comprises claw accommodating portion 60*c*. When door lock member 62 slides upward with respect to door main body 60 and claw 62*e* contacts the top edge of the inside wall surface of claw accommodating portion 60*c*, door lock member 62 may be in the position in which it protrudes upward from the upper end of door main body 60. When door lock member 62 slides downward with respect to door main body 60 and claw 62*e* contacts the bottom edge of the inside wall surface of claw accommodating portion 60*c*, door lock member 62 may be in the position in which it retreats within door main body 60. The position at which door lock member 62 contacts the top edge of the inside wall surface of claw accommodating portion 60*c* may be defined as the "projected position," and the position at which door lock member 62 contacts the bottom edge of claw accommodating portion 60*c* may be defined as the "retreated position."

An elastic member, such as a coil spring 67, may be positioned between door lock member 62 and door main body 60. Therefore, door lock member 62 may be elastically biased, such that it protrudes upward from door main body 60.

The top surface of key portion 62*b* may be a sloped surface which slopes downward. Therefore, when door 41 changes from the open position to the closed position, the top surface of door lock member 62 contacts the top edge of opening 45 of case 40, and when door 41 is rotated towards the closed position, door lock member 62 retreats within door main body 60 as it is relatively pressed against the top edge of opening 45. When door 41 is in the closed position, door lock member 62 again protrudes from door main body 60, and key portion 62*b* engages the top edge of case 40.

At this time, key portion 62*b* is in a state in which it is fitted into lock member fitting portion 46, which may be provided on the top edge of opening 45. Door lock member 62 may be elastically biased, such that it protrudes from door main body 60 due to coil spring 67, and is pressed within lock member fitting portion 46. Nevertheless, the position of door lock member 62 may be an intermediate position, such that it retreats slightly more to the retreated position side than to the protrusion side. Door lock member 62 may be elastically pressed against lock member fitting portion 46 when it is in the intermediate position, such that door lock member 62 does not elastically deviate from lock member fitting portion 46.

Lock release lever 63 substantially may have a rectangular plate shape, and it may be attached to the top of the outside of door main body 60 in a state in which it is fastened to case 40. Door main body 60 may comprise an accommodating portion 60*d* which houses lock release lever 63. Accommodating portion 60*d* may comprise a concave portion which may be provided on door main body 60, and when lock release lever 63 changes positions, lock release lever 63 may be fitted into accommodating portion 60*d*.

Supporting pin 63*a* may be provided on the bottom end of lock release lever 63. At the same time, pin support opening 60*e*, into which supporting pin 63*a* may be fitted may be provided on door main body 60. Because supporting pin 63*a* may be fitted into this pin support opening 60*e*, lock release lever 63 may be configured, such that it may rotate freely around the rotational center of supporting pin 63*a*. Specifically, lock release lever 63 may be configured, such that it may be freely rotated and displaced between a position which may be substantially parallel to the outer surface of door main body 60, e.g., a position in which it may be inclined at approximately 45 degrees, and a position in which it may be folded over substantially horizontally by moving the lever, e.g., raising the lever. The position of lock release lever 63 when it is housed within accommodating portion 60*d* may be defined as the "housed position," the position of lock release lever 63 when lock release lever 63 is inclined at approximately 45 degrees may be defined as the "neutral position," and the position of lock release lever 63 when it is folded over substantially horizontally may be defined as the "folded position."

The bottom end of lock release lever 63 may be an interlocking cam 63*b*, and interlocking cam 63*b* may be configured to slide door lock member 62 up and down when the position of lock release lever 63 changes. Because interlocking cam 63*b* is provided, when lock release lever 63 is rotated from the housed position, through the neutral position, and to the folded position, door lock member 62 slides from the projected position, through the intermediate position, and to the retreated position.

Interlocking cam 63*b* contacts seat portion 62*c* of door lock member 62. When door 41 is closed, lock release lever 63 attempts to further rotate door lock member 62 through interlocking cam 63*b* in a direction pressing downward. Nevertheless, door lock member 62 may be elastically biased upward by coil spring 67, such that door lock member 62 may not be displaced by the weight of lock release lever 63 alone, and door lock member 62 may be maintained in the intermediate position.

However, when lock release lever 63 forcibly is rotated, e.g., when a user attempts to replace ink cartridge 14 and operates and rotates lock release lever 63, lock release lever 63 may be rotated and displaced to the folded position. When lock release lever 63 is displaced to the folded position, interlocking cam 63*b* rotates and changes the position centered on supporting pin 63*a* and presses seat portion 62*c* downward. Consequently, door lock member 62 moves downward in opposition to the elastic force of coil spring 67 and may be displaced to the retreated position. When door lock member 62 is displaced to the retreated position, the lock of door 41 may be released, and door 41 changes from the closed position to the open position.

Door lock member 62 receives the elastic force of coil spring 67, such that if the rotational force which acts upon lock release lever 63 disappears, e.g., the user releases his lock release lever 63, door lock member 62 arrives in a position in which it protrudes most from door main body 60, and lock release lever 63 may be forcibly displaced to the housed position. Therefore, when replacing ink cartridge 14, because lock lever 92 may be almost completely housed within door main unit 60, rotating may be possible with rotating shaft portion 64 as the center of rotation to the point which door 41 may be nearly horizontal, such that the user readily may replace ink cartridge 14. Moreover, the two strips 61*c* which are provided on wall surface 61*b* of pressing retaining member 61 also operate as guides when housing ink cartridge 14 within accommodating chamber 50 in cooperation with a guide portion between curved portions 65*b*. Specifically, when ink cartridge 14 is to be inserted into accommodating portion 50, the user may load the bottom surface of ink cartridge 14 onto strips 61*c*, place the tip portion of ink cartridge 14 between curved portions 65*b*, and then press ink cartridge 14 in the direction of accommodating chamber 50. Further, when ink cartridge 14 is to be removed from accommodating chamber 50, the user removes ink cartridge 14 until the bottom surface of ink cartridge 14 reaches the top of strips 61*c* from between curved portions 65*b*.

When multifunction device 1 is in use, door 41 of refill unit 13 may be closed, and lock release lever 63 may be positioned in the neutral position. Therefore, when cover 20 is opened when replacing ink cartridge 14, lock release lever 63 slopes to the front surface side. Consequently, the user readily may operate lock release lever 63. If refill unit 13 is positioned on front surface 1*a* of multifunction device 1, and lock release lever 63 is positioned in the neutral position, then a space wide enough to accommodate refill unit 13 may need to be provided to be secured within multifunction device 1. Therefore, it may be desirable for refill unit 13 to be positioned further back from the rim of opening 21, resulting in an increase in the dimensions of multifunction device 1 will become large. Nevertheless, in an embodiment of the present invention, lock release lever 63 may rotate freely between the neutral position and the housed position when door 41 is in the closed position with respect to case 40, such that refill unit 13 may be positioned in the vicinity of the rim of opening 21. This arrangement may be employed because even if refill unit 13 is positioned on the rim of opening 21, the within wall surface of cover 20 contacts lock release lever 63 when cover 20 is closed, and when cover 20 is completely closed, lock release lever 63 may be displaced to the housed position as it is pressed by cover 20. Therefore, in this embodiment, a compact design for multifunction device 1 may be realized.

Referring to FIGS. 7-13, ink cartridges 14 which store black ink may be thicker than ink cartridges 14 which store other colored ink, e.g., because multifunction device 1 generally uses more black ink than other colored ink, e.g., cyan, magenta, yellow, and the like. Ink cartridge 14 may comprise a case 200 which substantially covers the entire body of an ink reservoir element 100 which stores ink, and a protector 300 which may be attached to case 200 and protects ink reservoir element 100 when ink cartridge 14 is in transit. Case 200 may have a substantially rectangular, parallelepiped shape, and may comprise a pair of largest surfaces 210*a* and 220*a* which oppose one another. In an embodiment of the present invention, ink reservoir element 100, case 200, protector 300, and all of the members contained in ink cartridge 14 may be non-metal materials, e.g., may comprise resin materials, such that they may be burned at the time of disposal. For example, nylon, polyester, or polypropylene may be used as resin materials.

Ink reservoir element 100 may comprise a frame portion 110 which forms an ink chamber 111 which stores ink, ink supply portion 120 which supplies ink stored in frame portion 110 to multifunction device 1, and ambient air intake portion 130 which introduces ambient air into frame portion 110. Ink reservoir element 100 also may comprise a translucent detection portion 140 which may be provided to detect the amount of ink stored within frame portion 110, an ink dispensing portion 150 which dispenses ink into frame portion 110, and a film 160 which may be welded to the top surface and the bottom surface of frame portion 110 to form an ink chamber on frame portion 110.

Case 200 may comprise a first case member 210 and a second case member 220 which are configured to sandwich ink reservoir element 100. First case member 210 may be a member which covers the bottom side surface of ink reservoir element 100, and second case element 220 may be a member which covers the top side surface of ink reservoir element 100. First and second case members 210 and 220 may comprise at least one resin material, and may be manufactured using injection molding. The depths of first and second case members 210 and 220 may be substantially equal to each other, and sum of these depths may be substantially equal to the thickness of ink reservoir element 100. Consequently, the distance between ink reservoir element 100 and the inside surface of case 200 may be relatively small, such that even if pressure is applied inward from the outside of case 200, the amount of deformation of case is relatively small, which reduces a potential amount of damage of case 200.

First case member 210 may comprise a plate-shaped portion which forms largest surface 210*a*, and vertical wall portions 210*b*-210*e* which may be provided in substantially orthogonal directions from the outer edge portions of the four sides of the plate-shaped portion. The vertical wall which forms the protector 300 side of first case member 210 may be designated as vertical wall portion 210*b*, the vertical wall positioned opposite vertical wall portion 210*b* may be designated vertical wall portion 210*c*, and the vertical walls which are connected to vertical wall portions 210*c* and 210*b* may be designated as vertical wall portions 210*d* and 210*e*, respectively.

A pair of case cutout portions 211 and 212 may be provided through vertical wall portion 210*b* of first case member 210 for exposing ink supply portion 120 and ambient air intake portion 130, respectively, to the outside of case 200. Case cutout portions 211 and 212 may be substantially semicircular from the edges of vertical wall portion 210*b*. A case cutout portion 213 also may be provided through vertical wall portion 210*b* between case cutout portion 211 and case cutout portion 212, and case cutout portion 213 may be for receiving ink detection sensor 57 at the position where ink detection sensor 57 sandwiches translucent detection portion 140. For example, case cutout portion 213 have substantially square or rectangular shape. A contact groove 211*a* which contacts ink supply portion 120 may be provided on the inside surface connecting to case cutout portion 211 of first case member 210, and a contact groove 212*b* which contacts ambient air intake portion 130 may be provided on the inside surface connecting to case cutout portion 212 of first case member 210. Because contact grooves 212*a* and 212*b* are provided, ink reservoir element 100 readily may be aligned with first case member 210.

Moreover, two case protrusion members 214*a* and 214*b* which protrude in the direction of protector 300 from the surface on which case cutout portions 211-213 are provided may be provided on first case member 210. Case protrusion members 214*a* and 214*b* may be provided on both sides of first case member 210 in the Y-direction, such that they sandwich case cutout portions 211-213. For example, case protrusion member 214*a* may protrude from ink supply portion 120 side, and case protrusion member 214*b* may protrude from ambient air intake portion 130 side. Case protrusion member 214*a* may have a sloping surface 214*a*2 which slopes in the direction of case cutout portions 211 to 213 towards the edge from the portion which connects to the outside surface of vertical wall portion 210*d* of case member 210. When ink cartridge 14 is to be installed into multifunction device 1, it may be installed, such that case protrusion member 214*a* is on the bottom side. Consequently, when ink cartridge 14 is installed, sloping surface 214*a*2 contacts bottom wall portion 41 of refill unit 13, and ink cartridge 14 may be smoothly led to the predetermined installation position due to its slope.

A case protrusion cutout portion 214*a*1 may be provided on case protrusion member 214*a*, and may be provided on the inside surface which forms the side of case cutout portions 211 to 213. Similarly, a case protrusion cutout portion 214*b*1 may be provided on case protrusion member 214*b*, and also may be provided on the inside surface which forms the side of case cutout portions 211 to 213. Case protrusion cutout portions 214*a*1 and 214*a*2 may have a substantially rectangular shape, and may prevent the natural desorption of protector 300 when protector 300 is attached to case 200. Moreover, a pair of protruding portions 330*a*1 and 330*b*1 of protector 300 may be fitted into case protrusion cutout portions 214*a*1 and 214*a*2.

A case fitting groove 214*b*2 may be provided on case protrusion member 214*b*, and may be provided across a portion of vertical wall portion 210*e* from the edge of case protrusion member 214*b*.

Moreover, a rod member 215*a*, and a pair of rod members 215*b* and 215*c* may be provided on first case member 210. Rod member 215 may protrude in the direction of second case member 220 in the vicinity of vertical wall portion 210*d* on ink supply portion 120 side, and may determine the position of ink reservoir element 100 sealed within case 200. Rod members 215*b* and 215*c* may protrude in the direction of second case member 220 in the vicinity of vertical wall portion 210*e* on ambient air intake portion 130 side, and may determine the position of ink reservoir element 100 sealed within case 200. The position of ink reservoir element 100 may be determined by the three locations of rod members 215*a* to 215*c*, such that they may prevent the incorrect attachment of ink reservoir element 100.

Second case member 220 may comprise a plate-shaped portion which forms largest surface 220*a*, and a plurality of vertical wall portions 220*b*-220*e* which are provided substantially in orthogonal directions from the outer edge portions of the four sides of the plate-shaped portion. The vertical wall which forms the protector 300 side of second case member 220 may be designated as vertical wall portion 220*b*, the vertical wall which is positioned opposite vertical wall portion 220*b* may be designated as vertical wall portion 220*c*, and the vertical walls which are respectively connected to vertical wall portions 220*c* and 220*b* may be designated as vertical wall portions 220*d* and 220*e*.

Three case cutout portions 221-223 may be provided through vertical wall portion 220*b*. A contact groove 221*a* connected to case cutout portion 221, and contact groove 222*a* connected to case cutout portion 222, also may be formed. Case cutout portions 221 and 222 may have substantially the same shape as case cutout portions 211 and 212 of first case member 210, and case cutout portion 223 may have substantially the same shape as case cutout portion 213 of first case member 210. Moreover, a pair of case protrusion members 224*a* and 224*b* may be provided on both sides of case cutout portions 221-223. Case protrusion member 224*a* may have a sloping surface 224*a*2 which slopes in the direction of case cutout portions 221-223 towards the edge from the portion which connects to the outside surface of vertical wall portion 210*d* of second case member 220. Case protrusion cutout portion 224*a*1 may be provided on case protrusion member 224*a*, and case protrusion cutout portion 224*b*1 and case fitting groove 224*b*2 may be provided on case protrusion member 224*b* across a portion of vertical wall portion 220*e* from the edge of case protrusion member 224*b*. A plurality of fitting opening portions 225*a*-225*c* may be provided in second case 220, and fitting opening portions 225*a*-225 may be configured to receive rod members 215*a*-215*c*. In an embodiment of the present invention, when first case member 210 is connected to second case member 220 to form case 200, case cutout portions 211 and 221 may form a first opening, case cutout portions 212 and 222 may form a second opening, and case cutout portions 213 and 223 may form a third opening. Moreover, when ink reservoir element 100 is positioned within case 200, ink supply portion 120 may protrude from the first opening, ambient air intake portion 130 may protrude from the second opening, and a portion of translucent portion 140 may be aligned substantially flush with the third opening.

In an embodiment of the present invention, first case member 210 and second case member 220 may have substantially the same shape, however, first case member 210 and second case 220 may have some different external dimensions. When first case member 210 and second case member 220 are connected to each other to hold ink reservoir element 100, case cutout portions 211 and 221 may form a substantially circular opening exposing ink supply portion 120 to the outside of case 200, and case cutout portions 212 and 222 may form a substantially circular opening exposing to the outside of case 200. Similarly, case cutout openings 213 and 223 may form a substantially rectangular opening, and translucent detection portion 140 may be positioned within and substantially flush with the substantially rectangular opening, such that a gap is provided on opposite sides of translucent detection portion 140. Moreover, a first protrusion member which contributes to the prevention of ink contamination of refill unit 13, the prevention of the installation of the cartridge into refill unit 13 in the wrong position, and the prevention of damage to ink supply portion 120 and ambient air intake portion 130 may be provided by case protrusion member 214*a* and case protrusion member 224*a*. Similarly, a second protrusion member which contributes to the prevention of the installation in the wrong position, and the prevention of damage to ink supply portion 120 and ambient air intake portion 130 may be provided by case protrusion member 214*b* and case protrusion member 224*b*.

In an embodiment of the present invention, ink supply portion 120 may be positioned closer to the first protrusion member than to the second protrusion member. A through-opening into which protrusion member 330*a*1 of protector 300 may be loosely inserted may be provided by case protrusion cutout portions 214*a*1 and 224*a*1, and a through-opening into which protrusion member 330*b*1 of protector 300 may be loosely inserted may be provided by case protrusion cutout portions 214*b*1 and 224*b*1. Moreover, a fitting groove into which first protector fitting portion 320 of protector 300 may be fitted may be provided by case fitting grooves 214*b*2 and 224*b*2.

With respect to first case member 210 and second case member 220, case protrusion members 214*a*, 214*b*, 224*a*, and 224*b* may have substantially the same shape as each other, and case cutout portions 211 to 213 and 221 to 223 also may have substantially the same shape as each other. Therefore, when first case member 210 and second case member 220 are resin-molded, their die shapes also may be substantially similar, such that costs associated with die design may be reduced.

Vertical wall portions 210*d*, 210*e*, 220*d*, and 220*e* may be provided on first and second case members 210 and 220, respectively, in directions which are orthogonal to longitudinal direction B. Vertical wall portions 210*d*, 210*e*, 220*d*, and 220*e* may be provided into concave shapes, and steps may be formed with respect to largest surfaces 210*a* and 220*a* of first and second case members 210 and 220, respectively. First and second case members 210 and 220 may be welded to the step portions, and ink reservoir element 110 may be fastened to case 200. The step portions on the side of ink supply portion 120 first may be case welded portions 216 and 226, and the step portions on the side of ambient air intake portion 130 may be second case welded portions 217 and 227.

In the following explanation, longitudinal direction B of first and second case members 210 and 220 refers to the longitudinal direction of ink cartridge 14, the longitudinal direction of ink reservoir element 100, and the longitudinal direction of case 200.

First case welded portion 226 may be connected to case protrusion member 224*a* in the same plane, and on the opposite side as case protrusion member 224*a*, first case welded portion 226 may comprise a concave portion 226*a* which may have a concave shape in the direction of the inside of second case member 220. First case welded portion 226 also may comprise an engagement portion 226*b* which engages pullout member 65 of door 41 when ink cartridge 14 is removed from refill unit 13. Concave portion 226*a* may be a region for securing the rotating range when pullout member 65 rotates. Case welded portion 227 may comprise a latch portion 227*a* which may have a concave shape in substantially an intermediate position of longitudinal direction B of second case member 220, and latch portion 227*a* may be a portion which engages swing arm mechanism 44*b*.

Similarly, a concave portion 216*a*, an engagement portion 216*b*, and a latch portion 217*a*, which are provided with substantially the same shapes as concave portion 226*a*, engagement portion 226*b*, and latch portion 227*a* of second case member 220, respectively may be provided on first case member 210.

Protector 300 may be a member for protecting ink supply portion 120, ambient air intake portion 130, and ink reservoir element 100 when ink cartridge 14 is transported. Protector 300 may comprise a resin material, and may be manufactured using injection molding.

A protector through-opening 310 may be provided through protector 300 in a location corresponding to the side of ambient air intake portion 130 on the bottom surface. This may be desirable because valve an open portion 721*a* for operating ambient air valve 720 may protrude outward from ambient air intake portion 130, and protector through-opening 310 may be protect valve open portion 721*a*.

A first protector fitting portion 320, which may be fitted into the fitting groove provided by case fitting grooves 214*b*2 and 224*b*2 may be provided in the vicinity of the end of the side of protector through-opening 310. A second protector fitting portion 330*a* may be fitted into the through-opening provided by case protrusion cutout portions 214*a*1 and 224*a*1, may fasten protector 300 to case 200, and may be provided in the vicinity of the end of the opposite side as the side on which first protector fitting portion 320 may be formed. Similarly, a second protector fitting portion 330*b* may be fitted into the through-opening provided by case protrusion cutout openings 214*b*1 and 224*b*1, may fasten protector 300 to case 200, and may be provided between first protector fitting portion 320 and protector through-opening 310.

Moreover, a pair of protector loose insertion portions 340*a* and 340*b* may be lightly inserted into the through-openings provided by case cutout portions 213 and 223 and the side wall of translucent detection portion 140, and may be provided in substantially intermediate positions in longitudinal direction C of protector 300. Protector loose insertion portions 340*a* and 340*b* may be connected to both side walls provided parallel to longitudinal direction C, and they may be formed, such that they protrude upward. A plurality of ribs may comprise the bottom surface of protector 300, and the plurality of ribs maintain the strength of protector 300.

First protector fitting portion 320 may be positioned, such that it extends in a direction parallel to a direction orthogonal to longitudinal direction C of protector 300. First protector fitting portion 320 may comprise a protector vertical wall 321 provided from the bottom wall of protector 300, and a pair of protector vertical walls 322 which are connected to the side wall on the opposite side as protector through-opening 310 from protector vertical wall 321. Each protector vertical wall 322 may comprise a top portion provided parallel to protector vertical wall 321 from the top end of first protector fitting portion 320, and a bottom portion connected to the side wall of protector 300 from a substantially intermediate position in the protrusion direction of first protector fitting portion 320. Moreover, each protector vertical wall 322 may comprise steps. Consequently, when fitted into the fitting groove provided by case fitting grooves 214*b*2 and 224*b*2, protector vertical wall 321 and the top of protector vertical wall 322 are inserted into the fitting groove.

When first protector fitting portion 320 is inserted into the fitting groove, it is inserted as it is restricted by the end of protector vertical wall 322 in longitudinal direction C and by both ends of protector vertical wall 321 which extends in the Z-direction orthogonal to longitudinal direction C. If first protector fitting portion 320 is provided with substantially the same shape as the fitting groove provided by case fitting grooves 214*b*2 and 224*b*2, the attachment of protector 300 takes time and effort, and if protector fitting portion 320 is small in comparison to the fitting groove, the position of the attachment direction of protector 300 may not be determined. Nevertheless, because first protector fitting portion 320 is inserted as it is restricted by protector vertical wall 321 at the flat surface of protector vertical wall 321 and at ends of both sides of protector vertical wall 321, and by protector wall 322 at both ends of protector vertical wall 322, the installation properties of protector 300 are improved, and improper installation may be prevented.

Protruding portions 330*a*1 and 330*b*1, which protrude away from each other may be provided on the edges of second protector fitting portions 330*a* and 330*b* in the direction in which second protector fitting portions 330*a* and 330*b* mutually separate, and shaft portions 330*a*2 and 330*b*2, which may have substantially cylindrical shapes may be provided in the direction of the bottom surface of protector 300 from these edges. Shaft portions 330*a*2 and 330*b*2 may have at least some elasticity because protector 300 may comprise a resin material, and protector 300 may be attached and removed as second protector fitting portions 330*a* and 330*b* are elastically deformed in the inside direction.

According to an embodiment of the present invention, black ink cartridge 14 may be configured, such that its external profile is larger than the external profile of colored ink cartridges 14. For example, second case member 220 for a black ink cartridge, which may comprise a case 1200, may be identical to second case member 220 for colored ink cartridges. Nevertheless, first case member 210 for a black ink cartridge, which may comprise a case 1200, may be thicker than first case member 210 for colored ink cartridges. Ink reservoir element 100 for black ink may have a sufficient capacity to store black ink, such that it may be configured with the same shape as ink reservoir element 100 for colored ink, and may use the same portions. Moreover, a protector 1300 may be provided corresponding to case 1200, and it may be thicker in the vertical direction than protector 300.

Black ink cartridge 14 is described with respect to first case member 1210. In this embodiment of present invention, only the depth of first case member 1210 differs from first case member 210.

First case member 1210 may comprise a plate-shaped portion which forms largest surface 1210*a*, and vertical wall portions 1210*b*-1210*e* which may be provided in substantially orthogonal directions from the outer edge portions of the four sides of the plate-shaped portion. The vertical wall which forms the protector 1300 side of first case member 1210 may be designated as vertical wall portion 1210*b*, the vertical wall which is positioned opposite vertical wall portion 1210*b* may be designated as 1210*c*, and the vertical walls which are connected to vertical wall portions 1210*c* and 1210*b* may be designated as vertical wall portions 1210*d* and 1210*e*. The vertical wall height of vertical wall portions 1210*b*-1210*e* of first case member 1210 for black ink may be about twice the vertical wall height of vertical wall portions 210*b*-210*e* of first case member 210 for colored ink, and the thickness of ink cartridge 14 for black ink accordingly may be increased relative to the thickness of ink cartridge for color ink.

As with first case member 210, case cutout portions 1211 and 1212 may be provided on first case member 1210 in order to expose ink supply portion 120 and ambient air intake portion 130 to the outside of case 200, respectively, and case cutout portion 1213 may be provided between case cutout portion 1211 and case cutout portion 1212. Two case protrusion members 1214*a* and 1214*b* may be provided on both sides of first case member 1210, and case protrusion member 1214*a* may have a sloping surface 1214*a*2. A plurality of rod members 1215*a*, 1215*b*, and 1215*c*, which determine the position of ink reservoir element 100, also may be provided on first case member 1210.

A rib 1218 may be provided on substantially the entire inside surface of first case member 1210, and rib 1218 protrudes in the Z-direction towards the side of ink reservoir element 100 to the degree which the external profile of first case member 1210 is enlarged with respect to first case member 210. Because rib 1218 may be provided, the space provided between ink reservoir element 100 and first case 1210 may be filled. It therefore may be possible to maintain the strength of case 1200 against pressure from the outside.

Moreover, by making the external profile of black ink cartridge 14 larger than the external profile of colored ink cartridge 14, it may be possible to differentiate between black ink cartridge 14 and color ink cartridges 14. Black ink may be a darker color than other ink colors, such that it is not desirable for black ink to mistakenly be loaded into refill unit 13 and used. Nevertheless, because the external profile of black ink cartridge 14 may be larger than the external profile of color ink cartridge 14, it readily may be differentiated from color ink cartridges 14. Further, accommodating chamber 50 within refill unit 13 may be provided according to the size of each ink cartridge 14, such that black ink cartridge 14 may not be installed into accommodating chamber 50 corresponding to a colored ink cartridge 14.

In black ink cartridge 14, the thicknesses of first case member 1210 and second case member 220 in the vertical direction may differ, such that ink supply portion 120, ambient air supply portion 130, and translucent detection portion 140 may be positioned in positions shifted from the center position in the vertical direction.

In an embodiment of the present invention, the external profile of a large-capacity black ink cartridge 14 may be configured, such that it is larger than the external profile of the colored ink cartridges 14 and the external profile of a small-capacity black ink cartridge 14. For example, the vertical wall height of vertical wall portions 2220*b*-2220*e* of second case member 2220 may be about twice the vertical wall height of vertical wall portions 220*b*-220*e* of second case member 220, and second case member 2220, which comprises case 2200, may be thicker than second case member 220 for colored ink cartridges 14 and small-capacity black ink cartridges 14. Moreover, in first case member 2210, which comprises case 2200, rib 1218 of first case member 1210 for black ink may be removed. Further, ink reservoir element 2100 may be thickened, such that the capacity increases with respect to ink reservoir element 100 for color ink cartridges 14 and small-capacity black ink cartridges 14. With respect to the reference numerals with large-capacity black ink cartridge 14, the reference numeral 2000 may be added to the reference numerals associated with colored ink cartridge 14. The thicknesses of first case member 2210 and second case member 2220 in the vertical direction may be substantially the same, such that ink supply portion 2120, ambient air supply portion 2130, and translucent detection portion 2140 may be positioned substantially in the center position in the vertical direction.

Because ink cartridges 14 corresponding to a large-capacity black ink cartridge, a small-capacity black ink cartridge, and a color ink cartridge may be different in size from each other, it may be desirable for refill unit 13 of multifunction device 1 to be configured, such that it may comprise multiple accommodating chambers 50 which house colored ink cartridges 14, and a single accommodating chamber 50 which selectively houses a small-capacity black ink cartridge 14 and a large-capacity black ink cartridge 14.

Figure 14A:
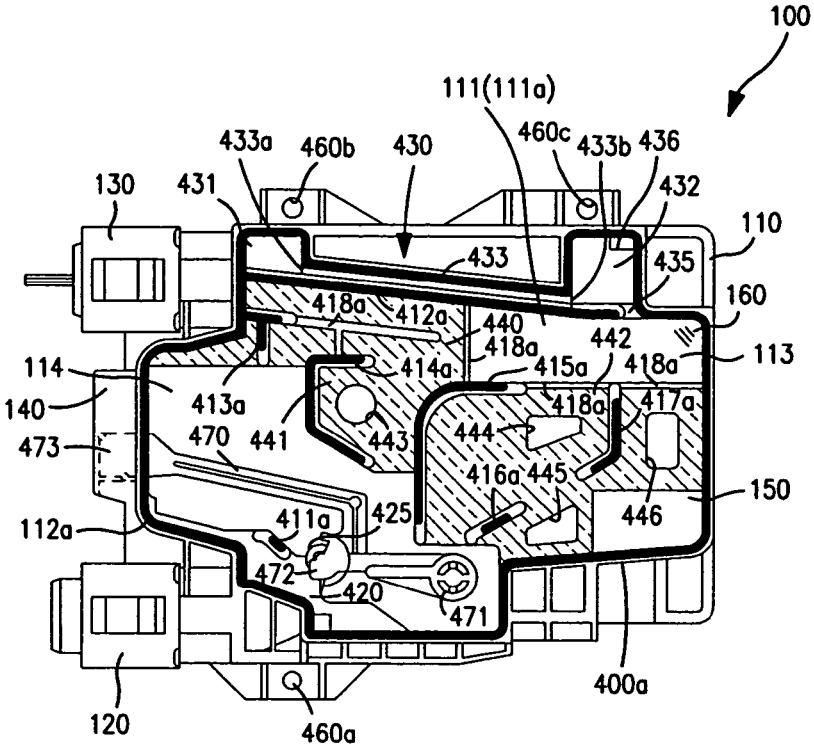
FIG. 14(*a*) is a front view of an ink reservoir element.
Figure 14B:
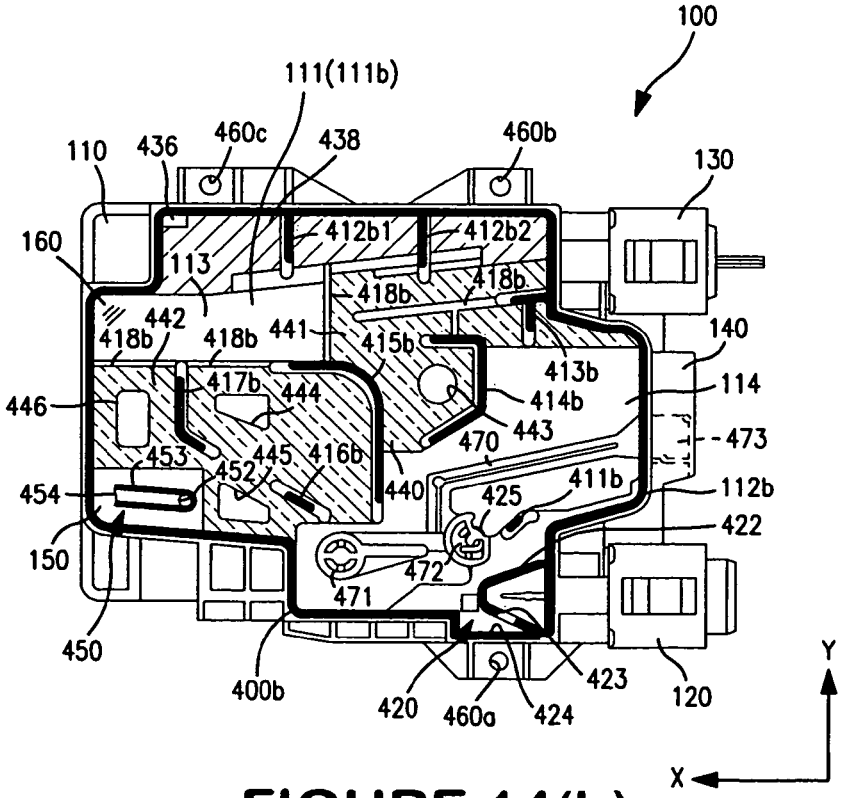
Figure 15A:
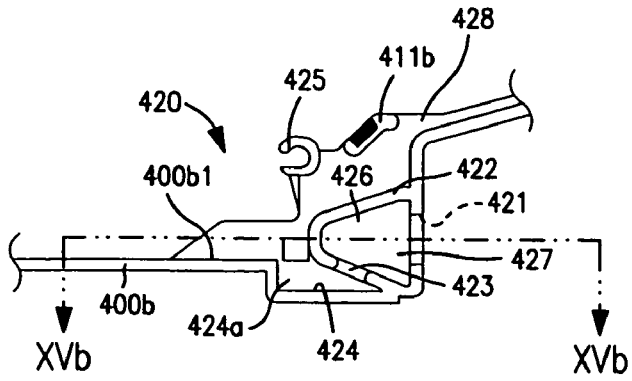
FIG. 15(*a*) is a side view of a supply path formation portion.
Figure 15B:
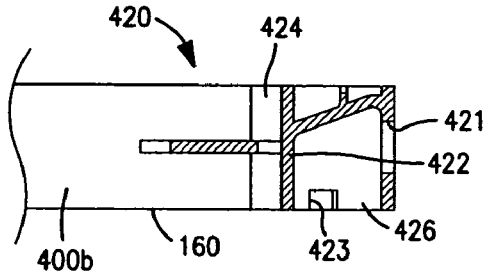
Figure 15C:
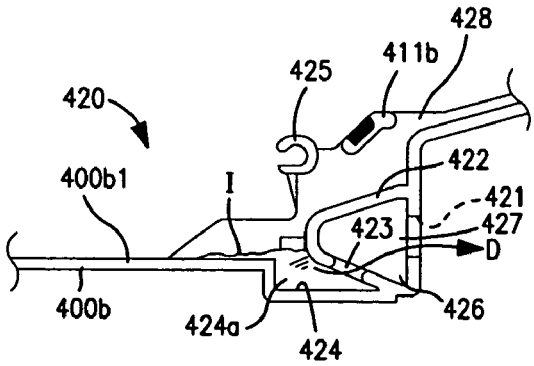
Figure 15D:
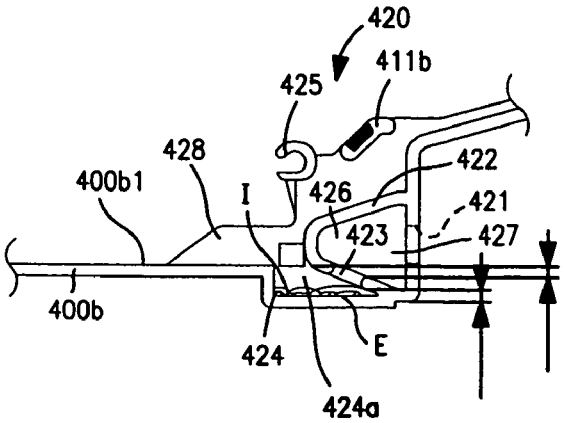

Referring to FIG. 14, ink reservoir 100 according to an embodiment of the present invention is depicted. Ink reservoir element 2100 is substantially similar to ink reservoir element 100, except ink reservoir element 2100 is thicker than ink reservoir 100. Therefore, only ink reservoir element 100 is discussed with respect to FIG. 14.

As described above, ink reservoir element 100 may comprise frame portion 110, ink supply portion 120, ambient air intake portion 130, translucent detection portion 140, ink dispensing portion 150, and film 160. Moreover, ink reservoir element 100 may be configured substantially as a flat hexahedron. The pair of surfaces which comprise the largest area of the hexahedron may be the front surface side and the back surface side of ink reservoir element 100, and it may be configured with about six surfaces with the side surfaces positioned in four directions which connect the front surface side and the back surface side. The pair of surfaces which comprise the largest area of ink reservoir element 100 are parallel to the pair of largest surfaces 210*a* and 220*a* of case 200 when loaded into case 200. Moreover, film 160 may be welded to both the front surface side and the back surface side of frame portion 110, such that the thickness of ink reservoir element 100 may be reduced in comparison to the case in which both sides are blocked by plate materials.

Frame portion 110 may be manufactured by injection molding using a resin material, and may be translucent, e.g., because light which may be emitted from light emitting portion 57*a* of ink detection sensor 57 may be transmitted to light receiving portion 57*b* in order to detect the amount of ink in ink reservoir element 100.

Referring to FIG. 14(*a*), an outer circumference rib portion 400*a* may be provided on the front surface side of frame portion 110 and may weld film 160 to the vicinity of the outer edge portion, and a plurality of inner circumference rib portions 411*a*-417*a* may be provided on the front surface side of frame portion 110 and may be provided on the inside of outer circumference rib portion 400*a*. Some of inner circumference rib portions 411*a*-417*a* may comprise at least one curved portion. Outer circumference rib portion 400*a* may be a vertical wall which defines the boundaries of the inner space of frame portion 100. Moreover, the blackened edge portions of the inner circumference rib portions 411*a*-417*a* may be welded surface portions, and the front surface side edge of outer circumference rib portion 400*a* may be the welded surface portion on the periphery of first opening 112*a*. In addition, at least a portion of at least some of the inner rib portions 411*a*-417*a* may be positioned closer to a center of ink chamber 111 than to an edge, e.g., outer circumference rib portions 400*a* and 400*b*, of ink chamber 111, and film 160 may be welded to the welded surface portion, e.g., via ultrasonic welding.

Referring to FIG. 14(*b*), an outer circumference rib portion 400*b* may be provided on the back surface side of frame portion 110 and may weld film 160 to the vicinity of the outer edge portion, and multiple inner circumference rib portions 411*a*-417*b* may be provided on the back surface side of frame portion 110 and may be provided on the inside of outer circumference rib portion 400*b*. Outer circumference rib portion 400*b* may be a vertical wall which defines the boundaries of the inner space of frame portion 100. Moreover, the blackened edge portions of the inner circumference rib portions may be welded surface portions 411*b*-417*b*, and the back surface side edge of the outer circumference rib portion 400*b* may be the welded surface portion on the periphery of the opening. Film 160 may be welded to the rib portion e.g., via ultrasonic welding.

The inside of outer circumference rib portions 400*a* and 400*b* may comprise ink chamber 111, and ink may be stored in ink chamber 111. The region on the front surface side of FIG. 14(*a*) may be first chamber 111*a* of ink chamber 111, and the region on the back surface side of FIG. 14(*b*) may be second chamber 111*b* of ink chamber 111. Moreover, outer circumference rib portion 400*a* may be first opening 112*a* of frame portion 110, and outer circumference rib portion 400*b* may be second opening 112*b* of frame portion 110.

Frame 110 may comprise a supply path forming portion 420 which communicates with ink supply portion 120 and supplies ink stored within ink chamber 111 to the outside. Frame 110 also may comprise an ambient air communication path forming portion 430 which communicates with ambient air intake portion 130 and introduces ambient air into ink chamber 111. Moreover, frame 110 may comprise a plate-shaped link forming portion 440 which may be provided in substantially the center of frame portion 110 or ink chamber 111 and connects the vicinity of ambient air intake portion 130 to the vicinity of ink dispensing portion 150. Frame 110 further may comprise a dispensing path forming portion 450 which communicates with ink dispensing portion 150 and dispenses ink into ink chamber 111. Link forming portion 440 may partition first chamber 111*a* and second chamber 111*b* of ink chamber 111 in a state in which they communicate with one another. Link forming portion 440 may be a linking plate which is positioned between virtual plane R and virtual plane S.

Ambient air path forming portion 430 may be positioned on the front surface side of frame portion 110, i.e., the side of first chamber 111*a* of ink chamber 111), and it may be substantially partitioned by plate portion 438 which extends parallel to the planes between a portion of outer circumference rib portion 400*a* and inner circumference rib portion 412*a* and virtual planes R and S. In this embodiment, ink chamber 111 within frame portion 110 may be provided as the region containing supply path forming portion 420, ambient air communication path forming portion 430, link forming portion 440, and dispensing path forming portion 450. Ambient air communication path forming portion 430 may be an ambient air path for introducing ambient air into ink chamber 111, such that alternatively it may be provided in a region other than ink chamber 111.

Moreover, on the outer edge of frame portion 110, thin plate-shaped protruding portions may be provided in one location on the bottom portion and in two locations on the top portion, and through-openings 460*a*-460*c*, into which rod members 215*a* to 215*c* of first case member 210 may be inserted may be provided through the protruding portions.

Inner circumference rib portions 411*a*-417*a* may comprise inner circumference rib portion 411*a* which may be provided on supply path forming portion 420, inner circumference rib portion 412*a* which may be provided on ambient air communication path forming portion 430, and inner circumference rib portions 413*a*-417*a* which are provided on link forming portion 440. Moreover, the welded surface portions of inner circumference rib portions 411*a*-417*a* may be positioned on the same virtual plane as the welded surface portion of outer circumference rib portion 400*a*, and film 160 may be welded on the same plane, e.g., virtual plane R.

Inner circumference rib portion 411*a* may be provided on supply path forming portion 420, and it may comprise a downward-sloping vertical wall which slopes in a direction which intersects with longitudinal direction B of frame portion 110. Inner circumference rib portion 412*a* forms one side wall of ambient air connection path 433 in ambient air communication path forming portion 430, and it may comprise a downward-sloping vertical wall which slopes in a direction which intersects with longitudinal direction B of frame portion 110. Inner circumference rib portion 413*a* may be provided in the vicinity of ambient air intake portion 130, and may comprise a downward-sloping vertical wall which slopes in a direction which intersects with longitudinal direction B of frame portion 110, and a vertical wall which extends from the downward-sloping vertical wall in a direction which is substantially orthogonal to longitudinal direction B of frame portion 110, such that the pair of vertical walls form a T-shape. Inner circumference rib portion 414*a* may be substantially provided into a leftward-facing horseshoe shape, and may comprise a first vertical wall which is parallel to longitudinal direction B of frame portion 110, a second vertical wall which extends from the first vertical wall in a direction which is substantially orthogonal to longitudinal direction B of frame portion 110, and a downward-sloping vertical wall which slopes from the second vertical wall in a direction which intersects with longitudinal direction B of frame portion 110.

Inner circumference rib portion 415*a* may comprise a first vertical wall which may be parallel to longitudinal direction B of frame portion 110, a second vertical wall which curves substantially perpendicularly, such that it faces the direction of the bottom portion of frame portion 110 from the first vertical wall, and a downward-sloping vertical wall which slopes downward from the second vertical wall in a direction which intersects with longitudinal direction B of frame portion 110. Inner circumference rib portion 416*a* may be provided in the vicinity of ink dispensing portion 150, and may comprise a downward-sloping vertical wall which slopes in a direction which intersects with longitudinal direction B of frame portion 110. Inner circumference rib portion 417*a* may be provided in the vicinity of ink dispensing portion 150, and may comprise a vertical wall which extends in a direction which is substantially orthogonal to longitudinal direction B of frame portion 110, and a downward-sloping vertical wall which slopes from this vertical wall in a direction which intersects with longitudinal direction B of frame portion 110.

In the above-described embodiment of the present invention, at least a portion of the vertical walls of inner circumference rib portions 411*a*-417*a* extends in a direction which slopes downward or may be substantially orthogonal to longitudinal direction B of frame portion 110, and the end of the bottom portion side is a free end. Consequently, even when inner circumference rib portions 411*a*-417*a* are provided on the inside of outer circumference rib portion 400*a* to suppress the slackening of film 160 when film 160 is welded to frame portion 110, inner circumference rib portions 411*a*-417*a* do not significantly inhibit the flow of ink facing ink supply portion 120. Moreover, inner circumference rib portions 411*a*-417*a* are spread around the inside of outer circumference rib portion 400*a*, such that they efficiently prevent the generation of slack in film 160 without inhibiting the flow of ink.

Inner circumference rib portion 411*b* and inner circumference rib portions 411*b*-417*b* may have substantially the same shape as inner circumference rib portion 411*a* and inner circumference rib portions 413*a*-417*a*, respectively, and may be positioned to correspond with inner circumference rib portion 411*a* and inner circumference rib portions 413*a*-417*a*, respectively. Nevertheless, in an embodiment of the present invention, inner circumference rib portion 412*b* may have a different shape and may be in a different position than inner circumference rib portion 412*a*. Moreover, the welded surface portions of inner circumference rib portions 411*b*-417*b* may be positioned in the same virtual plane as the welded surface portion of outer circumference rib portion 400*b*, and film 160 may be welded on the same plane, e.g., virtual plane S.

Inner circumference rib portion 412*b* may comprise inner circumference rib portion 412*b*1 which may comprise a vertical wall which extends from outer circumference rib portion 400*b* in a direction which is substantially orthogonal to longitudinal direction B of frame portion 110. Inner circumference rib portion 412*b* also may comprise inner circumference rib portion 412*b*2 which may comprise a vertical wall which extends from outer circumference rib portion 400*b* in a direction which may be substantially orthogonal to longitudinal direction B. Inner circumference rib portion 412*b*1 and inner circumference rib portion 412*b*2 may be provided from plate portion 438, which defines the boundaries of ambient air communication path forming portion 430. Inner circumference rib portion 412*b*1 and inner circumference rib portion 412*b*2 may suppress the generation of slack in film 160 in the portion corresponding to the back surface side of ambient air communication path forming portion 430. Moreover, as with the front surface side, inner circumference rib portions 411*b*-417*b* become free ends and are spread around on the back surface side of frame portion 110, such that they suppress the generation of slack in film 160 without inhibiting ink flow.

When inner circumference rib portions 411*a*-417*a* and 411*b*-417*b* are provided in a spread-out orientation and case 200 comprises a flexible resin material, it is possible to restrict case deformation with inner circumference rib portions 411*a*-417*a* and 411*b*-417*b* even if the case deforms on the side of ink reservoir element 100. Consequently, it is possible to prevent damage to case 200 and the damage to film 160. Further, when outer circumference rib portions 400*a* and 400*b* and inner circumference rib portions 411*a*-417*a* and 411*b*-417*b* comprises vertical walls which are provided on the front surface side or the back surface side, complex dies are not needed when frame portion 110 is injection-molded, which reduces manufacturing costs.

Referring to FIG. 15(*a*), supply path forming portion 420 may comprise a first supply communication opening 421 which communicates with ink supply portion 120, a supply partition wall 422 which may be a substantially triangular frame when viewed from the direction perpendicular to the page in FIG. 15(*a*), such that it encloses first supply communication opening 421, a covering wall 427 which covers the region on the inside of supply partition wall 422 on the vertical plane R side, and a second supply communication opening 423 which may be provided as a portion of supply partition wall 422. Supply path forming portion 420 also may comprise a supply concave portion 424 which may be provided by making a portion of the bottom portion of ink chamber 111 into a concave shape, a plate portion 428 which extends from outer circumference rib portion 400*b* and supply partition wall 422 and extends parallel to virtual planes R and S between the planes, an arm sandwiching portion 425 which may be provided on the free end of plate portion 428 and has movable member 470 which may be attached as a rotating member, and an inner circumference rib portion 411*a* which may be provided in the direction of translucent detection portion 140 from arm sandwiching portion 425.

Moreover, film 160 may be welded to supply partition wall 422, and the welded surface portion of film 160 may be positioned on the same virtual plane as the welded surface portion of outer circumference rib portion 400*b*, e.g., virtual plane S. The space enclosed by supply partition wall 422 and covering wall 427 may be an ink supply chamber 426 which temporarily stores the ink which is supplied to ink supply portion 120, and the space provided by supply concave portion 424 and plate portion 428 may be a concave portion space 424*a*. Referring to FIG. 14(*b*), concave portion space 424*a* may be positioned lower than portion 400*b*1 which forms the bottom portion of ink chamber 111 in the height direction, e.g., the Y-direction, of cartridge 14, and concave portion space 424*a* may comprise the portion of space which is on the bottommost side of ink chamber 111. Referring again to FIG. 15(*a*), first supply communication opening 421 may be provided above bottom portion 400*b*1 and at the same height as the top end of recessed space 424*a*, and second supply communication opening 423 may be provided below bottom portion 400*b*1. As such, second supply communication opening 423 may be positioned on the lower side of ink chamber 111 which may be lower than first supply communication opening 421. Moreover, ink supply chamber 426 may have a central axis extending from an open end of ink supply chamber 426 to a closed end of ink supply chamber 426, and second supply communication opening 423 may be offset from the central axis of ink supply chamber 426, and first supply communication opening 421 may be aligned with the central axis of ink supply chamber 426. Arm sandwiching portion 425 may have a substantially leftward-facing C shape when viewed from the direction perpendicular to the page in FIG. 15(*a*), and a portion of the side opposite ink supply portion 120 may be open. Referring to FIGS. 14(*a*) and 14(*b*), rib portion 411*b* and rib portion 411*a* may face the opposite sides as one another from plate portion 428.

Referring to FIG. 15(*b*), supply partition wall 422 may be formed, such that when film 160 is welded supply partition wall 422 separates the inside of frame portion 110 and first supply communication opening 421. As such, ink supply chamber 426 may communicate with the inside of frame portion 110 only via second supply communication opening 423. Consequently, ink stored within frame portion 110 may be supplied into ink supply chamber 426 from second supply communication path 423, and it then may be supplied to ink supply portion 120 via first supply communication opening 421.

Referring to FIG. 15(*c*), when liquid surface I of ink stored within frame 110 is higher than supply concave portion 424, the ink may be supplied to ink supply portion 120 via the ink flow path indicated by arrow D. In this case, recessed space 424*a* may be filled with ink, such that the inside of ink supply chamber 426 also may be filled with ink, such that even if liquid surface I of the ink drops below first supply communication opening 421, the ink may be supplied to ink supply portion 120 via second supply communication opening 423. In this embodiment, ink supply portion 120 may be substantially cylindrically shaped, a portion of an ink supply mechanism 500 and a check valve 670 may be housed within ink supply element 116, and a shaft portion 672 of check valve 670 may be inserted into first supply communication opening 421. Therefore, taking into consideration the space occupied by ink supply mechanism 500 and check valve 670, there may be a limit to the formation of first supply communication opening 421 on the bottom side of ink chamber 111. When supply partition wall 422 is not provided, and liquid surface I of the ink drops below first supply communication opening 421, it is not possible to supply the ink, and the full use of the ink within ink chamber 111 may be poor. Nevertheless, by providing supply partition wall 422 and forming second supply communication opening 433 on the bottom portion side lower than first supply communication opening 431, it is possible to supply ink until liquid surface I of the ink falls below second supply communication opening 433, such that the ink may be fully used.

Referring to FIGS. 15(*c*) and 15(*d*), when ink is further supplied from the state illustrated in FIG. 15(*c*) and liquid surface I of the ink drops below the upper end of supply concave portion 424 and becomes lower than second supply communication opening 423, ambient air flows into ink supply chamber 426, and consequently, additional ink no longer may be supplied.

Referring to FIG. 15(*d*), a distance t1 may be provided between the lower end of second supply communication opening 423 and a portion 400*b*1 which forms the bottom portion of ink chamber 111 in outer circumference rib portion 400*b*. If second supply communication opening 423 were positioned above portion 400*b*1, additional ink may not be supplied after liquid surface I of the ink reaches second supply communication opening 423. Therefore, supply concave portion 424 may be provided and may be configured, such that second communication opening 423 is positioned lower than portion 400*b*1 which forms the bottom portion of ink chamber 111 by the distance t1. Consequently, when the supply of ink has been completed, only a relatively small amount of ink remains in the vicinity of the bottom portion of supply concave portion 424, and the amount of ink which may not be supplied may be substantially reduced. Moreover, supply concave portion 424 may be provided on the bottommost portion of ink chamber 111, such that the ink within reservoir chamber 111 flows into supply concave portion 424 and accumulates in supply concave portion 424 when the amount of ink is reduced. Therefore, by providing supply concave portion 424, it is possible to facilitate the full use of the ink within ink chamber 111.

Debris E may be included with the ink remaining inside supply concave portion 424. For example, dust or plastic debris may be left over within frame portion 110 when ink cartridge 14 is manufactured. The specific gravity of the dust or plastic debris may be greater than the specific gravity of the ink, such that it remains in the vicinity of the bottom portion of frame portion 110. Therefore, debris E may be included within the ink remaining within supply concave portion 424, which may cause ink clogging which substantially reduces printing accuracy. Nevertheless, a distance t2 may be provided between second supply communication opening 423 and the bottom portion side wall of supply concave portion 424. Consequently, debris E remains within supply concave portion 424, such that the likelihood of ink clogging may be reduced.

Figure 16A:
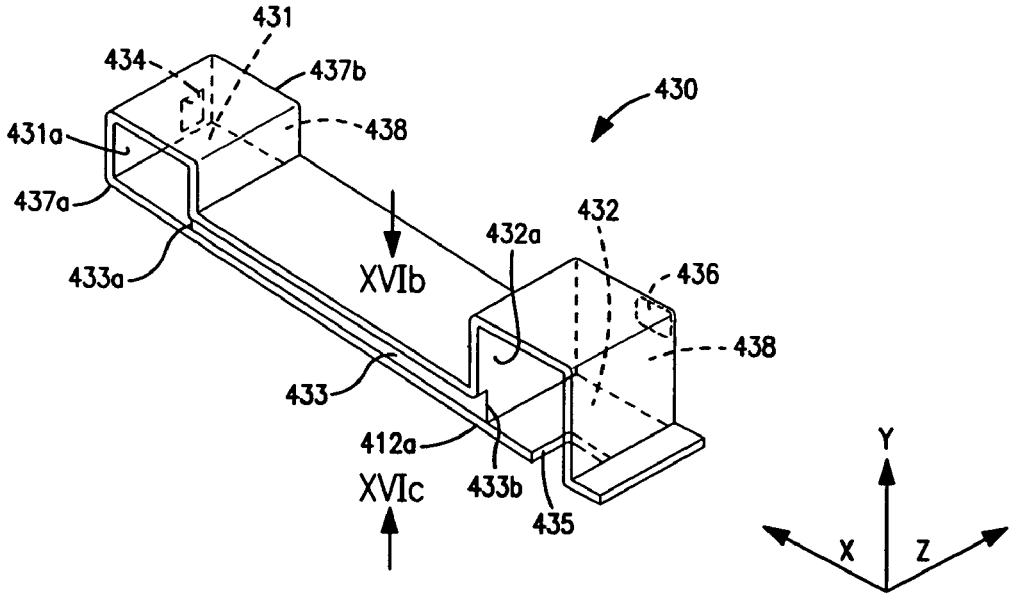
FIG. 16(*a*) is a perspective view of an ambient air path formation portion.
Figure 16B:
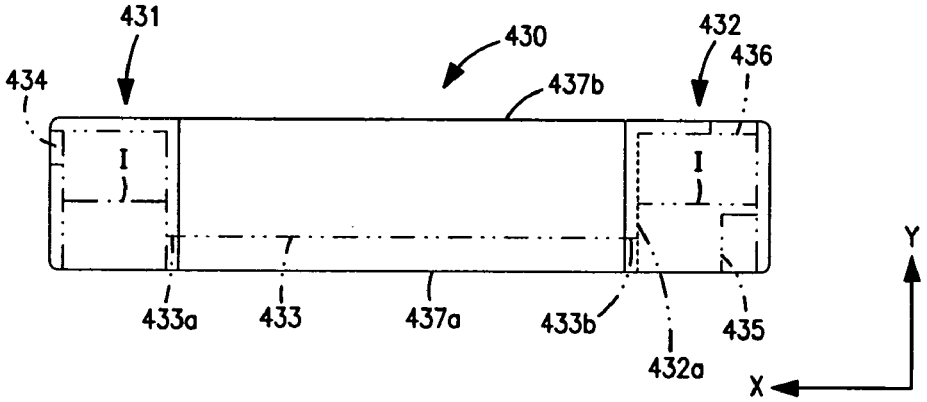
Figure 16C:
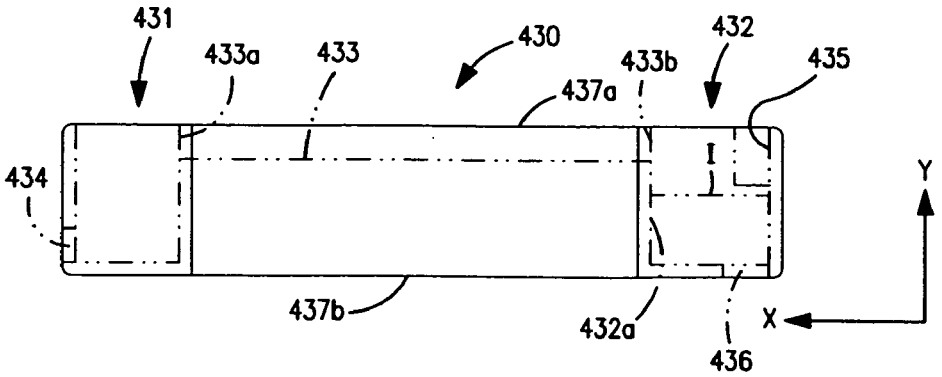

Referring to FIG. 16(*a*), ambient air communication path forming portion 430 may comprise a first ambient air communication chamber 431 which may have a substantially rectangular, parallelepiped shape and may communicate with ambient air intake portion 130, a second ambient air communication chamber 432 which may have a substantially rectangular parallelepiped shape and may communicate with ink chamber 111, and an ambient air connection path 433 which communicates with first ambient air communication chamber 431 and second ambient air communication chamber 432 on the side of first surface 437*a* on which film 160 may be welded. The chambers and the path of first ambient air communication chamber 431, second ambient air communication chamber 432, and ambient air connection path 433 are provided as film 160 is welded on the front side of FIG. 16(*a*).

A first ambient air communication opening 434 which communicates with ambient air intake portion 130 may be provided on the side of second surface 437*b* which opposes first surface 437*a* of first ambient air communication chamber 431. In second ambient air communication chamber 432, a second ambient air communication opening 435 which communicates with first chamber 111*a* of ink chamber 111 may be provided on the side of first surface 437*a*, and a third ambient air communication opening 436 which communicates with second chamber 111*b* of ink chamber 111 may be provided on second surface 437*b*. First ambient air communication opening 434 may be provided on side wall surface 431*a* of first ambient air communication chamber 431 on the side of ambient air intake portion 130, and communication opening 433*b* may be provided on side wall surface 432*a* of second ambient air communication chamber 432 on the side of first ambient air communication chamber 431. As described above, one of the side walls of ambient air connection path 433 may be a part of film 160.

In ambient air connection path 433, communication openings 433*a* and 433*b* which communicate with first ambient air communication chamber 431 and second ambient air communication chamber 432, respectively may be provided on the side of first surface 437*a*. Communication openings 433*a* and 433*b* may have opening areas which are substantially less than the side wall areas of first ambient air communication chamber 431 and second ambient air communication chamber 432. Because ambient air connection path has a relatively small cross-sectional area, the resistance of the flow path when ambient air passes through is relatively large. Consequently, it may be possible to reduce the evaporation of ink through ambient air connection path 433.

Referring to FIG. 14(*a*), ambient air connection path 433 slopes downward in the direction of second ambient air communication chamber 432 from first ambient air communication chamber 431. Because ambient air connection path 433 slopes downward, the device may be in the position in which ink cartridge 14 may be installed in refill unit 13 of multifunction device 1, ink which has penetrated into ambient air connection path 433 may be naturally returned to ink chamber 111 due to gravity. Moreover, because the cross-sectional area of ambient air connection path 433 may be made small, the penetration of ink stored within ink chamber 111 into ambient air connection path 433 may be reduced. When ink penetrates into ambient air connection path 433, a meniscus may be formed, and consequently, it may be difficult to introduce ambient air. As described above, because ambient air connection path 433 slopes downward, even when ink penetrates into the passage, the ink may be returned to ink chamber 111, such that the formation of meniscuses may be substantially prevented. Further, ambient air connection path 433 may be provided by the welding of film 160, such that at least one of the surfaces may be a side wall which may be deformed by bending. Therefore, even when a meniscus forms, the meniscus readily may be broken due to the bending and deformation of film 160, such that ambient air may be introduced. A portion of the surface of second ambient air communication opening 435 also may be provided by film 160, such that the formation of a meniscus on second ambient air communication opening 435 may be substantially prevented.

A third ambient air communication opening 436 may be provided on the uppermost portion of second ambient air communication chamber 432 in the position in which ink cartridge 14 may be installed in multifunction device 1. Therefore, even when a meniscus is provided on second ambient air communication opening 435 and second ambient air communication opening 435 may be blocked, ambient air may be introduced into ink chamber 111 via third ambient air communication opening 436.

As described above, case 200 may have a cubic shape comprising a pair of largest surfaces 210*a* and 220*a* which oppose each another, such that when loaded onto a flat bed one of largest surfaces 210*a* and 220*a* forms the bottom surface. At this time, ambient air intake portion 130 may be positioned on the side surface of case 200. Nevertheless, as described in detail below, it may be difficult for ink to leak from ambient air communication path forming portion 430 in either of the positions.

Referring to FIG. 16(*b*), when ink cartridge 14 is placed, such that ambient air connection path 433 is positioned on the lower side during the transportation of ink cartridge 14, the ink stored within ink chamber 111 passes through second ambient air communication chamber 432 and ambient air connection path 433 and penetrates into first ambient air communication chamber 431. Moreover, as described above, ambient air connection path 433 communicates through communication opening 433*b*, which has a smaller area than the side surface of second ambient air communication chamber 432, such that there are cases in which the ink within ink chamber 111 does not necessarily pass through ambient air communication chamber 433 and penetrate into first ambient air communication chamber 431. In the state illustrated in FIG. 16(*b*), liquid surface I of the ink has not reached the position of the opening of first ambient air communication opening 434, such that even if ink cartridge 14 is placed, such that ambient air connection path 433 is positioned on the lower side, the efflux of ink from ambient air intake portion 130 to the outside may be prevented.

Referring to FIG. 16(*c*), when ink cartridge 14 is placed, such that ambient air connection path 433 is positioned on the upper side during the transportation of ink cartridge 14, the ink stored within ink chamber 111 flows into second ambient air communication chamber 432, but liquid surface I of the ink does not reach the opening position of communication opening 433*b* of ambient air connection path 433. Consequently, the ink does not flow into ambient air connection path 433 from communication opening 433*b*, such that the ink does not flow into first ambient air communication chamber 431. Therefore, even when ink cartridge 14 is placed, such that ambient air connection path 433 is positioned on the upper side, the efflux of ink from ambient air intake portion 130 to the outside may be prevented.

Referring to FIGS. 14(*a*) and 14(*b*), link forming portion 440 connects the vicinity of ambient air intake portion 130 and ink dispensing portion 150 within ink chamber 111, and may be provided in substantially the center of ink chamber 111. Therefore, link forming portion 440 connects two locations which oppose frame portion 110, such that it also may be a reinforcement member which maintains the strength of frame portion 110. Link forming portion 440 further may be a divider plate which divides the chamber, such that the side of first opening 112*a* and the side of second opening 112*b* are in substantially the same region of space.

Link forming portion 440 may comprise an ambient air side linking portion 441 which may be provided on the side of ambient air intake portion 130 using inner circumference rib portions 415*a* and 415*b* as boundaries, and a dispensing side linking portion 442 which may be provided on the side of ink dispensing portion 150. On ambient air side linking portion 441, inner circumference rib portions 413*a*, 413*b*, 414*a*, and 414*b* may be respectively provided on the sides of first and second openings 112*a* and 112*b* from ambient air side linking portion 441. Further, the upper end of the height direction, e.g., Y-direction, of ambient air side linking portion 441 communicates with inner circumference rib portion 412*a* of ambient air communication path forming portion 430. Moreover, on dispensing side connecting portion 442, inner circumference rib portions 416*a*, 416*b*, 417*a*, and 417*b* may be respectively provided on the sides of first and second openings 112*a* and 112*b* from dispensing side linking portion 442.

A first linking communication opening 443 which communicates between first chamber 111*a* and second chamber 111*b* may be provided on ambient air side linking portion 441, and second through fourth linking communication openings 444-446 which connect first chamber 111*a* and second chamber 111*b* may be provided on dispensing side linking portion 442. If linking communication openings 443-446 are not provided on linking forming portion 440, first chamber 111*a* and second chamber 111*b* may not communicate in the center region of ink chamber 111, such that slight differences may arise in the amounts of ink in first chamber 111*a* and second chamber 111*b*. When there are differences in the amounts of ink in first chamber 111*a* and second chamber 111*b*, differences may arise in the air pressure within ink chamber 111, such that the adverse situation in which ink may not be smoothly supplied may arise. Nevertheless, by forming linking communication openings 443-446, such that they are spread across link forming portion 440, it may be possible to make the amounts of ink in first chamber 111*a* and second chamber 111*b* the same.

The portion enclosed by ambient air side linking portion 441, dispensing side linking portion 442, and ambient air communication path forming portion 430 may be a first reservoir chamber internal opening 113 which communicates between first chamber 111*a* and second chamber 111*b*, and the portion enclosed by ambient air side linking portion 441, dispensing side linking portion 442, and supply path forming portion 420 may be a second reservoir internal opening 114 which communicates between first chamber 111*a* and second chamber 111*b*. As such, the portion which introduces ambient air into ink chamber 111 and the portion which supplies ink stored within ink chamber 111 to the outside may communicate without link forming portion 440 and without the division of first chamber 111*a* and second chamber 111*b*. Consequently, the introduction of ambient air and the supply of ink may be performed in a stable space.

A linking rib 418*a* which connects multiple inner circumference rib portions 412*a*-417*a* and a linking rib 418*b* which connects inner circumference rib portion 412*b*-417*b* may be provided on link forming portion 440. Linking ribs 418*a* and 418*b* may be provided into thin-walled shapes with vertical walls which are lower than inner circumference rib portions 412*a*-417*a* and inner circumference rib portions 412*b*-417*b*. Further, a majority of linking ribs 418*a* and 418*b* may be provided on the edge of link forming portion 440. Consequently, linking ribs 418*a* and 418*b* connect inner circumference rib portions 412*a*-417*a* and 412*b*-417*b*, and they may be provided on the edge of link forming portion 440, such that they may maintain the strength of link forming portion 440. Moreover, linking ribs 418*a* and 418*b* may be provided into thin-walled shapes, and they may have vertical walls which are lower than inner circumference rib portions 412*a*-417*a* and 412*b*-417*b*, such that linking ribs 418*a* and 418*b* generally do not inhibit the flow of ink.

Figure 17A:
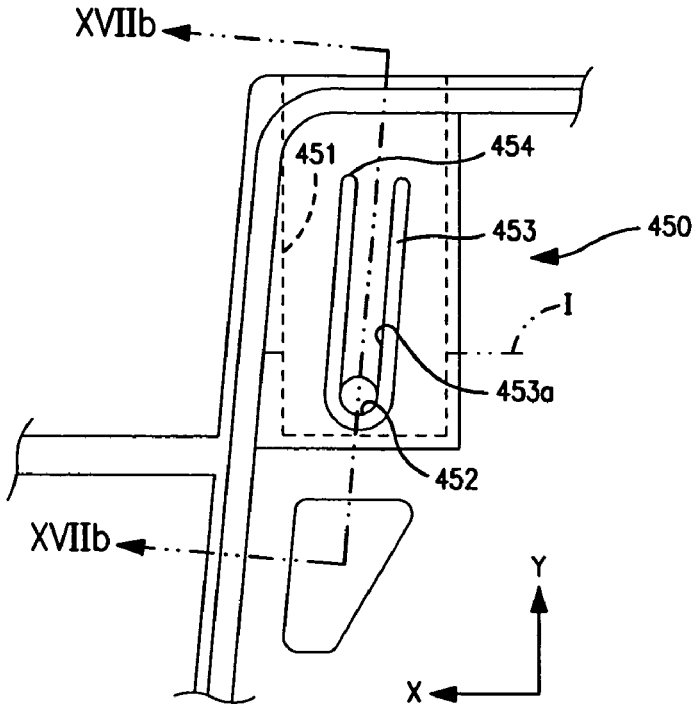
FIG. 17(*a*) is side view of an injection path formation portion.
Figure 17B:
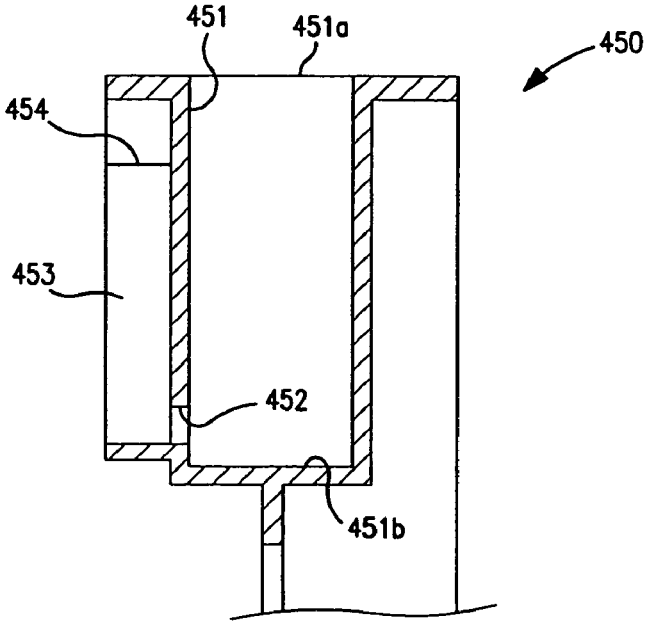

Referring to FIGS. 17(*a*) and 17(*b*), a dispensing path forming portion 450 may comprise a dispensing cylinder portion 451 which may have a substantially cylindrical shape into which ink dispensing plug 520 may be pressed, and a first dispensing communication opening 452 which communicates between this dispensing cylinder portion 451 and the inside of ink chamber 111. The dispensing path forming portion 450 also may comprise a substantially U-shaped dispensing partition wall 453 which may be provided from the outer surface of dispensing cylinder portion 451, in which the provided edge forms the welded surface portion on which film 160 may be welded and partitions first dispensing communication opening 452 with respect to ink chamber 111, and a second dispensing communication opening 454 which forms the opening portion of dispensing partition wall 453. The opened portion of dispensing cylinder portion 451 may be opening 451*a* which may be provided on the outside end surface of frame portion 110, and the surface which opposes opening 451*a* may be bottom portion 451*b* of dispensing cylinder portion 451. The region having boundaries which are defined by dispensing partition wall 453 and film 160 may be dispensing partition wall flow path 453*a*.

Dispensing partition wall 453 forms the inner circumference rib portion to which film 160 may be welded, and dispensing partition wall flow path 453*a* and second dispensing communication opening 454 may be provided when film 160 is welded. The welded end portion of dispensing partition wall 453 may be positioned on the same virtual plane as the welded end portion of outer circumference rib portion 400*b*.

When ink is dispensed into ink chamber 111, ink is dispensed in a state in which second dispensing communication opening 454 may be positioned on top and first dispensing communication opening 452 may be positioned on bottom. Moreover, ink sequentially passes through dispensing cylinder part 451, first dispensing communication opening 452, dispensing partition wall flow path 453*a*, and second dispensing communication opening 454, and the ink is dispensed until liquid surface I of the ink reaches the state shown in FIG. 17(*a*). Dispensing partition wall 453 may be provided substantially linearly from first dispensing communication opening 452 to second dispensing communication opening 454. Consequently, ink is dispensed smoothly without resistance.

When ink is dispensed, such that the inside of ink chamber 111 becomes full, the volume of ink expands and film 160 may be damaged or deformed by the boundary where ink cartridge 14 is positioned. If film 160 is damaged, the ink leaks, and if film 160 deforms, the volume within ink chamber 111 changes, making it difficult to stably supply ink. Therefore, in order to prevent damage and deformation of film 160, ink may not be dispensed to the degree which the inside of ink chamber 111 becomes full.

In this embodiment of the present invention, the air pressure within ink chamber 111 after ink is dispensed may be less than the ambient pressure. Therefore, a subsequent decompression process in which the pressure may be reduced by aspirating the ambient air within ink chamber 111 from dispensing path forming portion 450 may be performed. This may be performed to reduce the amount of ambient air within ink chamber 111, to maintain the degree of deaeration of the ink, and to reduce the generation of air bubbles within the ink. The deaeration of the ink may assist with maintaining the viscosity of the ink at a substantially constant level.

When subsequent decompression process is performed, and the ambient air within ink chamber 111 is aspirated from dispensing path forming portion 450, the resulting amount of ink may not be accurate regardless of whether or not an appropriate amount of ink was dispensed. If the amount of ink may be reduced, this causes losses to the user of ink cartridge 14, which may not be desirable. Therefore, when first dispensing communication opening 452 is enclosed by substantially U-shaped dispensing partition wall 453 and second dispensing communication opening 454 is positioned above liquid surface I of the ink, there may be an amount of distance between liquid surface I of the ink and second dispensing communication opening 454 even if the inside of ink chamber 111 is decompressed. As such, it may be possible to substantially prevent the escape of the ink within ink chamber 111 to the outside through dispensing path forming portion 450.

Figure 18A:
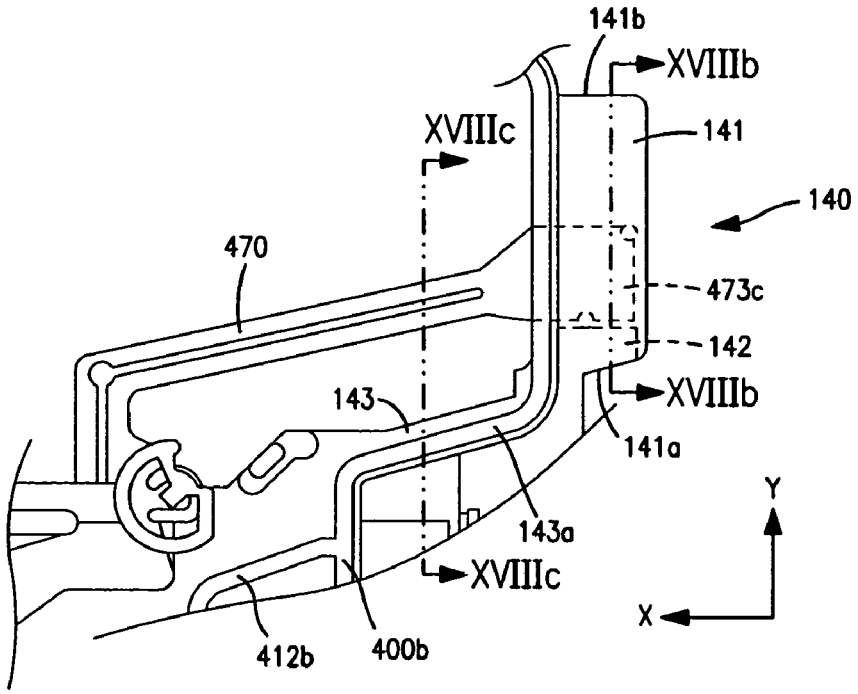
FIG. 18(*a*) is a side view of a signal blocking portion and a rib member disposed within an inner space of a translucent portion.
Figure 18B:
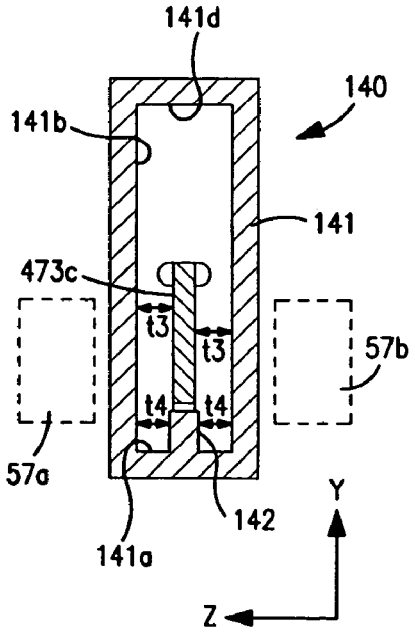
Figure 18C:
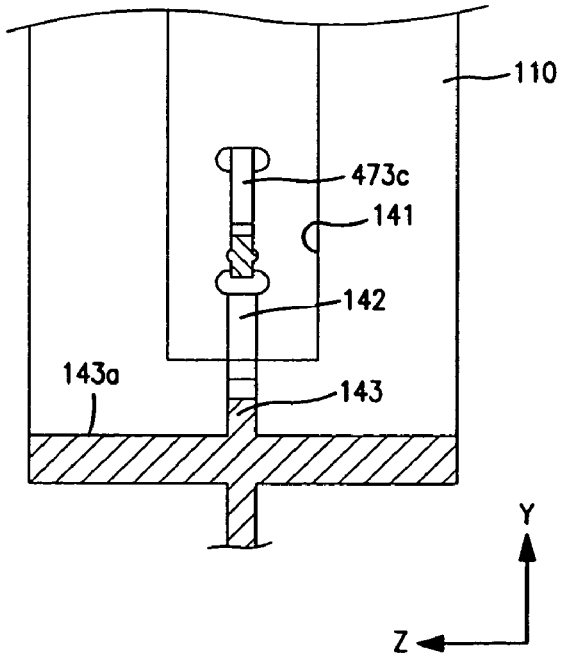

Referring to FIG. 18(*a*), translucent detection portion 140 may protrude outward from frame portion 110. Translucent detection portion 140 may comprise an enclosure portion 141 which encloses the end of movable member 470, e.g., blocking arm portion 473*c*, by sandwiching the end of movable member 470 with a pair of wall surfaces and forms a path through which movable member 470 may be displaced. Enclosure portion 141 may have a substantially box-shaped path by a bottom surface which may be provided by bottom wall 141*a* within enclosure portion 141, a pair of side surfaces which are provided by both side walls 141*b* which are provided on both sides from bottom wall 141*a*, an inner side surface which may be provided by inner side wall 141*c* which may be provided from bottom wall 141*a* and connects to both side walls 141*b*, and a ceiling surface which may be provided ceiling wall 141*d* which connects to the top edges of both side walls 141*b* and the top edge of inner side wall 141*c* and may be positioned opposite bottom wall 141*a*. Translucent detection portion 140 also may comprise a translucent portion rib 142 which may be provided, such that it protrudes upward from the bottom surface provided by bottom wall 141*a* and supports movable member 470 from below, and a vertical wall 143 which may be provided from the inside wall of frame portion 110, such that it connects to translucent portion rib 142 and extends in the direction of supply path forming portion 420. Translucent portion rib 142 may be positioned in the center of the width direction of the path within translucent detection portion 140, and it may be arranged, such that the end of movable member 470 also is positioned in the center of the path within translucent detection portion 140.

Movable member 470 may rotate based on the amount of ink within ink chamber 111, and it may be a member which may be used in combination with ink detection sensor 57 of multifunction device 1 to detect whether ink cartridge 14 has been installed in accommodating chamber 50 and whether the amount of ink is low by detecting the position of blocking arm portion 473*c*. Translucent detection portion 140 may be translucent, and light from light emitting portion 57*a* may be transmitted to light receiving portion 57*b*. Therefore, when blocking arm portion 473*c* is positioned in the light path between light emitting portion 57*a* and light receiving portion 57*b*, it blocks the light transmitted by light emitting portion 57*a*. Consequently, by rotating based on the amount of ink within ink chamber 111, movable member 470 may change the amount of light received by light receiving portion 57*b* and detect the presence or absence of ink.

Referring to FIG. 18(*b*), the thickness of translucent portion rib 142 may be selected, such that a second gap t4 between the inside walls of enclosure portion 141 and the outside wall of translucent portion rib 142 may be less than a first gap t3 between the inside walls of enclosure 141 and the outside of movable member 470. When liquid surface I of the ink falls below translucent detection portion 140, the ink within translucent detection portion 140 may be depleted, however, because first gap t3 between movable member 470 and enclosure 141 may be relatively small, ink may remain within translucent detection portion 140 due to the surface tension of the ink, and movable member 470 may not rotate normally due to the surface tension of the ink. Nevertheless, by forming arm supporting portion 142, such that first gap t3 is greater than second gap t4, the ink surface tension generated between translucent portion rib 142 and enclosure portion 141 may be greater than the ink surface tension generated between movable member 470 and enclosure portion 141. Consequently, the ink which remains within enclosure portion 141 may be drawn between arm supporting portion 142 and enclosure portion 141, such that it may be possible to substantially prevent ink from remaining between movable member 470 and enclosure portion 141. As such, the amount of ink may be accurately detected.

Referring to FIG. 18(*a*), bottom wall 141*a* on the lower portion of enclosure portion 141 slopes downward in the direction of ink chamber 111, such that the bottom surface provided by bottom wall 141*a* within enclosure 141 also slopes downward. Therefore, ink which may be drawn between enclosure portion 141 and arm supporting portion 142 flows downward in the direction of ink chamber 111. Further, referring to FIG. 18(*b*), the junction portion of bottom wall 141*a* of enclosure portion 141 and arm supporting portion 142 may be provided angularly from a cross-sectional perspective, e.g., about a right angle, such that the capillary force of the junction portion of enclosure portion 141 and translucent portion rib 142 is relatively strong, and ink may be guided to the side of ink chamber 111. Consequently, it may be possible to efficiently make the ink remaining within enclosure portion 141 flow downward.

Vertical wall 143 which connects to arm supporting portion 142 may be provided on sloping surface 143*a* which slopes downward in the direction of supply path forming portion 420 from arm supporting portion 142. Sloping surface 143*a* comprises a portion of the inside wall of frame portion 110. Referring to FIG. 18(*c*), the junction portion of vertical wall 143 and the inside wall of frame portion 110 may be provided angularly from a cross-sectional perspective, e.g., about a right angle, and it may be formed, such that its thickness is substantially equal to the thickness of arm supporting portion 142. Therefore, vertical wall 143 slopes downward in the direction of supply path forming portion 420, and the junction portion with the inside wall of frame portion 110 may have a substantially right angle, such that ink may be efficiently guided in the direction of supply path forming portion 420 by the slope and the capillary force. Because the thicknesses of translucent portion rib 142 and vertical wall 143 are substantially equal, vertical wall 143 may be provided in continuation from translucent portion rib 142. Consequently, there may be little or no resistance against the guiding of ink to supply path forming portion 420, and ink may be efficiently guided.

In the case in which movable member 470 may be rotated upward, movable member 470 contacts the ceiling surface provided by ceiling wall 141*b* which opposes bottom wall 141*a* of translucent detection portion 140, and the rotation of movable member 470 thus may be restricted. Therefore, it may be possible to prevent movable member 470 from moving out of enclosure portion 140.

Figure 19A:
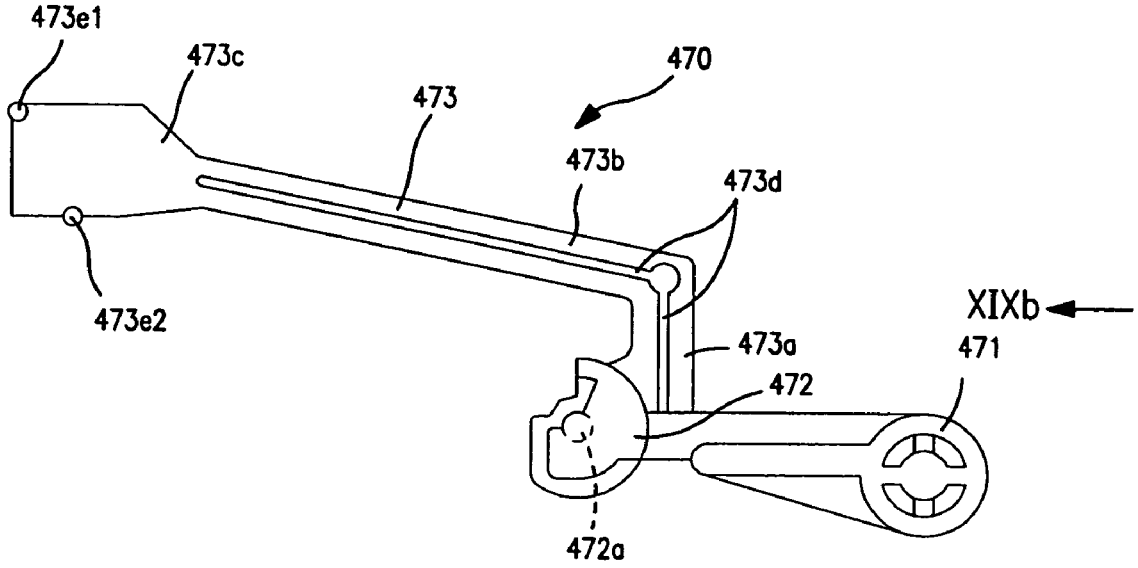
FIG. 19(*a*) is a front view of a movable member having a float portion and a signal blocking portion.
Figure 19B:
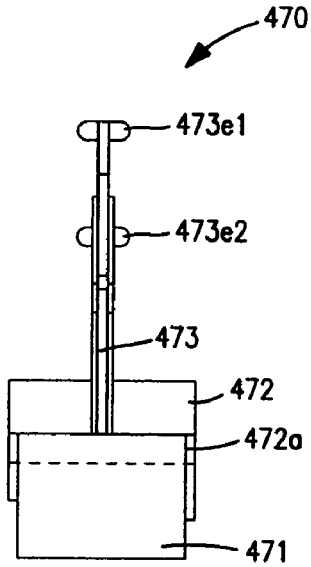

Referring to FIGS. 19(*a*) and 19(*b*), movable member 470 may be a member for detecting the amount of ink within ink chamber 111. Movable member 470 may be manufactured by injection molding using a resin material, e.g., polypropylene, and it has light-blocking properties, e.g., it may be opaque.

Movable member 470 may be a rotating member which rotates based on the amount of ink within ink chamber 111, and a portion of movable member 470 may be detected by ink detection sensor 57 which detects the amount of ink stored within ink chamber 111. Movable member 470 may comprise a float portion 471 which may comprise a material with a specific gravity which is less than the specific gravity of ink, a pivot portion 472 which may be attached to frame portion 110, such that it may pivot, and an arm portion 473, which extends from pivot portion 472 in a direction which may be substantially orthogonal to float portion 471. Pivot portion 472 may be a linking portion which connects float portion 471 and arm portion 473.

A substantially cylindrical attachment shaft 472*a* which may be attached to arm sandwiching portion 425 of frame portion 110 may be provided on pivot portion 472. Attachment shaft 472*a* may have a diameter which is less than the inside diameter of arm sandwiching portion 425, and is greater than the length of the opening of arm sandwiching portion 425. Consequently, when movable member 470 is rotated, it may be operated with little resistance, and the deviation of movable member 470 from arm sandwiching portion 425 may be prevented.

Arm portion 473 may comprise a vertical arm portion 473*a* which extends in a direction which is substantially perpendicular to float portion 471, a sloping arm portion 473*b* which slopes upward from vertical arm portion 473*a*, and a blocking arm portion 473*c*, which may be used as a light-blocking portion which blocks the range of possible detection of ink detection sensor 57.

Referring to FIG. 19(*b*), arm portion 473 may be substantially thinner than float portion 471 and pivot portion 472. Specifically, if arm portion 473 has a thick profile, the scale of translucent detection portion 140 may be increased, and consequently, the size of ink cartridge 14 and the resistance when movable member 470 rotates also may increase, which makes it difficult to accurately detect the amount of ink. Further, when the thickness of translucent detection portion 140 increases, the range of detection of ink detection sensor 57 widens accordingly, and the detection sensitivity deteriorates, which increases the costs associated with the ink detection sensor. Therefore, arm portion 473 may have a relatively thin profile. A plurality of ribs 473*d* may be provided on vertical arm portion 473*a* and sloping arm portion 473*b*, which may increase the strength of arm portion 473.

A pair of substantially semispherical arm protruding portions 473*e*1 and 473*e*2 may be provided on blocking arm portion 473*c* on the top and the bottom of the portion housed within translucent detection portion 140, respectively. Arm protruding portions 473*e*1 and 473*e*2 may reduce the likelihood of blocking arm portion 473*c* adhering to the inside wall of translucent detection portion 140 due to the surface tension of the ink. For example, because arm protruding portions 473*e*1 and 473*e*2 may have a substantially semispherical shape, the only portion which contacts the inside wall of translucent detection portion 140 may be the end of arm protruding portions 473*e*1 and 473*e*2, such that the effects of the surface tension of the ink may be reduced.

Float portion 471 may comprise a resin material with a specific gravity which is less than the specific gravity of ink, such that when liquid surface I of the ink is lowered, float portion 471 moves in the direction of the bottom portion of frame portion 110, i.e., float portion 471 and liquid surface I of the ink move in the same direction as ink is dispensed. When float portion 471 moves in the direction of the bottom portion, and arm portion 473 moves in the direction of the top portion using pivot portion 472 as a rotational axis, the state in which ink is depleted may be detected. Moreover, when the specific gravity of the materials comprising float portion 471 are less than the specific gravity of ink, it may be unnecessary to manufacture complex dies, such that the manufacturing cost of movable member 470 may be reduced.

Figure 20A:
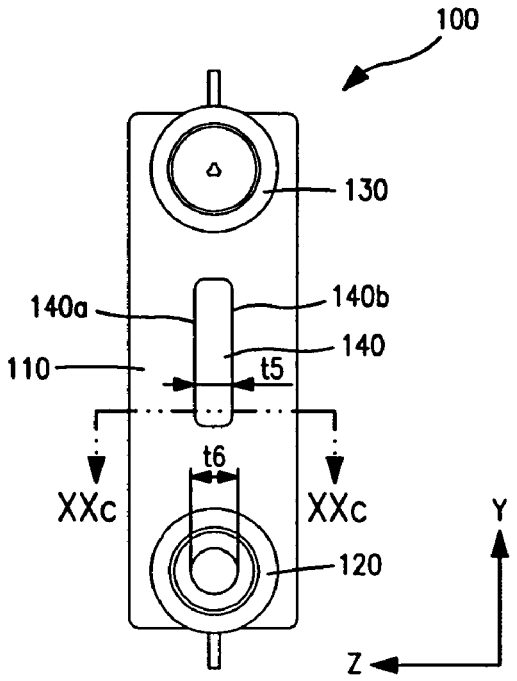
FIG. 20(*a*) is a side view of an ink reservoir element.
Figure 20B:
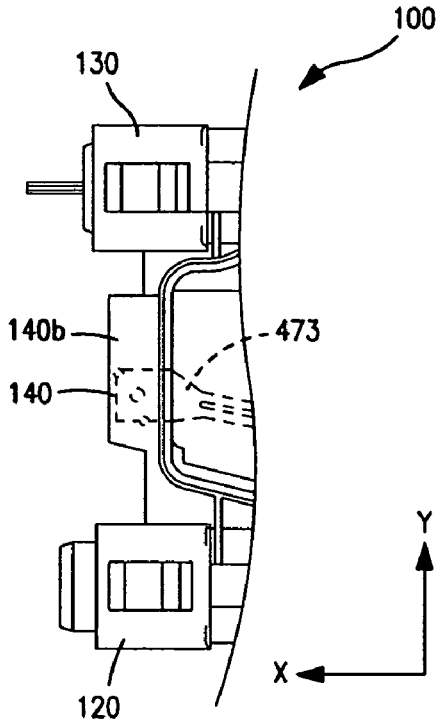
Figure 20C:
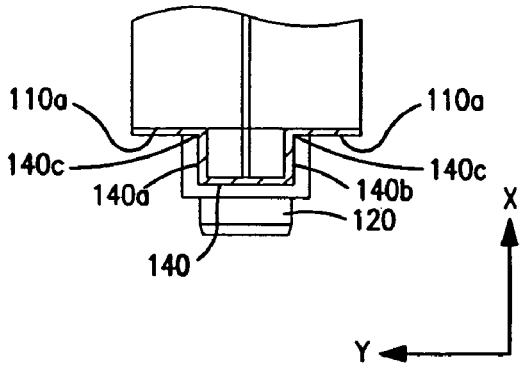

Referring to FIGS. 20(*a*) and 20(*b*), ink supply portion 120, ambient air intake portion 130, and translucent detection portion 140 may be provided on one of the side surfaces of frame portion 110. When ink cartridge 14 is installed within refill unit 13, ambient air intake portion 130, translucent detection portion 140, and ink supply portion 120 may be sequentially aligned from top to bottom.

Referring to FIG. 20(*a*), a width t5 of translucent detection portion 140 may be less than a diameter t6 of the opening of ink supply portion 120, e.g., an opening 600*a* of supply cap 600. Referring to FIG. 20(*b*), translucent detection portion 140 may be concave in the direction of frame portion with respect to ink supply portion 120 and ambient air intake portion 130.

Arm portion 473 of movable member 470 may be positioned within the inner space of translucent detection portion 140, and the light path of ink detection sensor 57 may be opened from the light-blocking state due to the rotation of arm portion 473, and the amount of ink may be detected. Light receiving portion 57*b* and light emitting portion 57*a* may be positioned on both sides of translucent detection portion 140, such that both side surfaces of translucent detection portion 140 form detection surfaces 140*a* and 140*b*. Referring again to FIG. 20(*a*), detection surfaces 140*a* and 140*b* may be parallel to the height direction, e.g., Y-direction, of ink cartridge 14 when ink cartridge 14 is installed in refill unit 13. When ink adheres to the front surfaces of detection surfaces 140*a* and 140*b*, it may be difficult to accurately detect the amount of ink.

For example, multifunction device 1 may be transferred to sale in a horizontal position, such that ink supply portion 120 may be positioned on top. Nevertheless, ink may leak out from ink supply portion 120 and adhere to translucent detection portion 140. Moreover, when ink cartridge 144 is temporarily removed from refill unit 13, ink which adheres to needle 49 of multifunction device 1 may adhere to the vicinity of the opening of ink supply portion 120, and after it is removed, the ink which adheres to the vicinity of the opening of ink supply portion 120 may adhere to translucent detection portion 140 depending on the position in which the user handles ink cartridge 14. When ink cartridge 14 is again installed in refill unit 13 when ink has adhered to translucent detection portion 140, because ink translucent detection portion 140 and light receiving portion 57*b* and light emitting portion 57*a* of ink detection sensor 57 are in close proximity in the installed state, the ink which adhered to translucent detection portion 140 may transfer to light receiving portion 57*b* and light emitting portion 57*a* of ink detection sensor 57. Ink which adheres to ink detection sensor 57 blocks light deteriorates the sensitivity of ink detection sensor 57. This deterioration of sensitivity may be even more prominent in black cartridges which use pigmented ink.

Referring to FIG. 20(*b*), translucent detection portion 140 may be provided in a position withdrawn to the side of ink chamber 111 with respect to ink supply portion 120, such that it may be difficult for ink to adhere to translucent detection portion 140 even when ink drips from ink supply portion 120. Specifically, the ink which drops from ink supply portion 120 generally may not head towards translucent detection portion 140, such that it does not adhere to translucent detection portion 140.

Because detection surfaces 140*a* and 140*b* are vertical when ink cartridge 14 is installed in refill unit 13, the ink may be most susceptible to the effects of gravity when ink cartridge 14 is installed in refill unit 13 while the ink is adhered to detection surfaces 140*a* and 140*b*, such that it drops relatively quickly. It therefore may be possible to substantially avoid the transfer of ink to light receiving portion 57*b* and light emitting portion 57*a* of ink detection sensor 57. Furthermore, the ink which drops may not adhere to the end surface of ink supply portion 120.

Referring to FIG. 20(*c*), side walls which form detection walls 140*a* and 140*b* from the side surface of frame portion 110 may be provided on translucent detection portion 140. Therefore, edge portion 140*c* where the side surface of frame portion 110 and detection surfaces 140*a* and 140*b* intersect may be provided at a substantially perpendicular angle. When ink adheres to the vicinity of edge 140*c*, the capillary force of edge 140*c* acts upon the ink because edge 140*c* may be provided at a substantially perpendicular angle, and the ink may flow to the side of ink supply portion 120 through edge 140*c*. It therefore may be possible to reduce the adherence of ink to detection surfaces 140*a* and 140*b*.

Figure 21:
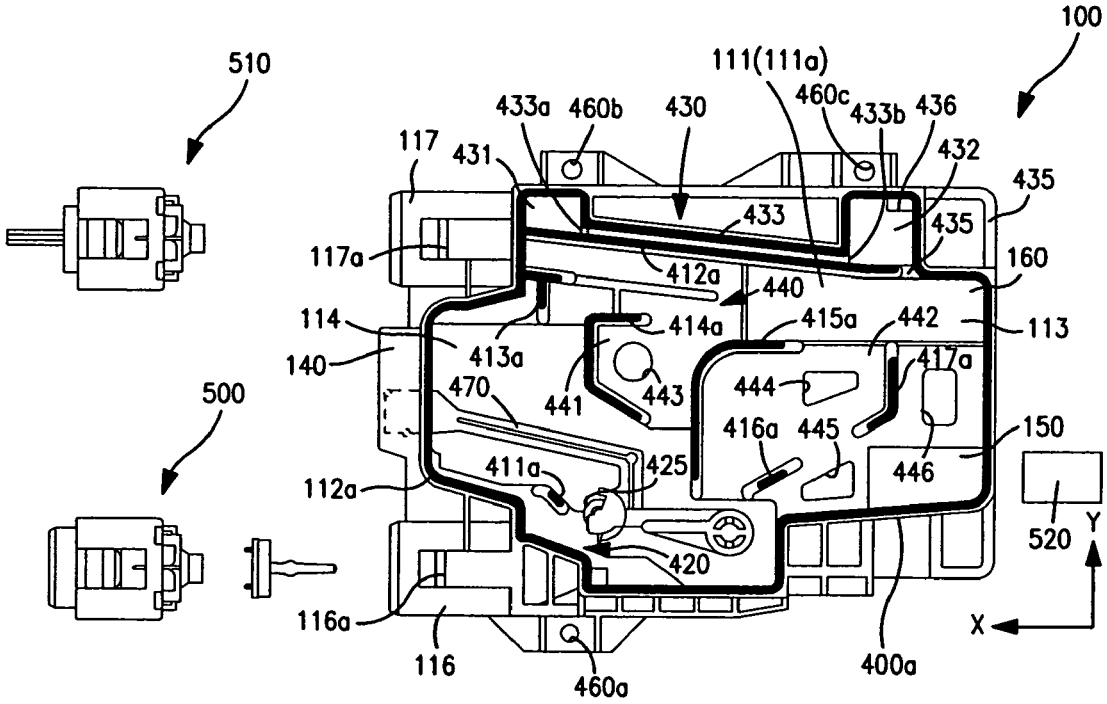
FIG. 21 is a side view of an ink reservoir element, according to an embodiment of the present invention.

Referring to FIG. 21, ink reservoir element 100 may be broken down into four main elements, frame portion 110, ink supply mechanism 500 which comprises ink supply portion 120, ambient air intake mechanism 510 which comprises ambient air intake portion 130, and ink dispensing plug 520 which may be pressed into dispensing cylinder portion 451 of ink dispensing portion 150. Ink dispensing plug 520 may comprise an elastic member, such as Pulci rubber, and once it is pressed into dispensing cylinder portion 451, it may be difficult to remove.

An ink supply element 116 may have a substantially cylindrical shape into which a portion of ink supply mechanism 500 may be inserted, and an ambient air intake element 117 may have a substantially cylindrical shape into which a portion of ambient air intake mechanism 510 may be inserted. Ink supply element 116 and ambient air intake mechanism 117 may be provided as a unit on frame portion 110. Further, protruding portions 116*a* and 116*b* which protrude in the direction of the outer circumference of ink supply element 116 in order to fasten ink supply mechanism 500 may be symmetrically positioned on ink supply element 116, and may be centered on the axial center of ink supply element 116. Similarly, protruding portions 117*a* and 117*b* which protrude in the direction of the outer circumference of ambient air intake element 117 in order to fasten ambient intake mechanism 510 may be symmetrically positioned on ambient air intake element 117, and may be centered on the axial center of ambient air intake element 117. Protruding portions 116*a*, 116*b*, 117*a*, and 117*b* may be formed, such that the end surface on the side of ink chamber 111 protrudes in a direction which is perpendicular to the outer circumferential surface of ink supply element 116 or the outer circumferential surface of ambient air intake element 117, and they may slope from the protruding edge portion towards the outer circumferential surface of ink supply element 116 or the outer circumference portion of ambient air intake element 117. As such, when ink supply mechanism 500 and ambient air intake mechanism 510 are attached to ink supply element 116 and ambient air intake element 117, the desorption of ink supply mechanism 500 and ambient air intake mechanism 510 may be substantially prevented.

Figure 22A:
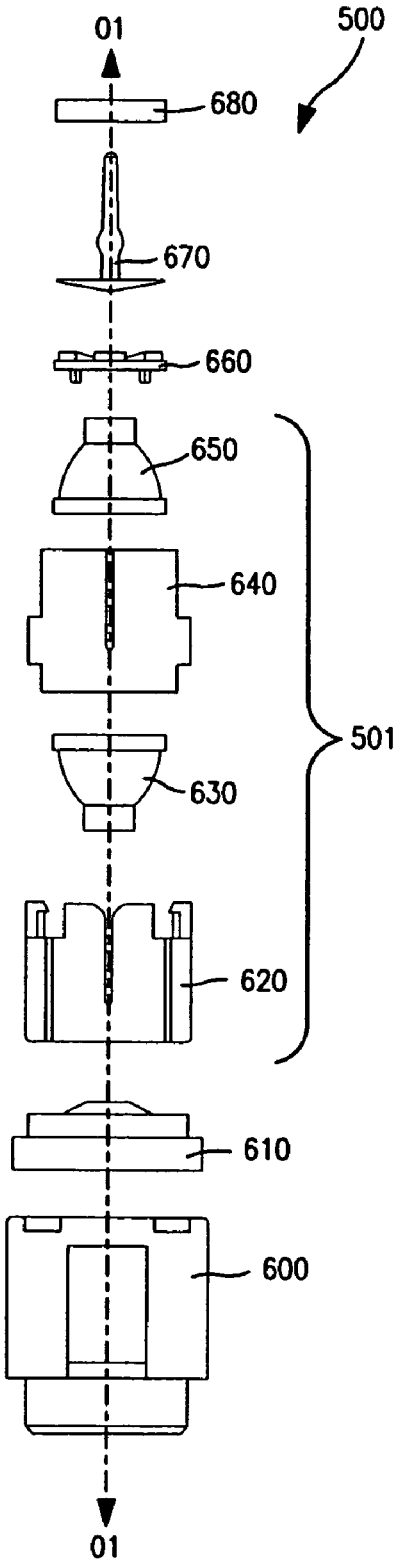
FIG. 22(*a*) is an expanded diagram of an ink supply mechanism.
Figure 22B:
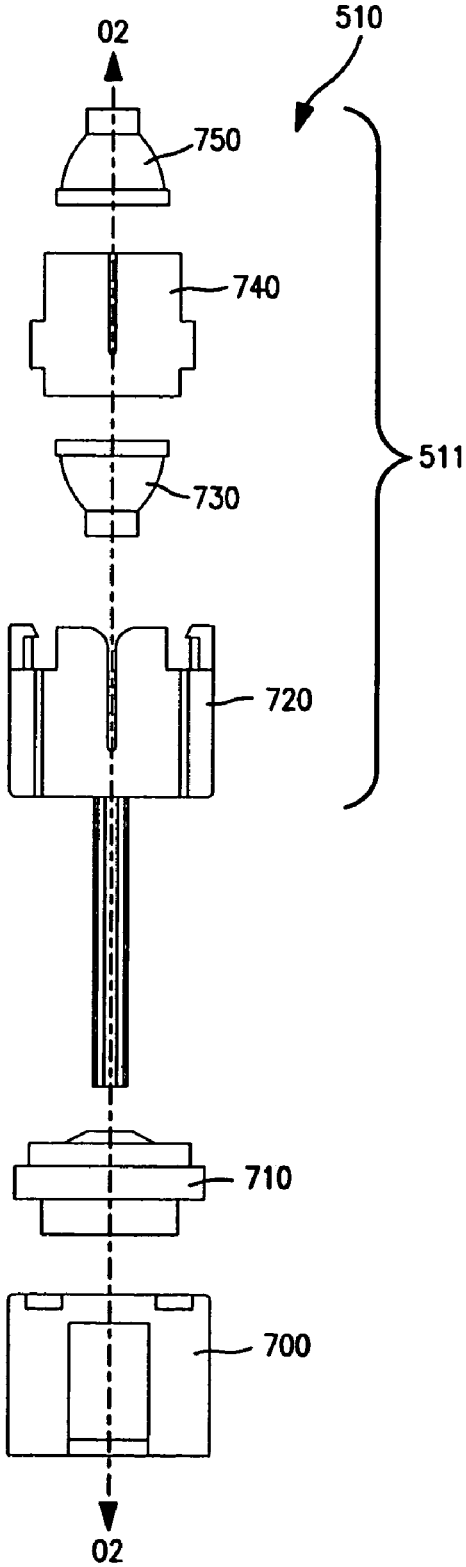
Figure 23A:
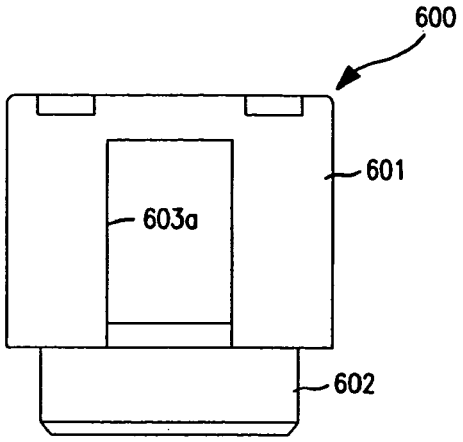
FIG. 23(*a*) is a side view of a supply cap.
Figure 23D:
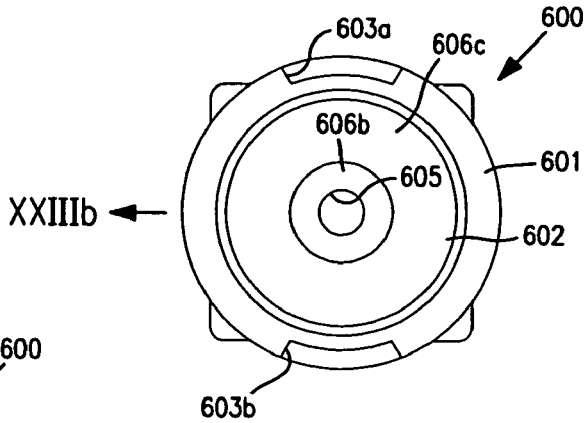
Figure 23B:
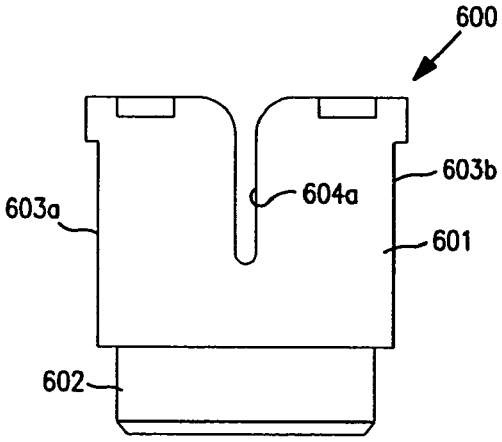
Figure 23E:
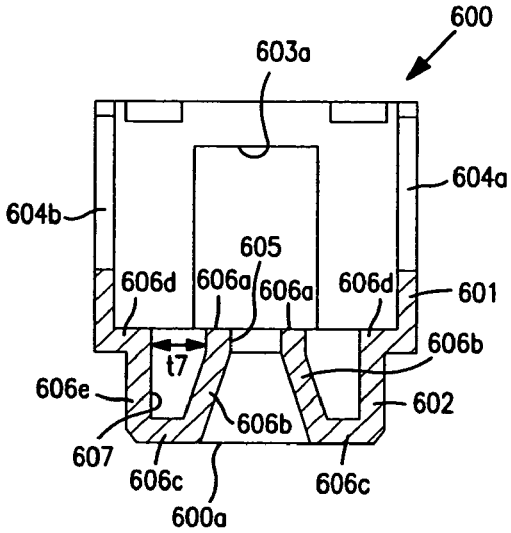
Figure 23C:
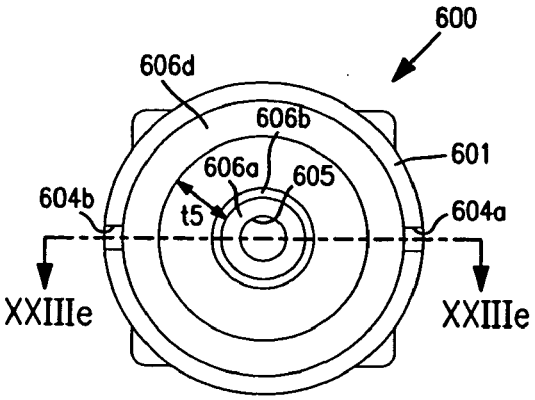
Figure 24A:
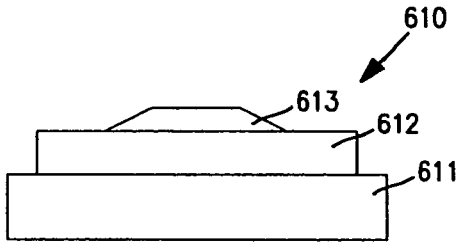
FIG. 24(*a*) is a side view of a supply joint.
Figure 24B:
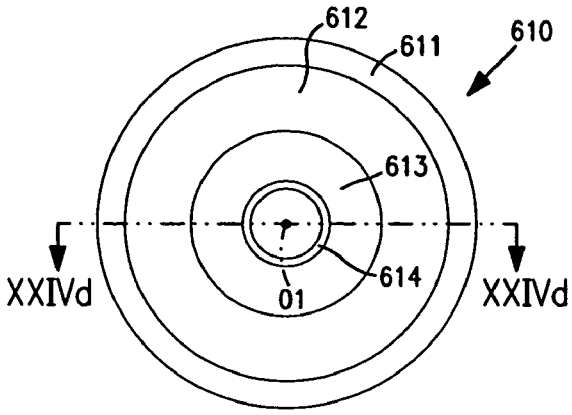
Figure 24C:
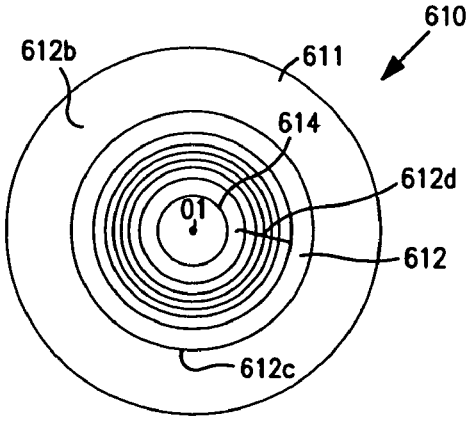
Figure 24D:
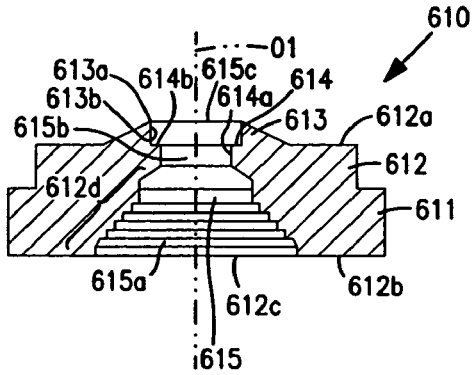
Figure 25A:
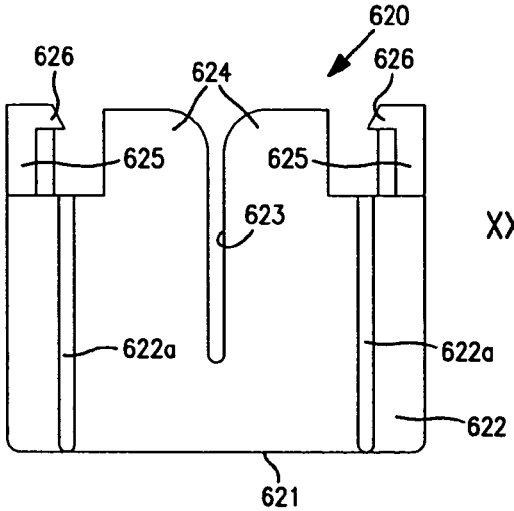
FIG. 25(*a*) is a side view of a supply valve.
Figure 25C:
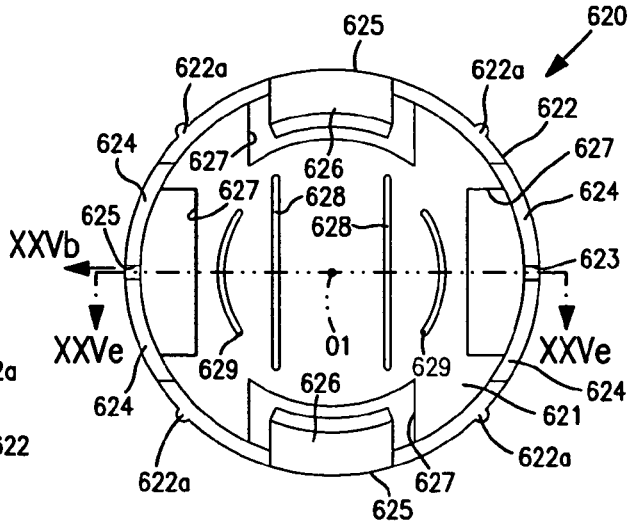
Figure 25B:
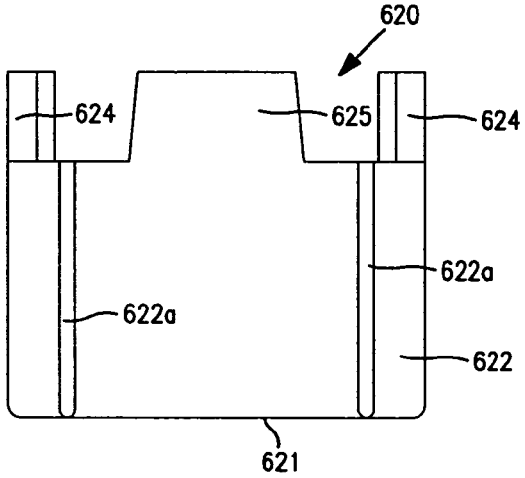
Figure 25D:
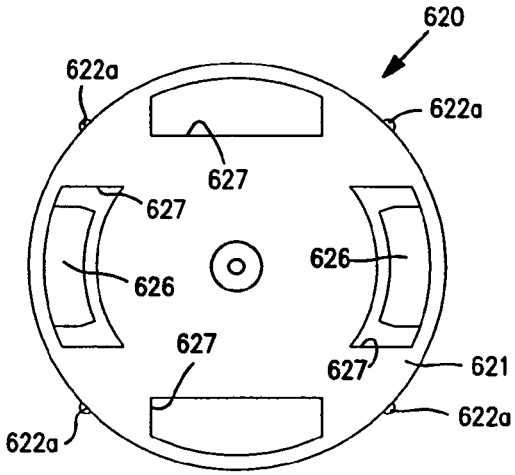
Figure 25E:
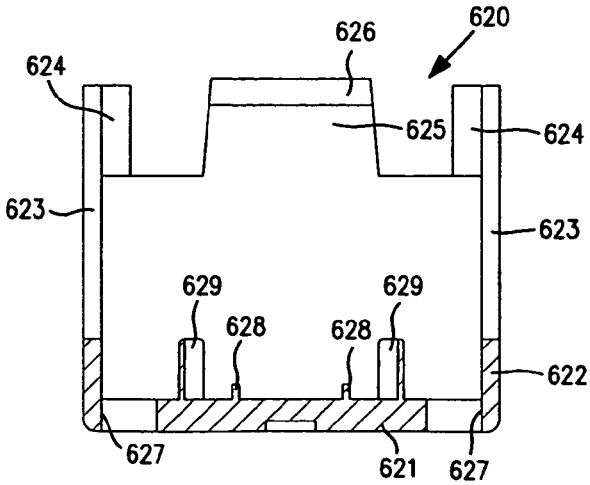
Figure 26A:
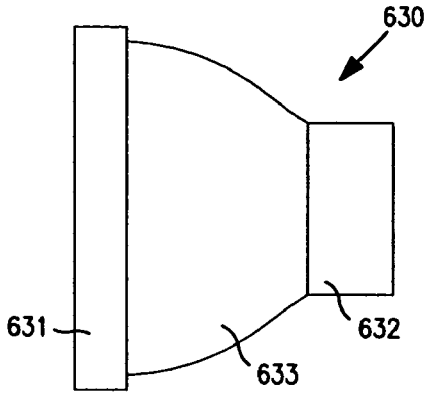
FIG. 26(*a*) is side view of the first supply spring.
Figure 26B:
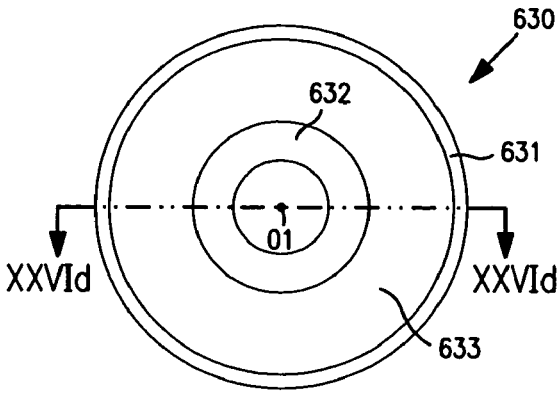
Figure 26C:
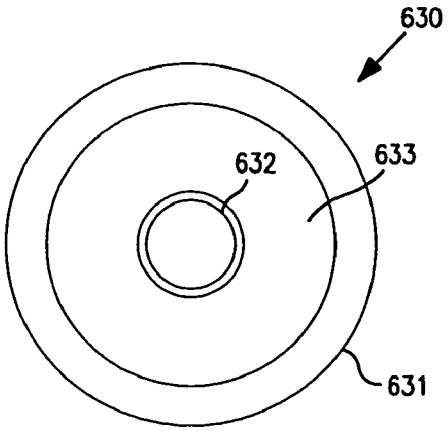
Figure 26D:
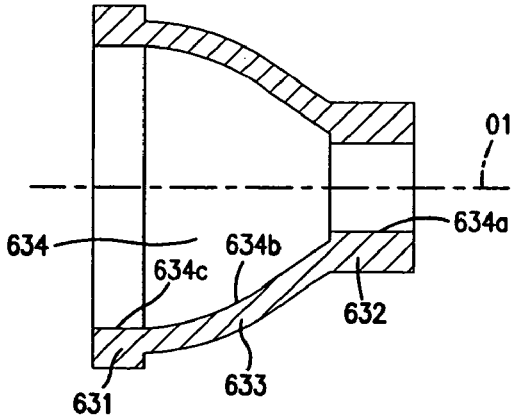
Figure 27A:
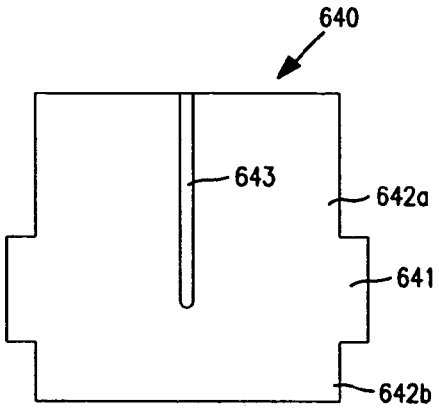
FIG. 27(*a*) is a side view of a supply slider.
Figure 27D:
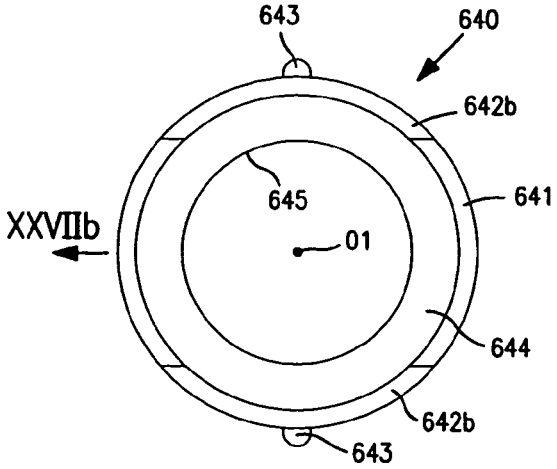
Figure 27B:
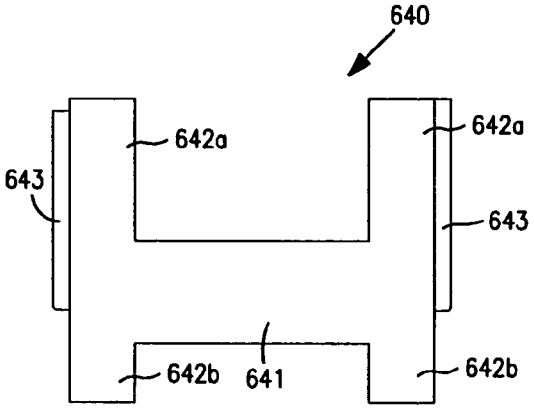
Figure 27E:
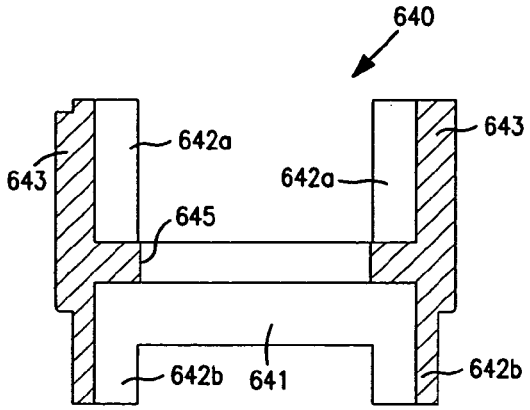
Figure 27C:
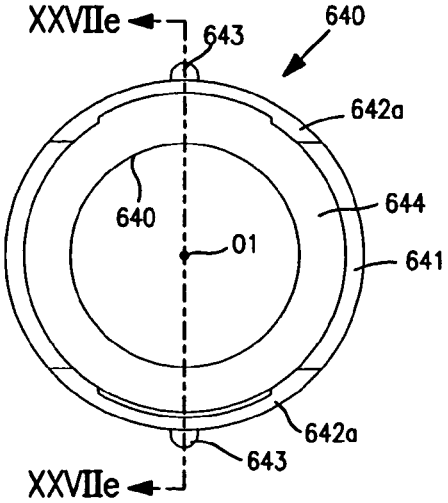
Figure 28A:
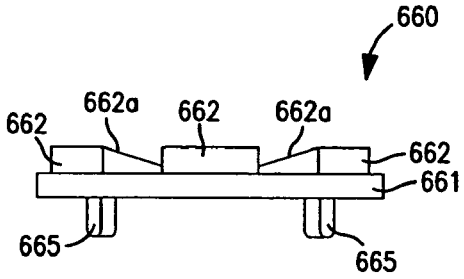
FIG. 28(*a*) is a side view of a valve seat.
Figure 28B:
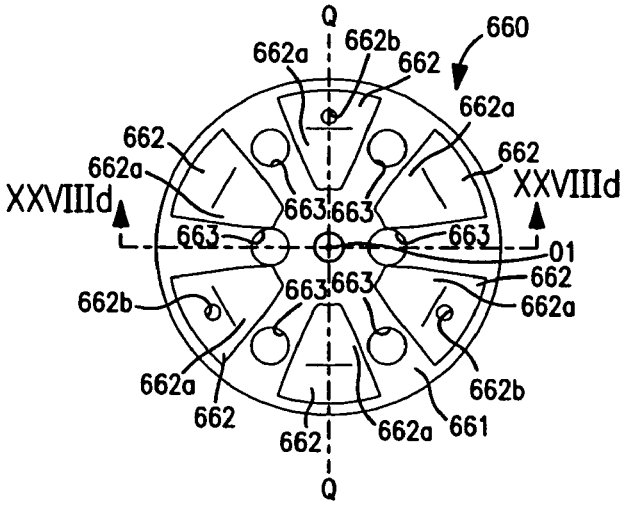
Figure 28C:
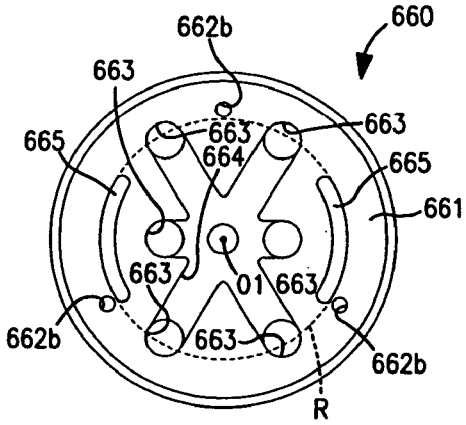
Figure 28D:
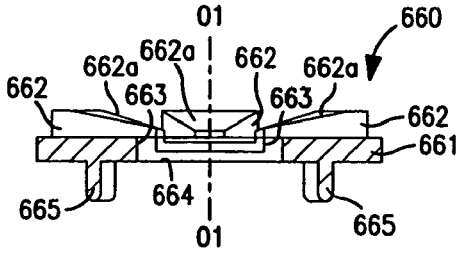
Figure 29A:
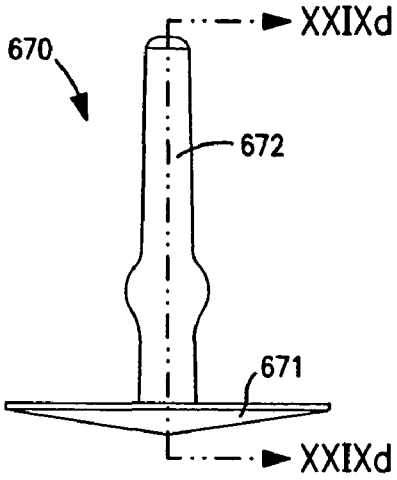
FIG. 29(*a*) is a side view of a check valve.
Figure 29C:
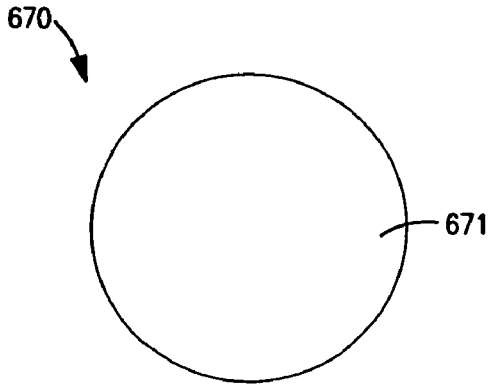
Figure 29B:
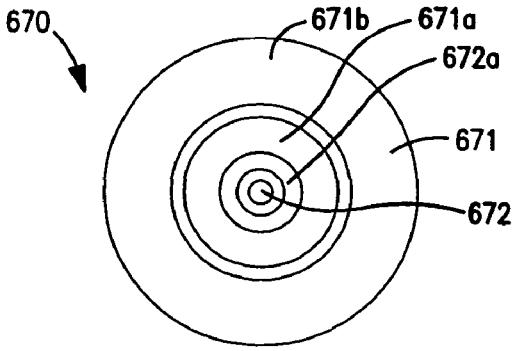
Figure 29D:
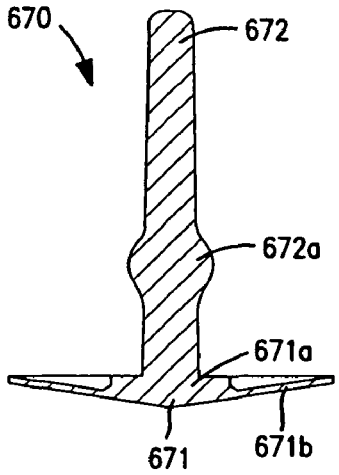
Figure 30A:
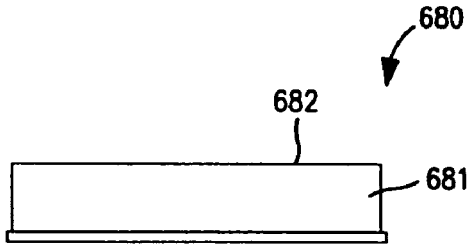
FIG. 30(*a*) is a side view of a cover.
Figure 30B:
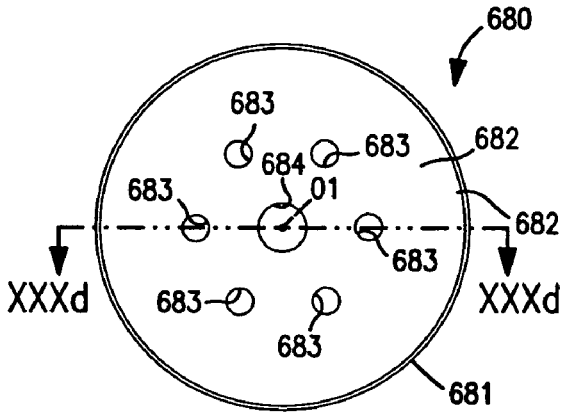
Figure 30C:
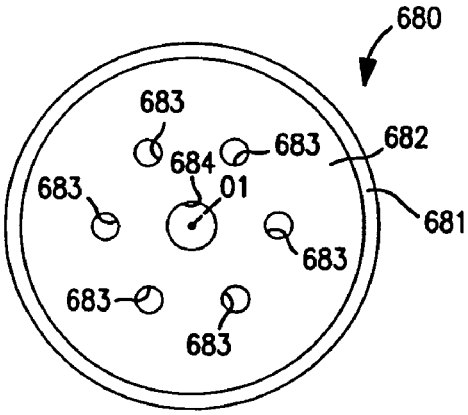
Figure 30D:
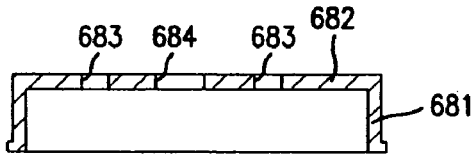
Figure 31A:
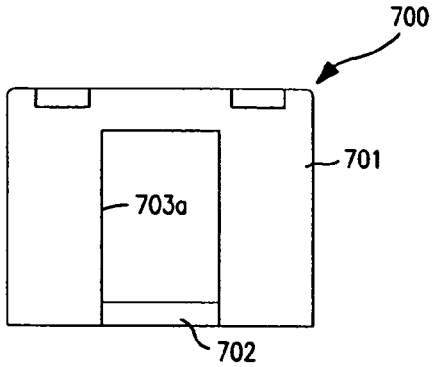
FIG. 31(*a*) is a side view of an ambient air cap.
Figure 31D:
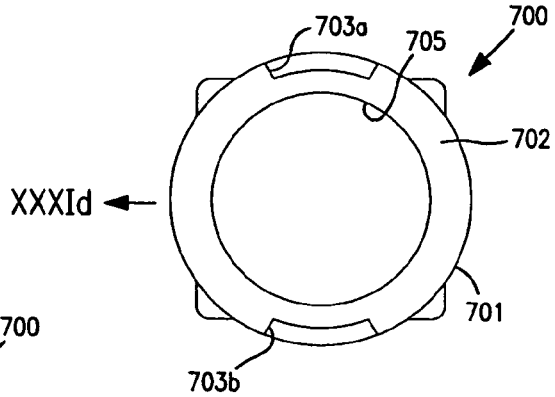
Figure 31B:
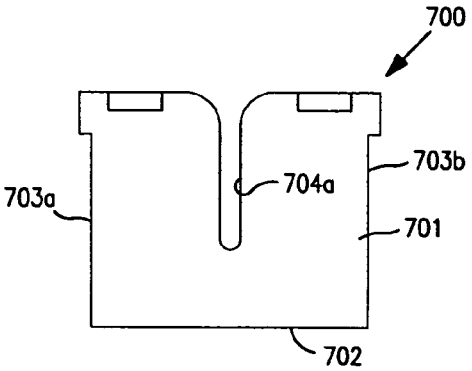
Figure 31E:
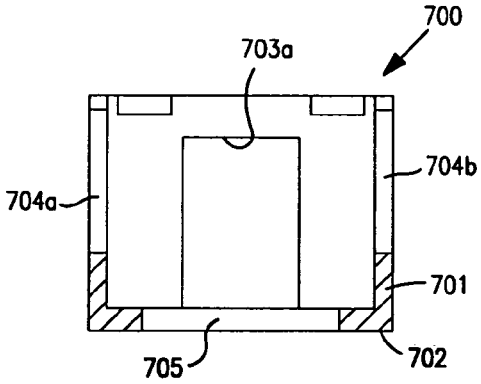
Figure 31C:
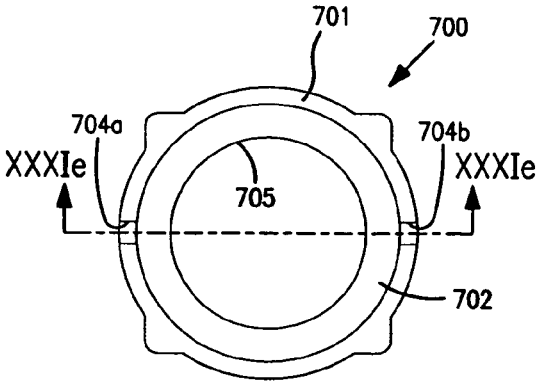
Figure 32A:
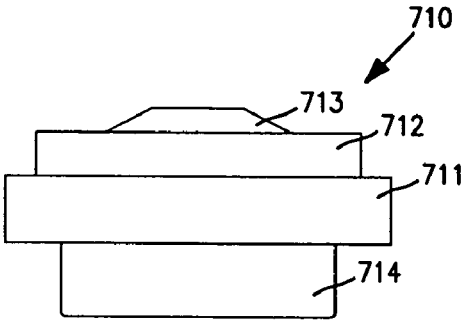
FIG. 32(*a*) is a side view of an ambient air joint.
Figure 32B:
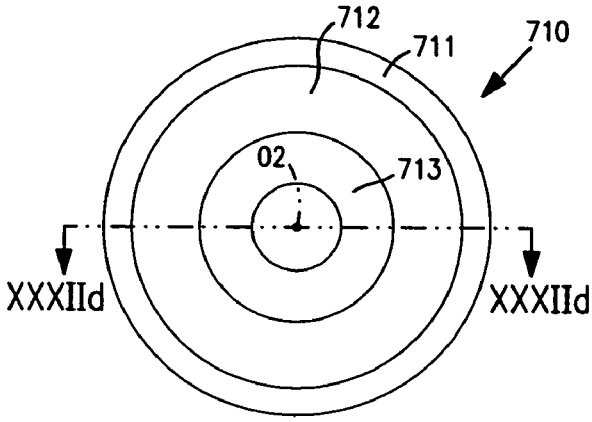
Figure 32C:
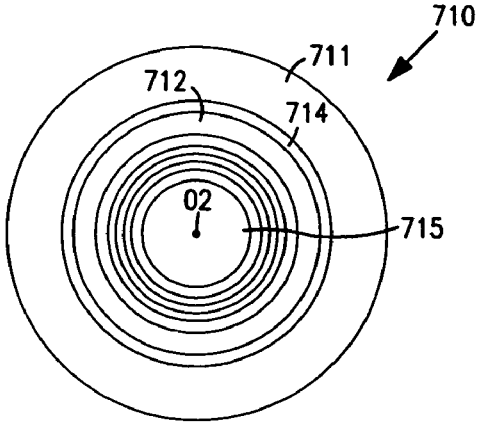
Figure 32D:
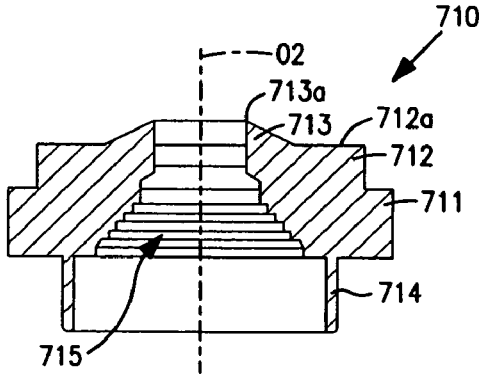

Referring to FIG. 22(*a*), ink supply mechanism 500 may comprise a supply cap 600 which may be installed on ink supply element 116, and a supply joint 610 which may comprise an elastic resin material, such as rubber, into which needle 49 of multifunction device 1 may be inserted. Ink supply mechanism 500 also may comprise a supply valve 620 which blocks the flow path of ink when supply joint 610 and the bottom wall contact, a first supply spring 630 which may be housed within supply valve 620 and may comprise a resinous elastic material, and supply slider 640 which covers the open surface of supply valve 620 and may be operated in a uni-axial direction, e.g., the direction of arrow O1, hereafter referred to as the "axial direction O1 of ink supply mechanism 500." Ink supply mechanism further may comprise a second supply spring 650 which may be housed within supply slider 640 and may comprise the same material and may have the same shape as first supply spring 630, a valve seat 660 which contacts second supply slider 650 and receives check valve 670, and a cover 680 which covers check valve 670 between the valve and valve seat 660. Supply valve 620, first supply spring 630, supply slider 640, and second supply spring 650 may comprise a supply valve mechanism 501.

Referring to FIG. 22(*b*), ambient air intake mechanism 510 may comprise an ambient air cap 700 which may be installed on ambient air intake element 117, an ambient air joint 710 which may comprise an elastic resin material, such as rubber, and an ambient air valve 720 which blocks the flow path of ink when ambient air joint 710 and the bottom wall contact and opens the flow path of ambient air when ink cartridge 14 is installed in multifunction device 1. Ambient air intake mechanism 510 also may comprise a first ambient air spring 730 which may be housed within ambient air valve 720 and may comprise a resinous elastic material, an ambient air slider 740 which covers the open surface of ambient air valve 720 and may be operated in a uni-axial direction, e.g., the direction of arrow O2, hereafter referred to as the "axial direction O2 of ambient air supply mechanism 510." Ambient air intake mechanism 510 further may comprise a second ambient air spring 750 which may be housed within ambient air slider 740 and may comprise the same material and may have the same shape as first ambient air spring 730. Ambient air valve 720, first ambient air spring 730, ambient air slider 740, and second ambient air spring 750 may comprise an ambient air valve mechanism 511.

Referring to FIG. 23(*a*), supply cap 600 may have a two-step shape from a side view perspective. The upper side portion in FIG. 23(*a*) may be a supply securing portion 601 which may be fastened to the outer circumferential surface of ink supply element 116 and may have a substantially cylindrical shape, and the lower side portion in FIG. 23(*b*) may be an ink storage portion 602 which has an ink storage space for preventing ink from dripping to the outside of ink cartridge 14.

Engagement openings 603*a* and 603*b* may be provided on supply securing portion 601 from the linking portion of ink storage portion 602 to the portion in the vicinity of the top, and may engage with protruding portions 116*a* and 116*b* of ink supply element 116 when supply cap 600 is secured to ink supply element 116.

Referring to FIG. 23(*b*), a pair of supply cap cutout portions 604*a* and 604*b* may be provided on supply securing portion 601 in a straight line which may be substantially orthogonal to a straight line which connects engagement openings 603*a* and 603*b*. Supply cap cutout portions 604*a* and 604*b* may be cut out facing the direction of ink storage portion 602 from the top surface of supply securing portion 601.

Referring to FIGS. 23(*c*) and 23(*d*), an insertion opening 605 into which needle 49 may be inserted may be provided in substantially the center position of ink storage portion 602 of supply cap 600. Referring to FIG. 23(*c*), the region from the circle which forms insertion opening 605 to the circle one step outward may be a first upper wall 606*a* which forms the upper end surface of ink storage portion 602, and the region from the circle of the outer side which forms a first upper wall 606*a* to the circle one step outward may be a sloping wall 606*b* which forms a sloping surface which slopes downward in the direction of the bottom surface of ink storage portion 602. The region from the circle of the outer side which forms sloping wall 606*b* to the circle one step outward may be a lower wall 606*c* which forms the lower end surface of ink storage portion 602, and the region from the circle of the outer side which forms lower wall 606*c* to the circle one step outward may be a second upper wall 606*d* which forms the lower end surface of supply securing portion 601 and forms the upper end surface of ink storage portion 602. The portion which connects lower wall 606*c* and second upper wall 606*d* may be an outer circumferential wall 606*e* which forms the outer circumferential surface of ink storage portion 602. Sloping wall 606*b* forms the cylindrical portion within ink storage portion 602, and outer circumferential wall 606*e* which may be connected to sloping wall 606*b* by lower wall 606*c* forms the cylindrical portion of the outside which encloses sloping wall 606*b*.

Referring to FIGS. 23(*d*) and 23(*e*), sloping wall 606*b* slopes downward, such that the insertion opening of needle 49 may have a tapered shape which decreases in diameter towards insertion opening 605 with a maximum diameter corresponding to opening 600*a* which forms the final exit of the ink. Consequently, the inner circumferential surface on the side of axial center O1 of sloping wall 606*b* becomes the insertion path into which needle 49 may be inserted. A space of t7 provided by sloping wall 606*b*, lower wall 606*c*, and outer circumferential wall 606*e* forms ink storing portion 607 which may store ink.

When supply cap 600 is attached to ink supply element 116, protruding portions 116*a* and 116*b* of ink supply element 116 protrude in the outer circumferential direction, such that supply cap 600 may be attached as it increases in diameter in the outer circumferential direction. Because supply cap cutout portions 604*a* and 604*b* are provided, the diameter of supply cap 600 increases in the direction in which engagement portions 603*a* and 603*b* move away from each other. Therefore, supply cap 600 may be attached without applying amount of pressure, such that it may be possible to improve the installation efficiency while reducing potential damage to supply cap 600.

Referring to FIG. 24(*a*), a supply joint 610 may be provided in three steps from a side view perspective. The bottom most step may be a joint outer circumference portion 611 which may be the portion which contacts second upper wall 606*d* of ink storage portion 602 of supply cap 600 and the inner circumferential surface of supply securing portion 601, and forms the outer circumference portion of supply joint 610. Joint outer circumference portion 611 may be the portion which is sandwiched between second upper wall 606*d* of supply cap 600 and the outside end surface of ink supply element 116 when supply cap 600 is secured to ink supply element 116. The top step of joint outer circumference portion 611 may be a joint inner circumference portion 612 which may be pressed into and positioned within ink supply element 116, and may form the inner circumference portion of supply joint 610. Further, the top step of joint inner circumference portion 612 may be a joint contact portion 613 which contacts supply valve 620. Supply joint 610 may comprise an elastic material, such as a resin rubber.

Referring to FIG. 24(*b*), the axial center of supply joint 610 may be positioned on axial center O1 of ink supply mechanism 500, and joint contact portion 613, joint inner circumference portion 612, and joint outer circumference portion may be sequentially provided towards the outer circumferential direction from axial center O1.

Referring to FIG. 24(*d*), joint contact portion 613 protrudes from top surface 612*a* of joint inner circumference portion 612. Joint contact portion 613 may narrow towards tip 613*a*, and tip 613*a* contacts the bottom surface of supply valve 620 and blocks the flow path of the ink. Further, joint protruding portion 614 which protrudes from the inner circumferential surface toward axial center O1, opening 612*c* which forms the insertion opening of needle 49 provided on bottom surface 612*b* of joint inner circumference portion 612, and stepped insertion path 612*d* which may be provided between opening 612*c* and joint protruding portion 614 may be provided on joint inner circumference portion 612. Referring to FIG. 24(*c*), the portion of insertion path 612*d* which may have a stepped shape may have substantially the same spacing from axial center O1 in the outer circumferential direction. Inner circumferential surface 614*a* of joint protruding portion 614 may be provided parallel to the direction of axial center O1 of ink supply mechanism 500, and stepped surface 614*b* may be provided in a direction which is orthogonal to the direction of axial center O1.

Referring again to FIG. 24(*d*), ink flow path 615 which passes through from bottom surface 612*b* of joint inner circumference portion 612 to tip 613*a* of joint contact portion 613 may be provided on supply joint 610. Ink flow path 615 may comprise an opening 612*c* which may be provided on bottom surface 612*b*, a step portion flow path 615*a* which may have boundaries which are defined by stepped insertion path 612*d* connected to opening 612*c*, a protruding portion flow path 615*b* which may have boundaries which are defined by inner circumferential surface 614*a* of joint protruding portion 614 connected to insertion path 612*d*, and a contact portion flow path 615*c* which may have boundaries which are defined by stepped surface 614*b* connected to inner circumferential surface 614*a* of joint protruding portion 614 and inner circumferential surface 613*b* of joint contact portion 613 connected to stepped surface 614*b*.

The lower half of step portion flow path 615*a* may have a stepped shape in the direction of axial center O1, and the upper half of step portion flow path 615*a* may have a tapered shape towards protruding portion flow path 615*b*. Moreover, step portion flow path 615*a* may have a stepped shape, such that the diameter gradually decreases from opening 612*c* towards the contact surface with inner circumferential surface 614*a* of joint protruding portion 614. The lower portion of step portion flow path 615*a* may have a stepped shape, such that even if needle 49 is removed and a relatively small amount of ink flows through ink flow path 615, the ink may be held by the capillary force due to the angular portion of the step portion, such that it may be possible to prevent ink from dripping to the outside of supply joint 610. When needle 49 is removed, the dripping of ink also may be prevented even if ink drips into ink flow path 615 from the tip of needle 49. In this embodiment, supply cap 600 may comprise ink storage portion 602, such that the portion of the lower half of step portion flow path 615*a* which may have a stepped shape alternatively may have a tapered shape.

Protruding portion flow path 615*b* may be the portion of ink flow path which has the smallest diameter, and it may have a substantially hollow cylindrical shape. The inside diameter of protruding portion flow path 615*b* may be less than the diameter of needle 49. Contact portion flow path 615*c* may have a substantially hollow cylindrical shape having an inside diameter which is greater than the diameter of protruding portion flow path 615*b*, and the inside diameter of contact portion flow path 615*c* may be greater than the diameter of needle 49. Because stepped surface 614*b* may be provided on the border of protruding portion flow path 615*b* and contact portion flow path 615*c*, the inside diameter in the direction of axial center O1 from protruding portion flow path 615*b* to contact portion flow path 615*c* changes. Consequently, joint contact portion 613 may be cut out into a countersunk shape by its inner circumferential surface 613*b* and stepped surface 614*b*, and tip 613*a* of joint contact portion 613 may be positioned in the periphery of the cutout portion.

Needle 49 may be inserted from opening 612*c*, and may be guided to the upper portion of step portion flow path 615*a* which may have a tapered shape and may be inserted into protruding portion flow path 615*b*. Because the inside diameter of protruding portion flow path 615*b* may be less than the diameter of needle 49, needle 49 elastically adheres to inner circumferential surface 614*a* of joint protruding portion 614 which forms protruding portion flow path 615*b* and is pressed within, such that it spreads protruding portion flow path 615*b*. As such, joint protruding portion 614 seals the periphery of needle 49 which may be pressed into protruding portion flow path 615*b*. Moreover, if the area of the portion of supply joint 610 which elastically adheres to the periphery of needle 49 is relatively large, the resistance when ink cartridge 14 is installed in multifunction device 1 also may be relatively large, and smooth installation is difficult. Nevertheless, in this embodiment of the present invention, joint protruding portion 614 only contacts needle 49 on the inner circumferential surface 614*a*, such that the surface of contact with needle 49 is reduced to smoothly install the cartridge in multifunction device 1. Moreover, needle 49 may be inserted into ink flow path 615, such that the flow path through which ink actually flows is inside of needle 49. Further, because contact portion flow path 615*c* may have a countersunk shape, the displacement of supply joint 610 in the direction of axial center O1 when needle 49 is inserted may be reduced.

Referring to FIG. 25(*a*), supply valve 620 may comprise a valve bottom wall 621 which forms the bottom surface of supply valve 620, and a valve outer circumferential wall 622 which may be provided along the direction of axial center O1 of ink supply mechanism 500 from valve bottom wall 621.

A pair of valve guide grooves 623, into which slider loose insertion portion 643 of supply slider 640 may be loosely inserted may be provided on valve outer circumferential wall 622. Referring to FIG. 25(*c*), the pair of valve guide grooves 623 may be symmetrically positioned with respect to axial center O1 of ink supply mechanism 500. Moreover, valve protrusion wall 624 which protrudes in the opposite direction as valve bottom wall 621 from the top of valve outer circumferential wall 622 in the direction of axial center O1 may be provided on valve outer circumferential wall 622, and valve guide grooves 623 may be provided across the vicinity of the bottom of valve outer circumferential wall 622 from the tip of valve protrusion wall 624. Because the valve guide grooves 623 may be secured over a relatively long distance, the deviation of slider loose insertion portion 643 from valve guide grooves 623 may be prevented.

Moreover, a pair of valve constraining portions 625 which protrude in the opposite direction as valve bottom wall 621 and restrict the operation of supply slider 640 may be connected to valve outer circumferential wall 622. Each of valve constraining portions 625 may comprise a valve hook portion 626 which protrudes towards axial center O1 from its tip and engages supply slider 640.

Further, four valve protruding portions 622*a* which protrude in semicircular shapes in the outer circumferential direction and may be provided from the top to the bottom of valve outer circumferential wall 622 may be provided on valve outer circumferential wall 622 with equal spacing along valve outer circumferential wall 622. Valve protruding portions 622*a* are provided in order to smoothly perform the operations of supply valve 620 when supply valve 620 is inserted into ink supply element 116. When there are no valve protruding portions 622*a*, the inner circumferential surface of ink supply element 116 and valve outer circumferential surface 622 may contact, such that the contact surface with ink supply element 116 is relatively large, and the resistance at the time of operation also is relatively large. Nevertheless, because in this embodiment of the present invention valve protruding portions 622*a* having semicircular shapes are provided, only valve protruding portions 622*a* may contact the inner circumferential surface of ink supply element 116, and the operations of supply valve 620 within ink supply element 116 may be smooth.

Valve constraining portions 625 and a valve protrusion wall may extend upward from valve outer circumferential wall 622. Consequently, the misalignment of supply slider 640 in the direction orthogonal to the direction of axial center O1 may be prevented. Further, the operation of supply slider 640 in the direction of axial center O1 may be restricted by valve constraining portion 625, such that first supply spring 630 may be reliably housed and operated.

Referring to FIG. 25(*c*), four ink flow paths 627 which communicate in the vertical direction of valve bottom wall 621 may be provided on valve bottom wall 621 in positions corresponding to valve guides 623 and valve constraining portion 625 in the direction of axial center O1 of ink supply mechanism 500. Valve bottom wall 621 protrudes upward from its bottom surface and may comprise a valve bearing portion 628 which may be a platform which receives spring top portion 632 of first supply spring 630. Valve bearing portion 628 may comprise two plate-shaped members positioned in parallel on valve bottom wall 621. Referring to FIG. 25(*e*), the height of valve bearing portion 628 in the direction of axial center O1 may be substantially lower than valve outer circumferential wall 622. Valve bearing portion 628 may be provided in order to ensure which first supply spring 630 does not contact valve bottom wall 621 when first supply spring 630 is positioned in the space within valve outer circumferential wall 622. Specifically, if first supply spring 630 contacts valve bottom wall 621, the ink flow path may be blocked and ink no longer flows. Therefore, valve bearing portion 628 may be provided in order to secure the ink flow path.

A valve inner circumferential wall 629 may have a substantially circular arc which covers the outer circumferential surface of spring top portion 632 of first supply spring 630, and may be provided on the outside of valve bearing portion 628 and on the inside of ink flow path 627. Valve inner circumferential wall 629 may be provided to restrict the movement of first supply spring 630 in a direction which may be orthogonal to axial center O1, and first supply spring 630 may be bent in the direction of axial center O1 by restricting the movement of first supply spring 630 in a direction which is orthogonal to axial center O1.

Referring to FIGS. 26(*a*)-26(*d*), first supply spring 630 may have a substantially reversed bowl shape, e.g., a substantially hollow cone. First supply spring 630 may comprise a ring-shaped spring bottom portion 631 which forms the bottom surface of first supply spring 630, a ring-shaped spring top portion 632 which has a diameter which is less than the diameter of spring bottom portion 631 and forms the top portion of the upper surface of first supply spring 630, and a spring plastic portion 633 which may be connected between spring top portion 632 and spring bottom portion 631 and bends and deforms when a load is applied in the direction of axial center O1 of ink supply mechanism 500. Spring top portion 632 contacts valve bearing portion 628 of supply valve 620 and forms a pressing portion which presses supply valve 620 in the direction of supply joint 610. The diameter of spring bottom portion 631 may be greater than the diameter of spring top portion 632, such that spring bottom portion 631 forms the base when spring plastic portion 633 is elastically deformed.

Referring to FIG. 26(*d*), an ink flow path 634 which communicates from the tip of spring top portion 632 to the bottom surface of spring bottom portion 631 may be provided on first supply spring 630. Ink flow path 634 may comprise a top portion flow path 634*a* which may have boundaries which are defined by the inner circumferential surface of spring top portion 632, a plastic portion flow path 634*b* which may have boundaries which are defined by the inner circumferential surface of spring plastic portion 633, and a bottom portion flow path 634*c* which may have boundaries which are defined by the inner circumferential surface of spring bottom portion 631. Referring to FIG. 26(*d*), the area of the opening of ink flow path 634 gradually increases from the tip of spring top portion 632 towards the bottom surface of spring bottom portion 631. Moreover, referring to FIGS. 26(*b*) and 26(*c*), top portion flow path 634*a* of spring top portion 632 may have a circular shape from the perspective of the direction perpendicular to the page. When spring plastic portion 633 is curved and has a substantially reversed bowl shape, spring plastic portion 633 may be more readily deformed than when spring plastic portion 633 has a substantially conic shape.

The cross-sectional shape of top portion flow path 634*a* of spring top portion 632 may be a substantially quadrilateral shape. When the opening of top flow path 634*a* has a substantially quadrilateral shape, the effects of air bubbles contained in the ink may be reduced. For example, the air bubbles contained in the ink may be spherical, and when the flow path is blocked by air bubbles which become larger than the inside diameter of top portion flow path 634*a*, the ink flow path may be blocked, and it may not be possible to send ink to multifunction device 1. Consequently, the quality of printing by multifunction device 1 decreases. Nevertheless, when the opening of top portion flow path 634*a* has a quadrilateral shape, the four corners are not blocked even when air bubbles are larger than the opening surface of top portion flow path 634*a*, such that the ink flow path may not be blocked. Further, the shape of the opening surface of top portion flow path 634*a* is not limited to a quadrilateral, and it alternatively may have a polygon shape, such as a hexahedron shape or a star shape.

Referring to FIG. 26(*d*), spring top portion 632 may have a relatively thick cylindrical shape which extends in the direction of axial center O1, and the cross-sectional shape perpendicular to the direction of axial center O1 may be substantially uniform. Similarly, spring bottom portion 631 also may have a relatively thick cylindrical shape which extends in the direction of axial center O1, and the cross-sectional shape perpendicular to the direction of axial center O1 may be substantially uniform.

Referring to FIG. 26(*d*), spring plastic portion 633 may have a substantially reversed bowl shape, e.g., a substantially conical shape, which curves at a predetermined angle in the direction of axial center O1. Consequently, the strength with respect to loading in the direction of axial center O1 may be weak in comparison to spring bottom portion 631 and spring top portion 632. Furthermore, spring plastic portion 633 may have a thinner profile than spring bottom portion 631 and spring top portion 632, which also reduces its strength. Accordingly, when first supply spring 630 elastically deforms, spring plastic 633 plastically deforms.

Second supply spring 650 may have the same shape as first supply spring 630, and second supply spring 650 may comprise a spring bottom portion 651, a spring top portion 652, a spring plastic portion 653, and an ink flow path 654, e.g., a top portion flow path 654*a*, a plastic portion flow path 654*b*, and a bottom portion flow path 654*c*. Further, first ambient air spring 730 and second supply spring 750 may have the same shape as first supply spring 630, and respectively may comprise spring bottom portions 731 and 751, spring top portions 732 and 752, spring plastic portions 733 and 753, ink flow paths 734 and 754, e.g., top portion flow paths 734*a* and 754*a*, plastic portion flow paths 734*b* and 754*b*, and bottom portion flow paths 734*c* and 754*c*.

Referring to FIGS. 27(*a*)-27(*c*), a supply slider 640 may comprise a resin material with a greater degree of hardness than first supply spring 630 and second supply spring 650. Supply slider 640 may comprise a slider outer circumferential wall 641 which forms the outer periphery of supply slider 640, a pair of slider protrusion walls 642*a* and 642*b* which protrude from this slider outer circumferential wall 641 in the direction of axial center O1 of ink supply mechanism 500, and a pair of slider loose insertion portions 643 which extend from slider outer circumferential wall 641 to the upper tip of slider protrusion wall 642*a* and are loosely inserted into valve guide grooves 623 of supply valve 620. Supply slider 640 also may comprise a slider platform portion 644 which may be provided on the inside of slider outer circumferential wall 641 and may contact spring bottom portions 631 and 651 of first and second springs 630 and 650, and a slider through-opening 645 which may be provided in the center position of slider platform portion 644 and connects the top and bottom of slider platform portion 644. Referring to FIG. 27(*c*), slider protrusion walls 642*a* and 642*b* may be positioned symmetrically, such that they sandwich axial center O1, and slider loose insertion portions 643 also may be positioned, such that they sandwich axial center O1.

The inside diameter of slider outer circumferential wall 641 may be substantially the same as the outside diameter of spring lower portions 631 and 651, and slider protrusion walls 642*a* and 642*b* may protrude from slider outer circumferential wall 641 in the direction of axial center O1, such that the movement of first and second springs 630 and 650 in the direction orthogonal to axial center O1 may be restricted. Consequently, first and second springs 630 and 650 are elastically deformed in the direction of axial center O1.

Slider loose insertion portions 643 may extend in the direction of axial center O1 of supply slider 640, such that when they are loosely inserted into valve guide grooves 623, they move smoothly in the direction of axial center O1 of supply slider 640, and misalignment in the direction orthogonal to the direction of axial center O1 may be prevented.

Referring to FIG. 28(*a*), valve seat 660 may comprise a valve seat bottom portion 661 which forms the bottom surface of valve seat 660 and contacts spring top portion 632 of second supply spring 650, and a plurality of valve seat bearing portions 662 which are positioned on the top surface of valve seat bottom portion 661. Each valve seat bearing portion 662 may comprise a valve seat sloping surface 662*a* which slopes downward as it approaches the center of valve seat 660, and a check valve 670 which may be received by valve seat sloping surface 662*a*.

Referring to FIG. 28(*b*), six valve seat bearing portions 662 may be provided with predetermined spacing in the circumferential direction of valve seat 660. First valve seat through-openings 662*b* which pass through the front and back of valve seat 660 may be provided on three of the six valve seat bearing portions. First valve seat through-openings 662*b* may be provided on a portion other than valve seat sloping surface 662*a* of valve seat bearing portion 662. Because first valve seat through-openings 662*b* may be provided on a portion which differs from the portion which receives check valve 670, the blockage of the ink flow path may be prevented.

Moreover, second valve seat through-openings 663 which pass through valve seat bottom portion 661 may be provided between valve seat bearing portions 662 of valve seat 660. Six of second valve seat through-openings 663 may be provided with left-right symmetry based on a center line Q which passes through axial center O1 of ink supply mechanism 500. The second valve seat through-openings 663 form an ink flow path through which ink flows.

Referring to FIG. 28(*c*), concave valve seat communication grooves 664 which connect each of the second valve seat through-openings 663 may be provided on the bottom surface of valve seat bottom portion 661. Valve seat communication grooves 664 connect second valve seat through-openings 663 to each other in a substantially linear manner on the bottom surface of valve seat bottom portion 661. Therefore, three valve seat communication grooves 664 which intersect at axial center O1 are formed. Moreover, a pair of valve protrusion members 665 which protrude from the bottom surface may be provided on the bottom surface of valve seat bottom portion 661. Spring top portion 652 of second supply spring may be housed in each of valve seat protrusion members 665, and they may contact the outer circumferential surface of spring top portion 652 of second spring 650, such that the movement of second supply spring 650 in the direction orthogonal to axial center O1 may be restricted.

Referring to FIG. 28(*d*), a gap may be provided between valve seat sloping surface 662*a* of valve seat bearing portions 662 and second valve seat through-openings 663 in the direction of axial center O1. Consequently, even when check valve 670 is supported on valve seat sloping surface 662*a*, the flow path of the ink may be secured. Moreover, even when the end surface of spring top portion 632 of second supply spring 650 contacts the bottom surfaces of second valve seat through-openings 663, second valve seat through-openings 663 are positioned to the outside of the virtual circumference of valve seat protrusion member 664, such that the flow path of the ink may be secured by valve seat communication grooves 664. Valve seat communication grooves 664 connect all of the second valve seat through-openings 663, such that even when there are second valve seat through-openings 663 which are enclosed by valve seat protrusion member 665, the ink flow path may be reliably secured.

Referring to FIGS. 29(*a*)-29(*d*), check valve 670 substantially may have an umbrella shape from a side view perspective, and it may comprise an umbrella portion 671 and a shaft portion 672. Umbrella portion 671 blocks the flow path of the ink by contacting cover 680, and may comprise a linking portion 671 which may be connected to shaft portion 672, and a wing portion 671*b* which extends substantially uniformly in the outer circumferential direction from linking portion 671*a*, and may have a relatively thin profile. Consequently, when umbrella portion 671 contacts cover 680, wing portion 671*b* adheres to cover 680 and elastically deforms, such that it may be possible to reliably block the ink flow path communication between cover 680 and check valve 670.

Referring to FIG. 29(*a*), the bottom surface of umbrella portion 671 may have a curved shape and may be supported by valve seat bearing portions 662 of valve seat 660, such that the flow path of the ink may be open when umbrella portion 671 is supported by valve seat bearings 662 of valve seat 660, and the flow path of the ink may be blocked when umbrella portion 671 contacts cover 680.

Shaft portion 672 may be a portion which is inserted into second cover through-opening 684 of cover 680. Shaft portion 672 may be positioned in the vicinity of cover 680 when it is attached to cover 680, and may comprise a ball portion 672*a* which may have a substantially spherical shape. Ball portion 672*a* may have a diameter which is greater than the diameter of second cover through-opening 684 of cover 680, and it prevents check valve 670 from falling off once it is attached to cover 680. Consequently, it may be possible to reduce the loss of check valve 670 when manufacturing ink cartridge 14, and operationality may be improved.

Referring to FIGS. 30(*a*)-30(*d*), cover 680 may have a substantially cylindrical shape in which the bottom surface side may be open. Cover 680 may comprise a cover outer circumferential wall 681 which forms the outer periphery, and a cover top portion 682 which forms the top surface of cover 680, and a bottom surface of cover 680 may be open. Valve seat 660 may be fitted into the opening of the bottom surface of cover 680, and check valve 670 may be housed between valve seat 660 and cover 680.

Referring to FIGS. 30(*b*) and 30(*c*), six first cover through-openings 683 which pass through the front and back of cover 680 may be provided in the circumferential direction with respect to axial center O1. First cover through-openings 683 form a flow path through which ink flows, and when umbrella portion 671 of check valve 670 contacts cover top portion 682, first cover through-openings 683 are blocked, and thus, the ink flow path also may be blocked.

Moreover, second cover through-opening 684, into which shaft portion 672 of check valve 670 may be inserted, may be provided in the center of cover top portion 682. Shaft portion 672 of check valve 670 may be inserted into second cover through-opening 684, and check valve 670 may be thereby attached. Even when check valve 670 is inserted into second cover through-opening 684, the flow path of the ink may be provided on a portion of inner circumferential surface. Nevertheless, when umbrella portion 671 of check valve 670 contacts cover top portion 682, the entire first cover through-opening may be blocked, such that the ink flow path of second cover through-opening 684 provided in the center may be simultaneously blocked.

Referring to FIG. 31(*a*), ambient air cap 700 may comprise a substantially cylindrical ambient air securing portion 701 which forms the side wall of ambient air cap 700 and may be fastened to ambient air intake element 117, and an ambient air cap bottom wall 702 which forms the bottom wall of ambient air cap 700. Engagement openings 703*a* and 703*b* may be provided on ambient air securing portion 701 from the bottom portion of ambient air securing portion 701 to the vicinity of the top portion, and may be engaged with protruding portions 117*a* and 117*b* of ambient air intake element 117 when ambient air cap 700 is fastened to ambient air intake element 117.

Referring to FIG. 31(*b*), ambient air cap cutout portions 704*a* and 704*b* may be provided on ambient air securing portion 701 and may be offset by about 90° with respect to axial center O2 from the positions in which engagement openings 703*a* and 703*b* are provided, and may be cut out from the top end of ambient air securing portion 701 to the vicinity of the bottom portion.

Moreover, referring to FIGS. 31(*c*) and 31(*d*), ambient air cap insertion opening 705, into which joint skirt portion 714 of ambient air joint 710 and valve open portion 721*a* of ambient air valve 720 may be inserted, may have a substantially central position on ambient air cap bottom wall 702. Ambient air joint 710 may be housed, such that it contacts the inside surface of ambient air cap bottom wall 702 and the inner circumferential surface of ambient air securing portion 701.

When ambient air cap 700 is attached to ambient air intake element 117, protruding portions 117*a* and 117*b* of ambient air intake element 117 protrude in the outer circumferential direction, such that ambient air cap 700 may be attached as it increases in diameter in the outer circumferential direction. Therefore, when ambient air cap 700 is attached, it may be attached without applying substantial pressure, such that installation efficiency may be improved and potential damage to ambient air cap 700 may be reduced.

Referring to FIG. 32(*a*), ambient air joint 710 may be provided in four steps from a side view perspective. The portion in the second step from the bottom may be a joint outer circumference portion 711 which may be the portion which contacts the inner circumferential surface of ambient air securing portion 701 and ambient air cap bottom wall 702, and forms the outer circumference portion of ambient air joint 710. The portion at the top step of joint outer circumference portion 711 may be a joint inner circumference portion 712 which may be provided on the inside of ambient air intake element 117 and forms the inner circumference portion of ambient air joint 710. Further, the portion at the top step of joint inner circumference portion 712 may be a contact portion 713 which contacts ambient air valve 720. The portion at the bottommost step may be a joint skirt portion 714 provided with a relatively thin profile, which may be a member which covers the outside surface of valve open portion 721*a* of ambient air valve 720 and exposes it to the outside from ambient air cap 700.

Referring to FIG. 32(*b*), the axial center of joint outer circumference portion 711, joint inner circumference portion 712, joint contact portion 713, and joint skirt portion 714 may be positioned on the same axial center as in the direction of axial center O2 of ambient air intake mechanism 510. Moreover, ambient air joint 710 may comprise an elastic material, such as a resin rubber, such that when ink cartridge 14 is installed in multifunction device 1, joint skirt portion 714 contacts the end surface of multifunction device 1 and is elastically deformed.

Referring to FIG. 32(*d*), joint contact portion 713 protrudes from top surface 712*a* of joint inner circumference portion 712. Joint contact portion 713 may narrow towards tip 713*a*, and tip 713*a* contacts the bottom surface of ambient air valve 720 and blocks the ambient air intake path. Moreover, joint path 715 which passes from the bottom surface of joint inner circumference portion 712 to tip 713*a* of joint contact portion 713 may be provided on ambient air joint 710, and valve open portion 721*a* of ambient air valve 720 may be inserted into joint path 715.

Figure 33A:
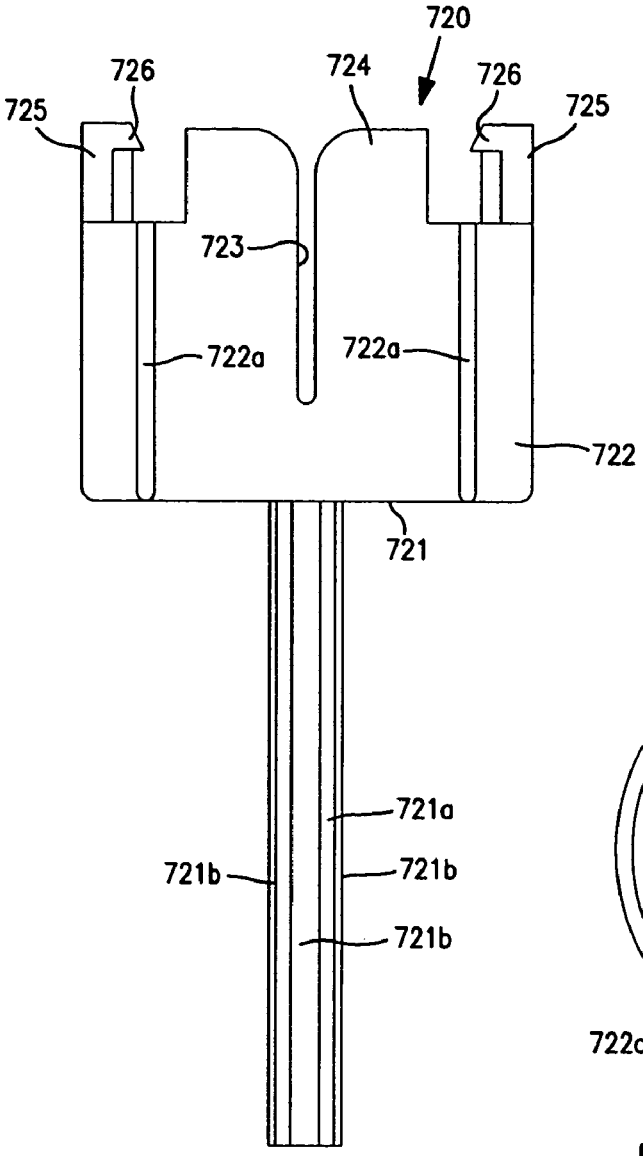
FIG. 33(*a*) is a side view of an ambient air valve.
Figure 33B:
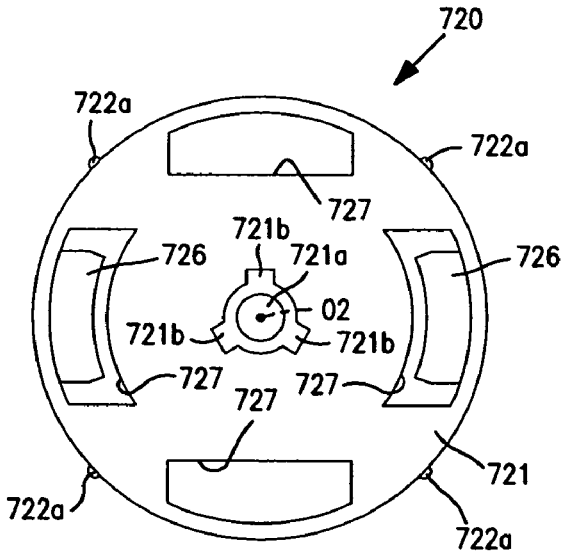

Referring to FIGS. 33(*a*) and 33(*b*), an ambient air valve 720 which is substantially the same as supply valve 620 except that ambient air valve 720 may comprise a valve open portion 721*a* which protrudes from the bottom surface of valve bottom wall 721 and opens the ambient air intake path by contacting the side of multifunction device 1, is depicted. Because ambient air valve 720 is substantially the same as supply valve, valve bottom wall 721, valve outer circumferential wall 722, valve protruding portion 722*a*, valve guide groove 723, valve protrusion wall 724, valve constraining portion 725, valve hook portion 726, ambient air intake path 727, valve bearing portion 728, and valve inner circumferential wall 729 are not discussed in detail.

Ambient air valve 720 may comprise valve open portion 721*a* which protrudes from the bottom surface of valve bottom wall 721. Valve open portion 721*a* may be positioned on axial center O2 of ambient air intake mechanism 510, and substantially may have a rod shape. A substantially semicircular convex portion 721*b* which protrudes from the bottom portion to valve bottom wall 721 in the outer circumferential direction may be provided on the outer circumferential surface of valve open portion 721*a*. Valve open portion 721*a* passes into joint path 715 of ambient air joint 710, and a portion of it may be exposed to the outside of ambient air cap 700. When ink cartridge 14 is installed in multifunction device 1, valve open portion 721*a* contacts the end surface of multifunction device 1, and the contact with joint contact portion 713 of ambient air joint 710 may be broken, thus forming an ambient air intake path.

When ink cartridge 14 is installed in multifunction device 1 and valve open portion 721*a* operates, joint skirt portion 714 of ambient air joint 710 also contacts the end surface of multifunction device 1 and elastically deforms, and this blocks communication between the ambient air intake path and the outside of joint skirt portion 714. Consequently, ambient air which may be introduced from the side of multifunction device 1 may be introduced smoothly. Moreover, even when joint skirt portion 714 elastically deforms toward axial center O2 and contacts valve open portion 721*a*, the ambient air intake path may be secured by convex portion 721*b* of valve open portion 721*a*. It therefore may be possible to prevent the ambient air intake path from being blocked and ensure ambient air is introduced into ink chamber 111 (see FIG. 14).

Figure 34:
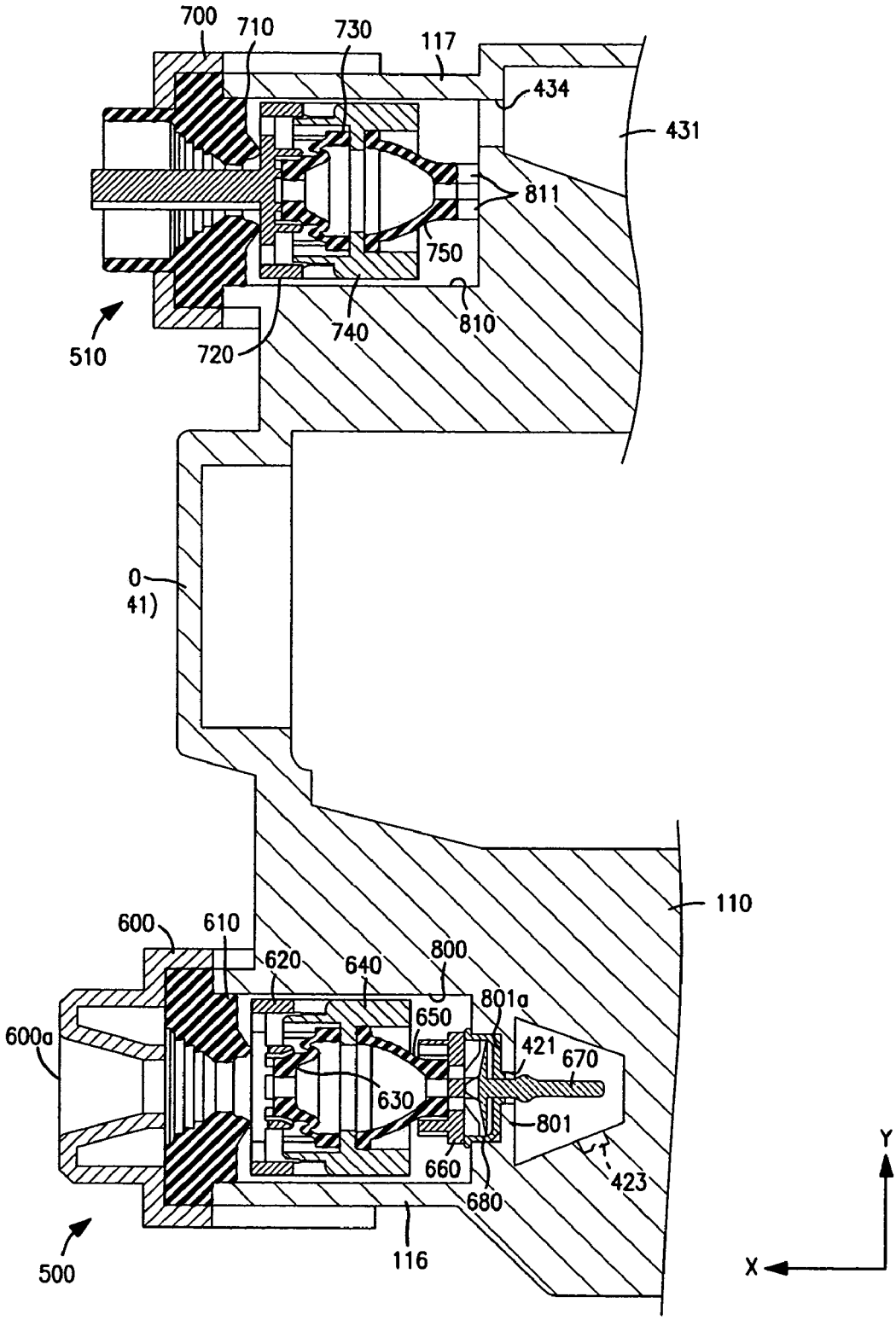
FIG. 34 is a partial, cross-sectional view showing an ink supply mechanism and an ambient air intake mechanism assembled into an ink supply unit and an ambient air intake element, according to an embodiment of the present invention.

Referring to FIG. 34, ink supply mechanism 500 may be inserted into inner circumferential surface 800 of ink supply element 116 and attached to ink supply element 116, and ambient air intake mechanism 510 may be inserted into inner circumferential surface 810 of ambient air intake element 117 and attached to ambient air intake element 117.

A protrusion wall 801 which protrudes in the direction of the inside of inner circumferential wall 800 may be provided on inner circumferential surface 800 of ink supply element 116 on the side of first supply communication opening 421 of supply path forming portion 420, and protrusion wall 801 may have a stepped shape which may house cover 680. Cover 680 may be inserted, such that it contacts stepped surface 801*a* of protrusion wall 801, and the position on the side of first supply communication opening 421 of ink supply mechanism 500 thus may be determined.

Shaft portion 672 of check valve 670 may be inserted into second cover through-opening 684 of cover 680, and valve seat 660 may be arranged, such that it houses check valve 670 within cover 680. Second supply spring 650 may be positioned on the bottom surface side of valve seat 660, and supply slider 640 may be arranged, such that it houses second supply spring 650. First supply spring 630 may be housed by supply slider 640 on the opposite side of second supply spring 650, and first supply spring 630 may be positioned between supply slider 640 and supply valve 620. Moreover, supply joint 610 may be arranged, such that it contacts the bottom surface of supply valve 620, and supply cap 600 may be fastened to the outside of ink supply element 116, such that it contacts the bottom surface of supply joint 610. Supply cap 600 may be fastened as it engages protruding portions 116*a* and 116*b* of ink supply element 116, such that the position on the outside of ink supply mechanism 500 may be determined. Therefore, the position of the direction of axial center O1 of ink supply mechanism 500 may be determined by supply cap 600 and stepped surface 801*a* of inner circumferential surface 800 of ink supply element 116.

The inside diameter of inner circumferential surface 800 of ink supply element 116 may be greater than the outside diameter of supply valve 620, and it may be configured, such that the operation of supply valve 620 in the direction of axial center O1 may be performed smoothly within ink supply element 116. As described above, four valve protruding portions 622*a* may be provided on the outer circumferential surface of supply valve 620, and it may be configured, such that the contact surface with inner circumferential surface 800 may be relatively small. Therefore, even when supply valve 620 operates in a diagonal direction with respect to axial center O1 and contacts inner circumferential surface 800, it may be possible to prevent supply valve 620 from becoming inoperable. Moreover, a gap may be provided between supply valve 620 and inner circumferential surface 800, such that an ink flow path which passes through the inside of ink supply mechanism 500 and an ink flow path which flows through the outside of supply valve 620 are formed. Consequently, inner circumferential surface 800 of ink supply element 116 may be the space which forms the ink flow path chamber.

Slider platform portion 644 may be sandwiched by spring bottom portion 631 of first supply spring 630 and spring bottom portion 631 of the second spring member 650. On the contact side of spring platform portion 644 with spring bottom portion 631 of the second spring member 650, slider platform portion 644 may be engaged by two valve hook portions 626 of supply valve 620, and movement in the direction of axial center O1 thus may be restricted. The space provided between supply valve 620 and supply slider 640 may be shorter than the length of first supply spring 630 in the direction of axial center O1, such that first supply spring 630 may be plastically deformed when it is attached to ink supply element 116.

A protruding portion 811 which protrudes in the direction of ambient air intake mechanism 510 may be provided on inner circumferential surface 810 of ambient air intake element 117 on the end surface of ambient air intake path forming portion 430. Protruding portion 811 may be configured as a pair of plate-shaped members, and it contacts the end surface of spring top portion 752 of second ambient air spring 750. Consequently, an ambient air intake path may be provided between protruding portion 811 and spring top portion 752 of second ambient air spring 750. Moreover, the position of ambient air intake mechanism 510 on the side of first ambient air communication opening 434 may be determined based on second ambient air spring 750 contacting protruding portion 811.

As with ink supply mechanism 500 side, ambient air slider 740 may be positioned on ambient air intake mechanism 510, such that it houses second ambient air spring 750, and first ambient air spring 730 may be housed by ambient air slider 740 on the opposite side of second ambient air spring 750. Moreover, ambient air joint 710 may be arranged, such that it contacts the bottom surface of ambient air valve 720, and ambient air cap 700 may be fastened to the outside of ambient air intake element 17, such that it contacts the bottom surface on the outer circumferential side from joint skirt portion 714 of ambient air joint 710. Ambient air cap 700 may be fastened as it engages protruding portions 117*a* and 117*b* of ambient air intake element 117, such that the position on the outside of ambient air intake mechanism 510 may be determined. Therefore, the position of the direction of axial center O2 of ambient air intake mechanism 510 may be determined by ambient air cap 700 and protruding portion 811.

Moreover, the space provided between ambient air valve 720 and ambient air slider 740 may be shorter than the length of first ambient air spring 730 in the direction of axial center O2, such that first ambient air spring 730 may be plastically deformed when it is attached to ambient air intake element 117.

Figure 35:
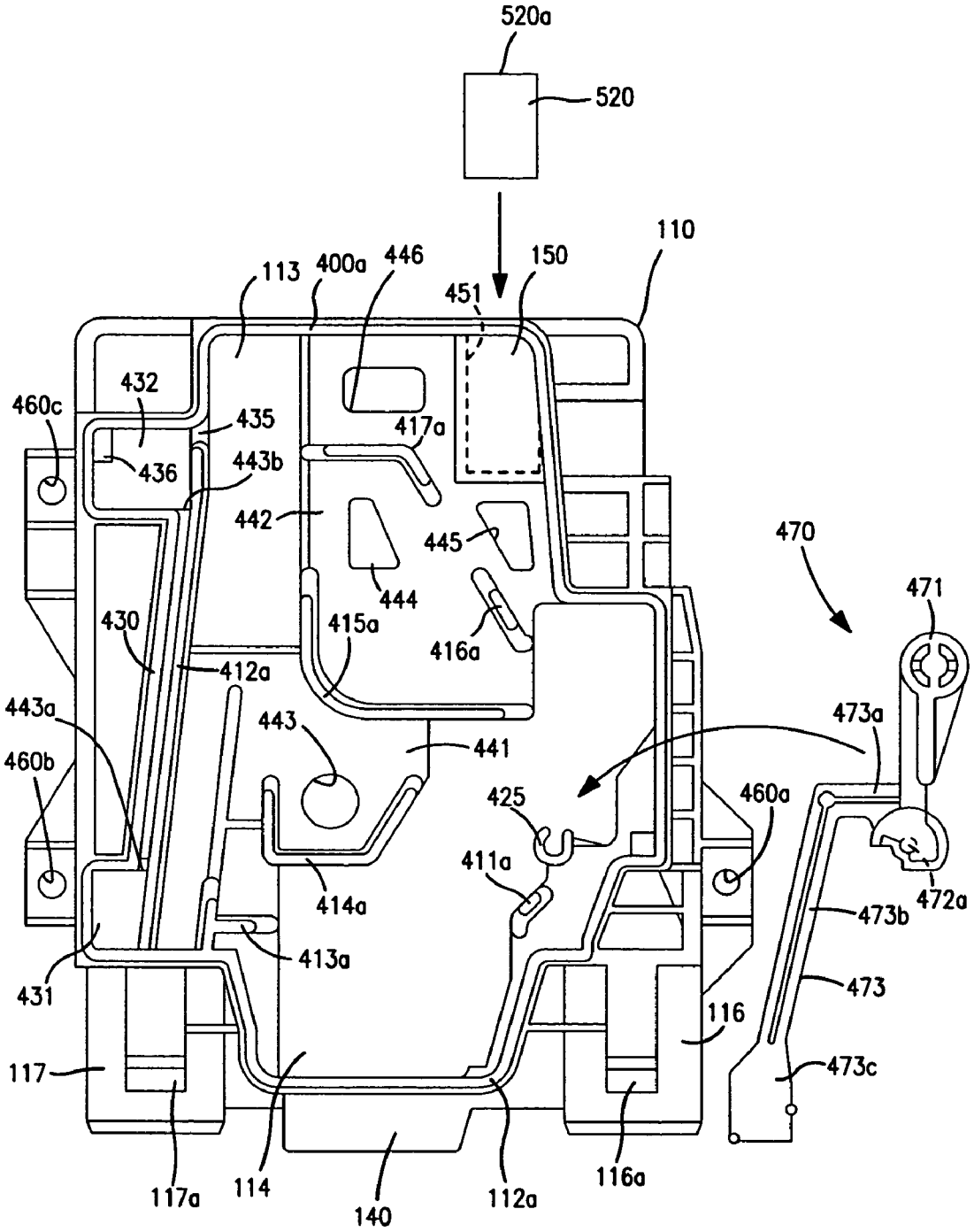
FIG. 35 is a side view of an ink reservoir element showing a manufacturing process of the ink reservoir element prior to welding a film side wall of the ink reservoir element, according to an embodiment of the present invention.

Referring to FIG. 35, in manufacturing of ink cartridge 14, movable member 470 first may be attached to frame portion 110. Frame portion 110 and movable member 470 each may be molded using injection molding in a preliminary process.

In movable member 470, attachment shaft 472*a* which may be provided on pivot portion 472 may be attached to arm sandwiching portion 425 which may be provided in the vicinity of supply path forming portion 420 of frame portion 110. Arm sandwiching portion 425 opens on the opposite side as the side of ink supply element 116. Consequently, movable member 470 may be attached in the range in which first chamber 111*a* and second chamber 111*b* communicate, such that movable member 470 may be efficiently attached with substantially no interference. Moreover, arm portion 473 may be attached, such that blocking arm portion 473*c* may be housed on the inside of translucent detection portion 140. When movable member 470 is attached to arm sandwiching portion 425, the vertical and horizontal range of movement of blocking arm portion 473*c* may be restricted by each wall 141*a*-141*d* of enclosure portion 141 of translucent detection portion 140. Consequently, when ink cartridge 14 is installed in multifunction device 1, an empty ink state may be reliably detected, such that the reliability of the product may be improved.

In this embodiment of the present invention, a supporting portion which forms the axis of rotational operation of movable member 470 may be configured as pivot portion 472 and may be supported on arm sandwiching portion 425 of frame portion 110. Alternatively, an attachment shaft may be provided on the side of frame portion 110 and a sandwiching portion may be provided on the side of movable member 470, or movable member 470 and frame portion 110 may be attached using a hinge junction. Specifically, any attachment structure in which movable member 470 may be attached, such that it may rotate with respect to frame portion 110, may be employed.

When the attachment of movable member 470 is complete, ink dispensing plug 520 may be pressed within dispensing cylinder portion 451 of ink dispensing portion 150. Ink dispensing plug 520 may be pressed, such that outside end surface 520*a* of ink dispensing plug 520 is in substantially the same plane as the outside surface of frame portion 110, and ink dispensing plug 520 may not contact bottom portion 451*b* of dispensing cylinder portion 451. Specifically, first dispensing communication opening 452 of dispensing path forming portion 450 may be provided on the side surface of dispensing cylinder portion 451, and when ink dispensing plug 520 is pressed to the back of dispensing cylinder portion 451, first dispensing communication opening 452 may become blocked, making it impossible to dispense ink. Moreover, ink dispensing plug 520 may be attached before movable member 470 is attached.

Figure 36A:
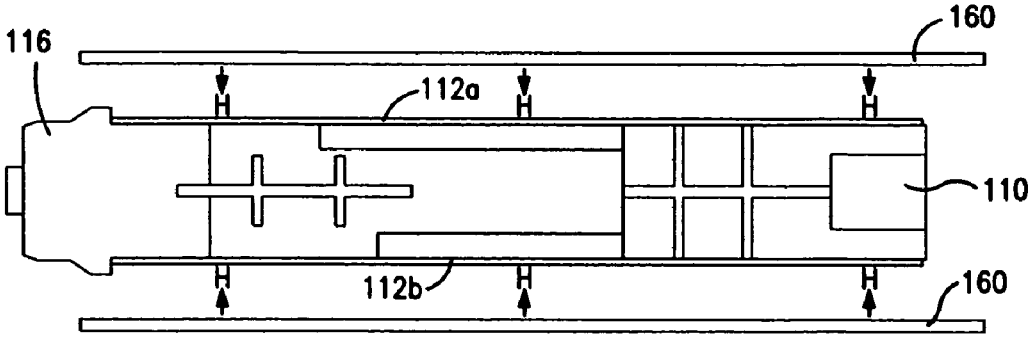
FIG. 36(*a*) is a top view of an ink reservoir element showing the welding surface of film side walls of the ink reservoir element onto a frame portion.
Figure 36B:
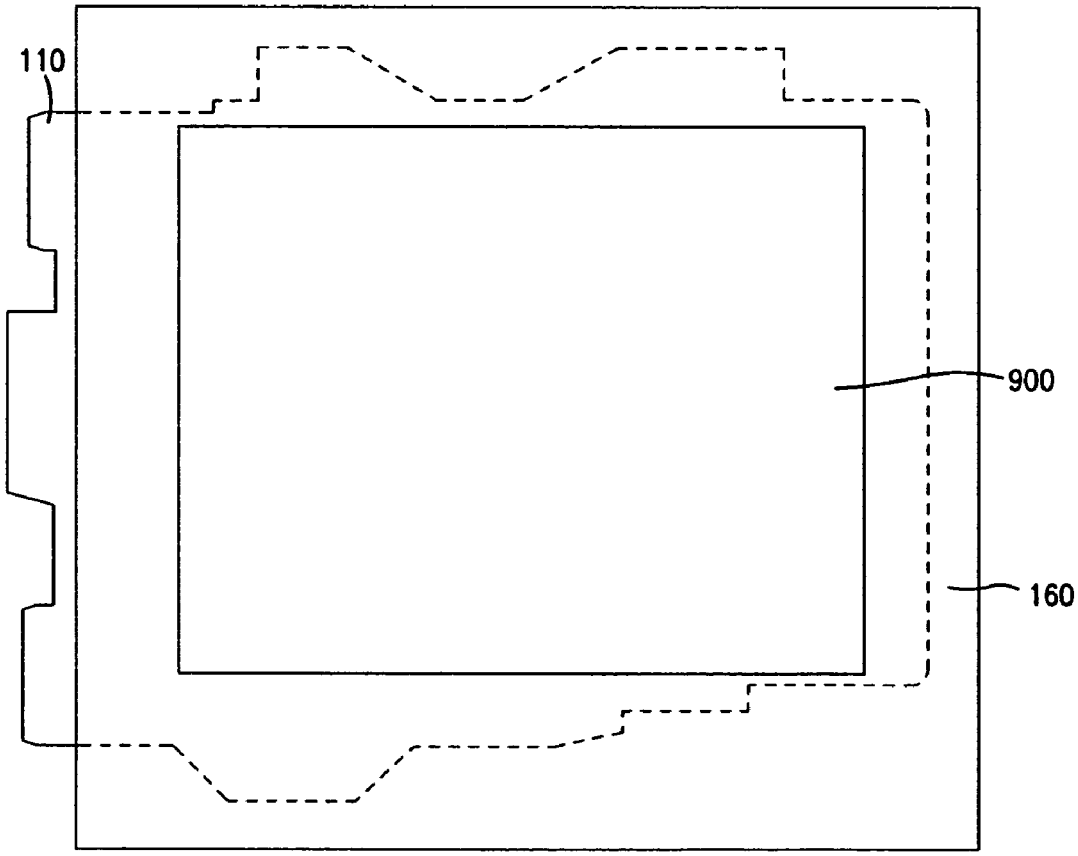

Referring to FIG. 36(*a*), when the attachment of movable member 470 and ink dispensing plug 520 is complete, film 160 may be welded. Film 160 may be welded to frame portion 110, such that it covers both the openings of first opening 112*a* and second opening 112*b*, e.g., film 160 may be welded to both sides of frame portion 110 in two securing processes, a first securing process in which film 160 is welded to first opening 112*a*, and a second securing process in which film 160 is welded to second opening 112*b*.

Referring to FIG. 36(*b*), film 160 may be cut, such that it is larger than the external outline of frame portion 110 it covers frame portion 110. At this time, film 160 may be positioned on first opening 112*a* and second opening 112*b* without wrinkles by aspirating film 160 with an aspirator (not shown) from the side of frame portion 110. A ultrasound welded surface 900 of an ultrasonic welding device (not shown) then may be place on film 160, such that it covers the outer circumference portions of first and second openings 112*a* and 112*b* from the top of film 160, and film 160 may be welded to frame portion 110. When film 160 is welded to each rib portion, the portions painted black in FIG. 37(*a*), i.e., outer circumference rib portions 400*a* and 400*b* and inner circumference rib portions 411*a*-417*a* and 411*b*-417*b*, are welded.

Inner circumference rib portions 411*a*-417*a* and 411*b*-417*b* may be dispersed on frame portion 110 on the inner circumferential side of outer circumference rib portions 400*a* and 400*b*. If ultrasonic welding is performed with respect to all of the rib portions, the structure of ultrasound welded surface 900 becomes complex, and consequently, the manufacturing cost increases. Nevertheless, in this embodiment, ultrasound welded surface 900 of the ultrasonic welding device may be configured, such that it covers all of the rib portions. Consequently, it may be possible to reduce increases in the manufacturing cost of the welding process of film 160.

Moreover, film 160 may comprise a double-layered film comprising a nylon film and a polyethylene film, hereinafter referred to as "nylon polyethylene," and the side which contacts frame portion 110 may be the polyethylene film layer. Nylon polyethylene completely blocks liquids, however, it is relatively gas permeable, such that a small amount of gas circulation may be possible between ink chamber 111 and a packaging bag 930. Consequently, gas which may be present in the ink within ink chamber 111 gradually may pass through film 160 and move into the space provided between enclosure element 930 and case 200, such that the generation of air bubbles within the ink may be prevented. Those of ordinary skill in the art readily will understand that film 160 may comprise any type of substance which is sufficiently strong and is sufficiently gas permeable. For example, a film in which a nylon film and a polypropylene film are provided into two layers, or a film provided by mixing nylon and polyethylene or nylon and polypropylene, may be employed.

Frame portion 110 may comprise a polyethylene resin, and it may comprise the same type of substance as the film of film 160. Because film 160 and frame portion 110 comprise the same material, both film 160 and the rib portions may be fused and welded reliably at the time of ultrasonic welding. In this embodiment, film 160 has a double-layer structure. For example, nylon films may be stronger than polyethylene films, however, their melting point also may be higher, such that they may be difficult to weld at low temperatures. When film 160 has a double-layer structure comprising nylon and polyethylene, film 160 may be sufficiently strong based on the nylon layer and may be welded to frame portion 110 at a relatively low temperature based on the polyethylene layer. Furthermore, the nylon layer may not melt during welding, such that there are fewer changes in the thickness of the film in the vicinity of the rib portions.

Figure 37A:
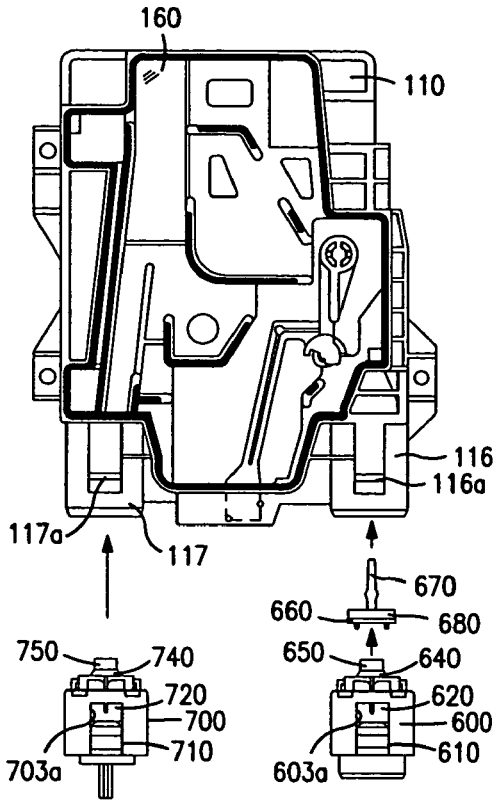
FIG. 37(*a*) is a side view of an ink reservoir element an attachment process for attaching an ink supply mechanism and an ambient air intake mechanism onto a frame portion.
Figure 37B:
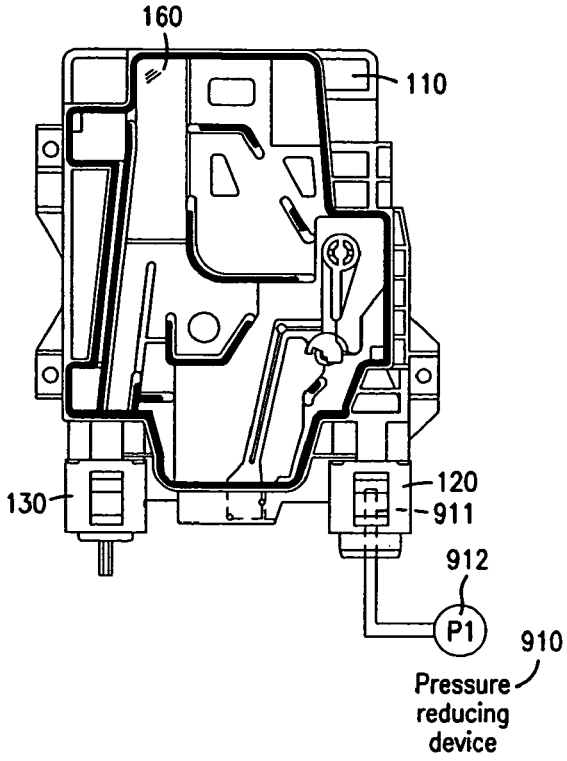
Figure 37C:
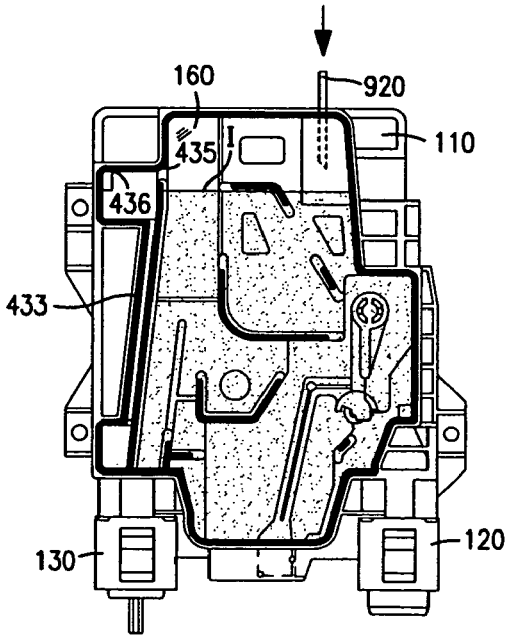

Referring to FIG. 37(*a*), when the welding of film 160 is complete, ink supply mechanism 500 and ambient air intake mechanism 510 are attached to frame portion 110. Ink supply mechanism 500 may be attached to ink supply element 116, and ambient air intake mechanism 510 may be attached to ambient air intake element 117. In the attachment of ink supply mechanism 500, a component in which cover 680, check valve 670, and valve seat 660 are provided as a unit may be inserted within ink supply element 116, e.g., in a position which contacts stepped surface 801*a*. At this time, the tip of check valve 670 may be inserted into first supply communication opening 42, and it may be attached, such that it protrudes into the space enclosed by supply partition wall 422. A component in which supply joint 610, supply valve 620, first supply spring 630, supply slider 640, and second supply spring 650 are provided as a unit within supply cap 600 may be inserted within inner circumferential surface 800 of ink supply element 116, and supply cap 600 may be secured to the outer circumferential surface of ink supply element 116. At this time, supply cap 600 may be pushed in the direction of ink supply element 116, and engagement openings 603*a* and 603*b* of supply cap 600 are engaged with protruding portions 116*a* and 116*b* of ink supply element 116. In supply joint 610, joint inner circumference portion 612 may be pressed within inner circumferential surface 800 of ink supply element 116, and joint outer circumference portion 611 may be sandwiched between ink supply element 116 and supply cap 600. When the attachment of supply cap 600 to ink supply element 116 is complete, the attachment of ink supply mechanism 500 also is complete, and ink supply portion 120 may be fully constructed.

Similar to the attachment of ink supply mechanism 500 to ink supply element 116, the attachment of ambient air intake mechanism 510 to ambient air intake element 117 may be performed in a process in which a component in which ambient air joint 710, ambient air valve 720, first ambient air spring 730, ambient air slider 740, and second ambient air spring 750 are provided as a unit in ambient air cap 700 may be inserted within inner circumferential surface 810 of ambient air intake element 117, and ambient air cap 700 may be fixed to the outer circumferential surface of ambient air intake element 117. At this time, ambient air cap 700 may be pushed to the side of ambient air intake element 117, and engagement openings 703*a* and 703*b* of ambient air cap 700 are engaged with protruding portions 117*a* and 117*b* of ambient air intake element 117. In ambient air joint 710, joint inner circumference portion 712 may be pressed within inner circumferential surface 810 of ambient air intake element 117, and joint outer circumference portion 711 may be sandwiched between ambient air intake element 117 and ambient air cap 700. When the attachment of ambient air cap 700 to ambient air intake element 117 is complete, the attachment of ambient air intake mechanism 510 also is complete, and ambient air intake portion 130 may be fully constructed.

Referring to FIG. 37(*b*), when the attachment of ink supply mechanism 500 and ambient air intake mechanism 510 to supply element 116 and ambient air intake element 117, respectively, is complete, a decompression process in which ink chamber 111 may be decompressed may be performed. In this embodiment of the present invention, the decompression of ink chamber 111 may be performed from the side of ink supply portion 120. In the decompression of ink chamber 111, suction tube 911 of pressure reducing device 910 may be inserted into supply joint 610 of ink supply mechanism 500, and supply valve 620 may be pressed by suction tube 911, thus opening the ink flow path. A suction pump 912 (P1) then may be activated and the ambient air within frame portion 110 may be aspirated. The ambient air within frame portion 110 may be aspirated by pressure reducing device 910, and when it reaches a predetermined pressure, e.g., a pressure which may be less than the ambient pressure, suction pump 912 may be stopped, and suction tube 911 may be removed from ink supply element 120. When suction tube 911 is removed from ink supply portion 120, supply valve 620 contacts joint contact portion 613 of supply joint 610 due to the elastic force of first and second supply springs 630 and 650, and the flow path of the ink thus may be blocked, such that the decompressed state may be maintained.

Referring to FIG. 37(*c*), when the decompression of ink chamber 111 is complete after the decompression process, ink dispensing needle 920 may be inserted into ink dispensing plug 520, and ink is dispensed into ink chamber 111. The inside of ink chamber 111 may be depressurized, such that the ink may be swiftly dispensed into ink chamber 111, and when a predetermined amount of ink has been dispensed, dispensing needle 920 may be removed and the ink dispensing process is completed. The air pressure within ink chamber 111 after ink is dispensed may be a first air pressure p1. Moreover, a predetermined amount of ink may correspond to an amount of ink which is sufficient for liquid surface I of the ink to drop below second ambient air communication opening 435 and third ambient air communication opening 436 of ambient air communication path forming portion 430. Therefore, when ink is dispensed, the penetration of ink into ambient air connection path 433 may be avoided. One reason for not dispensing inside ink chamber 111 until no vacant space is left inside ink chamber 111 may be to prevent damage or deformation to film 160. Moreover, the region below liquid surface I of the ink may be the ink space where ink may be stored, and the space above liquid surface I of the ink and the space containing ambient air communication path forming portion 430 may be the ambient air communication space. Nevertheless, the ink space and the ambient air communication space may change in shape and size depending on the state in which ink cartridge 14 may be positioned and the amount of ink.

Ink is dispensed when the inside of ink chamber 111 is decompressed by pressure reducing device 910, such that even after the dispensing of ink is complete, the air pressure within ink chamber 111 is in the decompressed state, i.e., at air pressure p1. Therefore, a subsequent decompression process may not be necessary after the ink dispensing process. If a subsequent decompression process is not performed, the manufacturing process is simplified. Nevertheless, the air pressure p1 within ink chamber 111 after the ink is dispensed may not necessarily be within a predetermined range. Consequently, in an embodiment of the present invention, a subsequent decompression process may be performed in order to adjust the air pressure to a level within the predetermined range.

The subsequent decompression process may be performed using ink dispensing needle 920 which was inserted into ink dispensing plug 520. For example, a supply device which supplies ink (not shown) and a pressure reducing device which reduces the pressure by aspirating the ambient air within frame portion 110 (not shown) may be connected to ink dispensing needle 920, and once the ink is completely dispensed, the flow path may be switched and decompression by the pressure reducing device may begin. The a third air pressure p3 within ink chamber 111 after subsequent decompression is performed may be less than the air pressure p1 within ink chamber 111 after the ink is dispensed. Therefore, the quantity of gas within ink chamber 111 further decreases, such that the generation of air bubbles within the ink may be prevented. Moreover, the ink which flows in at the time of the ink dispensing process collides with the inside surface within ink chamber 111, such that air bubbles are more likely to be generated, however, the air bubbles generated at this time may be removed. Further, the device also may be configured, such that a decompression needle (not shown) for performing subsequent decompression may be provided separately from ink dispensing needle 920, and decompression may be performed by inserting the decompression needle after removing ink dispensing needle 920.

Referring to FIG. 17, the opening of second dispensing communication opening 454 in dispensing path forming portion 450 may be positioned above liquid surface I of the ink, such that even if subsequent decompression may be performed with a pressure reducing device, the ink may not be aspirated to the outside through the dispensing path. Therefore, the amount of ink which may be dispensed may not change due to subsequent decompression, such that it may be possible to reliably dispense a predetermined amount of ink.

When the dispensing or the decompression of the ink is complete, dispensing plug 520 may be pressed until it contacts bottom portion 451*b* of dispensing cylinder portion 451. Therefore, after ink dispensing plug 520 is pressed to bottom portion 451*b* of dispensing cylinder portion 451, first dispensing communication opening 452 may be blocked by the outer circumferential surface of ink dispensing plug 520, such that even if the dispensing needle is mistakenly inserted again, the ink may not be dispensed.

Figure 38A:
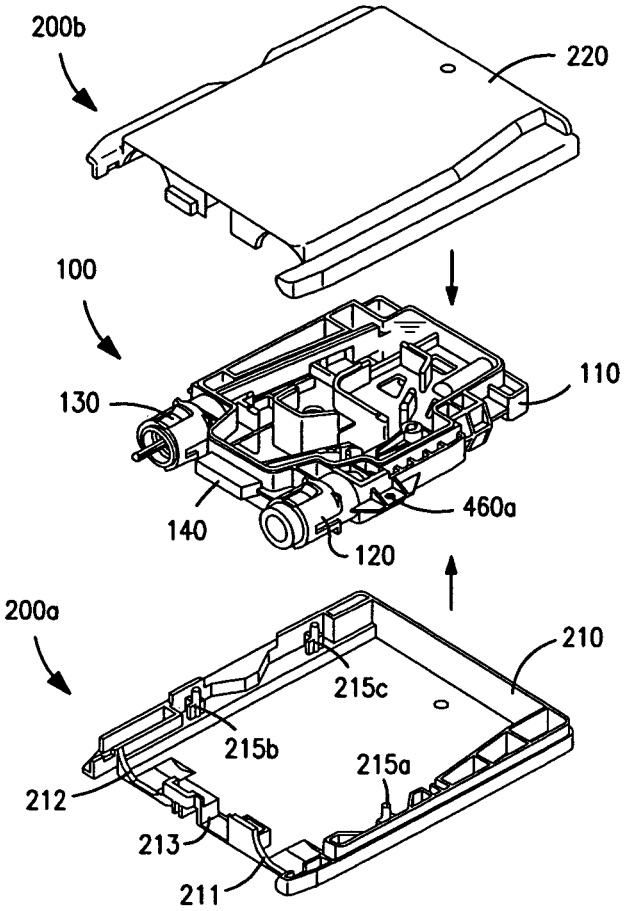
FIG. 38(*a*) is an expanded view of an ink cartridge showing a process of disposing a frame portion within a case.
Figure 38B:
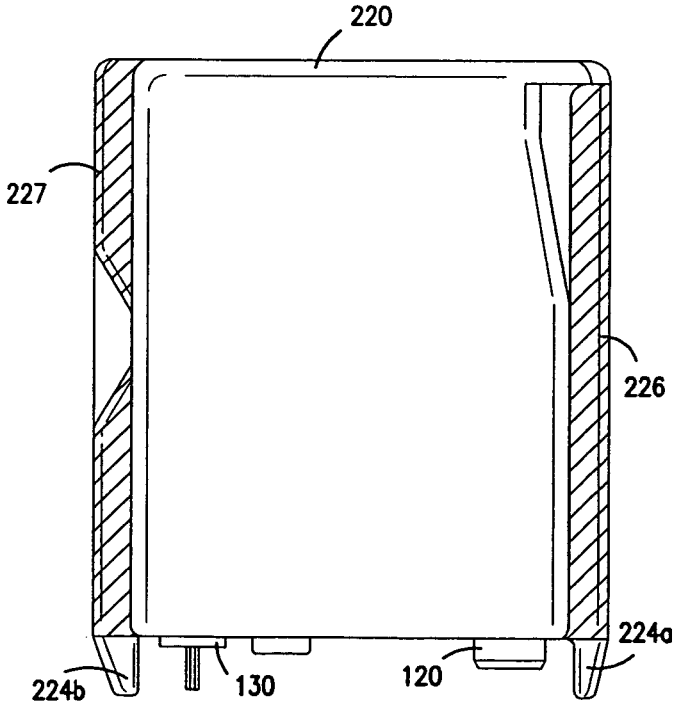

Referring to FIG. 38(*a*), when the dispensing or the decompression of the ink is complete, the manufacture of ink reservoir element 110 also may be complete, such that case 200 may be assembled. Case 200 may be molded by injection-molding, and it may be manufactured in advance.

As described above, in the assembly of cover 200, rod members 215*a*-215*c* of first case member 210 may be inserted into three through-openings 460*a*-460*c* which may be provided on the outer circumference portion of frame portion 100, and ink reservoir element 110 may be installed in first case member 210. At this time, ink supply portion 120 and ambient air intake portion 130 are respectively engaged with case cutout portions 211 and 212, and the outer wall of ink supply portion 120 and the outer wall of ambient air intake element 130 may contact grooves 211*a* and 212*a*. Second case member 220 then may be attached, such that case fitting opening portions 225*a*-225*c* of second case member 220 engage with rod members 215*a* to 215*c* of first case member 210. At this time, ink supply portion 120 and ambient air intake portion 130 are respectively engaged with case cutout portions 221 and 222 of second case member 220, and the outer wall of ink supply portion 120 and the outer wall of ambient air intake element 130 contact grooves 221*a* and 222*a*.

Referring to FIG. 38(*b*), when the assembly of first and second cases 210 and 220 is complete, first and second case members 210 and 220 are welded to each other. In the welding process of first and second case members 210 and 220, first case welded portion 216 of first case member 210 and first case welded portion 226 of second case member 220 are welded together, and second case welded portion 217 of first case member 210 and second case welded portion 227 of second case member 220 are welded together. In this embodiment of the present invention, the entire first and second rib portions 226 and 227 are welded in case 200 welding process, however, alternatively, several spots may be partially welded.

In this embodiment, first and second case members 210 and 220 are assembled after the ink is dispensed into ink reservoir element 100, and first and second case members 210 and 220 are then welded, such that the vibration due to ultrasonic welding may be absorbed by the ink. Therefore, it may be possible to substantially prevent situations in which the rib portions of frame portion 110 or film 160 are damaged, or film 160 peels due to vibration. Moreover, when the rib portions of first and second case members 210 and 220 are partially welded, the generation of vibration due to ultrasonic welding may be further reduced.

Referring to FIG. 38(*b*), case protrusion members 214*a* and 224*a* and case protrusion members 214*b* and 224*b* protrude outward from ink supply portion 120 and ambient air intake portion 130. Therefore, when ink cartridge 14 is installed in inkjet recording device 1, even when ink cartridge 14 is dropped, case protrusion members 214*a*, 214*b*, 224*a*, and 224*b* contact the ground, such that damage to ink supply portion 120 and ambient air intake portion 130 may be prevented. Further, the opening of the ambient air intake path or the ink supply path also may be prevented, such that the leakage of ink may be prevented.

Figure 39A:
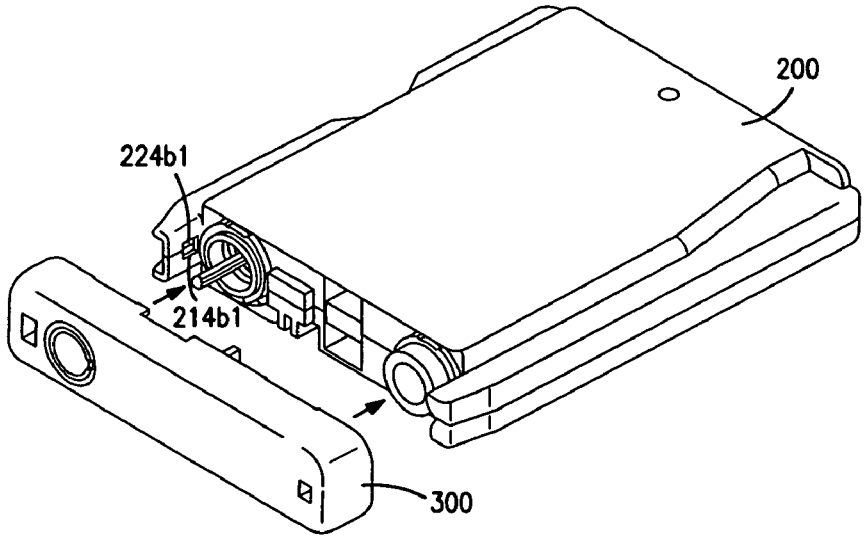
FIG. 39(*a*) is a perspective view of an ink cartridge showing a process for attaching a protective cap to the ink cartridge.
Figure 39B:
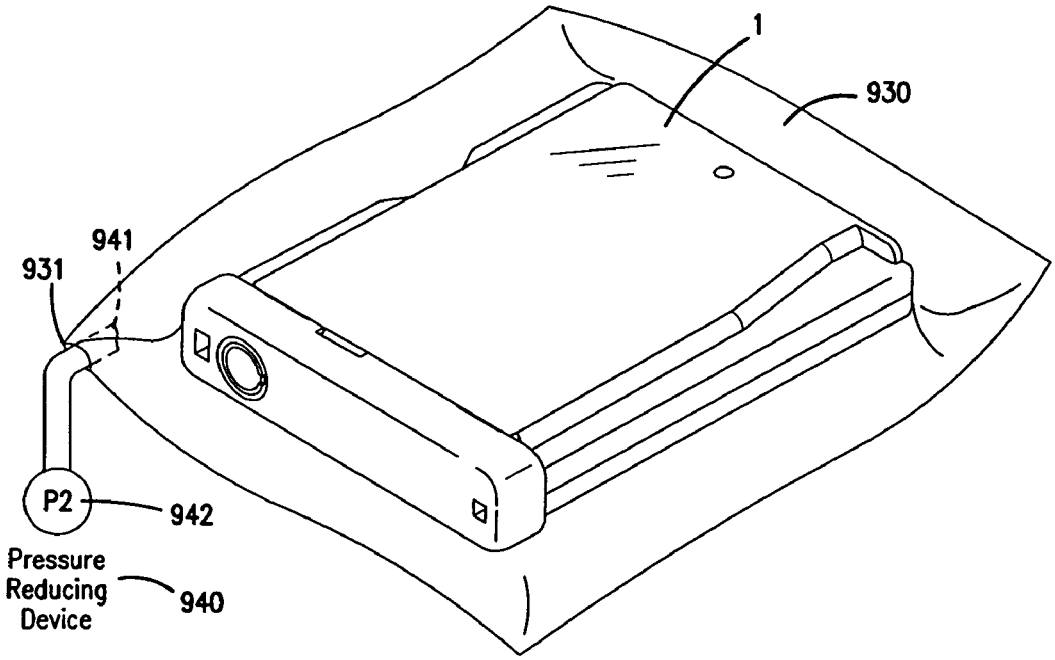

Referring to FIG. 39(*a*), when the welding process of case 200 is complete, protector 300 may be attached to case 200. Protector 300 may be removed when ink cartridge 14 is attached to multifunction device 1, and may be configured, such that it may be freely attached and detached. As described above, protruding portions 330*a*1 and 330*b*1 of protector 300 engage with through-openings provided by case protrusion cutout portions 214*a* and 224*a* of first and second case members 210 and 220 and through-openings provided by case protrusion cutout portions 214*b* and 224*b* of first and second case members 210 and 220, and protector 300 thus may be attached to case 200. Because second protector fitting portions 330*a* and 330*b* of protector 300 elastically deform in directions facing away from each other, protector 300 readily may be attached and detached.

Referring to FIG. 39(*b*), when the attachment of protector 300 is complete, ink cartridge 14 may be housed within packaging bag 930 in order to ship ink cartridge 14. The inside of packaging bag 930 then may be decompressed by pressure reducing device 940. Packaging bag 930 may be a bag element with one open end, and in the packaging process, all of the other opened portions excluding opening 931 are ultrasonically welded in a state in which ink cartridge 14 is enclosed. Suction tube 941 of pressure reducing device 940 may be inserted through this opening 931, and the ambient air within of packaging bag 930 may be aspirated and reduced by activating suction pump 942 (P2). The air pressure of packaging bag 930 due to decompression may be at a level which is lower than the ambient pressure, however, it may be reduced, such that it becomes a second air pressure p2 which may be lower than air pressure p3. When decompression by pressure reducing device 940 is complete, suction tube 941 may be removed and opening 931 may be welded, such that ink cartridge 14 may be shipped. The relationship between air pressures p1 to p3 may be the relationship p2<p3<p1. In an embodiment of the present invention, the relationship between air pressure p1 and p2 may be p1−p2 is greater than or equal to about 3 Kilopascals, e.g., between about 9 Kilopascals about 18 Kilopascals, such that ratio between air pressures p1 and p2 is between about 0.81 and 0.9. For example, air pressure p1 may be between about −77 Kilopascals and −83 Kilopascals, and air pressure p2 may be between about −92 Kilopascals and −95 Kilopascals.

Because the air pressure within packaging bag 930 may be lower than the air pressure within ink chamber 111, film 160 of ink cartridge 14 may be plastically deformed on the side of packaging bag 930. If the air pressure within packaging bag 930 is greater than the air pressure within ink chamber 111, film 160 may harden and lose flexibility, or may be damaged when the inside of ink chamber 111 is decompressed, e.g., when ink cartridge 14 is not used for a substantial period of time. When film 160 loses flexibility, the shape of ink chamber 111 may not change, and the air pressure becomes non-uniform, such that ink may not be accurately supplied. Moreover, when film 160 is damaged, the ink within ink chamber 111 flows to the outside of ink cartridge 14. Nevertheless, in this embodiment, the inside of packaging bag 930 may be decompressed, such that the air pressure may be lower than the air pressure within ink chamber 111, such that film 160 may be deformed on the side of packaging bag 930. Therefore, even when ink cartridge 14 is not used for a substantial period of time, it may be possible to prevent the damage of film 160 and to prevent loss of flexibility of film 160.

Because the air pressure within of packaging bag 930 may be lower than the air pressure within ink chamber 111, gas which remains within ink chamber 111 may be gradually moved outside ink chamber 111 based on film 160 comprising nylon polyethylene or the like, which may be relatively gas permeable, as described above in detail.

In this embodiment, ink cartridge 14 may be packaged in packaging bag 930 and decompressed when protector 300 is attached to case 200, such that it may not make direct contact with ambient air intake portion 130 or ink supply portion 120 as packaging bag 930 deforms due to decompression. Valve open portion 721*a* protrudes to the outside of ambient air intake portion 130, such that if packaging bag 930 makes direct contact with valve open portion 721*a*, valve open portion 721*a* operates and the ambient air intake path may be opened. If the ambient air intake path is opened, the ink within ink chamber 111 leaks out. Moreover, ambient air intake portion 130 and ink supply portion 120 may be damaged in step with the deformation of packaging bag 930. Nevertheless, in this embodiment of the present invention, protector 300 may be attached to case 200, such that the damage of ambient air intake portion 130 and ink supply portion 120 may be prevented, and the opening of the ambient air intake path may be prevented.

As described above, ink cartridge 14 may be manufactured in a process in which case 200 is welded over ink reservoir element 100 after ink is dispensed within ink chamber 111 of frame portion 110. In some known ink cartridges, ink is dispensed from outside the case after the ink reservoir element is covered with the case. With, such a known ink cartridge, it is necessary to prepare a frame and a case according to the amount of ink stored and the color of the ink. Nevertheless, in this embodiment, case 200 may be covered after ink is dispensed into ink chamber 111 of ink reservoir element 100, such that common portions may be used for ink reservoir element 100, thereby reducing the manufacturing cost of ink cartridge 14.

Moreover, in ink cartridge 14, ink dispensing portion 150 may be concealed by case 200, such that it may not be seen from the outside, and problems associated with ink spilling if the user removes ink dispensing plug 520 may be prevented. When ink cartridge 14 is attached to multifunction device 1, packaging bag 930 first may be broken, and ink cartridge 14 then may be removed from the inside of packaging bag 930. This may be done after protector 300 is removed from case 200. The direction in which each ink cartridge 14 may be installed into multifunction device 1 may be the same.

Figure 40A:
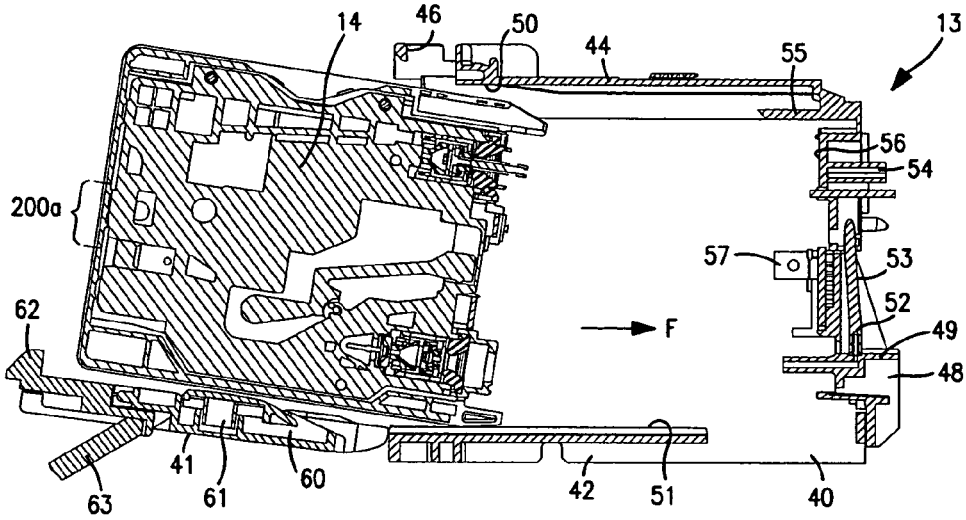
FIGS. 40(*a*)-40(*c*) are cross-sectional views of an ink cartridge and a multifunction device showing a method of attaching the ink cartridge to the multifunction device, according to an embodiment of the present invention.
Figure 40B:
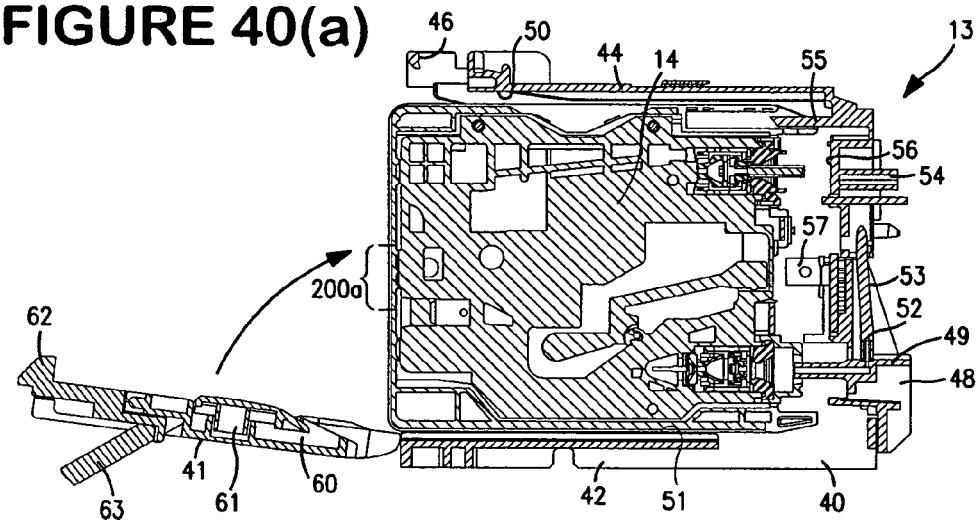
Figure 40C:
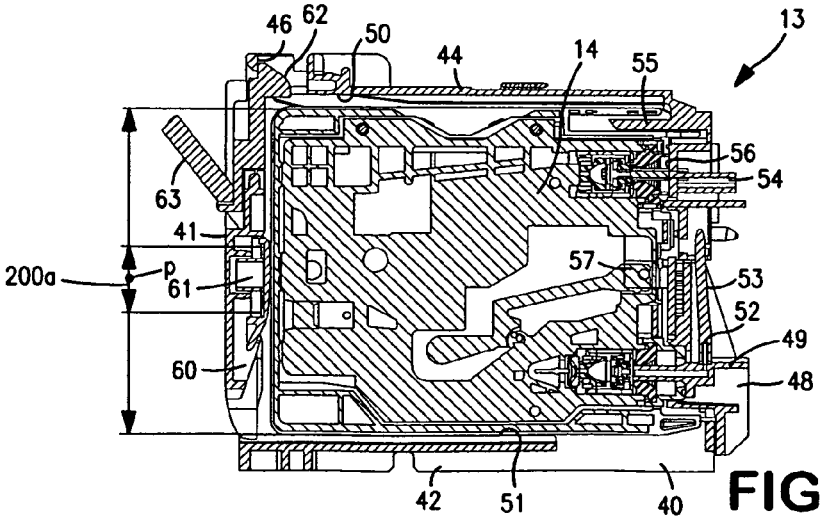

Referring to FIG. 40(*a*), in refill unit 13, needle 49 may be provided at a lower portion of the side of back surface 56 of case 40, and needle 49 protrudes along installation direction F of ink cartridge 14. Referring to FIG. 40(*c*), installation direction F may be parallel to the longitudinal direction of ink cartridge 14 which may be installed into refill unit 13. Ink detection sensor 57 may be provided above needle 49. Ink detection sensor 57 may have a substantially left-facing horseshoe shape, and the open end of the horseshoe shape may be light emitting portion 57*a* which emits light, and the other end may be light receiving portion 57*b* which receives light. Light emitting portion 57*a* and light receiving portion 57*b* are respectively inserted into through-openings provided by case cutout portions 213 and 223 and translucent detection portion 140, and are attached, such that they protrude from back surface 56. Ink detection sensor 57 may be configured, such that it may not output a signal to a control unit provided on multifunction device 1 when light receiving portion 57*b* receives light which is emitted from light emitting portion 57*a* and may output a signal to the control device when light which is emitted from light emitting portion 57*a* is blocked and is not received by light receiving portion 57*b*.

Referring again to FIG. 40(*a*), when ink cartridge 14 is installed in multifunction device 1, ink cartridge 14 may be installed, such that ink supply portion 120 is located below ambient air intake portion 130. This state may be the installation position of ink cartridge 14.

Moreover, when ink cartridge 14 is installed in multifunction device 1, ink supply portion 120, translucent detection portion 140, and ambient air intake portion 130 are sequentially positioned from bottom to top, and ink supply portion 120, translucent detection portion 140, and ambient air intake portion 130 may be provided on a single end surface. Referring to FIG. 40(*b*), the single end surface may be the one side surface of case 200 positioned in the front in installation direction F when ink cartridge 14 is in the installation position. Therefore, because ink supply portion 120, translucent detection portion 140, and ambient air intake portion 130 are provided, such that they are focused, e.g., positioned adjacent to each other, on a single end surface, ink detection sensor 57, needle 49, and path 54, which are on the side of multifunction device 1, may be consolidated on a single surface, e.g., back surface 56. If ink supply portion 120 were provided on the bottom surface of ink cartridge 14, and translucent detection portion 140 and ambient air intake portion 130 were provided on the side surface of ink cartridge 14, it may become necessary to provide needle 49 on the bottom surface side of case 40 of refill unit 13, and to provide ink detection sensor 57 and path 54 on the side of the side surface, e.g., back surface 56, of case 40, which may increase the size of multifunction device 1. Nevertheless, in this embodiment, these portions are consolidated, such that the size of multifunction device 1 may be reduced.

Ink supply portion 120 and translucent detection portion 140 may be sequentially provided on the single end surface from top to bottom, and by using movable member 470 for detecting ink, the ink may be used to the fullest extent. For example, when the amount of ink is detected by irradiating a portion of the ink cartridge using a photo-detector, if a method in which the presence of ink may be detected directly were used, the ink could not be fully used with a configuration in which the ink supply opening and the irradiated portion which may be irradiated by photo-detector are both provided on a single end surface, as in this embodiment. Specifically, if the irradiated portion is positioned below the ink supply opening, the position of the ink supply opening becomes relatively high, such that ink which is stored below the ink supply opening may not be used. Conversely, if the irradiated portion is positioned above the ink supply opening, the position of the irradiated portion becomes relatively high, such that a significant quantity of ink may be inside the ink cartridge when the photo-detector detects the absence of ink. Nevertheless, in this embodiment, movable member 470 may be used, such that even when the irradiated portion is provided in a relatively high position, the absence of ink may be detected in step with the timing in which the actual amount of ink becomes low, and the ink supply opening may be provided in a low position, such that there may be an insignificant amount of ink inside the ink cartridge when the absence of ink is detected.

Referring again to FIG. 40(*a*), ink cartridge 14 may be installed in a process in which case protruding portions 214*a* and 224*a* of case 200 are inserted to slide on door main body 60, and the back surface of ink cartridge 14 may be pushed in installation direction F until most of ink cartridge 14 is inserted into refill unit 13. Moreover, as described above, sloping surfaces 214*a*2 and 224*a*2 may be provided on case protrusion members 214*a* and 224*a*, such that ink cartridge 14 may be smoothly inserted due to sloping surfaces 214*a*2 and 224*a*2, and a portion of the back surface of ink cartridge 14 may be push portion 200*a*, such that it contacts pressing retaining member 61.

Referring to FIG. 40(*b*), when ink cartridge 14 is pushed within refill unit 13 in installation direction F, protrusion 55 may be fitted into a groove provided by case protruding grooves 214*b*2 and 224*b*2. Further, the tip of needle 49 may be positioned within supply cap 600 of ink supply portion 120. The movement of ink cartridge 14 in the horizontal direction may be restricted by protrusion 55 and protruding grooves 214*b*2 and 224*b*2, and the movement in the vertical direction may be restricted by bottom plate portion 42 and ceiling plate portion 44 of refill unit 13, such that it may be possible to prevent ink cartridge 14 from being inserted diagonally and to prevent ink detection sensor 57 and needle 49 from being damaged.

When door member 60 is rotated from the state of FIG. 40(*b*) in the direction of the arrow shown in FIG. 40(*b*), pushing retaining member 61 of door member 60 contacts push portion 200*a* forming a portion of the back surface of ink cartridge 14, and pushes ink cartridge 14 in the installation direction F. As door member 60 is rotated further, door lock member 62 of door member 60 fits into lock member fitting portion 46 of refill unit 13, completing the installation of ink cartridge 14, as shown in FIG. 40(*c*). The middle point p illustrated in FIG. 40(*c*) may be the central position in the vertical direction of ink cartridge 14. The position where pushing retaining member 61 pushes push portion 200*a* may be a position including the middle point p of ink cartridge 14 and extending below the middle point p. Specifically, push portion 200*a* may be provided at a position above ink supply portion 120 and below ambient air intake portion 130 in the vertical direction. Moreover, when the state of FIG. 40(*c*) is reached, the tip of swing arm mechanism 44*b* fits into latch portions 217*a* and 227*a* and retains ink cartridge 14.

Once installation of ink cartridge 14 is complete, needle 49 may be inserted into ink supply portion 120 and ink supply may be enabled, valve opening portion 721*a* of ambient air intake portion 130 contacts back surface 56 of case 40, thereby enabling intake of ambient air, and ink detection sensor 57 may be inserted through the through-opening provided by case cutout portions 213 and 223 and translucent detection portion 140, thereby enabling detection of the remaining quantity of ink.

Furthermore, because ink sensor 57 may be inserted through the through-opening provided by case cutout portions 213 and 223 and translucent detection portion 140 when ink cartridge 14 is installed in refill unit 13, light emitting portion 57*a* and light receiving portion 57*b* of ink detection sensor 57 become positioned within case 200. Thus, it becomes possible to prevent damage to ink detection sensor 57, and to prevent misdetection of ink due to dirt, dust, or the like adhering to light emitting portion 57*a* and light receiving portion 57*b*.

Moreover, because pushing retaining member 61 may be impelled by coil spring 66, it may stably retain ink cartridge 14. When ink cartridge 14 has been installed in refill unit 13, the elastic force of spring members 630, 650, 730 and 750 of ink supply mechanism 500 and ambient air intake mechanism 510 act in the direction away from the side on which needle 49 is arranged. As described above, pushing retaining member 61 may be configured to have a greater elastic force than the elastic force generated by spring members 630, 650, 730 and 750, and thus, may be able to stably retain ink cartridge 14 once it has been installed. Furthermore, push portion 200*a* which may be depressed by pushing retaining member 61 may be located substantially in the middle between ink supply portion 120 and ambient air intake portion 130, thereby allowing a substantially uniform elastic force to be applied to ink supply portion 120 and ambient air intake portion 130. Specifically, ink cartridge 14 may be retained at three points in the installation direction of ink cartridge 14, e.g., at a first point at the front of refill unit 13, and at a pair of second points at the back of refill unit 13, with the imaginary line linking these three points forming substantially an isosceles triangle shape. Thus, retaining ink cartridge 14 by three points allows ink cartridge 14 to be retained stably. Furthermore, because the elastic force of pushing retaining member 61 may be used to retain ink cartridge 14, the load on the surface of ink cartridge 14 decreases relative to when ink cartridge 14 is secured by engagement with its surface. Thus, it becomes possible to prevent damage to ink cartridge 14 through excessive loads being applied to ink cartridge 14.

In addition, because pushing retaining member 61 pushes below the middle position, e.g., midpoint p, in the height direction of ink cartridge 14, a large force may not be needed to operate door member 60, making it possible to stably retain ink cartridge 14 at a predetermined position. The pivot of rotation of door member 60 may be located at a lower portion of case 40, and the user performs the operation of opening and closing the door member by manipulating the edge portion of door member 60. Thus, if push portion 200*a* is positioned at the upper portion of the back surface of ink cartridge 14, the point of action at which pushing retaining member 61 pushes ink cartridge 14 will be at a distance from the pivot of rotation of door member 60, thus requiring a large force for the user to close the door member. In contrast, if push portion 200*a* is positioned at the lower portion of the back surface, for instance below ink supply portion 120, the user will be able to close the door member with minimum force, however, because a point at the lower portion of ink cartridge 14 may be pushed, ink cartridge 14 may rotate and be pushed in at an angle, such that needle 49 may not be inserted accurately into ink supply portion 120. Nevertheless, according to an embodiment of the present embodiment, because push portion 200*a* may be positioned below the middle position of ink cartridge 14 in the height direction and above the position corresponding to ink supply portion 120, a large force may not be required to operate the door member, making it possible to stably install the ink cartridge at the predetermined location.

Figure 41:
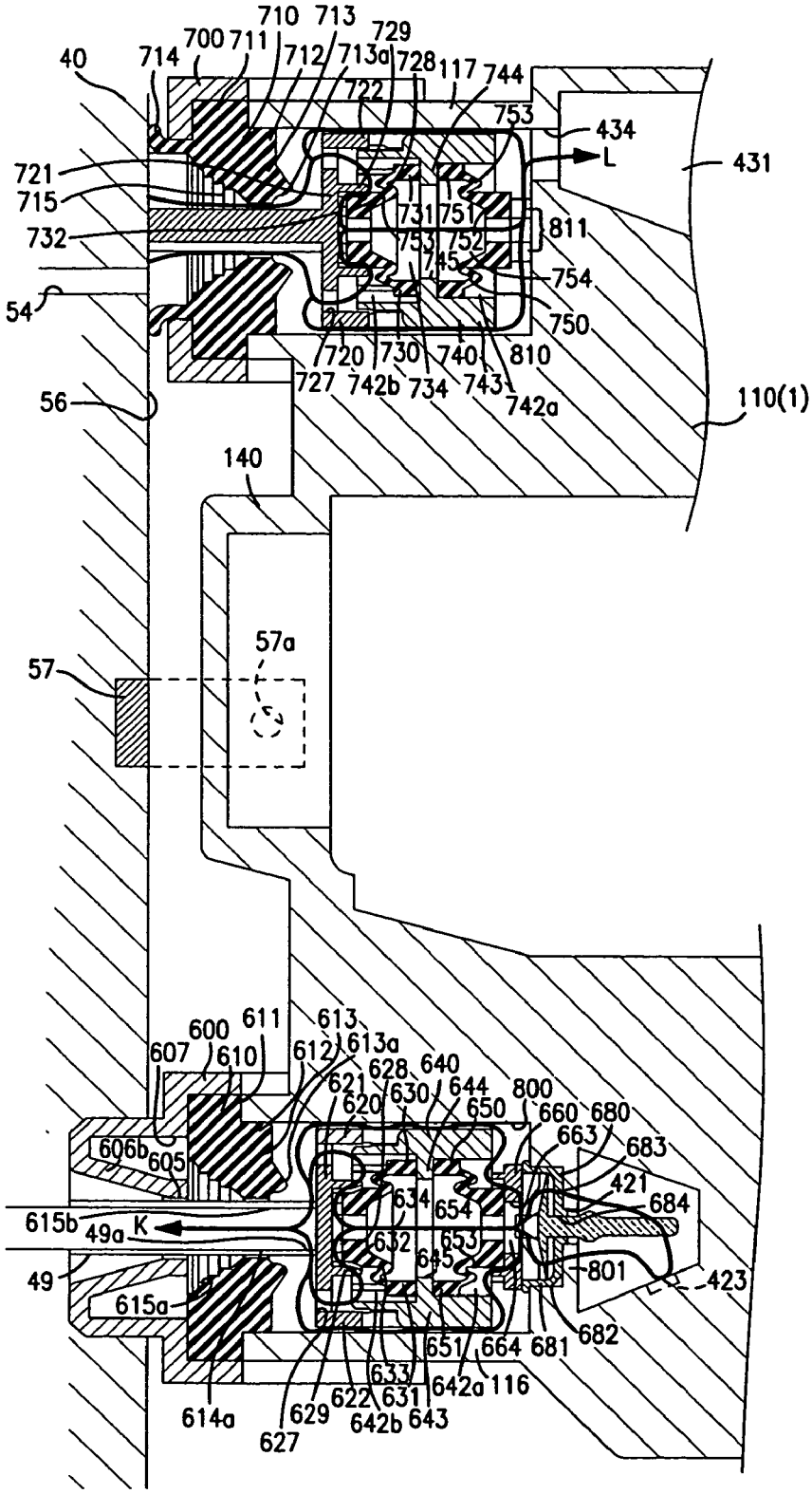
FIG. 41 is a cross-sectional view of an ink cartridge which is attached to a multifunction device, according to an embodiment of the present invention.

Referring to FIG. 41, when ink cartridge 14 is installed in multifunction device 1, light emitting portion 57*a* and light receiving portion 57*b* of ink detection sensor 57 are positioned at positions sandwiching translucent detection portion 140. Translucent detection portion 140 may comprise a translucent or a transparent resin material, allowing the light emitted from light emitting portion 57*a* of ink detection sensor 57 to pass through translucent detection portion 140 and be received by light receiving portion 57*b*. Because blocking arm portion 473*c* of movable member 470 may be positioned in enclosure portion 141 of translucent detection portion 140, the ink quantity may be detected by the operation of movable member 470.

When ink cartridge 14 is installed in multifunction device 1, needle 49 may be inserted through the space surrounded by sloping wall 606*d*, insertion opening 605, and ink flow path 615 of supply joint 600, and the tip of needle 49 contacts valve bottom wall 621, depressing supply valve 620. Consequently, supply valve 620 moves away from joint contact portion 613, thereby forming an ink flow path. Needle 49 communicates with a discharge opening (not shown) of multifunction device 1 via ink extraction opening 52 and ink tube 53. Furthermore, a cutout 49*a* may be provided in the tip of needle 49 for securing an ink flow path, such that the ink flow path may be secured by cutout 49*a* even when the tip of needle 49 contacts valve bottom wall 621.

With respect to ink supply mechanism 500, first supply spring 630 housed within supply valve 620 has a slightly flexed spring flexible portion 633, and there may be no flexing in spring flexible portion 653 of second supply spring 650 positioned on the opposite side of supply slider 640 from first supply spring 630, which may allow for the determine the flexing order of first and second supply springs 630 and 650. Specifically, first supply spring 630 with flexed spring flexible portion 633 flexes more readily than second supply spring 650, such that when needle 49 is inserted, first supply spring 630 flexes first, and second supply spring 650 flexes thereafter.

The height of ink supply mechanism 500 in the direction of axis O1 may have a dimensional error from the manufacturing of the various components of ink supply mechanism 500, such that the more components that are included in ink supply mechanism 500, the more likely there will be a dimensional error. Nevertheless, because supply slider 640 may be brought into contact with valve hook portion 626 of valve member 610, at least the error in the dimensions of first supply spring 630 becomes substantially irrelevant.

Moreover, the inside diameter of valve outer circumferential wall 622 of supply valve 620 and the outside diameter of slider outer circumferential wall 641 of supply slider 640 may be substantially equal. Thus, it becomes possible to prevent the occurrence of misalignment in the direction of displacement when supply slider 640 operates in the direction of axis O1 of ink supply mechanism 500. Furthermore, the inside diameter of slider outer circumferential wall 641 and the outside diameter of spring bottom portions 631 and 651 of first and second supply springs 630 and 650, respectively, also may be substantially equal. Thus, it becomes possible to reduce misalignment in the direction orthogonal to axis O1 when first and second spring members 630 and 650 are positioned on slider pedestal portion 644 of supply slider 640. In addition, although the external shape of valve outer circumferential wall 622 of supply valve 620 may be less than the inside diameter of ink supply element 116, because valve protruding portion 622*a* may be provided outward from valve outer circumferential wall 622 of supply valve 620, it becomes possible to prevent misalignment in the direction of displacement when supply valve 620 operates in the direction of axis O1. Therefore, telescoping operation in the direction of axis O1 becomes more stable.

Moreover, when valve bottom wall 621 of supply valve 620 is depressed by needle 49 and moves in the direction of valve seat 660, first supply spring 630 may be flexibly deformed so as to become compressed, whereupon supply slider 640 moves in the direction of valve seat 660 and the second supply spring undergoes flexible deformation.

Once ink cartridge 14 is installed in case 40 of multifunction device 1, first and second supply springs 630 and 650 also undergo elastic deformation, forming an ink communication path, the flow through which is indicated by arrow K. The ink communication path may be a flow path provided between ink chamber 111, second supply communication opening 423, first supply communication opening 421, first cover through-opening 683, second cover through-opening 684, first valve seat through-opening 662*b*, and second valve seat through-opening 663, valve seat communication groove 664, ink flow path 654, slider through-opening 645, ink flow path 634, first spring member 930, and valve bearing portion 628, and may be a flow path which leads successively through ink flow path 627, cutout 49*a* of needle 49, and the inside of needle 49. A central axis of the ink communication path may be aligned with the central axis of ink supply chamber 426. Moreover, the space between valve outer circumferential wall 622 of supply valve 620 and the inner circumferential surface of ink supply member 116 also may be an ink flow path.

When needle 49 is press-fitted into protruding portion flow path 615*b* through step portion flow path 615*a*, joint protruding portion 614 may be pulled by needle 49 due to the friction between its own inner circumferential surface 614*a* and the outer circumferential surface of needle 49, and may be displaced in the direction of insertion of needle 49. In this embodiment of the present invention, joint contact portion 613 may be cut out into a countersunk shape, such that the displacement of joint protruding portion 614 in the direction of insertion of needle 49 may not be transmitted directly to tip 613*a* of joint contact portion 613. Specifically, tip 613*a* of joint contact portion 613 substantially may not be displaced in the direction of insertion, but may be slightly displaced in a direction away from needle 49. Thus, the shape change of supply joint 610 accompanying insertion of needle 49 may be, such that joint contact portions 613 are displaced away from each other. Assuming joint contact portion 613 had a shape with a gently sloping surface going from inner circumferential surface 614*a* of joint protruding portion 614 to tip 613*a* of joint contact portion 613, as needle 49 was inserted, joint protruding portion 614 would deform so as to be displaced in the direction of insertion of needle 49, the deformation of joint protruding portion 614 would be directly transmitted to joint contact portion 613, and joint contact portion 613 would be displaced in the direction of insertion together with joint protruding portion 614. Consequently, the insertion stroke of needle 49 for forming an ink flow path between supply valve 620 and joint contact portion 613 would become longer, such that needle 49 would have to be made longer. Nevertheless, when needle 49 is made longer, it is more likely to be damaged by contact with other members, and the length of ink supply mechanism 500 in the direction of axis O1 becomes longer, thus increasing its size. Nevertheless, in this embodiment of the present invention, because joint contact portion 613 may be displaced in a direction substantially orthogonal to the direction of insertion of needle 49, the stroke for forming an ink flow path does not need to be made long. Thus, it becomes possible to reduce the contact of needle 49 with other members and to reduce the size increase of ink supply mechanism 500.

When ink cartridge 14 is removed from multifunction device 1, needle 49 may be withdrawn, whereupon valve bottom wall 621 of supply valve 620 contacts joint contact portion 613, obstructing the ink communication path. At this time, second supply spring 650 becomes fully stretched, and first supply string 630 returns to a slightly flexed deformed state. When ink cartridge 14 is removed from multifunction device 1, as needle 49 is withdrawn, the ink present in the vicinity of ink flow path 615 of supply joint 610 flows toward ink cap 600, and flows out into step portion flow path 615*a*. Nevertheless, because the quantity of ink which flows into step portion flow path 615*a* may be relatively small, the ink may be retained by the capillary force of step portion of step portion flow path 615*a*, such that the amount of ink which flows to the outside of ink cartridge 14 may be reduced. Furthermore, even when ink flows out from step portion flow path 615*a*, because the opening portion of ink storage portion 602 of supply cap 600 may be wider than opening 612*c* of step portion flow path 615*a*, the ink flowing out flows into ink storing portion 607 of ink supply cap 600. Therefore, it becomes possible to reliably prevent ink from flowing out of ink cartridge 14.

In ambient air intake mechanism 510, when ink cartridge 14 is installed in multifunction device 1, valve opening portion 721*a* of ambient air valve 720 contacts back surface 56 of case 40, depressing ambient air valve 720. Consequently, ambient air valve 720 may move away from joint contact portion 713 of ambient air joint 710, forming an ambient air intake path L. Furthermore, when valve opening portion 721*a* of ambient air valve 720 contacts and is depressed by surface 56, joint stroke portion 714 of ambient air joint 710 contacts back surface 56, and joint skirt portion 714 undergoes flexible deformation so as to expand in diameter. Consequently, it becomes tightly held against back surface 56, blocking the outside and inside of joint skirt portion 714. Moreover, there may be path 54 provided in back surface 56 on the inside of joint skirt portion 714, which serves as a path for taking in ambient air which may be admitted into ink chamber 111 via path 54.

First ambient air spring 730 housed within ambient air valve 720 has a slightly flexed spring flexible portion 733, and there may not be a flexing in spring flexible portion 753 of second ambient air spring 750. Thus, the flexing order also may be determined for first and second ambient air springs 730 and 750.

Furthermore, the inside diameter of valve outer circumferential wall 722 of ambient air valve 720 and the inside diameter of slider outer circumferential wall 741 of ambient air valve 720 may be substantially equal. Thus, the occurrence of misalignment in the direction of displacement when ambient air slider 740 operates in the direction of axis O2 of ambient air intake mechanism 510 may be prevented. In addition, the inside diameter of slider outer circumferential wall 741 and the outside diameters of spring bottom portions 731 and 751 of first and second ambient air spring members 730 and 750, respectively, also may be substantially equal. Thus, it becomes possible to prevent misalignment in the direction orthogonal to axis O2 when first and second ambient air springs 730 and 750 are positioned on slider pedestal portion 744 of ambient air slider 740.

Moreover, although the outside shape of valve outer circumferential wall 722 of ambient air valve 720 may be less than the inside diameter of ambient air intake element 117, because valve protruding portion 722*a* may be provided outward from valve outer circumferential wall 722 of ambient air valve 720, misalignment in the direction of displacement when ambient air valve 720 operates in the direction of axis O2 may be prevented. Therefore, telescoping operation in the direction of axis O2 of ambient air intake mechanism 510 may be stabilized.

When ambient air valve 720 is depressed by valve opening portion 721*a* and moves in the direction of protruding portion 811, first ambient air spring 730 undergoes flexible deformation so as to become compressed, and when ambient air valve 720 is depressed, ambient air slider 740 moves in the direction of protruding portion 811 and second ambient air spring 750 undergoes flexible deformation.

When ink cartridge 14 is installed in case 40 of multifunction device 1, first and second ambient air springs 730 and 750 also undergo elastic deformation, forming an ambient air intake path L. The ambient air intake path L may be a flow path passing successively through the path provided between joint path 715, ink flow path 727, first ambient air spring 730 and valve bearing portion 728, the path provided between ink flow path 734, slider through-opening 745, ink flow path 754, spring top portion 752, and first ambient air communication opening 434. This flow path may be the main flow path through which the majority of ambient air flows. Furthermore, the space between valve outer circumferential wall 722 of ambient air valve 720 and inner circumferential surface 810 of ambient air intake element 117 also forms a portion of the ambient air intake path. Referring to FIG. 16, ambient air subsequently passes through first ambient air communication chamber 431, communication opening 433*a*, ambient air connection path 433, communication opening 433*b*, second ambient air communication chamber 432, second ambient air communication opening 435, and third ambient air communication opening 436, and may be admitted within ink chamber 111. When the ambient air intake path L is opened, air may be taken in, such that the inside of ink chamber 111 may be brought to ambient air pressure.

As described above, the ink communication path and the ambient air intake path L are provided when ink cartridge 14 is installed in multifunction device 1. Furthermore, the operation of ink supply mechanism 500 and ambient air intake mechanism 510 may be, such that they operate smoothly and without misalignment relative to the axes O1 and O2. Thus, ink cartridge 14 readily may be installed, the supply of ink and the intake of ambient air may be carried out reliably.

Figure 42B:
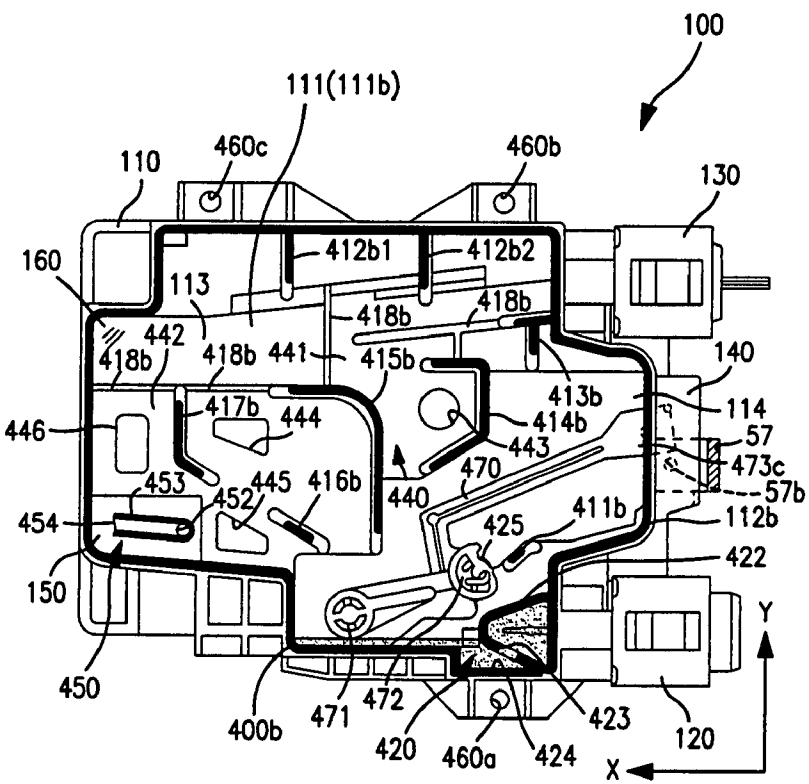
FIG. 42(*a*) is a side view of an ink reservoir element showing the position of a movable member when there is ink within the ink reservoir element.
Figure 42A:
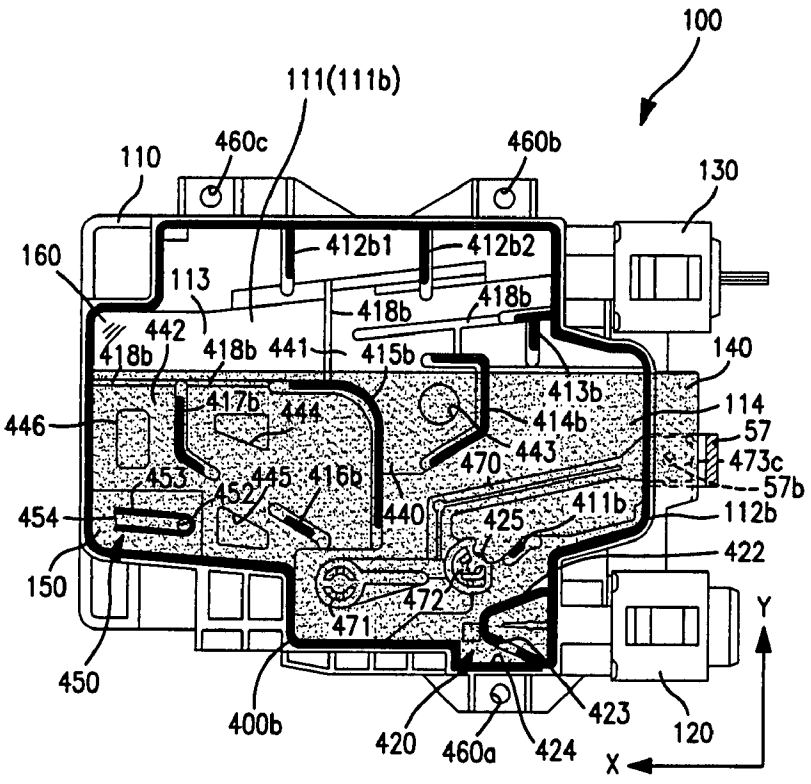
Figure 43:
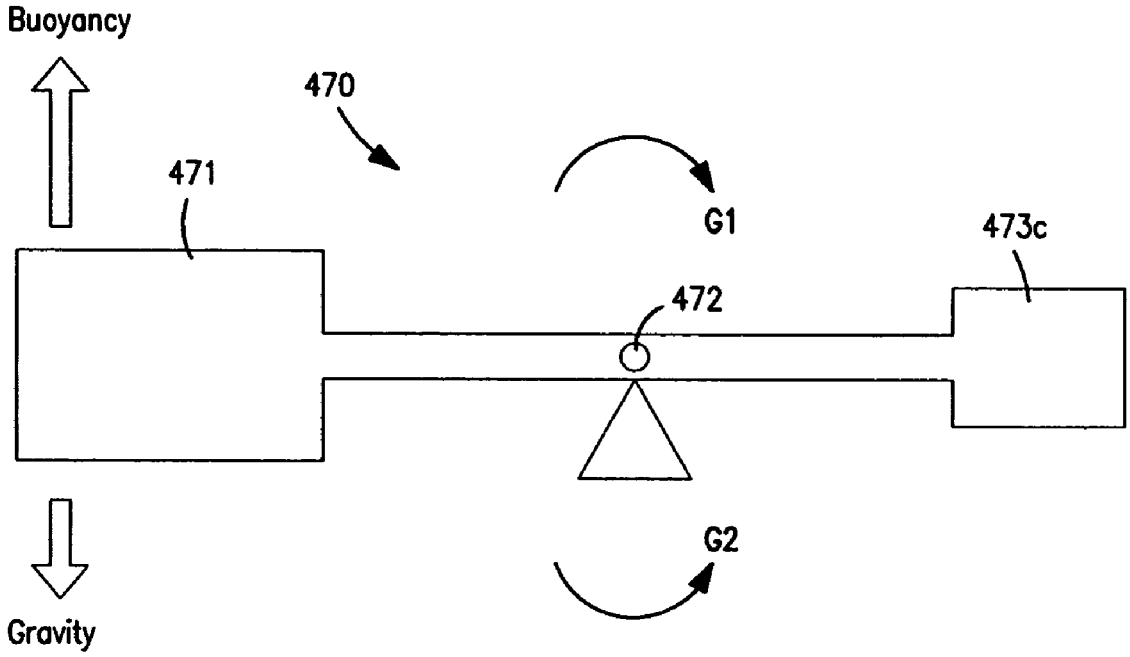
FIG. 43 is a schematic diagram showing an operational theory of the movable member, according to an embodiment of the present invention.

Referring to FIG. 42(*a*), the direction of rotation of movable member 470 may be determined based on the combined force of the buoyancies and gravities acting on the right side portion and the left side portion. Nevertheless, in order to simply the description of movable member 470, it is assumed that all of the forces which act on movable member 470 also act on float portion 471. Based on this assumption, the rotation of movable member 470 is determined by the buoyancy and the gravity acting on float portion 471. Referring to FIG. 42(*a*), when there is a large amount of ink stored in ink chamber 111, because float portion 471 of movable member 470 may comprise resin material with a lower specific gravity than the specific gravity of ink, the buoyancy generated on float portion 471 increases, and float portion 471 floats in the ink. The combined force of gravity and buoyancy generated on float portion 471 causes a rotating force to be received in the clockwise direction. Nevertheless, blocking arm portion 473*c* contacts arm supporting portion 142 which rises from bottom wall 141*a* of translucent detection portion 140, and thus, blocking arm portion 473*c* may be positioned in a position blocking the optical path between light emitting portion 57*a* and light receiving portion 57*b* of ink detection sensor 57.

As the ink within ink chamber 111 passes through the ink communication path and decreases in quantity, the liquid surface I of ink drops. As the liquid surface I of ink drops, blocking arm portion 473*c* emerges on the liquid surface I of ink, and subsequently, float portion 471 also emerges on the liquid surface I of ink. When float portion 471 emerges on the liquid surface I of ink, the buoyancy generated on float portion 471, which causes movable member 470 to rotate in the clockwise direction, and the gravity generated on float portion 471, which movable member 471 to rotate in the counterclockwise direction, balance each other out, such that the overall combined force may be balanced. Subsequently, as the liquid surface I of ink drops further, float portion 471 moves downward following the liquid surface I, such that movable member 470 rotates counterclockwise. The rotating operation causes blocking arm portion 473*c* to move upward away from arm supporting portion 142, and an optical path may be created between light emitting portion 57*a* and light receiving portion 57 of ink detection sensor 57. In this state, a controller (not shown) of multifunction device 1 determines that ink cartridge 14 is out of ink.

Referring to FIGS. 42(*a*) and 42(*b*), as the quantity of ink transitions from a substantial amount of ink to substantially no ink, float portion 471 may transition from an upper position to a lower position adjacent to bottom portion 400*b*1 of ink chamber 111. Thus, when the quantity of ink in ink chamber 111 is low, an out-of-ink discrimination accurately may be detected.

Referring to FIG. 42(*b*), in the out-of-ink state, there still may be some ink left within ink chamber 111. The ink surface I at this time may be slightly higher than portion 400*b*1 forming the bottom of ink chamber 111. Furthermore, as discussed above, ink chamber 111 and ink supply portion 120 communicate via ink supply chamber 426 delimited by supply partition wall 422, and ink chamber 111 and ink supply chamber 426 communicate via second supply communication opening 423 positioned below bottom portion 400*b*1 provided on supply partition wall 422. When the liquid surface I of ink is lower than second supply communication opening 423, ambient air enters the area within supply partition wall 422, and it may not be possible to supply ink. Thus, in this embodiment of the present invention, to detect the state occurring immediately before ink supply becomes not possible, movable member 470 may be designed to rotate, such that the out-of-ink state may be detected when the liquid surface I of the ink may be above second supply communication opening 423. Consequently, by positioning second supply communication opening 423 below portion 400*b*1 forming the bottom portion of ink chamber 111, it is possible to reliably prevent ink from running out prior to detecting an out-of-ink state. Furthermore, when an out-of-ink state is detected, there only may be an insubstantial amount ink on bottom portion 400*b*1 of ink chamber 111, with ink remaining only within concave portion space 424*a* which may be a relatively narrow space provided below bottom portion 400*b*1 in ink chamber 111.

Once the out-of-ink discrimination is made, an out-of-ink lamp may be illuminated or audio may be used to inform the user that the device may be out of ink. It also may be possible to use a counter provided in the controller to remember the number of times ink has been discharged and to detect the quantity of ink remaining by additionally employing a software counter which hypothetically determines whether the device may be out of ink.

Referring to FIGS. 42(*a*) and 42(*b*), the attachment position of attachment shaft 472*a* may be below translucent detection portion 140 and above ink supply portion 120, and may be positioned to the rear of supply path forming portion 420 in the direction of installation of ink cartridge 14. In this embodiment of the present invention, ink supply portion 120, ambient air intake portion 130, and translucent detection portion 140 are positioned together on one side surface of ink cartridge 14. This allows the various mechanisms to be positioned together on refill unit 13, thereby reducing the side of refill unit 13 and preventing the shape of refill unit 13 from becoming complicated. Furthermore, ink supply portion 120 preferably may be positioned at the lower side of ink cartridge 14 so as to provide for more complete utilization of ink, and ambient air intake portion 130 preferably may be positioned at the upper side of ink cartridge 14. Thus, translucent detection portion 140 may be positioned between ink supply portion 120 and ambient air intake portion 130. With respect to ink cartridge 14, if the center of rotation of movable member 470 is positioned above or at the same position as translucent detection portion 140, the length of space between float portion 417 and pivot portion 472 will increase and movable member 470 will become larger, and the quantity of ink which may be stored will decrease accordingly. In contrast, if the center of rotation of movable member 470 is positioned below ink supply portion 120, the movable range of float portion 471 will be relatively small, making detection of the out-of-ink state difficult. Thus, in this embodiment of the present invention, the center of rotation of movable member 470 may be positioned above ink supply portion 120 and below translucent detection portion 140. Consequently, as described above, the out-of-ink state reliably may be detected, and the reduction of ink reservoir capacity due to increased size of movable member 470 may be avoided.

Moreover, if float portion 471 is positioned in the vicinity of supply partition wall 422, float portion 471 will be near second supply communication opening 423, and the vibration caused by the operation of float portion 471 will be transmitted to the ink, interfering with ink flow. In particular, if the liquid surface I of ink becomes wavy, ambient air may enter supply partition wall 422 via second supply communication opening 423, hindering the supply of ink. Conversely, placing float portion 471 away from supply partition wall 422 will make arm portion 473 larger, such that float portion 471 also will be larger to ensure buoyancy of float portion 471. Consequently, the amount of ink which may be stored in ink chamber 111 will decrease. Thus, in this embodiment of the present invention, the position of center of rotation of movable member 470 may be positioned in the vicinity of supply partition wall 422, and float portion 471 may be positioned at the middle of ink chamber 111 in the Y direction to avoid enlargement of movable member and adverse effects on ink flow.

Referring to FIG. 42(*a*), when movable member 470 is attached to arm sandwiching portion 425 and ink is available, the top end surface of blocking arm portion 473*c* may be positioned substantially parallel to the liquid surface of ink. When the liquid surface of ink drops and reaches the same position as the top end surface of shielding arm 473*c*, the surface tension of ink acts as a force to retain shielding arm 473. If the force by which the surface tension of ink retains shielding arm 473*c* is greater than the buoyancy of float portion 473*a*, movable member 470 may not operate properly. Thus, in this embodiment of the present invention, the top end surface forming the outside of translucent detection portion 140 of shielding arm 473*c* may have an angle so as to slope downward, reducing the portion of shielding arm 473*c* which may be substantially parallel to the liquid surface of ink. Thus, the force exerted by the surface tension of ink on shielding arm 473*c* may be reduced, allowing movable member 470 to operate normally.

Figure 44:
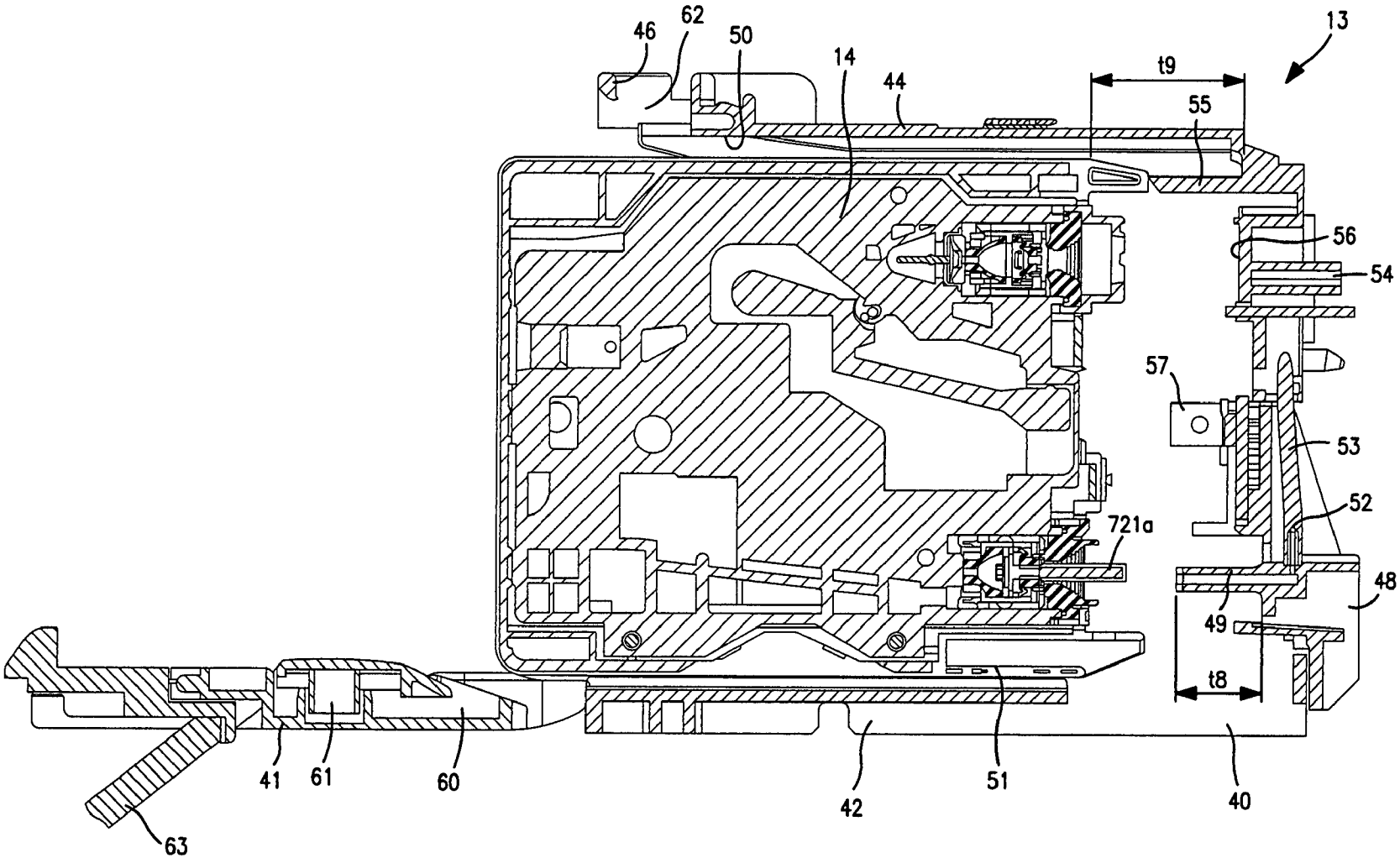
FIG. 44 is a cross-sectional view of an ink cartridge which improperly is attached to a multi-functional device.

Referring to FIG. 44, when ink cartridge 14 is inserted into the case, if the top and bottom are reversed relative to the proper installation orientation, the tips of case protruding portions 214*a* and 224*a* will contact the tip of protrusion 55. When installed with the top and bottom reversed from the proper installation orientation, ink supply portion 120 will be located above ambient air intake portion 130, resulting in an incorrect orientation with respect to the proper installation orientation.

As shown in FIG. 44, the total projection distance t9 including the projection distance of protrusion 55 from back surface 56 of case 40 and the projection distance of case protruding portions 214*a* and 224*a* from case 200 may be longer than the projection distance t8 of needle 49 from needle forming member 48. Providing a difference between projection distance t8 and projection distance t9 prevents contact between the tip of valve opening portion 721*a* protrusion outward from ambient air intake portion 130 and the tip of needle 49. Needle 49 may be a member for extracting the ink within ink cartridge 14 and supplying the ink to the ink jet recording head (not shown), such that needle 49 may be damaged or deformed, and thus, ink may not be accurately supplied and printing may not be performed accurately. Nevertheless, by providing a difference between projection distance t8 and projection distance t9, contact between needle 49 and valve opening portion 721*a* may be prevented, thus making it possible to prevent damage or deformation of needle 49 and allowing the ink to be reliably supplied.

Furthermore, the position of the detection window provided by translucent detection portion 140 and case cutouts 213 and 223 in the vertical direction may be displaced slightly from the center, such that when ink cartridge 14 is installed upside-down from the proper installation orientation, ink detection sensor 57 may contact the outer wall of case 200, which may damage ink detection sensor 57. Nevertheless, because a difference may be provided between projection distance t8 and projection distance t9, it becomes possible to prevent damage to ink detection sensor 57 due to contact with the outer wall of case 200, making it possible to accurately detect the quantity of ink.

Figure 45A:
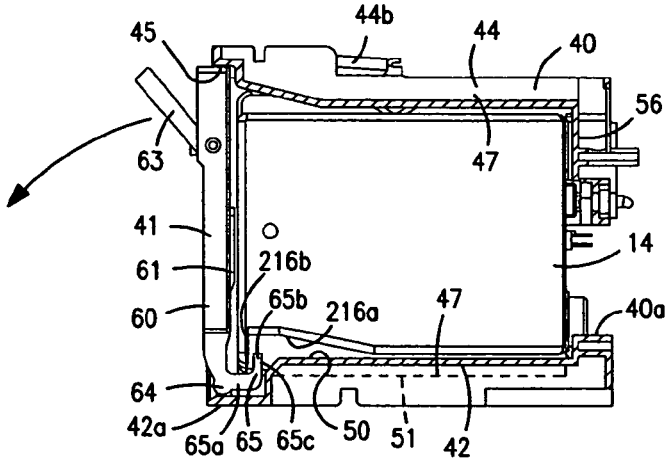
FIGS. 45(*a*)-45(*c*) are side views of an ink cartridge and partial, cross-sectional views of a multifunction device showing a method of removing the ink cartridge from the multifunction device, according to an embodiment of the present invention.
Figure 45B:
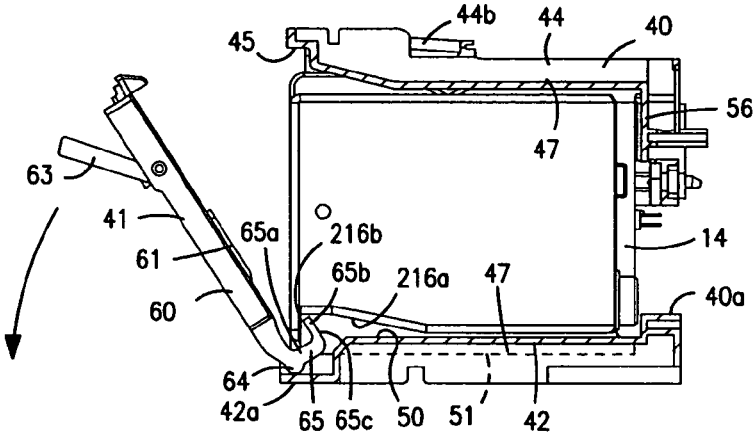
Figure 45C:
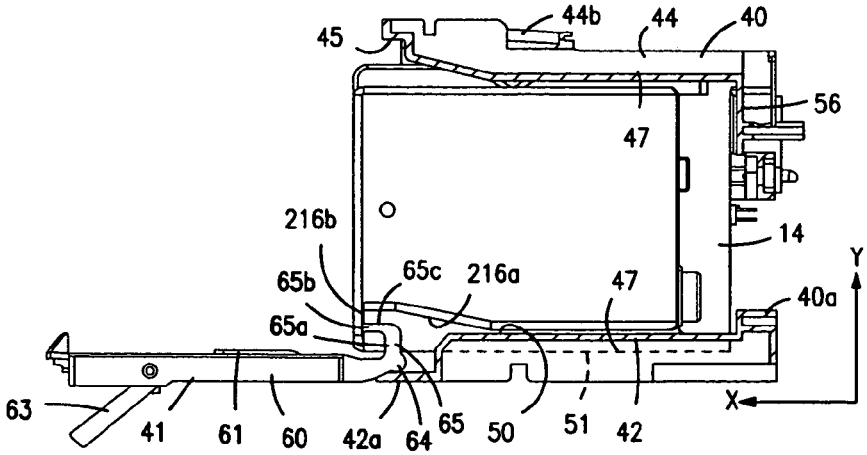

Referring to FIG. 45(*a*), to remove ink cartridge 14 from multifunction device 1, lock release lever 63 of door 41 may be rotated forward. As discussed above, when lock release lever 63 is rotated, the engagement between door lock member 62 and lock member fitting portion 46 may be disengaged, and consequently, door 41 may be rotated forward.

Referring to FIG. 45(*b*), a portion of curved portion 65*b* of pullout member 65 may be positioned within concave portions 215*a* and 226*a* of case 200, such that when rotated by lock release lever 63, the tip of curved portion 65*b* of pullout member 65 of contacts latch portions 216*b* and 226*b* case 200. Referring to FIG. 45(*c*), when door 41 is rotated further forward, latch portions 216*b* and 226*b* of case 200 are pulled out by curved portion 65*b* of pullout member 65, and consequently, a portion of ink cartridge 14 protrudes form within case 40. From this state, the user readily may remove ink cartridge 14. Thus, the operability of ink cartridge 14 replacement operation may be improved.

Figure 46A:
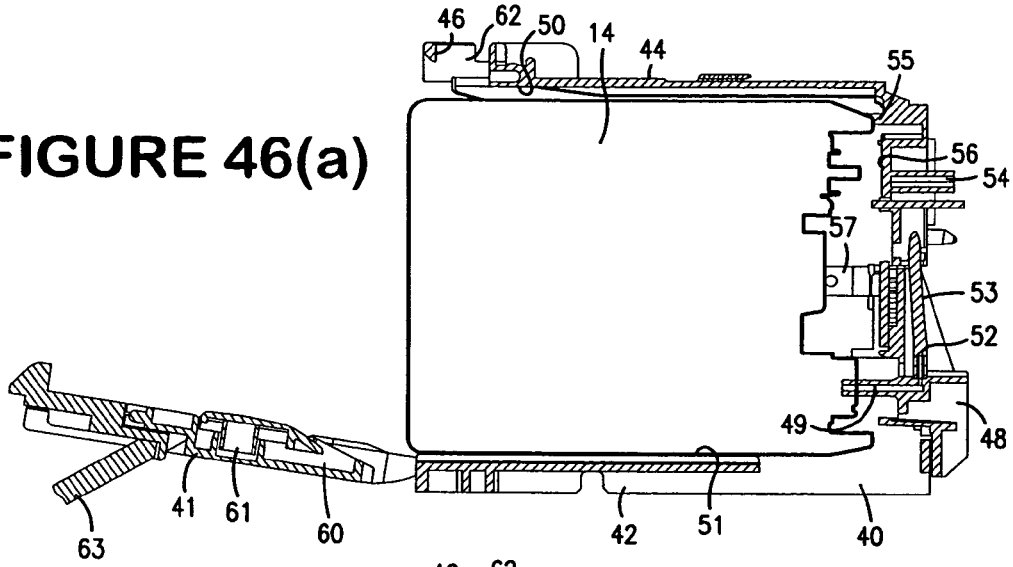
FIGS. 46(*a*) and 46(*b*) are side views of an ink cartridge and cross-sectional views of a multifunction device showing a method of removing the ink cartridge from the multifunction device, according to an embodiment of the present invention.
Figure 46B:
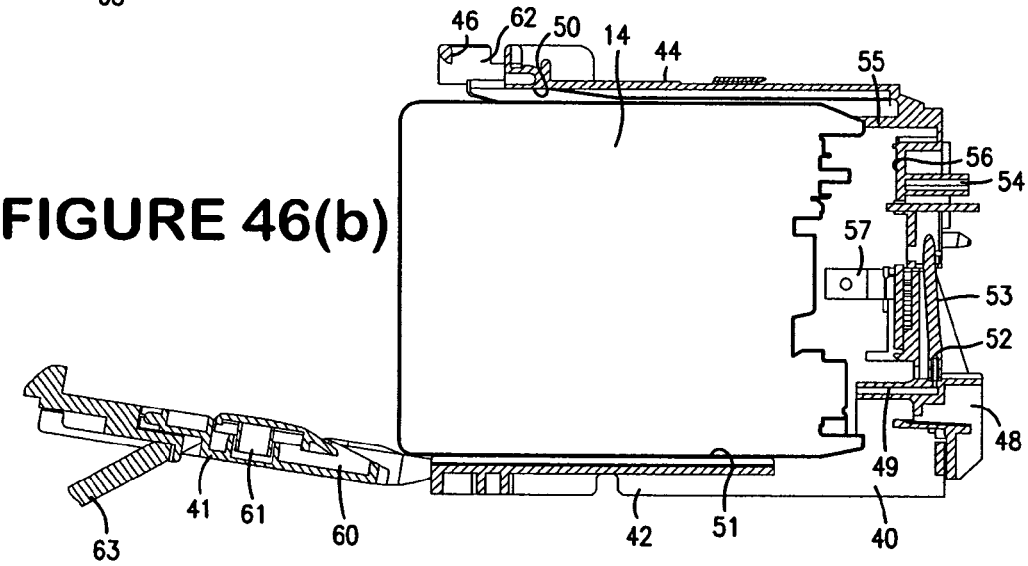
Figure 46C:
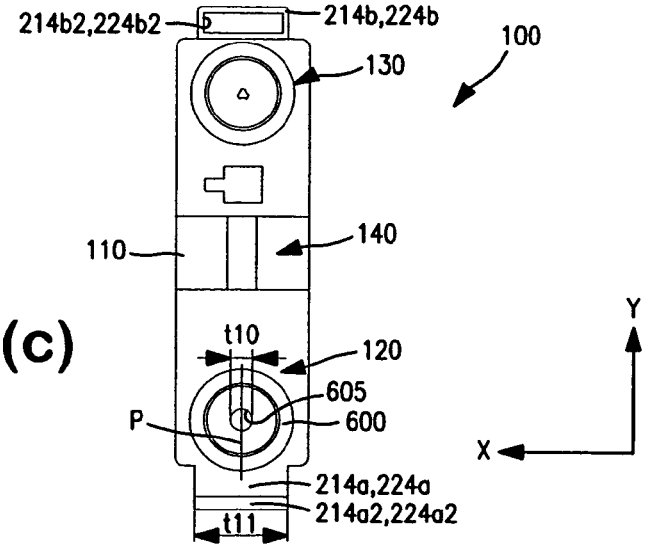

Referring to FIGS. 46(*a*)-46(*c*), when ink cartridge 14 is installed in multifunction device 1, needle 49 may be inserted within ink supply portion 120. Ink supply mechanism 500 may comprise a valve mechanism impelled by first supply spring 630 and second supply spring 650, such that when removing ink cartridge 14 from multifunction device 1, ink may adhere to the protruding tip of needle 49 and/or ink may flow out from ink supply portion 120. Because valve 620 moves in a direction such that it contacts joint contact portion 613 due to the impelling force of first supply spring 630 and second supply spring 650 when needle 49 is removed from supply joint 610, ink may be pushed out in a direction such that it flows out from protruding portion flow path 615*b* to step portion flow path 615*a*, such that some ink may stick to the protruding tip of needle 49 or flow outside ink supply portion 120. Consequently, when ink cartridge 14 is removed, the ink adhering to the tip of needle 49 may drip down in the form of ink drops, or ink may flow down from ink supply portion 120.

Nevertheless, referring to FIG. 46(*b*), in this embodiment of the present invention, because the projection comprising case protrusion members 214*a* and 224*a* protrudes further outward than the protrusion tip of ink supply portion 120, even when the ink adhering to the tip of needle 49 drips down in the form of ink drops or if ink flows down from ink supply portion 120, the dripped ink may adhere to ink supply portion 120 side surface of case protrusion members 214*a* and 224*a*. Furthermore, because case protrusion members 214*a* and 224*a* and ink supply portion 120 are positioned relatively close to each other, the ink dripping form ink supply portion 120 may adhere to case protrusion members 214*a* and 224*a*.

Referring to FIG. 46(*c*), insertion opening 605 of supply cap 600 may be an ink supply opening into which needle 49 may be inserted and through which ink flows out, and the thickness t1 in the widthwise direction of ink cartridge 14 of case protrusion members 214*a* and 224*a* may be longer than the diameter t10 of insertion opening 605, e.g., the diameter of needle 49 may be narrower than the diameter t10 of through-opening 605. Furthermore, when viewed vertically, insertion opening 605 may be accommodated entirely within the region occupied by case protrusion members 214*a* and 224*a*. Thus, when ink cartridge 14 is removed, even when ink adhering to the tip of needle 49 drips down or if ink flows down from insertion opening 605, the dripped ink may be caught by case protrusion members 214*a* and 224*a*. Furthermore, because case protrusion members 214*a* and 224*a* protrude horizontally in the installation orientation of ink cartridge 14, and the surface on ink supply portion 120 side may be provided to be substantially flat, the ink adhering to case protrusion members 214*a* and 224*a* may be prevented from dripping further down. Consequently, it may be possible to prevent ink from dripping down into and dirtying the inside of refill unit 13. If the inside of refill unit 13 is dirtied, ink cartridge 14 also may be dirtied during installation or removal of cartridge 14, thus making the user's hands dirty. Nevertheless, such problems may be avoided by substantially preventing the ink from adhering within refill unit 13.

Figure 47A:
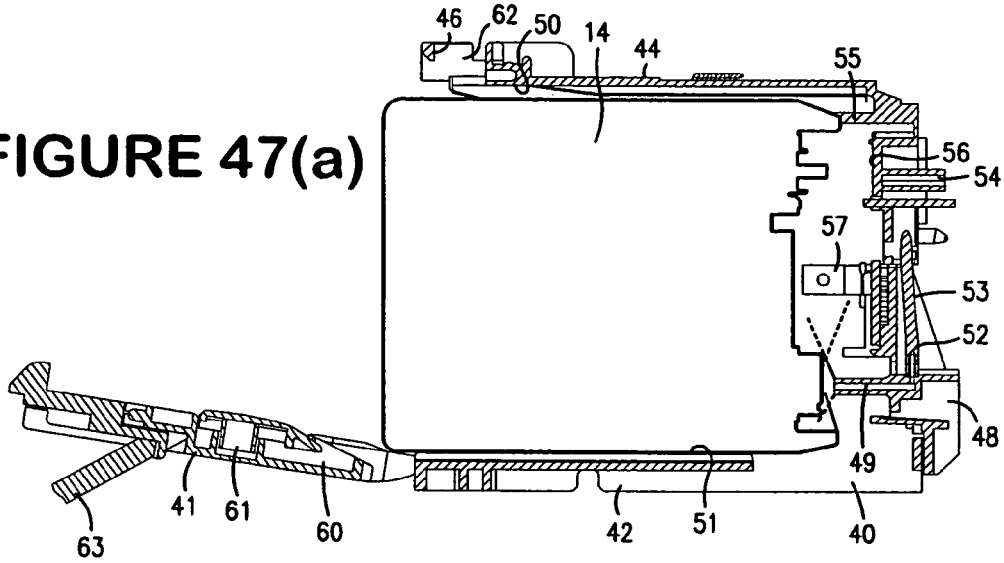
FIG. 47(*a*) is side view of an ink cartridge and a cross-sectional view of a multifunction device.
Figure 47B:
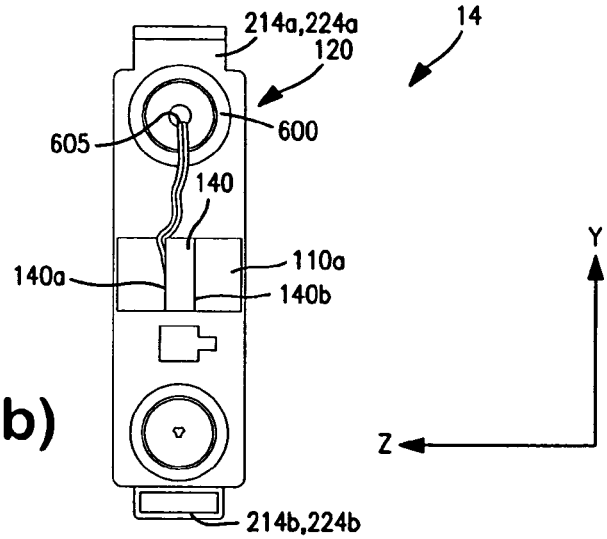
Figure 47C:
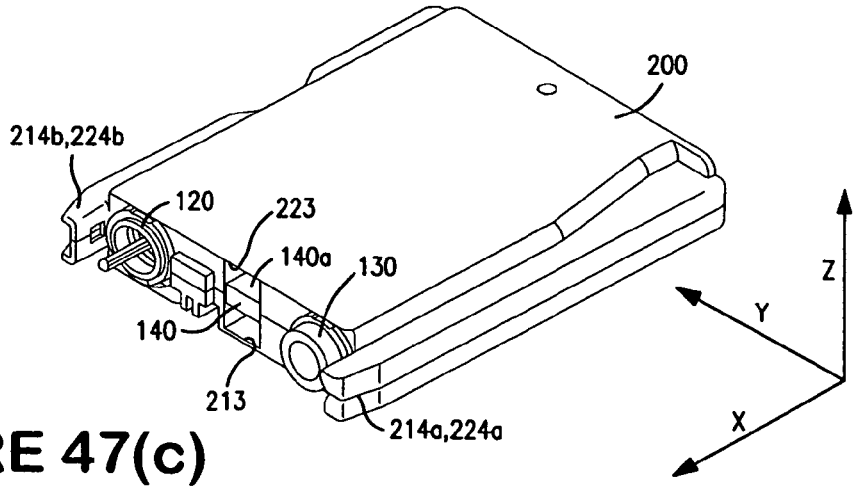

Referring to FIG. 47(*a*), when ink cartridge 14 is installed in or removed from refill unit 13, ink may spatter from the protrusion tip of ink supply portion 120 or the protrusion tip of needle 49. This may be due to ink supply mechanism 500 of ink supply portion 120 opening and closing, and thus, the pressure of ink changes rapidly upon installation and removal of ink cartridge 14, causing the ink held within ink supply mechanism 500 to fly out forcefully. Moreover, when needle 49 suddenly is exposed to the outside from the state of being positioned within ink supply portion 120, the ink may flow back and spatter.

When ink cartridge 14 is in the installation orientation, translucent detection portion 140 may be positioned at a position corresponding to ink detection sensor 57, such that translucent detection portion 140 may be positioned above ink supply portion 120. The majority of ink spattering from needle 49 and ink supply portion 120 spatters downward under its own weight, such that the adhesion of ink to translucent detection portion 140 may be reduced by positioning translucent detection portion 140 above ink supply portion 120. Furthermore, detection surfaces 140*a* and 140*b* may be provided in a plane parallel to the line jointing the center of translucent detection portion 140 and cap insertion opening 605. The majority of ink spattering from cap insertion opening 605 spatters in substantially linear fashion, such that even if ink spatters from cap insertion opening 605, not much ink will adhere to detection surfaces 140*a* and 140*b*, making it possible to reduce the adhesion of ink to detection surfaces 140*a* and 140*b*.

Referring to FIG. 47(*b*), if ink cartridge 14 is removed during use and placed, such that the positional relationship of ink supply portion 120 and ambient air intake portion 130 is upside down relative to the installation orientation of ink cartridge 14, ink may drip down from insertion opening 605 of supply cap 600. Because the ink dripping form insertion opening 605 flows under its own weight, it will flow out in substantially linear fashion in the direction of translucent detection portion 140 and adhere to detection surfaces 140*a* and 140*b* of translucent detection portion 140.

Nevertheless, when translucent detection portion 140 is positioned below ambient air intake portion 130 and above ink supply portion 120, detection surfaces 140*a* and 140*b* of translucent detection portion 140 will be positioned vertically, such that the ink adhering to detection surfaces 140*a* and 140*b* will drip down to ambient air intake portion 130 side under its own weight. Furthermore, because the surface of detection surfaces 140*a* and 140*b* may be provided out of a resin material into a smooth plane, adhering ink readily may flow down. Thus, it possible to reduce the adhesion of ink to the side surface of translucent detection portion 140. Furthermore, when ink cartridge 14 is installed, ink supply portion 120 may be positioned toward the lower portion and ambient air intake portion 130 may be positioned toward the upper portion, such that even if ink adheres to translucent detection portion 140 during installation or removal of ink cartridge 14, the ink will flow to ink supply portion 120 side, making it possible to reduce the adhesion of ink to detection surfaces 140*a* and 140*b*. Moreover, as discussed above, edge portion 40 of detection surfaces 140*a* and 140*b* and side surface 100*a* of frame portion 110 may be provided substantially at a right angle, such that ink adhering to detection surfaces 140*a* and 140*b* more readily may flow downward due to the effect of the capillary force of edge portion 140*c*. Therefore, adhesion of ink to detection surfaces 140*a* and 140*b* may be reduced.

Referring to FIG. 47(*c*), translucent detection portion 140 may be positioned within case 200, and a space into which light emitting portion 57*a* and light receiving portion 57*b* of ink detection sensor 57 enter may be provided on both sides of detection surfaces 140*a* and 140*b* by case cutouts 213 and 223. Thus, translucent detection portion 140 may be covered by case 200, such that even if ink should spatter, adhesion of spattered ink to detection surfaces 140*a* and 140*b* may be reduced. Moreover, because a portion of ink supply portion 120 protrudes outward from case 200, in the installation orientation of ink cartridge 14, the distance to translucent detection portion 140 becomes farther. Thus, the majority of spattered ink may not reach translucent detection portion 140, such that it possible to reduce the adhesion of ink to detection surfaces 140*a* and 140*b*. Furthermore, case protrusion members 214*a* and 224*a* and case protrusion members 214*b* and 224*b* may be provided at the ends, and ink supply portion 120 and ambient air intake portion 130 may be positioned between case projecting portions 214*a* and 224*a* and case projecting portions 214*b* and 224*b*. Moreover, case projecting portions 214*a* and 224*a* and case projecting portions 214*b* and 224*b* may extend further outward than ink supply portion 120. Thus, if ink cartridge 14 is dropped on to a surface, ink supply portion 120 may not contact the surface, such that it possible to reduce outflow of ink from ink supply portion 120 due to the contact with the surface. Consequently, the adhesion of ink to detection surfaces 140*a* and 140*b* may be reduced.

Figure 48A:
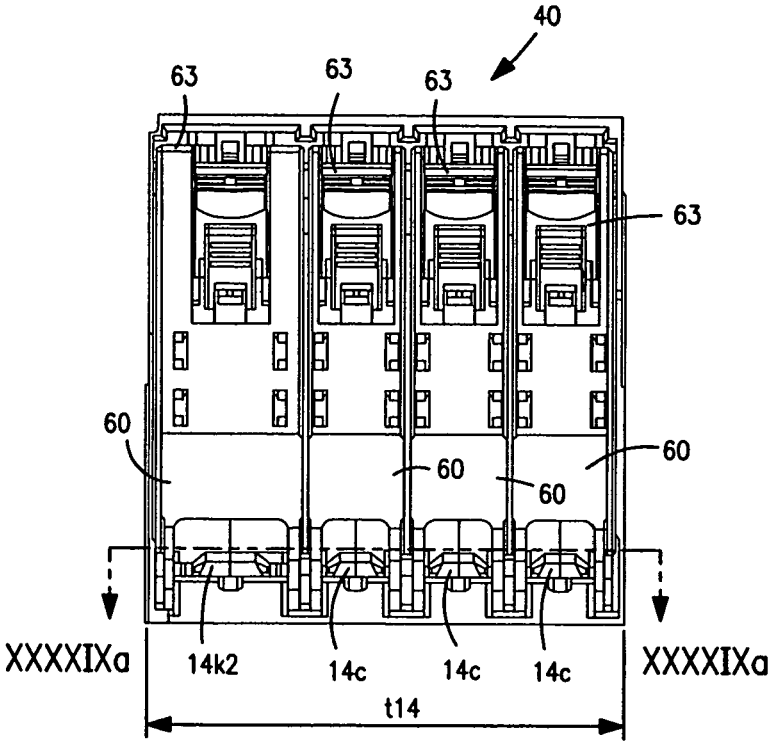
FIG. 48(*a*) is a front view of a case configured to hold a large capacity black ink cartridge and a plurality of color ink cartridges.
Figure 48B:
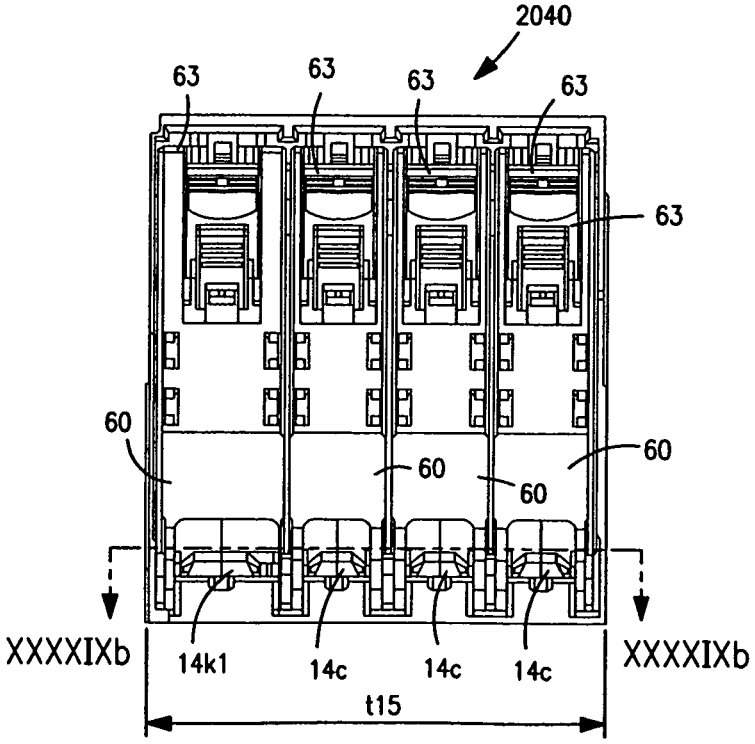

Referring to FIG. 48(*a*), case 40 may be configured to accommodate a plurality of ink cartridges, e.g., about four ink cartridges, such that the ink cartridges are aligned in case 40. In an embodiment of the present invention, four ink cartridges may be employed. For example, three color ink cartridges 14*c* may be positioned side by side, and a large capacity black ink cartridge 14*k*2 or a small capacity black ink cartridge 14*k*1 may be positioned adjacent thereto. Case 40 shown in FIG. 48(*a*) accommodates a large capacity black ink cartridge 14*k*2.

Referring to FIG. 48(*b*), case 2040 may be configured to accommodate a plurality of ink cartridges, e.g., about four positioned ink cartridges. In an embodiment of the present invention, four ink cartridges may be employed. For example, three color ink cartridges 14*c* may be positioned side by side, and a small capacity black ink cartridge 14*k*1 may be positioned adjacent thereto.

Because case 40 selectively may allow a large capacity black ink cartridge 14*k*2 or a small capacity black ink cartridge 14*k*1 to be installed therein, case 40 may be configured to accommodate a large capacity black ink cartridge 14*k*2. Thus, the lateral width t14 of case 40 may be longer than the lateral width t15 of case 2040. The difference between the lateral width t14 of case 40 and the lateral width t15 of case 2040 corresponds to the difference between the height of vertical wall portions 220*b*-220*e* of second case member 220 and the height of vertical wall portions 2220*b*-2220*e* of second case member 2220.

Furthermore, case 40 may allow a small capacity black ink cartridge 14*k*1 or a large capacity black ink cartridge 14*k*2 to be installed, and case 2040 only may allow the installation of a small capacity black ink cartridge 14*k*1. Specifically, because users who do not frequently print may not need a large capacity black ink cartridge 14*k*2, it may be preferable to provide such users with a smaller multifunction device 1 which does not allow the installation of a large capacity black ink cartridge 14*k*2. Furthermore, because case 2040 for installing small capacity black ink cartridges 14*k*1 and case 40 for installing large capacity black ink cartridge 14*k*2 only may differ slightly in external shape, the majority of die used may be shared between the two, providing for a cost reduction.

Figure 49A:
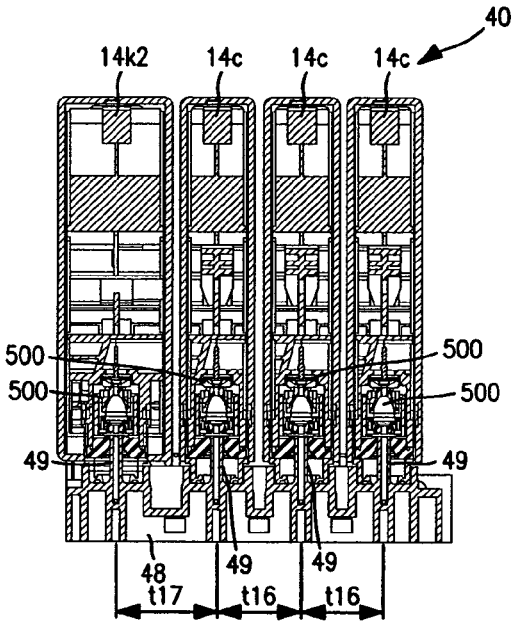
FIG. 49(*a*) is a cross-sectional view of the case of FIG. 48(*a*) along the XXXXIXa-XXXXIXa line.
Figure 49B:
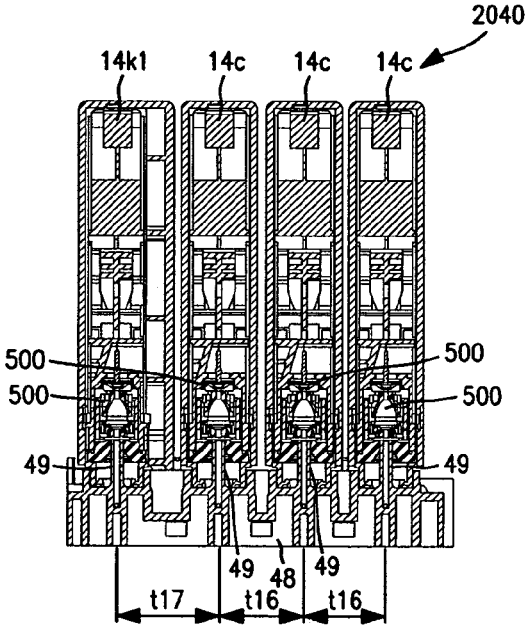

Referring to FIG. 49(*a*), when ink cartridges 14*c* and 14*k*2 are accommodated in case 40, a needle 49 penetrates into ink supply mechanism 500 of each of ink cartridges 14*c* and 14*k*2. The gaps t16 between needles 49 penetrating color ink cartridges 14*c* may be substantially equal, and the gap t17 between needle 49 penetrating into large capacity black ink cartridge 14*k*2 and needle 49 penetrating the adjacent color ink cartridge 14*c* may be longer than gap t16. The difference between gap t16 and gap t17 corresponds to the difference between the height of vertical wall portions 210*b*-210*e* of first case member 210 and the height of vertical wall portions 2210*b*-2210*e* of first case member 2210.

Referring to FIG. 49(*b*), when ink cartridges 14*c* and 14*k*1 are accommodated within case 2040, a needle 49 penetrates within ink supply mechanism 500 of each of ink cartridges 14*c* and 14*k*1. The gap t16 between needles 49 penetrating into color ink cartridges 14*c* and the gap t17 between needle 49 penetrating into small capacity black ink cartridge 14*k*1 and needle 49 penetrating into the adjacent color ink cartridge 14*c* may be the same length as gaps t16 and t17 of case 40. For example, the state of accommodation of small capacity black ink cartridge 14*k*1 in case 2040 may involve positioning first case member 1210 of small capacity black ink cartridge 14*k*1 on color ink cartridge 14*c* side, thereby making the distance between needle 49 penetrating into small capacity black ink cartridge 14*k*1 and needle 49 penetrating into the adjacent color ink cartridge 14*c* the same as the distance between needle 49 penetrating into large capacity black ink cartridge 14*k*2 of case 40 and needle 49 penetrating into the adjacent color ink cartridge 14*c*. Consequently, identical needle forming members 48 may be provided in case 40 and case 2040 even though the lateral widths t14 and t15 of cases 40 and 2040 may differ, making the needle forming member 48 a common component and making it possible to reduce costs when fabricating case 40 and case 2040.

Furthermore, as discussed above, ink supply mechanism 500 may be a valve mechanism impelled by first supply spring 630 and second supply spring 650, such that when ink cartridge 14 is removed from multifunction device 1, ink may flow out from ink supply portion 120 or may spatter around. Needles 49 may be positioned continuously, without any partition plates being provided between needles 49, such that when ink spatters from ink supply portion 120, the spattered ink adheres to the adjacent needles 49. Needles 49 may be portions which supply ink to multifunction device 1, such that when a different ink color may be mixed into a needle 49, color change will occur during printing, and printing quality will decline. In this embodiment of the present invention, the black ink may be a pigment type ink, and the color inks may comprise dye type inks. For example, black ink may be used primarily for text printing, and thus, may be made from a pigment type ink with low permeability into paper in order to make the edges of characters clear, and color ink may be used primarily for image printing, such that it may be made from a dye type ink with high permeability into paper in order to make the granularity of dots less apparent and improve the appearance of coloration. Although there may not be a substantial effect of color change when color inks are mixed together, when black ink mixes with another color ink, the effect of color change is greater, such that it may not be desirable for black ink to be mixed with other color inks. Furthermore, when mixing with other ink colors has been confirmed, generally, recovery processing involving forced ejection of ink may be carried out, however, because ink may be wasted for the recovery processing, the ink utilization efficiency may decrease. Moreover, because black ink may be a pigment type ink, black ink may have a higher viscosity relative to dye type ink, such that it may not be readily removed even if recovery processing is carried out. Nevertheless, in this embodiment of the present invention, ink cartridges 14*k*1 and 14*k*2 holding black ink may be positioned at the end in the direction of arrangement in case 40, and ink supply portion 120 and needle 49 may be shifted away from color ink cartridges 14*c*, such that even if black ink spatters, the spattered ink is unlikely to adhere to the adjacent needle 49. Therefore, decline in printing quality may be suppressed, and ink may not be used for recovery processing.

Figure 50A:
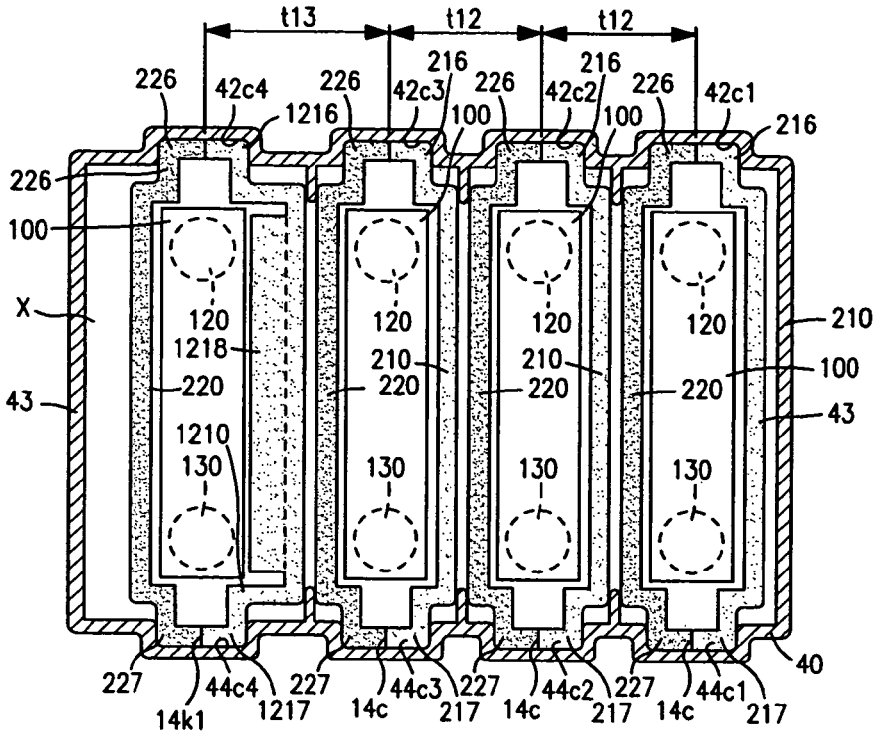
FIGS. 50(*a*)-50(*b*) are cross-sectional views of a case with a plurality of ink cartridges held therein, according to an embodiment of the present invention.
Figure 50B:
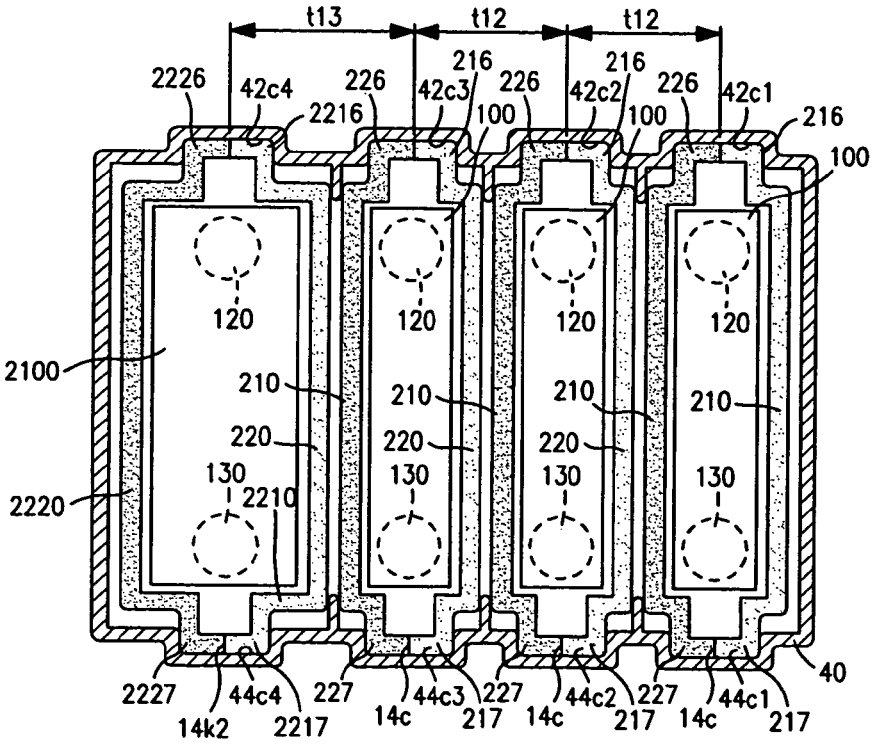
Figure 51A:
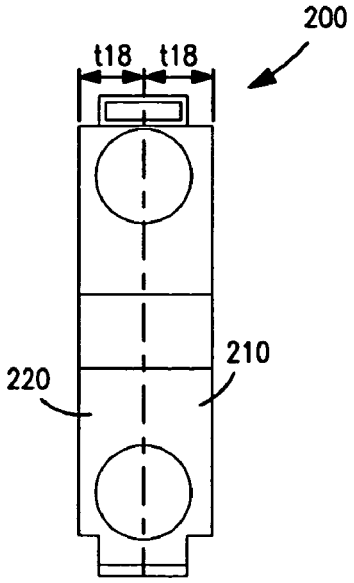
FIGS. 51(*a*)-51(*d*) are front views of different combinations of a pair of case members connected to each other, according to an embodiment of the present invention.
Figure 51B:
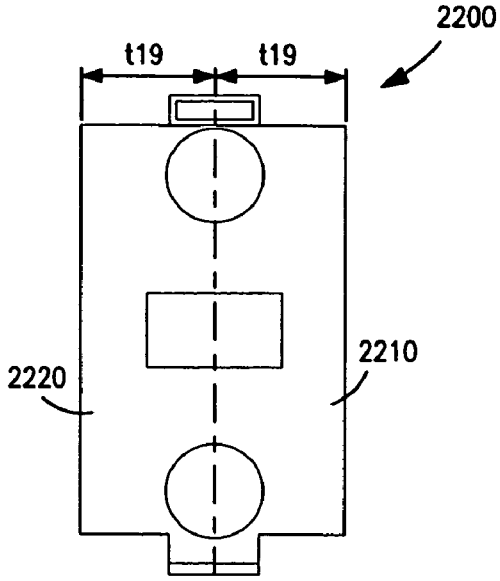
Figure 51C:
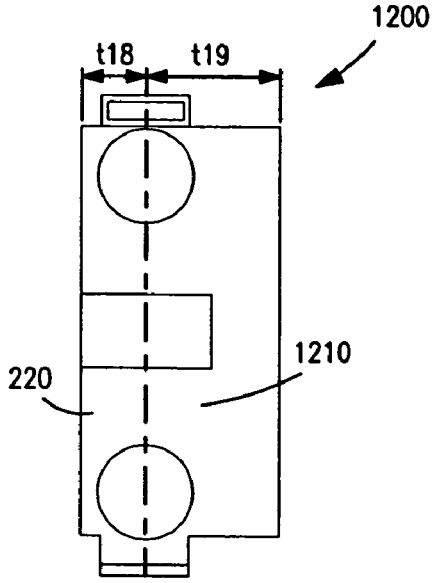
Figure 51D:
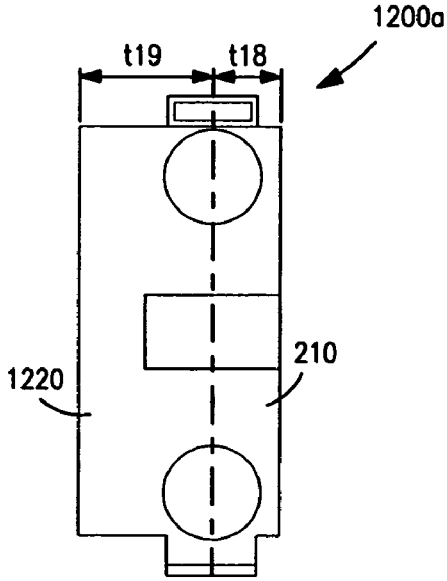

Referring to FIG. 50 (*a*), accommodating grooves 42*c*1-42*c*4 and 44*c*1-44*c*4 may be provided in bottom plate portion 42 and ceiling plate portion 44 of case 40, and may be configured to accommodate case welded portions 216, 226, and 1216 of case 200, and case welded portions 217, 227, and 1217 of case 1200, respectively. Accommodating grooves 42*c*1-42*c*4 and 44*c*1-44*c*4 may have substantially the same shape.

Furthermore, the space between accommodating grooves 42*c*1 and 42*c*2 and the space between accommodating grooves 42*c*2 and 42*c*3 provide a separation distance t12, and the space between accommodating grooves 42*c*3 and 42*c*4 provides a separation distance t13 longer than distance t12. For example, as discussed above, small capacity black ink cartridge 14*k*1 may have a larger outer shape than the other color ink cartridges 14*c*, such that ink supply portion 120 and ambient air intake portion 130 of small capacity black ink cartridge 14*k*1 may be shifted by the difference between distance t12 and distance t13 in the direction away from ink supply portion 120 and ambient air intake portion 130 of other color ink cartridges 14*c*. The difference between distance t12 and distance t13 may be the same as the difference between gap t16 and gap t17 between needles 49, and may correspond to the difference between the height of verticals wall portions 210*b*-210*e* of first case member 210 and the height of vertical wall portions 2210*b*-2210*e* of first case member 2210, or the difference between vertical wall portions 210*b*-210*e* of first case member 210 and vertical wall portions 1210*b*-1210*e* of first case member 1210.

Moreover, a predetermined space X may be provided between the outer surface of second case 220 of small capacity black ink cartridge 14*k*1 and the inner surface of side plate portion 43. The predetermined space X may be provided to allow for large capacity black ink cartridge 14*k*2. Specifically, referring to FIG. 50(*b*), predetermined space X allows refill unit 13 to be used for both small capacity black ink cartridge 14*k*1 and large capacity black ink cartridge 14*k*2.

Referring to FIG. 50(*b*), when a large capacity black ink cartridge 14*k*2 is installed in refill unit 13, the space which would be provided when a small capacity black ink cartridge 14*k*1 is installed becomes occupied. Furthermore, the positions of ink supply portion 120 and ambient air intake portion 130 may be the same when ink cartridge 14*k*1 is installed and when ink cartridge 14*k*2 is installed. Thus, the same case 40 may be used with black ink cartridges 14*k*1 and 14*k*2, making it possible to reduce fabrication costs.

Figure 52A:
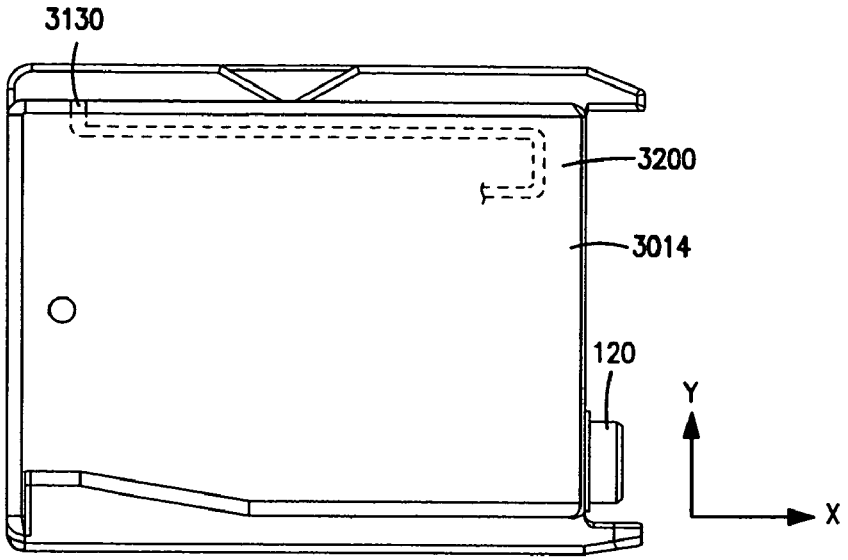
FIG. 52(*a*) is a side view of an ink cartridge.
Figure 52B:
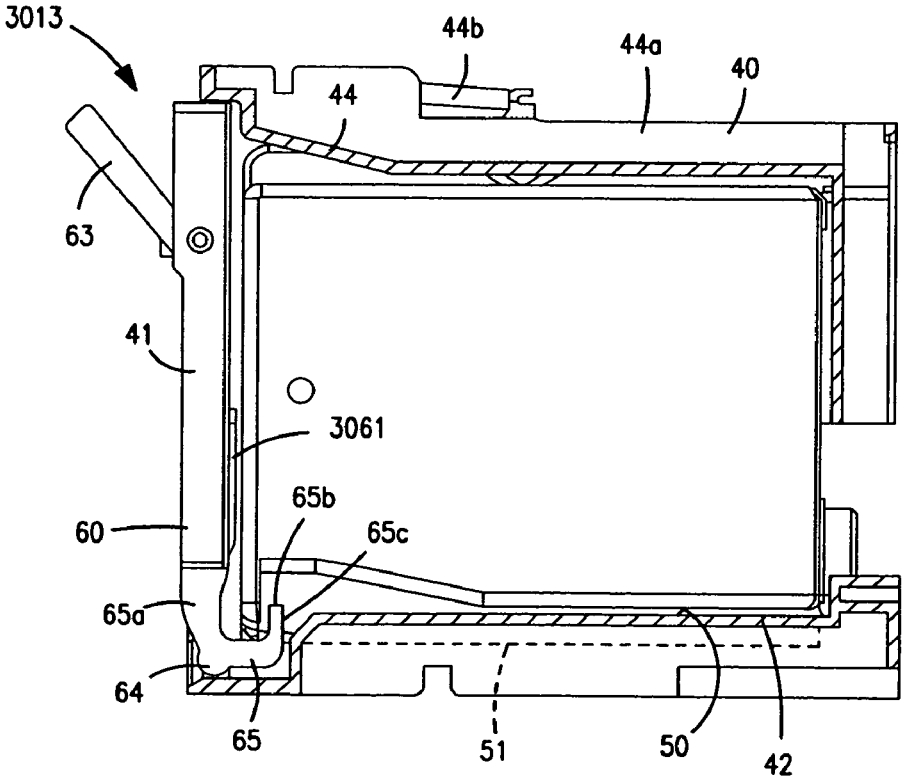

Referring to FIG. 51(*a*) case 200 may comprise first and second case members 210 and 220, and the thicknesses of first and second case members 210 and 220 may be equal to thickness t18. Referring to FIG. 52(*b*), case 2200 may comprise first and second case members 2210 and 2220, and the thicknesses of first and second case members 2210 and 2220 may be thickness t19 which may be about twice the thickness of t18.

Referring to FIG. 51(*c*), case 1200 may comprise first and second case members 1210 and 220, and the thicknesses of first and second case members 1210 and 220 may be thickness t19 for first case member 1210 and t18 for second case member 220. Thus, according to an embodiment of the present invention, three types of cases, e.g., cases 200, 1200, and 2200, having different sizes and/or volumes, may be provided from two first case members of different thickness and two second case members of different thickness. In this embodiment of the present invention, the thicknesses of first and second case members 210 and 220 forming case 200 may be equal, and the thicknesses of first and second case members 2110 and 2220 forming case 2200 also may be equal. Nevertheless, those or ordinary skill in the art at the time of the invention readily will understand that so long as the thickness of one side, e.g., the first case member 2210, of the case members making up the largest first ink cartridge, e.g., case 2200, is greater than the thickness of one side, e.g., first case member 210, of the case members making up the smaller third ink cartridge, e.g., case 200, and the thickness of the other side, e.g., second case member 2220, of the case members making up the largest first ink cartridge is greater than the thickness of the other side, e.g., second case member 220, of the case members making up the smaller third ink cartridge, three types of cases with different sizes may be fabricated using four case members.

Cases 200, 1200, and 2200 may comprise a resin material and may be manufactured by injection molding. Thus, a die corresponding to each case 200, 1200, and 2200 may be employed, with six types of dies being used if dies are fabricated for all of the cases. Namely, because cases 200, 1200, and 2200 have a space within them, at least two members used to construct each case. Thus, with three cases 200, 1200, and 2200 of different size, six types of members may be employed.

Nevertheless, because dies are expensive, it may be desirable to share dies to the extent possible. In this embodiment of the present invention, second case member 220 for black may be made common with second case member 220 for color, e.g., may be made from the same mold. Thus, a separate die may not be necessary for second case member 220 for black, providing a reduction in costs. Moreover, first case member 1210 for black may involve making first case member 210 for color deeper and providing a rib 1218. Thus, the tip side of vertical wall portions 1210*b*-1210*e* past rib 1218 in first case member 120 used for black may have the same shape as the tip side of vertical wall portions 210*b*-210*e* of first case member 210 used for color. Therefore, first case members 1210 and 210 may be manufactured by using a common die for the main portion of first case members 1201 and 210. Thus, costs may be reduced relative to when two types of molds are fabricated. Furthermore, because first case member 2210 for large capacity black may have the same shape as first case member 1210 for black but without rib 1218, a common die may be used for the main portion of first case members 210, 1201, and 2210. In this way, even when there are multiple types of ink cartridges 144*c*, 14*k*1, and 14*k*2, a cost reduction may be achieved by using common dies to the extent possible.

Furthermore, in cases 200, 1200, and 2200 of different sizes, if the through-openings which allow ink supply portion 120 and ambient air intake portion 130 to protrude to the outside have the same shape, and substantially semi-circular case cutout portions 211, 212, 221, 222, 1211, 1212, 2211, 2212, 2221, and 2222 corresponding to one half of these through-openings are provided in the same substantially semi-circular shape in first case member 210, second case member 220, first case member 1210 for black, first case member 2210 for large capacity black, and second case member 2220 for large capacity black, a partially common structure may be used for each of dies, reducing the costs of designing the dies.

In this embodiment of the present invention, case 1200 may be made from second case member 220 of case 200, and a first case member 1210 may have substantially the same shape as the first case member of case 2200. Nevertheless, referring to FIG. 51(*d*), it also may be possible to make a case 1200*a* from first case member 210 of case 200 and a second case member 1220 which is substantially the same shape as second case member of case 2200. Because vertical wall portions 210*b*-210*e* and 220*b*-220*e* of case members 210 and 220 are provided to be substantially equal in height, and because vertical wall portions 210*b*-210*e* and 220*b*-220*e* of case members 2210 and 2220 are provided to be substantially equal in height, the outside shape sizes of case 1200*a* and case 1200 may be substantially the same.

Moreover, it may be possible to create a case comprising a combination of first case member 210 and second case member 2220, or a case comprising a combination of first case member 2210 and second case member 220 as the case for black. Nevertheless, those of ordinary skill in the art at the time of the invention readily will understand that any combination of case members may be employed provided that the combination of case members allows three different size cases to be created.

Referring to FIGS. 52(*a*) and 52(*b*), another embodiment of the present invention is depicted. Referring to FIG. 52(*a*), an ink cartridge 3014 may be configured with a different location for ambient air intake portion 130 relative to ink cartridge 14. In ink cartridge 3014, ambient air may be taken into ink cartridge 3014 through an ambient air intake path 3131 provided in a labyrinth shape going from a through-opening 3130 provided on the top surface of case 3200.

Referring to FIG. 52(*b*), a refill unit 3013 may be configured with a pushing retaining member 3061 provided on door 41 lower than pushing retaining member 61 is provided on door 41. For example, there may be no air intake portion on the side surface opposite pushing retaining member 3061 of ink cartridge 3014, and thus, the elastic force acting when ink cartridge 3014 is installed in refill unit 3013 acts only on the lower portion of ink cartridge 3014. Thus, in order to stably install ink cartridge 3014 within refill unit 3013, pushing retaining member 3061 and ink supply portion 120 are configured to be substantially on the same line in the horizontal direction. Being positioned substantially on the same line, the direction in which the elastic force acts also may be substantially on the same line, reducing tilting of ink cartridge 3014 and allowing it to be stably installed. Ink cartridge 3014 may comprise an ink reservoir element 100 within it, or may be configured, such that ink may be stored within case 3200.

Figure 53A:
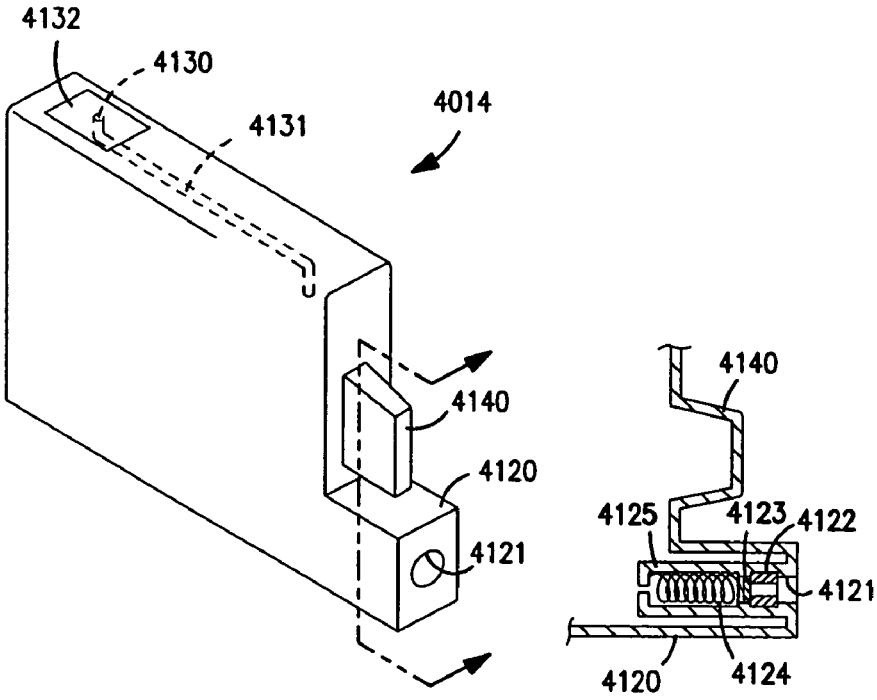
FIG. 53(*a*) is a perspective view of an ink cartridge, according to yet another embodiment of the present invention.
Figure 53B:
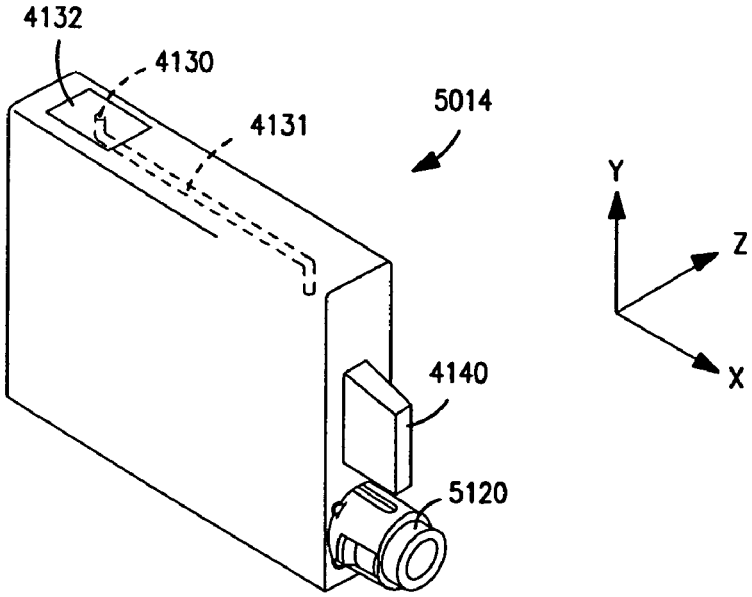

Referring to FIG. 53(*a*), an ink cartridge 4014 according to yet another embodiment of the present invention is depicted. Ink cartridge 4014 may have a through-opening 4130 for admitting ambient air into ink cartridge 4014 provided in a portion of its top surface. The air admitted through through-opening 4130 may pass through a labyrinth shaped air intake path 4131 and may be admitted within ink cartridge 4014. A seal member 4132 may be glued to ink cartridge 4014 to prevent deaeration and outflow of ink within ink cartridge 4014 before use. To use ink cartridge 4014, seal member 4132 may be peeled off, and then the cartridge is installed in multifunction device 1.

A detection portion 4140 may be a protrusion provided outward from one end surface extending substantially in the vertical direction of ink cartridge 4014, and below which may be provided ink supply portion 4120. An ink supply opening 4121 into which needle 49 may be inserted may be provided on the protrusion tip of ink supply portion 4120. Ink cartridge 4014 may not have a structure corresponding to ink reservoir element 100, and stores the ink directly within the case.

A joint 4122 may be provided within ink supply portion 4120, which forms the insertion portion into which needle 49 may be inserted, a valve 4123 which fills an opening of joint 4122 and may be positioned in the direction on the inner side of ink cartridge 4014 of joint 4122, and a spring component 4124 which biases valve 4123 in the direction of joint 4122. Consequently, the valve mechanism which opens and closes ink supply port 4121 may be formed.

Moreover, a partition wall 4125 which divides the inner side of ink cartridge 4014 and ink supply portion 4120 may be provided as a single unit with ink cartridge 4014. Partition wall 4125 may form a space to store the valve mechanism.

Referring to FIG. 53(*b*), an ink cartridge 5014 according to still yet another embodiment of the present invention is depicted. Ink cartridge 5014 may be substantially the same as ink cartridge 4014, except that ink supply portion 4120 has been replaced by ink supply portion 5120.

Figure 54:
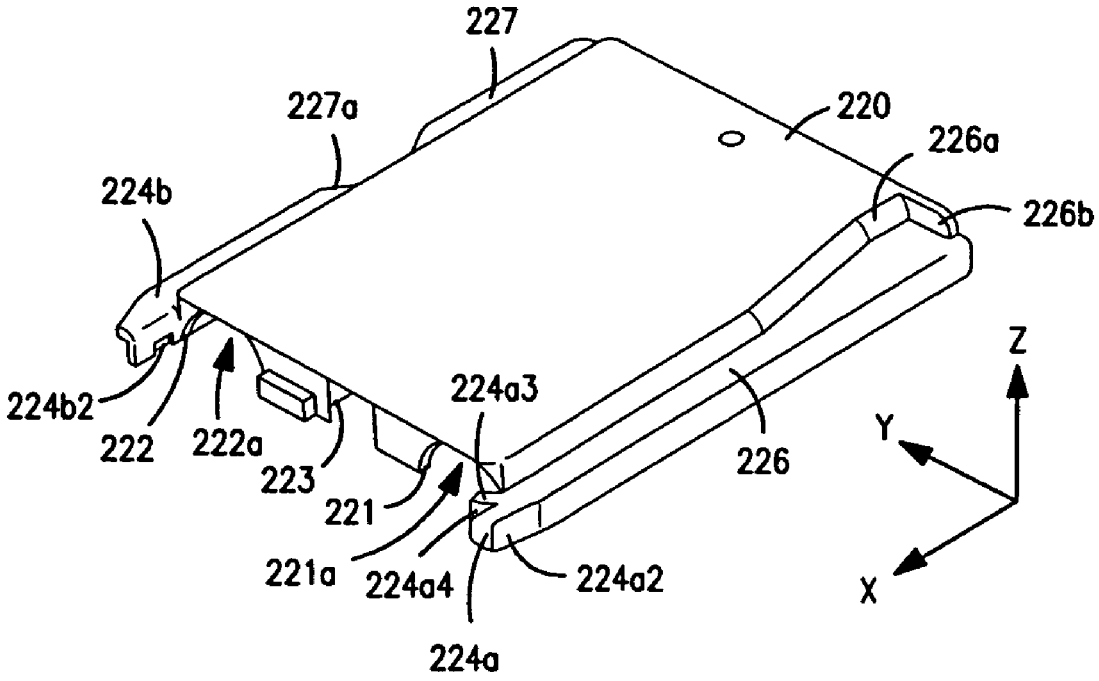
FIG. 54 is a perspective view of an ink cartridge, according to a further embodiment of the present invention.
Figure 54:
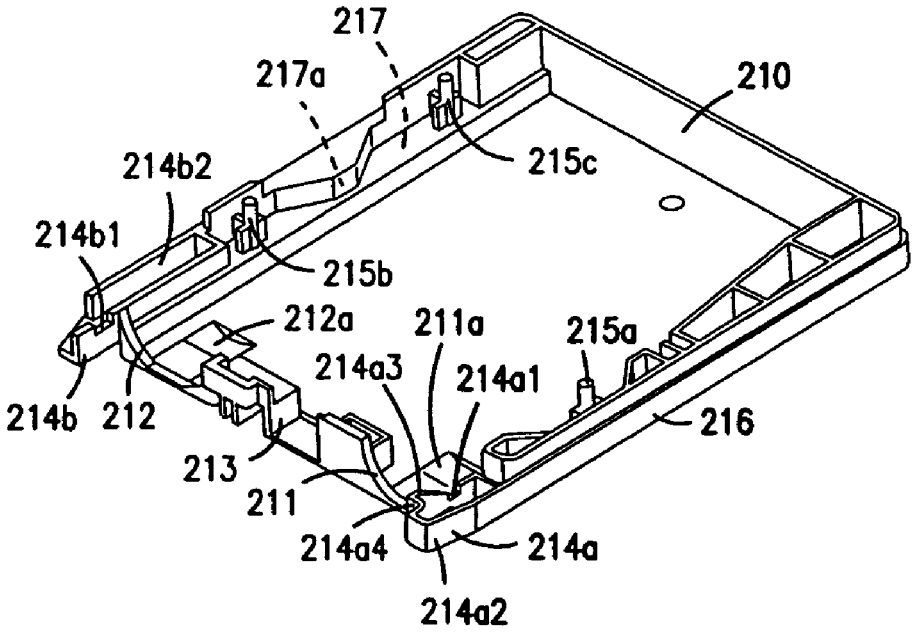
Figure 55:
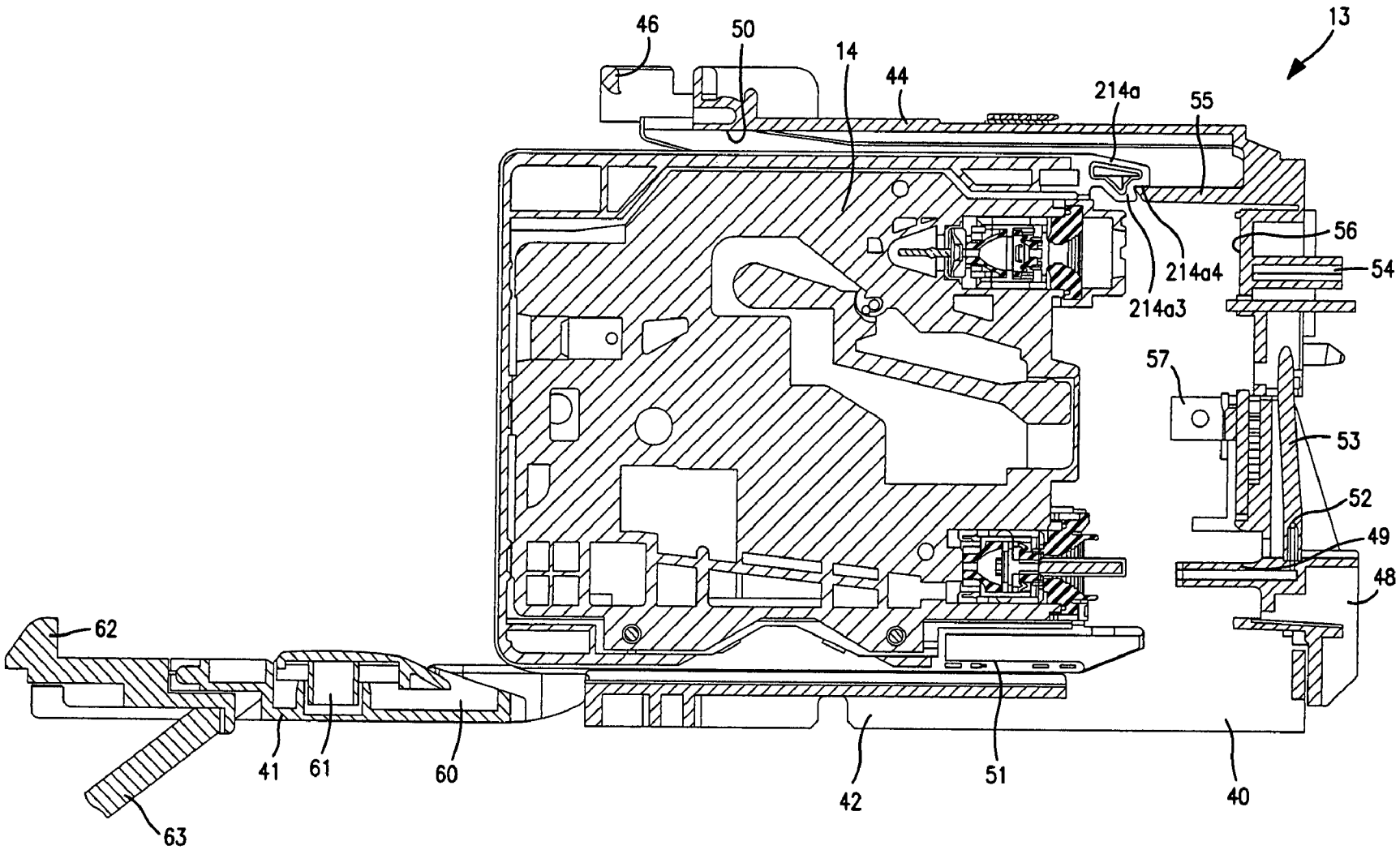
FIG. 55 is a cross-sectional view of the ink cartridge of FIG. 54 and a multifunction device, in which the ink cartridge is attached to the multifunction device, according to an embodiment of the present invention.

Referring to FIGS. 54 and 55, another embodiment of the present invention is depicted. In this embodiment, case 200 may be constructed, such that its edge shape is different with respect to case protruding portions 214*a* and 224*a*. The remaining structure of case 200 depicted in FIGS. 54 and 55 is substantially the same the structure of case 200 in the earlier embodiments of the present invention. Therefore, only the differences between case 200 in FIGS. 54 and 55 and case 200 in the earlier embodiments of the present invention are discussed with respect to FIGS. 54 and 55.

In this embodiment of the present invention, case 200 comprises second protruding portions 214*a*3 and 224*a*3 which protrude in the direction of case protruding portions 214*b* and 224*b* towards case protruding portions 214*a* and 214*b*, such that protruding portions 214*a* and 214*b* form the truncated L, e.g., V or U, shaped step 214*a*4 and 224*a*4.

Referring to FIG. 55, when ink cartridge 14 provided by second protruding portions 214*a*3 and 224*a*3 is attached to refill unit 13 in the incorrect orientation, the leading edge of protrusion 55 on case 40 side fits into steps 214*a*4 and 224*a*4. Therefore, when ink cartridge 14 is attached in the incorrect orientation, because protrusion 55 matches steps 214*a*4 and 224*a*4, it may be possible to prevent problems in which protrusion 55 passes case protruding portions 214*a* and 224*a* and goes to the upper side of case 200 or to the lower side of case protruding portions 214*a* and 224*a*, and thus, ink cartridge 14 may be inserted toward the back side of case 40. Therefore, it may be possible to prevent ink cartridge 14 from striking needle 49, and thus to prevent the destruction or deformation of needle 49 and ink detection sensor 57. Moreover, those of ordinary skill in the art readily will understand that steps 214*a*4 and 224*a*4 of this embodiment of the present invention may have any shape, e.g., a V-shape or a U-shape, which will not come loose when attaching it in the wrong orientation and the edge of the protrusion may be fitted into steps 214*a*4 and 224*a*4.

Figure 56:
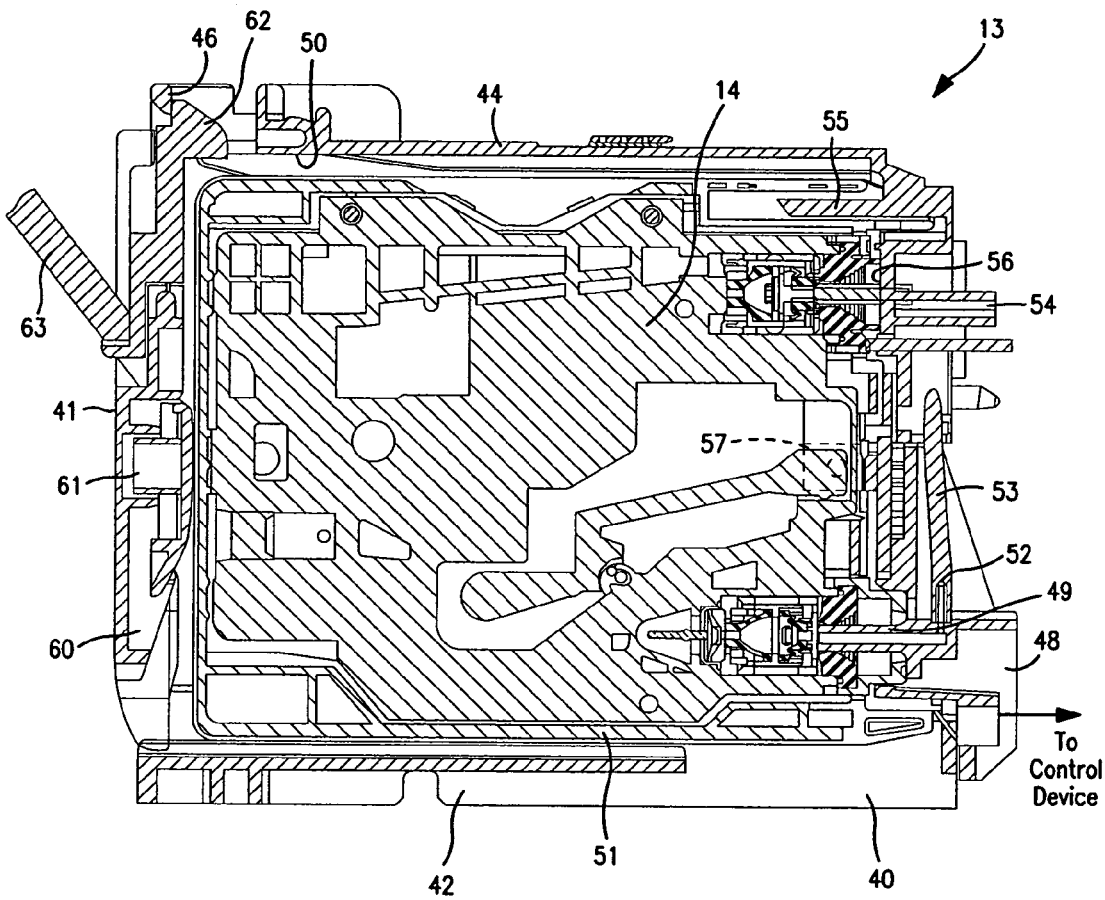
FIG. 56 is a cross-sectional view of an ink cartridge according to still a further embodiment of the present invention and a multifunction device, in which the ink cartridge is attached to the multifunction device, according to an embodiment of the present invention.
Figure 57:
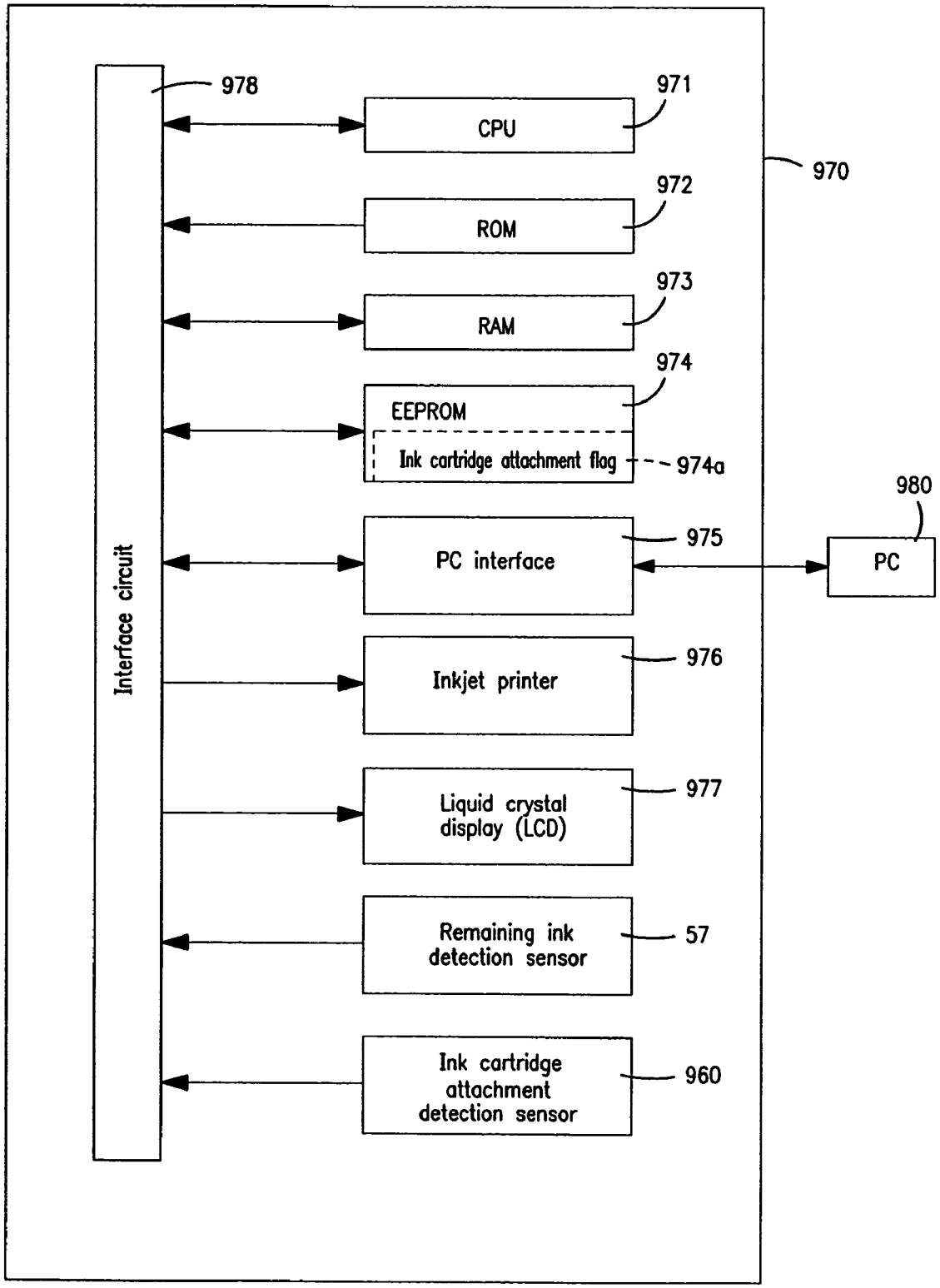
FIG. 57 is a block diagram of the electrical structure of a multifunction device, according to an embodiment of the present invention.
Figure 58:
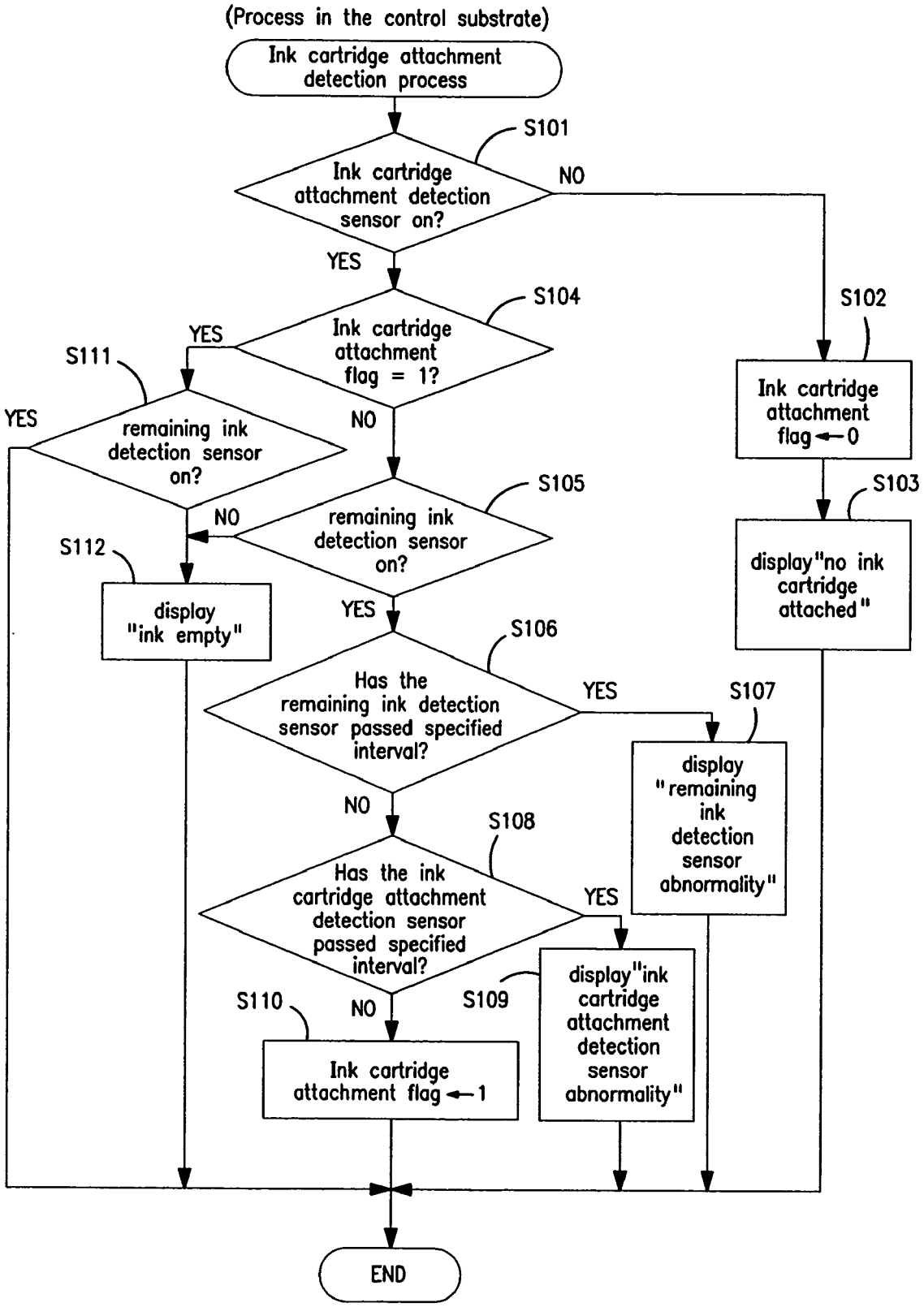
FIG. 58 is a flow-chart of an ink cartridge attachment detection process executed by a computer processing unit, according to an embodiment of the present invention.

Referring to FIGS. 56-58, yet another embodiment of the present invention is depicted. This embodiment may comprise an additional ink cartridge attachment detection sensor 960. Referring to FIG. 56, when ink cartridge 14 is attached to the correct attachment position, the edge of case protruding portions 214*a* and 224*a* may press a protruding portion of ink cartridge detection sensor 960, and by pressing the protruding portion, the ink cartridge attachment detection sensor 960 may send a signal to a control board 970. Control board 970 may be a control device to perform the main control of multifunction device 1.

Referring to FIG. 57, control board 970 may comprise a CPU 971 which may function as a calculation means, a ROM 972 which may be a memory which may not be overwritten and stores the control program and the fixed value data, a RAM 973 which may be a memory which may be overwritten and may be used as the work memory, an EEPROM 974 which may be a non-volatile memory which may be overwritten and stores data even after the power source is turned off, a PC interface 975 which performs electrical connections between an external PC 980 and control board 970, an inkjet printer 976 which performs printing by discharging ink as instructed by CPU 971, a liquid crystal display portion 35 which performs each type of display, an ink detection sensor 57 which detects the amount of ink in ink cartridge 14, an ink cartridge attachment detection sensor 960 which detects whether or not ink cartridge 14 has been attached, and an interface circuit 978 which performs input and output of each type of signal. There also may be various counters and timers included, and the updating of counter values and timer values may be performed according to the processing performed within CPU 971.

Within EEPROM 974, there may be an ink cartridge attachment flag 974*a*. Ink cartridge attachment flag 974 may go on when ink cartridge 14 has been correctly attached, and it may go off when ink cartridge 14 has been removed. Further, once ink cartridge attachment flag 974*a* has been turned on, it may remain on until it is turned off by ink cartridge attachment detection sensor 960.

Referring to FIG. 58, an ink cartridge attachment detection process may be an interruption process which may be executed at specific intervals, e.g., about every 4 ms, after completion of the initial set-up process after the power source has been turned on for multifunction device 1. When the ink cartridge attachment detection process is executed, it first may confirm whether or not ink cartridge attachment detection sensor 960 is on (S101), and if the ink cartridge attachment detection sensor 960 is off, then there may be no ink cartridge 14 attached to multifunction device 1. The value of ink cartridge attachment flag 974*a* then may be set to be 0 (S102), and liquid crystal display portion 35 may display that ink cartridge 14 has not been attached (S103), and the process is complete. In the event that a new multifunction device 1 is being used for the first time since being shipped from a factory, the value of ink cartridge attachment flag 974*a* has been set to 0.

If in step S101 ink cartridge attachment detection sensor 960 is on, it means that ink cartridge 14 is attached, and the process will confirm whether or not the value of ink cartridge attachment flag 974*a* is 1 (S104). In the event that the value of ink cartridge attachment flag 974*a* is 0, the process will confirm whether or not ink detection sensor 57 has been on based on the timing in which ink cartridge 14 is attached (S105). If ink detection sensor 57 is off, then blocking arm portion 473*c* of ink cartridge 14 may have been removed from between light emitting portion 57*a* and the light receiving portion 57*b*, e.g., because a substantially empty ink cartridge was attached, and an ink empty display may be displayed on liquid crystal display portion 35 (S112). The process then is complete.

Nevertheless, if ink detection sensor 57 is on in step S105, then the process will confirm whether or not ink detection sensor 57 has been on for longer than a predetermined amount of time, e.g., about 10 seconds, (S106). If ink detection sensor 57 has been on for longer than the predetermined amount of time, it means that ink detection sensor 57 has been on for longer than the predetermined amount of time at the timing where ink cartridge 14 is attached, so it is considered that there may be impurities attached to the surface of light emitting portion 57*a* and the light receiving portion 57*b*, and the impurities may be obstructing the light path between these surfaces, or it is considered that sensor 960 malfunctioned. Therefore, if in step S106 if ink detection sensor 57 has been on for longer than a predetermined amount of time, then a ink detection sensor abnormality will be displayed on the liquid crystal display portion 35 (S107), and the process will be complete.

Within step S106, if ink detection sensor 57 has not been on for longer than the predetermined amount of time, next, the process will determine whether or not ink cartridge attachment detection sensor 960 has been on for longer than the predetermined amount of time (S108). Specifically, if the ink cartridge attachment detection sensor 960 already has been on for longer than the predetermined amount of time, there may be damage in ink cartridge attachment detection sensor 960. Therefore, if ink cartridge attachment detection sensor 960 has been on for longer than the predetermined amount of time in step S108, then an ink cartridge attachment detection sensor abnormality will be displayed on liquid crystal display portion 35 (S109), and the process will be complete.

Within step S108, unless ink cartridge attachment detection sensor 960 is on for longer than the predetermined amount of time, ink cartridge 14 has been correctly attached, and the value of ink cartridge attachment flag 974*a* will be set to 1 (S110). The process then will be complete. Specifically, ink cartridge attachment detection sensor 960 and ink detection sensor 57 will change in approximately the same timing, and when the value of ink cartridge attachment flag 974*a* is set to 1, by detecting attachment of ink cartridge 14, it will be set to the state in which it is possible to print using multifunction device 1.

Within step S110, when ink cartridge attachment flag 974*a* is set to 1, the process to detect the ink within ink cartridge 14 may be performed. Specifically, within step S111, whether or not ink detection sensor 57 has been on will be confirmed, and if ink detection sensory 57 has been on in step S111, then there is ink inside ink cartridge 14, and the process is complete. In contrast, if ink detection sensor 57 is off in step S111, then an ink empty display will be displayed on liquid crystal display 35 (S112), and the process is complete.

Thus, in the above-described embodiment of the present invention, when the value of ink cartridge attachment flag 974*a* is 1, e.g., if no error has been detected, multifunction device 1 will allow execution of the printing process. Therefore, it may be possible to avoid execution of the printing process when it is not whether or not ink cartridge 14 has been attached.

Figure 59A:
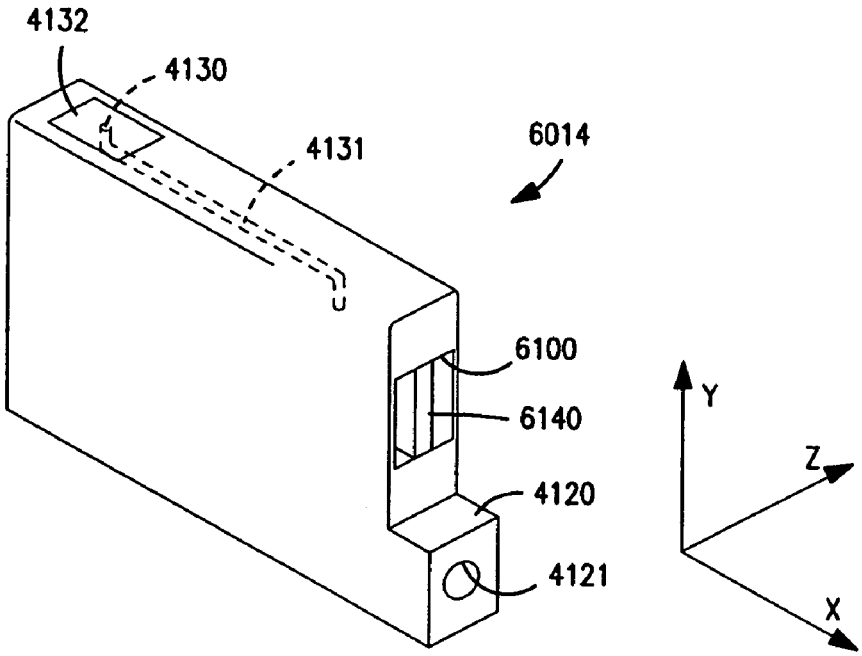
FIG. 59(*a*) is a perspective view of an ink cartridge, according to yet a further embodiment of the present invention.
Figure 59B:
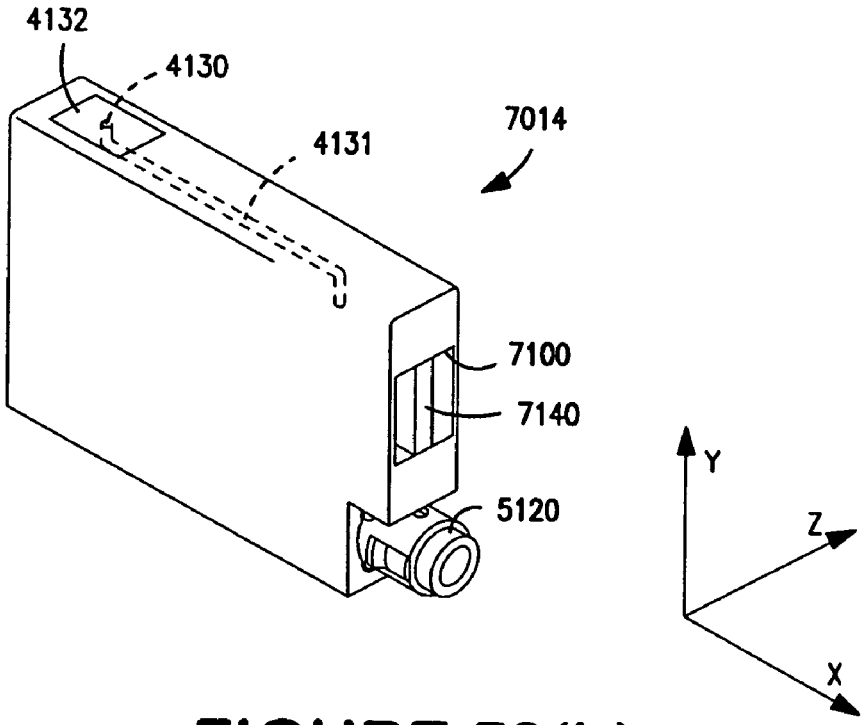

FIGS. 59(*a*), and 59(*b*) depict an ink cartridge 6014 and an ink cartridge 7014, respectively, according to further embodiments of the present invention. Ink cartridges 6014 and 7014 may be substantially similar to ink cartridges 4014 and 5014, respectively, except that shapes of side surfaces on which ink supply portions 4120 and 5120 are provided may be different. Therefore, only the differences between ink cartridges 6014 and 7014 and ink cartridges 4014 and 5014 are discussed with respect to ink cartridges 6014 and 7014, respectively.

Referring to FIG. 59(*a*), a concave portion 6100 may be provided above ink supply portion 4120, and a detection portion 6140 may be provided in the central position of concave portion 6100. Therefore, on both sides of detection portion 6140, there may be a space provided in which light emitting portion 57*a* and the light receiving portion 57*b* of ink detection sensor 57 may be inserted.

Referring to FIG. 59(*b*), a concave portion 7100 may be provided above ink supply portion 5120, and a detection portion 7140 may be provided in the central position of concave portion 7100. Therefore, on both sides of detection portion 7140, there may be a space provided in which light emitting portion 57*a* and the light receiving portion 57*b* of ink detection sensor 57 may be inserted.

Detection portions 6140 and 7140 of ink cartridges 6014 and 7014, respectively, may be positioned within concave portions 6100 and 7100, respectively, provided on the side surfaces, such that it may be possible to reduce the adherence of ink which has flown from the ink supply portions 4120 and 5120 onto the detection portions 6140 and 7140, respectively.

The surface of the sides of concave portions 6100 and 7100 on ink supply portions 4120 and 5120, respectively, may be a sloped surface which may be sloped in the direction of ink supply portions 4120 and 5120, respectively. By using this structure, if any ink adheres to detection portions 6140 and 7140, the ink may not accumulate within concave portions 6100 and 7100, respectively, making it possible to reduce the adherence of ink onto detection portions 6140 and 7140. Detection portions 6140 and 7140 also contain movable members within, e.g., movable member 470.

Figure 60:
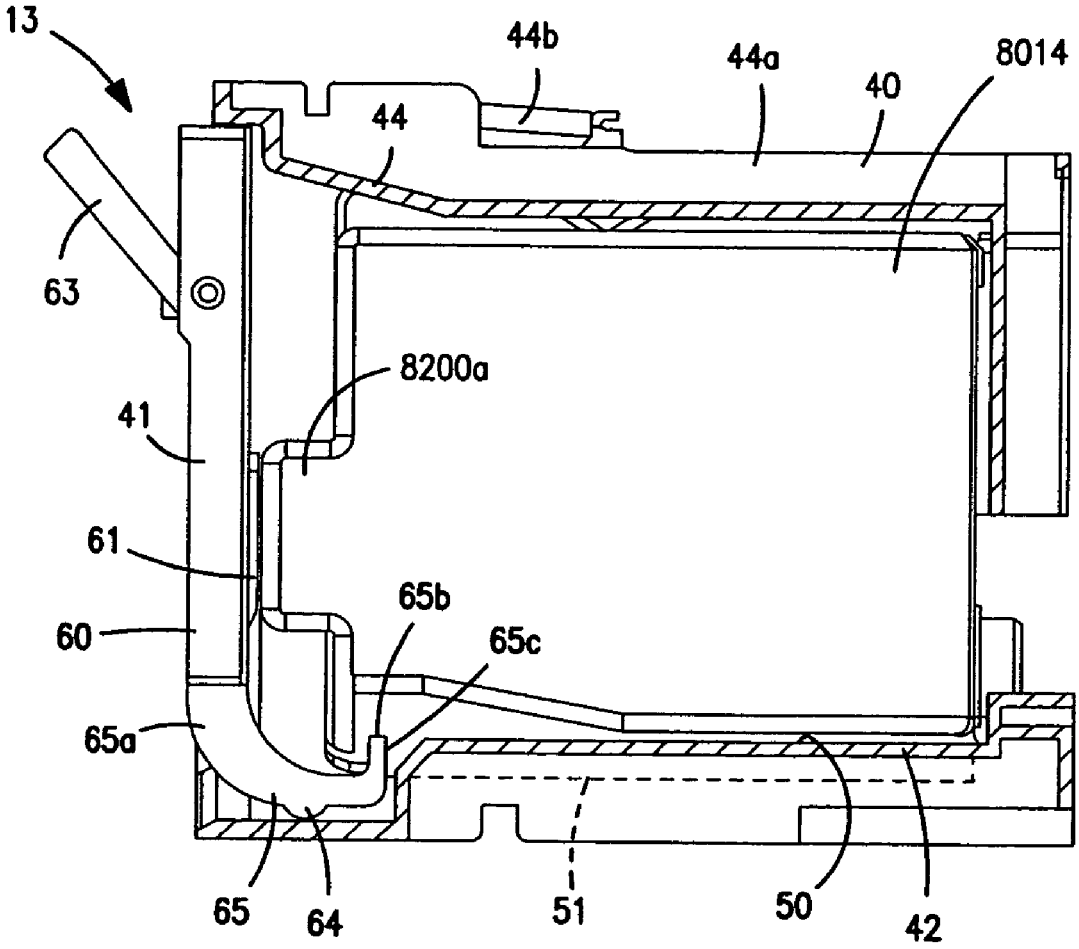
FIG. 60 is a side view of an ink cartridge, according to another embodiment of the present invention.

FIG. 60 depicts an ink cartridge 8014 and a refill unit 13 according to yet another embodiment of the present invention. Ink cartridge 8014 may be substantially similar to ink cartridge 14. Therefore, only the differences between ink cartridge 8014 and ink cartridge 14 are discussed with respect to ink cartridge 8014. Referring to FIG. 60, ink cartridge 8014 may comprise a pushing portion 8200*a* which may be configured to contact pressing retaining member 61 of door main body 60, and that protrudes towards the outside from side surface 1 of ink cartridge 8014. In this embodiment of the present invention, pushing portion 8200*a* may protrude from the side surface. Nevertheless, pushing portion 8200*a* may have an opposite concave shape. In this modification, the pressing retaining member may protrude from door main body 61.

Figure 61:
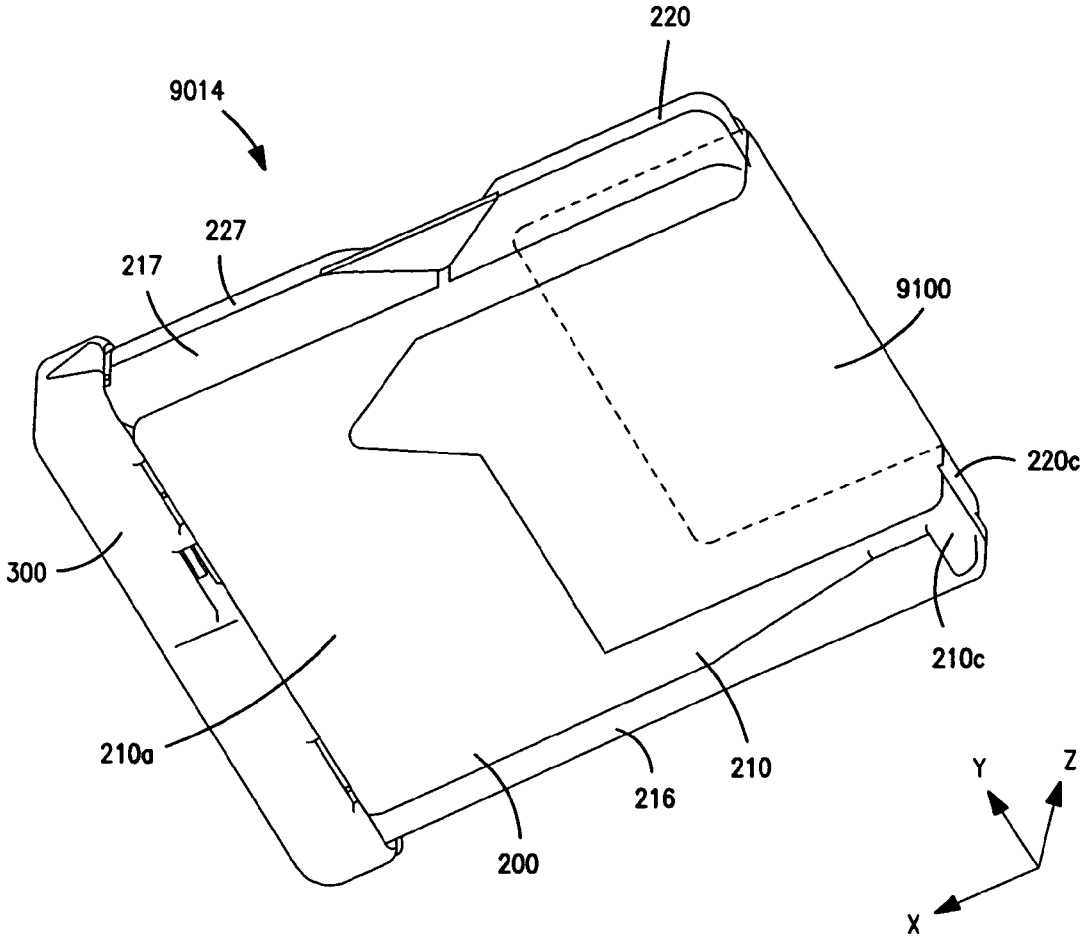
FIG. 61 is a perspective view of an ink cartridge, according to yet another embodiment of the present invention.
Figure 62:
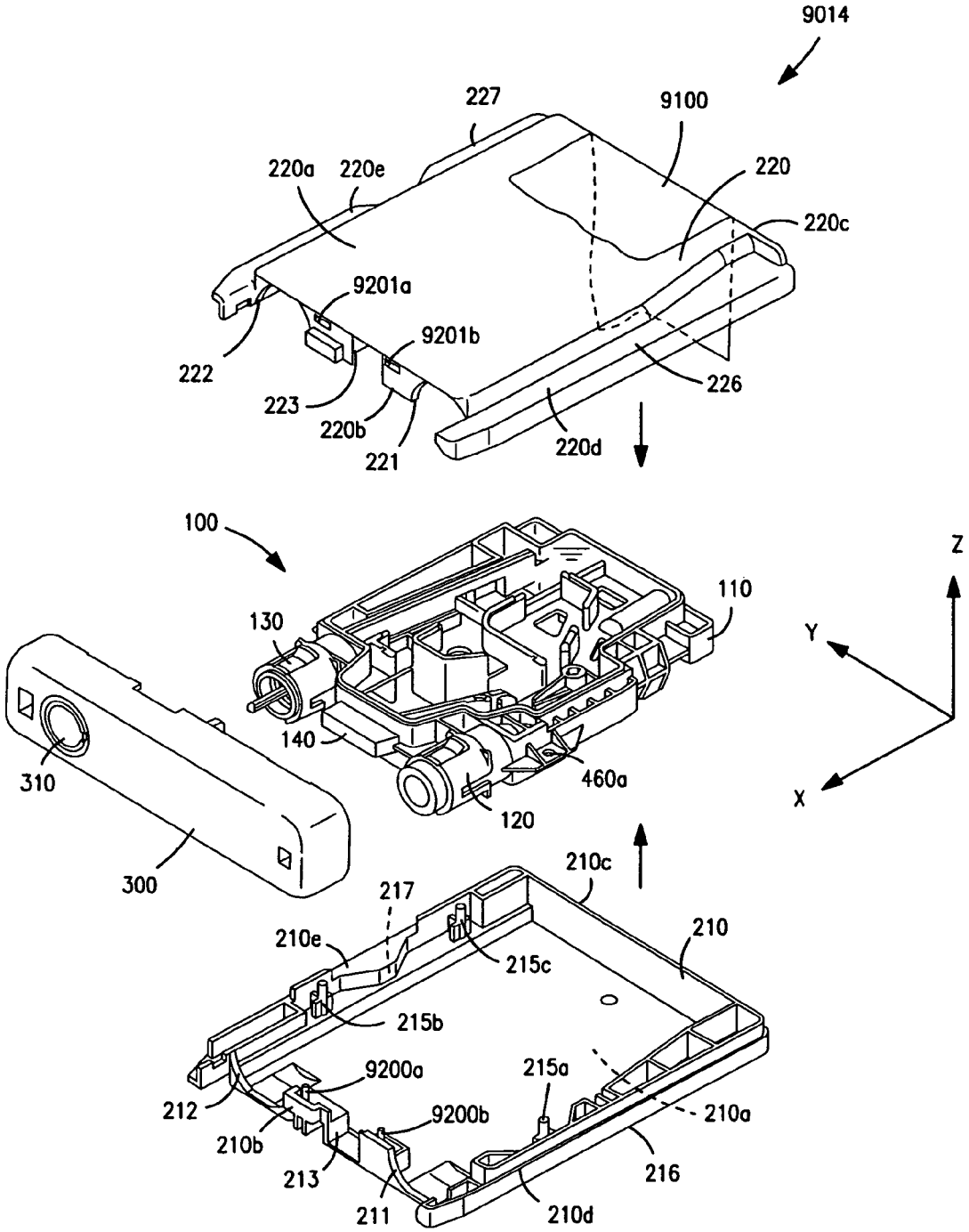
FIG. 62 is an expanded, perspective view of the ink cartridge of FIG. 61, according to an embodiment of the present invention.
Figure 63:
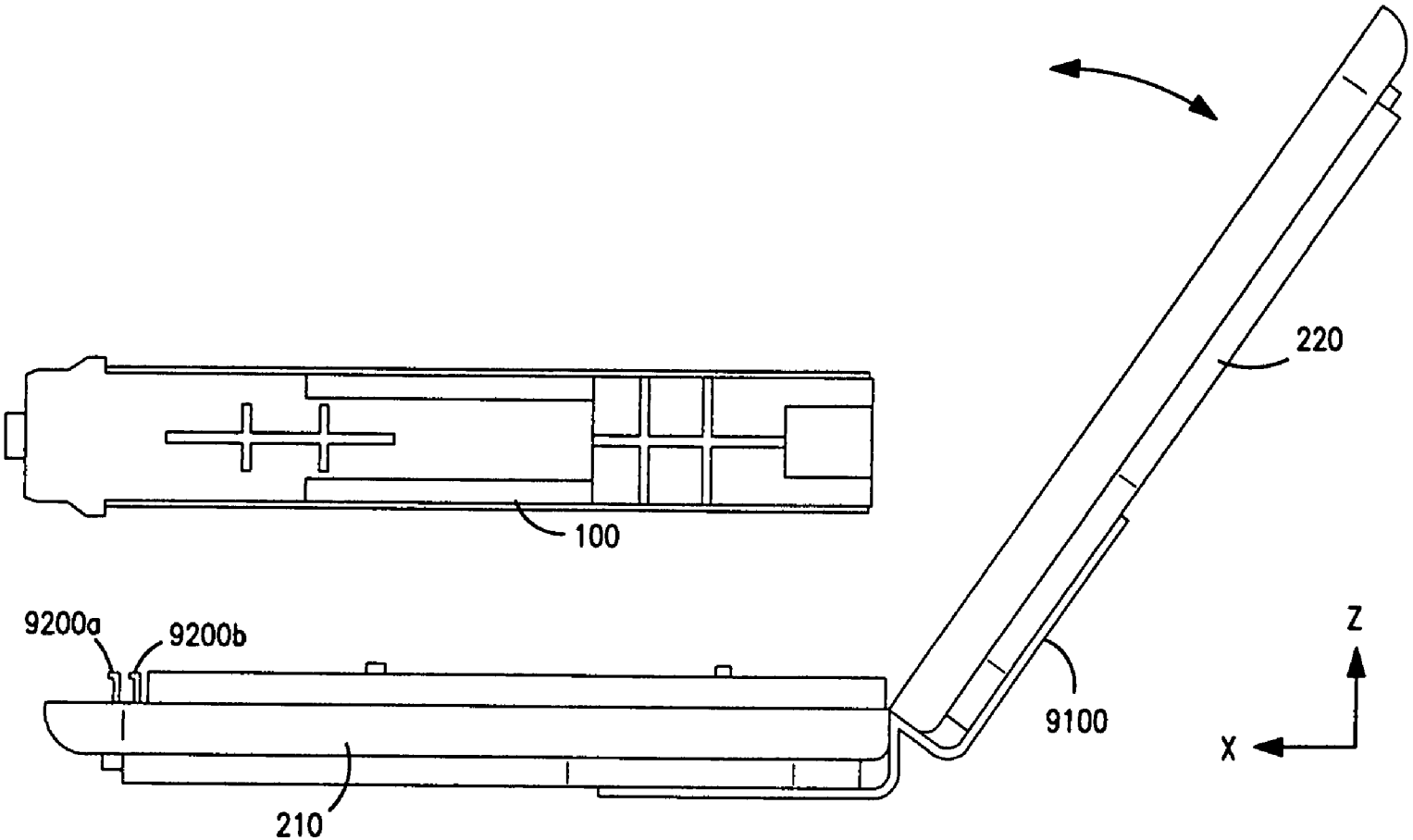
FIG. 63 is a side view showing a process for replacing an ink reservoir element, according to an embodiment of the present invention.

FIGS. 61-63 depict an ink cartridge 9014 according to still yet another embodiment of the present invention. Ink cartridge 9014 may be substantially similar to ink cartridge 14. Therefore, only the differences between ink cartridge 9014 and ink cartridge 14 are discussed with respect to ink cartridge 9014. Ink cartridge 14 comprised an ink reservoir element 100 which was not replaceable because it was welded into first and second case members 210 and 220. Nevertheless, the ink reservoir element of ink cartridge 9014 may be replaceable.

Referring to FIG. 61, ink cartridge 9014 may comprise a seal 9100 attached to outer surface of case 200. Seal 9100 may be attached to maximum surface 220*a* and vertical wall portion 220*c* of second case member 220, and may be attached to vertical wall portion 210*c* and maximum surface 210*a* of first case member 210. Seal 9100 may have the model number and corresponding color of ink cartridge 9014 printed on it, such that it may be possible to visually recognize the color of ink which may be stored within ink cartridge 9014.

Referring to FIG. 62, within vertical wall portion 210*b* of first case member 210, a pair of engagement portions 9200*a* and 9200*b* may be provided, which protrude in the direction of second case member 220. Moreover, within vertical wall portion 220*b* of second case member 220, a pair of engagement openings 9201*a* and 9201*b* may be provided, which engage the edges of engagement portions 9200*a* and 9200*b*, respectively. Therefore, when manufacturing ink cartridge 9014, ink reservoir element 100 may be positioned within first case member 210, and then engagement portions 9200*a* and 9200*b* of first case member 210 may be fitted with engagement openings 9201*a* and 9201*b* of second case member 920, respectively, to join first case member 210 and second case member 220. Then, seal 9100 may be adhered along maximum surface 210*a* and vertical wall portion 210*c* of first case member 210 and maximum surface 220*a* and vertical wall portion 210*c* of second case member 220. Protector 300 then may be attached, and ink cartridge 9014 may be manufactured.

With respect to ink cartridge 9014, it may be possible to undue the connection between engagement portions 9200*a* and 9200*b* and engagement openings 9201*a* and 9201*b* by pressing the edge of engagement portions 9200*a* and 9200*b* via engagement openings 9201*a* and 9201*b* from the outer side of vertical wall portion 210*b*.

Referring to FIG. 63, because one edge surface of first and second case members 210 and 220 may be connected via seal 9100, it may be possible to open and close first and second case member 210 and 220 by using the edge of vertical wall portions 210*c* and 220*c* as an axis. For example, seal portion 9100 may be a connecting member to connect first and second case members 210 and 220, and seal portion 9100 may function as a hinge member when first and second case member 210 and 220 are opened and closed. Therefore, ink reservoir element 100 may be replaced by undoing the connection between engagement portions 9200*a* and 9200*b* and engagement openings 9201*a* and 9201*b*, and when a portion of first case member 210 is separated from a portion of second case member 220, a new ink reservoir element 100 may be inserted, and first and second case members 210 and 220 may be reconnected. Alternatively, new ink may be injected into the existing ink reservoir element 100

Figure 64:
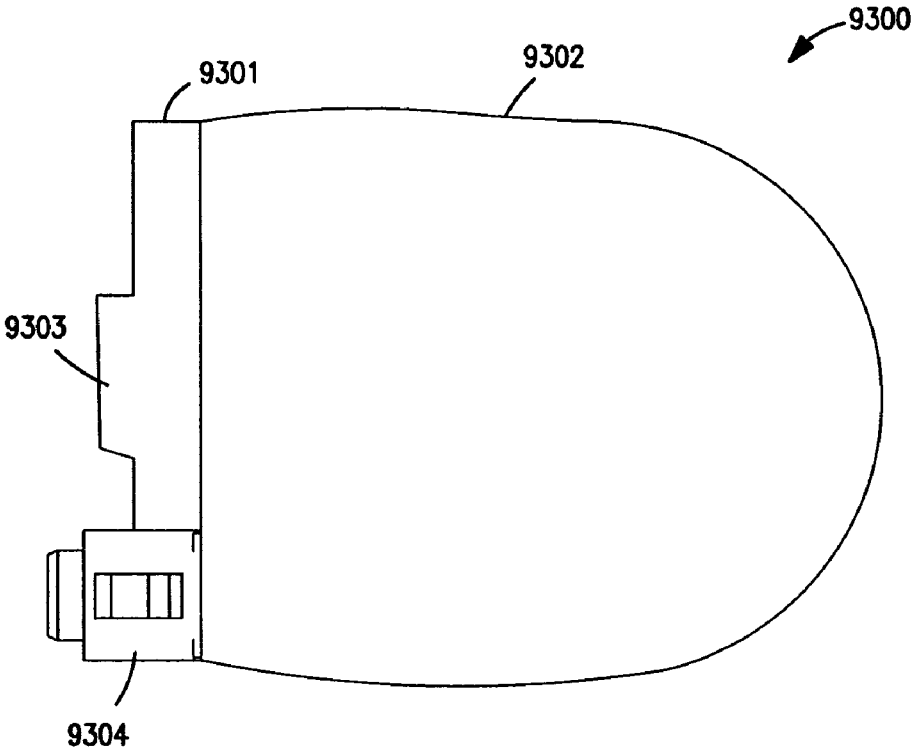
FIG. 64 is a side view of an ink reservoir unit according to another embodiment of the present invention.
Figure 65A:
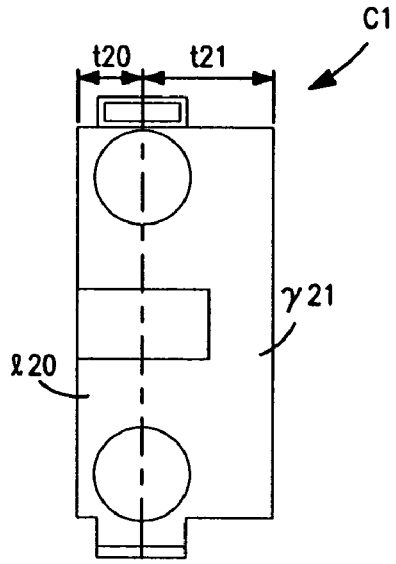
FIGS. 65(*a*)-65(*d*) are front views of different combinations of a pair of case members connected to each other, according to another embodiment of the present invention.
Figure 65B:
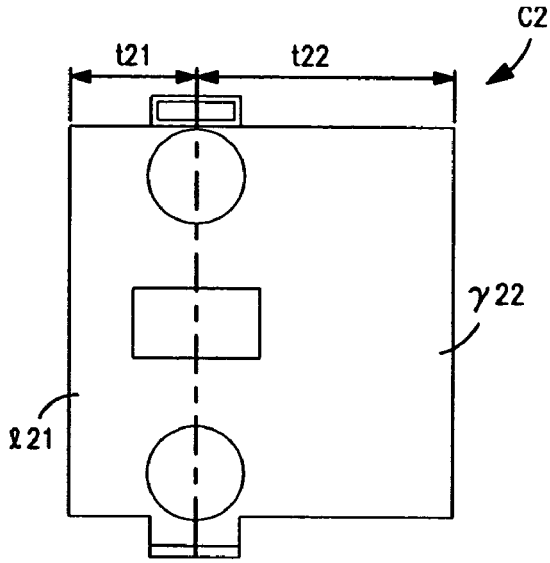
Figure 65C:
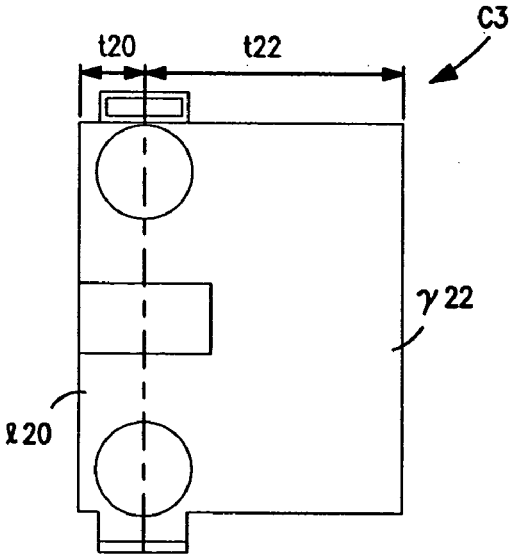
Figure 65D:
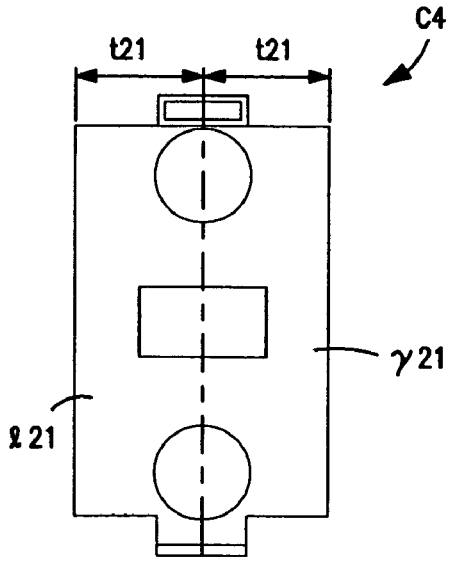
Figure 66A:
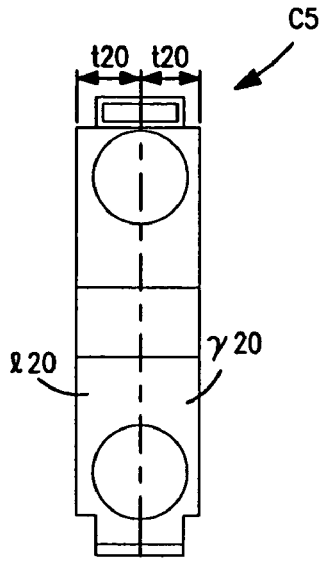
FIGS. 66(*a*)-66(*d*) are front views of different combinations of a pair of case members connected to each other, according to yet another embodiment of the present invention.
Figure 66B:
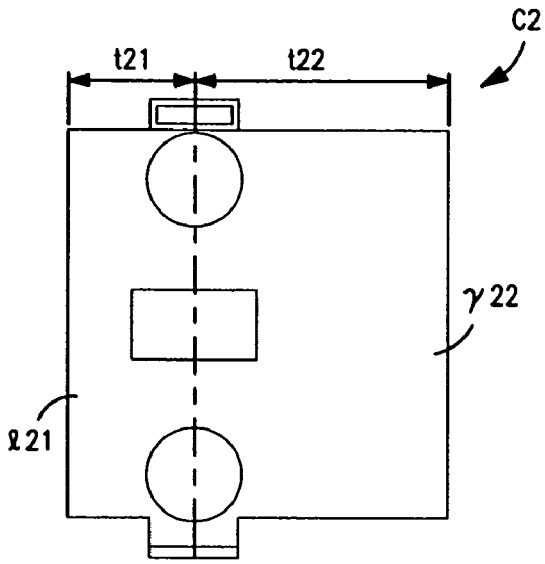
Figure 66C:
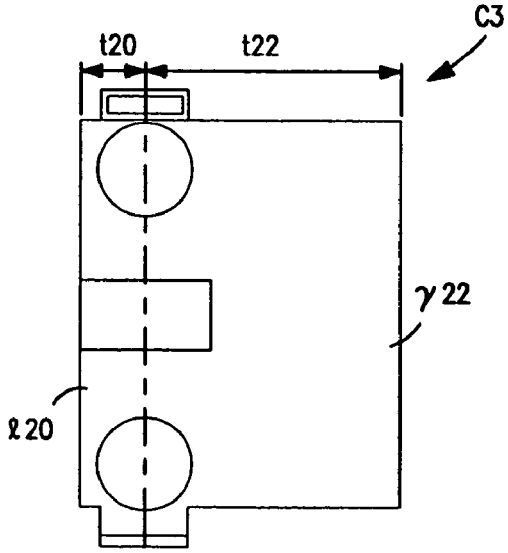
Figure 66D:
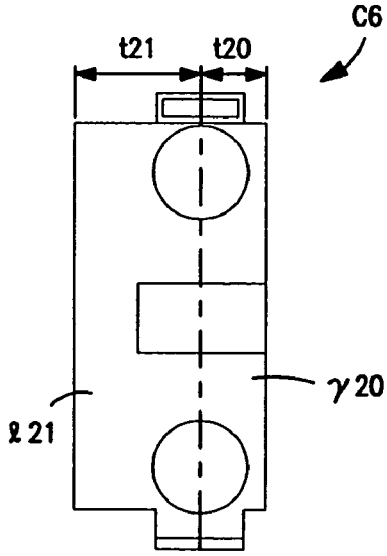
Figure 67A:
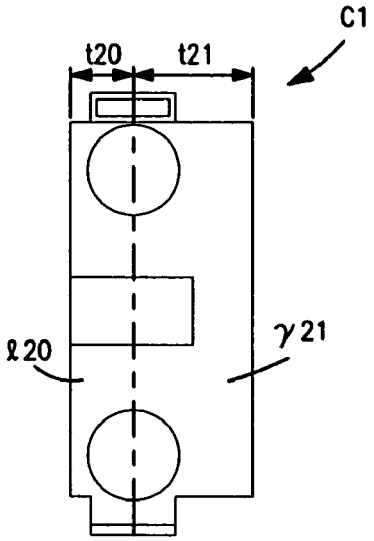
FIGS. 67(*a*)-67(*d*) are front views of different combinations of a pair of case members connected to each other, according to still yet another embodiment of the present invention.
Figure 67B:
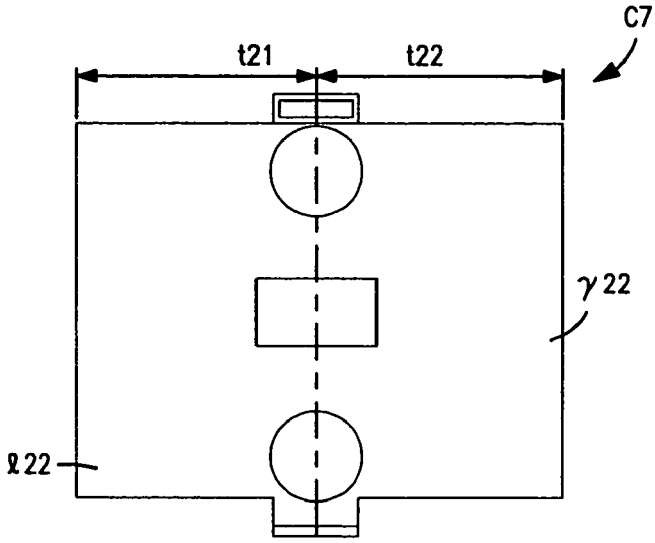
Figure 67C:
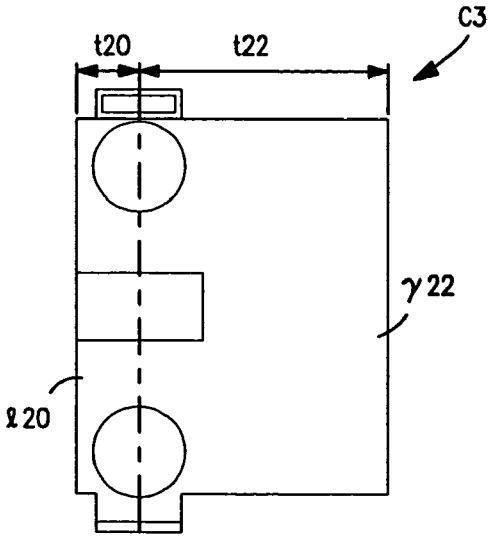
Figure 67D:
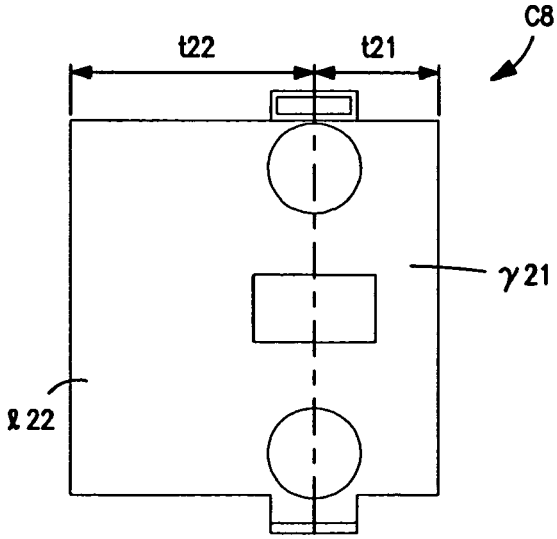

FIG. 64 depicts an ink reservoir element 9300 according to another embodiment of the present invention. Ink reservoir element 9300 may be substantially similar to ink reservoir element 100. Therefore, only the differences between ink reservoir element 9300 and ink reservoir element 100 are discussed with respect to ink reservoir element 9300. Referring to FIG. 64, ink reservoir element 9300 may be fixed within the first and second case members. Ink reservoir element 9300 may comprise a hard portion 9301 which may be provided through injection formation using a resin material, and a bag element 9302 connected to hard portion 9301, which may be a flexible element which forms a reservoir space for storing ink therein. Hard portion 9301 may comprise a detection portion 9303 which may be configured to be positioned between light emitting portion 57*a* and light receiving portion 57*b* of ink detection sensor 57, and an ink supply portion comprising ink supply mechanism 500 and supply cap 600. In operation, when the ink within bag portion 9302 is reduced, bag portion 9302 may shrink in response to the reduction in ink, and the ink is substantially depleted, the reservoir space also may be substantially depleted. Therefore, it may be difficult to position a movable member within bag portion 9302 to detect the amount of ink remaining within bag portion 9302.

Moreover, hard portion 9301 may have light barrier properties, and because it may be positioned between light emitting portion 57*a* and light receiving portion 57*b*, it may block the emitted light which is emitted from light emitting portion 57*a*. Therefore, it may be possible to detect whether there is an ink reservoir element 9300 contained within the first and second case members, and as such, it may be possible to prevent printing processes from being performed by multifunction device 1 when no ink reservoir 9300 is present.

Referring to FIGS. 65(*a*)-67(*d*), modified examples of combinations of the case members are depicted. Referring to FIG. 65(*a*), a case C1 may comprise a case member 120 and a case member r21. The thickness of case member 120 may be a thickness t20, and the thickness of case member r21 may be a thickness t21 which may be thicker than the thickness t20. Referring to FIG. 65(*b*), a case C2 may comprise a case member 121 and a case member r22. The thickness of case member 121 may be thickness t21, and the thickness of case member r22 may be a thickness t22 which may be thicker than the thickness t21. Further, the difference between the thickness t22 and the thickness t21 may be different than the difference between the thickness t21 and the thickness t20.

Referring to FIGS. 65(*c*) and 65(*d*), by changing the combination of case members 121 and r22 which form case C2 and case members 120 and r21 which form case C1, a case C3 and a case may be formed. Specifically, case C3 may comprise case member 120 and case member r22, and case C4 may comprise case member 121 and case member r21. Moreover, the size of cases C1-C4 may be different from each other, e.g., with the relationship C1<C4<C3<C2. Therefore, it may be possible to form four cases with different shapes according to the amount of ink to be stored using four case members 120, r21, 121 and r22.

In addition, in order to form four cases with different outer shapes using four case member, it may be necessary for another relationship to be satisfied. Specifically, the difference between the thickness t22 of one side of the case member which forms the largest first ink cartridge and the thickness t21 of one side of the case member which forms the smallest third ink cartridge may need to be different than the difference between the thickness t21 of other side of the case member which forms the largest first ink cartridge and the thickness t20 of other side of the case member which forms the smallest third ink cartridge.

Referring to FIG. 66(*a*), a case C5 may comprise case member 120 and the case member r20. The thicknesses of case members 120 and r20 may be thickness t20. The case C2 in FIG. 66(*b*) may be the same as the case C2 in FIG. 65(*b*). Referring to FIGS. 65(*c*) and 65(*d*), by modifying the combination of case members 120 and r20 which form case C5 and case members 121 and r22 which form case C2, a case C3 and a case C6 may be formed. Specifically, case C3 may comprise case member 120 and case member r22, and case C6 may comprise case member 121 and case member r20. Further, the difference between the thickness t20 of case member r20 and the thickness t22 of case member r22 may be different than the difference between the thickness t21 of case member 121 and the thickness t20 of case member 120. Therefore, using case members 120 and r20 which form case C5 and case members 121 and r22 which form the case C2, the small scale case C5, the large scale case C2, and the two types of mid-sized cases C3 and C6 may be formed. Moreover, the size of cases C2, C3, C5, and C6 may be different from each other, e.g., with the relationship C5<C6<C3<C2. Therefore, it may be possible to form four cases with different shapes according to the amount of ink to be stored using four case members 120, r21, 121 and r22.

Referring to FIG. 67(*a*), the case C1 of FIG. 67(*a*) may be the same as case C1 of FIG. 65(*a*). Referring to FIG. 67(*b*), a case C7 may comprise case member 122 and case member r22. The thicknesses of case members 122 and r22 may be thickness t22. Referring to FIGS. 67(*c*) and 67(*d*), by modifying the combination of case members 120 and r21 which form the case C1 and the case members 122 and r22 which form the case C7, a case C3 and a case C8 may be formed. Specifically, case C3 may comprise case member 120 and the case member r22, and case C8 may comprise case member 122 and case member r21. Further, the difference between the thickness t22 of case member r22 and the thickness t21 of case member r21 may be different than the difference between the thickness t22 of case member 122 and the thickness t20 of case member 120. Therefore, using case members 120 and r21 which form the case C1 and case members 122 and r22 which form case C7, the small scale case C1, the large scale case C7, and the two types of mid-sized cases C3 and C8 may be formed. Moreover, the size of cases C1, C3, C7, and C8 may be different from each other, e.g., with the relationship C1<C3<C8<C7. Therefore, it may be possible to form four cases with different shapes according to the amount of ink to be stored using four case members 120, r21, 122 and r22.

As described above, within the case members which form each case, when the thickness of the case members which are positioned on one side are different than the thicknesses of the case members which are positioned on the other side, it may be possible to form four cases with different sizes from the four case members.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge, comprising:

an ink chamber;

a communication path configured to dispense ink from an interior of the ink chamber to an exterior of the ink chamber;

a valve member configured to move in a particular direction to selectively open and close the communication path;

an elastic member having a first opening formed therethrough; and a cap member connected to the elastic member, wherein elastic member is positioned between the valve member and the cap member, and the cap member has a second opening formed therethrough and at least one chamber formed therein, wherein at least a portion of the at least one chamber is aligned with at least a portion of the first opening in the particular direction, and at least a portion of the second opening is aligned with at least a portion of the first opening in the particular direction.

2. The ink cartridge of claim 1, wherein the first opening is tapered, and a circumference of a first portion of the first opening connected to the communication path is less than a circumference of a second portion of the first opening connected to the second opening.

3. The ink cartridge of claim 2, wherein first opening comprises a stepped, tapered opening.

4. The ink cartridge of claim 2, wherein the second opening is tapered, and a circumference of a first portion of the second opening connected to the second portion of the first opening is less than a circumference of a second portion of the second opening opposite the first portion of the second opening.

5. The ink cartridge of claim 1, wherein at least a portion of the elastic member is disposed within at least a portion of the cap member.

6. The ink cartridge of claim 5, wherein the communication path comprises at least one wall, and the ink cartridge further comprises at least one protrusion extending from an exterior of the at least one wall, wherein the cap further has at least one third opening formed therethrough, wherein the at least one third opening is configured to receive the at least one protrusion to secure the cap member to the exterior of the at least one wall.

7. The ink cartridge of claim 6, wherein the at least one protrusion comprises a pair of protrusions, and the at least one third opening comprises a pair of third openings.

8. The ink cartridge of claim 1, wherein when the communication path is closed by the valve member the valve member contacts the elastic member, and when the communication path is open the valve member is spaced from the elastic member.

* * * * *